US007576734B2

(12) United States Patent
Kimura

(10) Patent No.: US 7,576,734 B2
(45) Date of Patent: Aug. 18, 2009

(54) SIGNAL LINE DRIVING CIRCUIT, LIGHT EMITTING DEVICE, AND METHOD FOR DRIVING THE SAME

(75) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 275 days.

(21) Appl. No.: 10/282,234

(22) Filed: Oct. 29, 2002

(65) Prior Publication Data

US 2003/0156102 A1 Aug. 21, 2003

(30) Foreign Application Priority Data

Oct. 30, 2001 (JP) ..... 2001-333462
Sep. 30, 2002 (JP) ..... 2002-287997

(51) Int. Cl.
*G09G 5/00* (2006.01)

(52) U.S. Cl. ..... 345/204; 345/89; 345/98; 345/99; 345/211

(58) Field of Classification Search ..... 345/89, 345/98–99, 204, 211; 315/169.1, 169
See application file for complete search history.

(56) References Cited

U.S. PATENT DOCUMENTS 4,967,140 A 10/1990 Groeneveld et al.
5,041,823 A * 8/1991 Johnson et al. ..... 345/94
5,138,310 A 8/1992 Hirane et al.
5,266,936 A * 11/1993 Saitoh ..... 345/98
5,517,207 A 5/1996 Kawada et al.
5,594,463 A 1/1997 Sakamoto
5,793,163 A 8/1998 Okuda
5,844,368 A 12/1998 Okuda et al.
5,923,309 A * 7/1999 Ishizuka et al. ..... 345/82
5,953,003 A * 9/1999 Kwon et al. ..... 345/204
6,091,203 A 7/2000 Kawashima et al.
6,201,822 B1 3/2001 Okayasu
6,222,357 B1 4/2001 Sakuragi (Continued)

FOREIGN PATENT DOCUMENTS

EP 1 039 440 9/2000

(Continued)

OTHER PUBLICATIONS

Abe et al., *16-1: A Poly-Si TFT 6-Bit Current Data Driver for Active Matrix Organic Light Emitting Diode Displays*, Eurodisplay 2002, pp. 279-282.

(Continued)

*Primary Examiner*—Richard Hjerpe
*Assistant Examiner*—Leonid Shapiro
(74) *Attorney, Agent, or Firm*—Eric J. Robinson; Robinson Intellectual Property Law Office, P.C.

(57) ABSTRACT

Variation occurs in transistor characteristics. The present invention relates to a signal line driver circuit comprising: a plurality of current source circuits corresponding to a plurality of wirings; and a shift register, characterized in that: the plurality of current source circuits each comprise capacitor means for converting a supplied current to a voltage in accordance with a sampling pulse supplied from the shift register and supply means for supplying a current corresponding to the converted voltage.

8 Claims, 82 Drawing Sheets

U.S. PATENT DOCUMENTS

| | | | | |
|---|---|---|---|---|
| 6,229,506 | B1 | 5/2001 | Dawson et al. | |
| 6,310,589 | B1 | 10/2001 | Nishigaki et al. | |
| 6,331,844 | B1 | 12/2001 | Okumura et al. | |
| 6,344,843 | B1 | 2/2002 | Koyama et al. | |
| 6,369,516 | B1 * | 4/2002 | Iketsu et al. | 315/169.3 |
| 6,373,454 | B1 | 4/2002 | Knapp et al. | |
| 6,473,064 | B1 | 10/2002 | Tsuchida et al. | |
| 6,498,438 | B1 | 12/2002 | Edwards | |
| 6,501,466 | B1 | 12/2002 | Yamagishi et al. | |
| 6,535,185 | B2 | 3/2003 | Kim et al. | |
| 6,552,702 | B1 | 4/2003 | Abe et al. | |
| 6,714,091 | B2 | 3/2004 | Norskov et al. | |
| 6,765,560 | B1 | 7/2004 | Ozawa | |
| 6,788,231 | B1 | 9/2004 | Hsueh | |
| 6,809,320 | B2 | 10/2004 | Iida et al. | |
| 6,859,193 | B1 | 2/2005 | Yumoto | |
| 6,876,350 | B2 | 4/2005 | Koyama | |
| 6,937,233 | B2 | 8/2005 | Sakuma et al. | |
| 6,963,336 | B2 | 11/2005 | Kimura | |
| 6,999,048 | B2 | 2/2006 | Sun et al. | |
| 7,023,482 | B2 | 4/2006 | Sakuragi | |
| 2001/0048410 | A1 | 12/2001 | Nishigaki et al. | |
| 2002/0057244 | A1 | 5/2002 | Koyama et al. | |
| 2002/0135309 | A1 | 9/2002 | Okuda | |
| 2003/0048669 | A1 | 3/2003 | Abe | |
| 2003/0128199 | A1 | 7/2003 | Kimura | |
| 2003/0128200 | A1 | 7/2003 | Yumoto | |
| 2003/0169250 | A1 | 9/2003 | Kimura | |
| 2004/0056705 | A1 * | 3/2004 | Dabral | 327/534 |
| 2004/0085029 | A1 | 5/2004 | Kimura | |
| 2004/0085270 | A1 | 5/2004 | Kimura | |
| 2004/0174282 | A1 | 9/2004 | Sun et al. | |
| 2004/0207578 | A1 | 10/2004 | Koyama | |
| 2004/0222985 | A1 | 11/2004 | Kimura | |
| 2005/0001794 | A1 | 1/2005 | Nakanishi et al. | |
| 2005/0200300 | A1 | 9/2005 | Yumoto | |
| 2006/0028413 | A1 | 2/2006 | Kimura | |
| 2006/0103610 | A1 | 5/2006 | Kimura | |
| 2006/0119552 | A1 | 6/2006 | Yumoto | |

FOREIGN PATENT DOCUMENTS

| | | | |
|---|---|---|---|
| EP | 1 063 630 | A2 | 12/2000 |
| EP | 1 102 234 | A2 | 5/2001 |
| EP | 1 130 565 | | 9/2001 |
| EP | 1 333 422 | | 8/2003 |
| EP | 1447787 | | 8/2004 |
| EP | 1450342 | | 8/2004 |
| EP | 1463026 | | 9/2004 |
| JP | 62-122488 | | 8/1987 |
| JP | 02-105907 | | 4/1990 |
| JP | 05-042488 | | 10/1993 |
| JP | 06-118913 | | 4/1994 |
| JP | 07-036409 | | 2/1995 |
| JP | 08-095522 | | 4/1996 |
| JP | 08-101669 | | 4/1996 |
| JP | 08-106075 | | 4/1996 |
| JP | 9-244590 | | 9/1997 |
| JP | 09-244590 | | 9/1997 |
| JP | 10-312173 | | 11/1998 |
| JP | 11-045071 | | 2/1999 |
| JP | 11-231834 | | 8/1999 |
| JP | 11-282419 | | 10/1999 |
| JP | 2000-081920 | | 3/2000 |
| JP | 2000-122607 | | 4/2000 |
| JP | 2000-305522 | | 11/2000 |
| JP | 2001-034221 | A | 2/2001 |
| JP | 2001-042822 | A | 2/2001 |
| JP | 2001-56667 | | 2/2001 |
| JP | 2001-056667 | A | 2/2001 |
| JP | 2001-147659 | A | 5/2001 |
| JP | 2001-290469 | | 10/2001 |
| JP | 2001-005426 | | 1/2002 |
| JP | 2002-152565 | | 5/2002 |
| JP | 2002-514320 | A | 5/2002 |
| JP | 2002-517806 | A | 6/2002 |
| JP | 2002-215095 | A | 7/2002 |
| JP | 2002-278497 | A | 9/2002 |
| JP | 2003-150112 | | 5/2003 |
| JP | 2003-195812 | | 7/2003 |
| JP | 2003-195815 | | 7/2003 |
| KR | 2001-085788 | | 9/2001 |
| TW | 200300245 | | 5/2003 |
| TW | 200300543 | | 6/2003 |
| TW | I 252454 | | 4/2006 |
| TW | I 256607 | | 6/2006 |
| WO | WO 98/48403 | | 10/1998 |
| WO | WO 99/65011 | | 12/1999 |
| WO | WO 01/26088 | | 4/2001 |
| WO | WO 02/39420 | | 5/2002 |

OTHER PUBLICATIONS

Hattori, *Data-Line Driver Circuits for Current Programmed Active-Matrix OLED Based on Poly-Si TFTs*, AM-LCD '02, pp. 17-20.

Yumoto et al., *Pixel-Driving Methods for Large-Sized Poly-Si AM-OLED Displays*, Asia Display/IDW '01, pp. 1395-1398.

Akira Yumoto et al., "Pixel-Driving Methods for Large-Sized Poly-Si AM-OLED Displays," Asia Display, IDW '01, pp. 1395-1398.

Reiji Hattori et al., "Analog-Circuit Simulation of the Current-Programmed Active-Matrix Pixel Electrode Circuits Based on Poly-Si TFT for Organic Light-Emitting Displays," The Japan Society of Applied Physics, AM-LCD '01, Jul. 11-13, 2001, pp. 223-226.

Hattori et al., *Circuit Simulation of Poly-Si TFT Based Current-Writing Active-Matrix Organic LED Display,* Technical Report of IEICE, ED 2001-8, SDM2001-8, pp. 7-14.

Morosawa et al., *A Novel Poly-Si TFT Current DAC Circuit for AM-OLED Displays,* AM-LCD '03, pp. 301-304.

Tseng et al., *A New 6-Bit Digital-Type Current Driven Structure of OLED Display,* IDW '03, pp. 271-274.

Tseng et al., *An Active Matrix OLED Display Employing an Improving Gray Scale Structure*, IDW '03, pp. 523-526.

International Preliminary Examination Report dated Oct. 14, 2004 for Application No. PCT/JP2002/011278; PCT6040/6636.

International Preliminary Examination Report dated Oct. 14, 2004 for Application No. PCT/JP2002/011279; PCT6041/6637.

International Preliminary Examination Report dated Oct. 14, 2004 for Application No. PCT/JP2002/011280; PCT6042/6638.

International Preliminary Examination Report dated Oct. 14, 2004 for Application No. PCT/JP2002/011354; PCT6050/6639.

International Preliminary Examination Report dated Oct. 14, 2004 for Application No. PCT/JP2002/011355; PCT6051/6640.

Inukai, K. et al., "4.0-In. TFT-OLED Displays and a Novel Digital Driving Method," SID Digest '00: SID International Symposium Digest of Technical Papers, 2000, pp. 924-927.

European Search Report (Application No. 02775425.8) Dated Dec. 4, 2007.

Office Action (Application No. 2004-7006499) Dated Dec. 19, 2008.

* cited by examiner

Signal input

Completion of signal input

Signal input to pixel

Signal input

Completion of signal input

Signal input to pixel

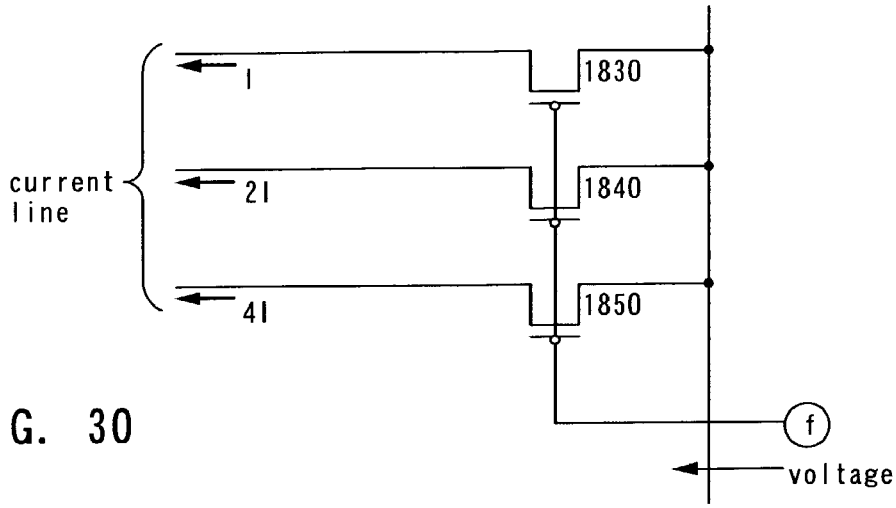
FIG. 30
FIG. 31A
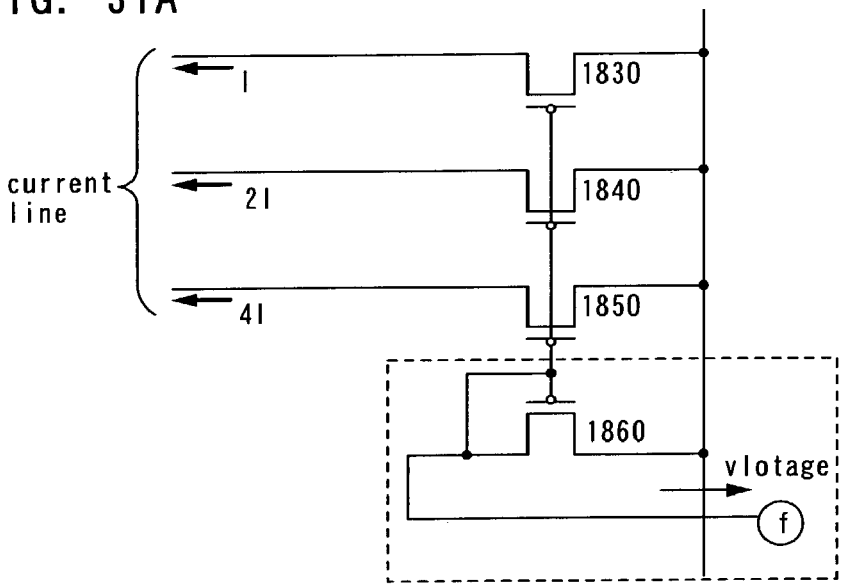
FIG. 31B
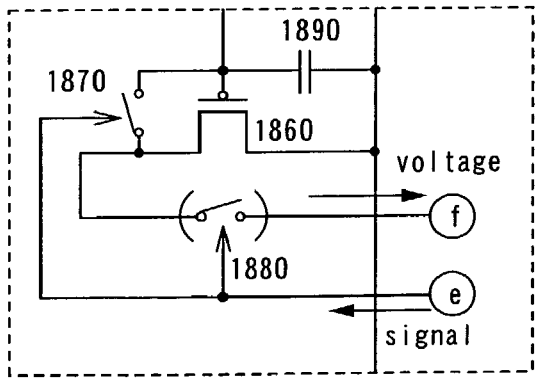

| A | B | C | first line | second line | third line | fourth line | fifth line | sixth line | seventh line | eighth line |
|---|---|---|---|---|---|---|---|---|---|---|
| 0 | 0 | 0 | 1 | 0 | 0 | 0 | 0 | 0 | 0 | 0 |
| 0 | 0 | 1 | 0 | 1 | 0 | 0 | 0 | 0 | 0 | 0 |
| 0 | 1 | 0 | 0 | 0 | 1 | 0 | 0 | 0 | 0 | 0 |
| 0 | 1 | 1 | 0 | 0 | 0 | 1 | 0 | 0 | 0 | 0 |
| 1 | 0 | 0 | 0 | 0 | 0 | 0 | 1 | 0 | 0 | 0 |
| 1 | 0 | 1 | 0 | 0 | 0 | 0 | 0 | 1 | 0 | 0 |
| 1 | 1 | 0 | 0 | 0 | 0 | 0 | 0 | 0 | 1 | 0 |
| 1 | 1 | 1 | 0 | 0 | 0 | 0 | 0 | 0 | 0 | 1 |

SIGNAL LINE DRIVING CIRCUIT, LIGHT EMITTING DEVICE, AND METHOD FOR DRIVING THE SAME

TECHNICAL FIELD

The present invention relates to a technique of a signal line driver circuit. Further, the present invention relates to a light emitting device including the signal line driver circuit.

BACKGROUND ART

Recently, display devices for performing image display are being developed. Liquid crystal display devices that perform image display by using a liquid crystal element are widely used as display devices because of advantages of high image quality, thinness, lightweight, and the like.

In addition, light emitting devices using self-light emitting elements as light emitting elements are recently being developed. The light emitting device has characteristics of, for example, a high response speed suitable for motion image display, low voltage, and low power consumption, in addition to advantages of existing liquid crystal display devices, and thus, attracts a great deal of attention as the next generation display device.

As gradation representation methods used in displaying a multi-gradation image on a light emitting device, an analog gradation method and a digital gradation method are given. The former analog gradation method is a method in which the gradation is obtained by conducting analog control the magnitude of a current that flows to a light emitting element. The latter digital gradation method is a method in which the light emitting element is driven only in two states thereof: an ON state (state where the luminance is substantially 100%) and an OFF state (state where the luminance is substantially 0%). In the digital gradation method, since only two gradations can be displayed, a method configured by combining the digital gradation method and a different method to display multi-gradation images has been proposed.

When classification is made based on the type of a signal that is input to pixels, a voltage input method and a current input method are given as pixel-driving methods. The former voltage input method is a method in which: a video signal (voltage) that is input to a pixel is input to a gate electrode of a driving element; and the driving element is used to control the luminance of a light emitting element. The latter current input method is a method in which the set signal current is flown to a light emitting element to control the luminance of the light emitting element.

Hereinafter, referring to FIG. 16(A), a brief description will be made of an example of a circuit of a pixel in a light emitting device employing the voltage input method and a driving method thereof. The pixel shown in FIG. 16(A) includes a signal line 501, a scanning line 502, a switching TFT 503, a driving TFT 504, a capacitor device 505, a light emitting element 506, and power sources 507 and 508.

When the potential of the scanning line 502 varies, and the switching TFT 503 is turned ON, a video signal that has been input to the signal line 501 is input to a gate electrode of the driving TFT 504. According to the potential of the input video signal, a gate-source voltage of the driving TFT 504 is determined, and a current flowing between the source and the drain of the driving TFT 504 is determined. This current is supplied to the light emitting element 506, and the light emitting element 506 emits light.

As a semiconductor device for driving the light emitting element, a polysilicon transistor is used. However, the polysilicon transistor is prone to variation in electrical characteristics, such as a threshold value and an ON current, due to defects in a grain boundary. In the pixel shown in FIG. 16(A), if characteristics of the driving TFT 504 vary in units of the pixel, even when identical video signals have been input, the magnitudes of the corresponding drain currents of the driving TFTs 504 are different. Thus, the luminance of the light emitting element 506 varies.

To solve the problems described above, a desired current may be input to the light emitting element, regardless of the characteristics of the TFTs for driving the light emitting element. From this viewpoint, the current input method has been proposed which can control the magnitude of a current that is supplied to a light emitting element regardless of the TFT characteristics.

Next, referring to FIGS. 16(B) and 17, a brief description will be made of a circuit of a pixel in a light emitting device employing the current input method and a driving method thereof. The pixel shown in FIG. 16(B) includes a signal line 601, first to third scanning lines 602 to 604, a current line 605, TFTs 606 to 609, a capacitor device 610, and a light emitting element 611. A current source circuit 612 is arranged to each signal line (each column).

Operations of from video signal-writing to light emission will be described by using FIG. 17. In FIG. 17, reference numerals denoting respective portions conform to those shown in FIG. 16. FIGS. 17(A) to 17(C) schematically show current paths. FIG. 17(D) shows the relationship between currents flowing through respective paths during a write of a video signal, and FIG. 17(E) shows a voltage accumulated in the capacitor device 610 also during the write of a video signal, that is, a gate-source voltage of the TFT 608.

First, a pulse is input to the first and second scanning lines 602 and 603 to turn the TFTs 606 and 607 ON. A signal current flowing through the signal line 601 at this time will be referred to as $I_{data}$. As shown in FIG. 17(A), since the signal current $I_{data}$ is flowing through the signal line 601, the current separately flows through current paths $I_1$ and $I_2$ in the pixel. FIG. 17(D) shows the relationship between the currents. Needless to say, the relationship is expressed as $I_{data}=I_1+I_2$.

The moment the TFT 606 is turned ON, no charge is yet accumulated in the capacitor device 610, and thus, the TFT 608 is OFF. Accordingly, $I_2=0$ and $I_{data}=I_1$ are established. In the moment, the current flows between electrodes of the capacitor device 610, and charge accumulation is performed in the capacitor device 610.

Charge is gradually accumulated in the capacitor device 610, and a potential difference begins to develop between both the electrodes (FIG. 17(E)). When the potential difference of both the electrodes has reached $V_{th}$ (point A in FIG. 17(E)), the TFT 608 is turned ON, and $I_2$ occurs. As described above, since $I_{data}=I_1+I_2$ is established, while $I_1$ gradually decreases, the current keeps flowing, and charge accumulation is continuously performed in the capacitor device 610.

In the capacitor device 610, charge accumulation continues until the potential difference between both the electrodes, that is, the gate-source voltage of the TFT 608 reaches a desired voltage. That is, charge accumulation continues until the voltage reaches a level at which the TFT 608 can allow the current $I_{data}$ to flow. When charge accumulation terminates (B point in FIG. 17(E)), the current $I_2$ stops flowing. Further, since the TFT 608 is fully ON, $I_{data}=I_2$ is established (FIG. 17(B)). According to the operations described above, the operation of writing the signal to the pixel is completed. Finally, selection of the first and second scanning lines 602 and 603 is completed, and the TFTs 606 and 607 are turned OFF.

Subsequently, a pulse is input to the third scanning line 604, and the TFT 609 is turned ON. Since VGS that has been just written is held in the capacitor device 610, the TFT 608 is already turned ON, and a current identical to $I_{data}$ flows thereto from the current line 605. Thus, the light emitting element 611 emits light. At this time, when the TFT 608 is set to operate in a saturation region, even if the source-drain voltage of the TFT 608 varies, a light emitting current $I_{EL}$ flowing to the light emitting element 611 flows continuously.

As described above, the current input method refers to a method in which the drain current of the TFT 609 is set to have the same current value as that of the signal current $I_{data}$ set in the current source circuit 612, and the light emitting element 611 emits light with the luminance corresponding to the drain current. By using the thus structured pixel, influence of variation in characteristics of the TFTs constituting the pixel is suppressed, and a desired current can be supplied to the light emitting element.

Incidentally, in the light emitting device employing the current input method, a signal current corresponding to a video signal needs to be precisely input to a pixel. However, when a signal line driver circuit (corresponding to the current source circuit 612 in FIG. 16) used to input the signal current to the pixel is constituted by polysilicon transistors, variation in characteristics thereof occurs, thereby also causing variation in characteristics of the signal current.

That is, in the light emitting device employing the current input method, variation in characteristics of TFTs constituting the pixel and the signal line driver circuit need to be suppressed. However, while the influence of variation in characteristics of the TFTs constituting the pixel can be suppressed by using the pixel having the structure of FIG. 16(B), suppression of the influence of variation in characteristics of the TFTs constituting the signal line driver circuit is difficult.

Hereinafter, using FIG. 18, a brief description will be made of the structure and operation of a current source circuit arranged in the signal line driver circuit that drives the pixel employing the current input method.

The current source circuit 612 shown in FIGS. 18(A) and 18(B) corresponds to the current source circuit 612 of FIG. 16(B). The current source circuit 612 includes constant current sources 555 to 558. The constant current sources 555 to 558 are controlled by signals that are input via respective terminals 551 to 554. The magnitudes of currents supplied from the constant current sources 555 to 558 are different from one another, and the ratio thereof is set to 1:2:4:8.

FIG. 18(B) shows a circuit structure of the current source circuit 612, in which the constant current sources 555 to 558 shown therein correspond to transistors. The ratio of ON currents of the transistors 555 to 558 is set to 1:2:4:8 according to the ratio (1:2:4:8) of the value of L (gate length)/W (gate width). The current source circuit 612 then can control the current magnitudes at $2^4$=16 levels. Specifically, currents having 16-gradation analog values can be output for 4-bit digital video signals. Note that the current source circuit 612 is constituted by polysilicon transistors, and is integrally formed with the pixel portion on the same substrate.

As described above, conventionally, a signal line driver circuit incorporated with a current source circuit has been proposed (for example, refer to Non-patent Documents 1 and 2).

In addition, digital gradation methods include a method in which a digital gradation method is combined with an area gradation method to represent multi-gradation images (hereinafter, referred to as area gradation method), and a method in which a digital gradation method is combined with a time gradation method to represent multi-gradation images (hereinafter, referred to as time gradation method). The area gradation method is a method in which one pixel is divided into a plurality of sub-pixels, emission or non-emission is selected in each of the sub-pixels, and the gradation is represented according to a difference between a light emitting area and the other area in a single pixel. The time gradation method is a method in which gradation representation is performed by controlling the emission period of a light emitting element. To be more specific, one frame period is divided into a plurality of subframe periods having mutually different lengths, emission or non-emission of a light emitting element is selected in each period, and the gradation is presented according to a difference in length of light emission time in one frame period. In the digital gradation method, the method in which a digital gradation method is combined with a time gradation method (hereinafter, referred to as time gradation method) is proposed. (For example, refer to Patent Document 1).

[Non-patent Document 1]

Reiji Hattori & three others, "Technical Report of Institute of Electronics, Information and Communication Engineers (IEICE)", ED 2001-8, pp. 7-14, "Circuit Simulation of Current Specification Type Polysilicon TFT Active Matrix-Driven Organic LED Display"

[Non-patent Document 2]

Reiji H et al.; "AM-LCD'01", OLED-4, pp. 223-226

[Patent Document 1]

JP 2001-5426 A

DISCLOSURE OF THE INVENTION

In the above-described current source circuit 612, the ON currents of the transistors are set to a ratio of 1:2:4:8 by designing the L/W values. However, in the transistors 555 to 558, variations occur in the threshold value and mobility due to a number of factors for variations in the gate length, gate width, and thickness of a gate insulating film, which are attributed to differences in manufacturing steps and substrates used. This makes it difficult to precisely set the ON currents of the transistors 555 to 558 to 1:2:4:8. That is, depending on the column, variation occurs in the value of the current to be supplied to the pixel.

To precisely set the ON currents of the transistors 555 to 558 to 1:2:4:8 as designed, current source circuits arranged to all the columns need to be identical in characteristics to one another. Specifically, the characteristics of transistors in all current source circuits of the signal line driver circuit need to be arranged identical to one another. However, such arrangement is extremely difficult to be realized.

The present invention has been made in view of the problems described above, and therefore provides a signal line driver circuit capable of suppressing the influence of variation in characteristics of TFTs to thereby supply a desired signal current to a pixel. In addition, the present invention provides a light emitting device capable of suppressing the influence of variation in characteristics of TFTs constituting both the pixel and the driver circuit to thereby supply a desired signal current to a light emitting element by using the pixel having a circuit structure suppressing the influence of variation in characteristics of TFTs.

The present invention provides a signal line driver circuit having a structure which is provided with an electric circuit (current source circuit) that suppresses the influence of variation in characteristics of TFTs to flow a desired constant current. In addition, the present invention provides a light emitting device provided with the signal line driver circuit.

The present invention provides a signal line driver circuit in which a current source circuit is arranged in each column (each signal line or the like).

In the signal line driver circuit according to the present invention, the current source circuit arranged in each signal line (each column) is set to supply a predetermined signal current by using a reference constant current source. The current source circuit for which the signal current is set has a capability of supplying a current proportional to the reference constant current source. Consequently, using the current source circuit, the influence of variation in characteristics of the TFTs constituting the signal line driver circuit can be suppressed. A switch for determining whether the set signal current is supplied from the current source circuit to the pixel is controlled by a video signal.

To be more specific, in the case where a signal current proportional to a video signal is required to flow to a signal line, a switch is arranged to determine as to whether the signal current is supplied from the current source circuit to the signal line driver circuit, and the switch is controlled by the video signal. Here, the switch for determining as to whether the signal current is supplied from the current source circuit to the signal line driver circuit is referred to as a signal current control switch.

Note that the reference constant current source may be formed integrally with the signal line driver circuit on a substrate. Alternatively, an IC or the like may be arranged on the outside of the substrate to input a constant current as a reference current.

The outline of the signal line driver circuit of the present invention will be described with reference to FIGS. 1 and 2. FIGS. 1 and 2 each show a signal line driver circuit in the periphery of three signal lines of i-th to (i+2)-th columns.

First, a case where signal currents proportional to video signals are needed to flow to the signal lines will be described.

In FIG. 1, current source circuits 420 are arranged in the respective signal lines (respective columns) in a signal line driver circuit 403. The current source circuits 420 each include a terminal a, a terminal b, and a terminal c. A setting signal is input to the terminal a. A current (reference current) is supplied to the terminal b from a reference constant current source 109 connected to a current line. The terminal c outputs a signal held in the current source circuit 420 via a switch 101 (signal current control switch). That is, the current source circuit 420 is controlled by the setting signal input from the terminal a, the current (reference current) is supplied from the terminal b, and the current proportional to the current (reference current) is output from the terminal c. The switch 101 (signal current control switch) is arranged between the current source circuit 420 and a pixel, and ON/OFF of the switch 101 (signal current control switch) is controlled by the video signal.

Next, using FIG. 2, a description will be made of a signal line driver circuit of the present invention that has a structure different from that shown in FIG. 1. In FIG. 2, two or more current source circuits 420 are provided for each signal line (each column) in a signal line driver circuit 403. The current source circuit 420 includes a plurality of current source circuits. Here, it is assumed that two current source circuits are arranged in each column and that the current source circuit 420 includes a first current source circuit 421 and a second current source circuit 422. The first current source circuit 421 and the second current source circuit 422 each include a terminal a, a terminal b, terminal c, and a terminal d. A setting signal is input to the terminal a. A current (reference current) is supplied to the terminal b from a reference constant current source 109 connected to a current line. Further, the terminal c outputs signals (signal currents) held in the first current source circuit 421 and the second current source circuit 422 via a switch 101 (signal current control switch). A control signal is input from the terminal d. That is, the current source circuit 420 is controlled by the setting signal input from the terminal a and the control signal input from the terminal d, the current (reference current) is supplied from the terminal b, and the current (signal current) proportional to the current (reference current) is output from the terminal c. The switch 101 (signal current control switch) is arranged between the current source circuit 420 and a pixel, and ON/OFF of the switch 101 (signal current control switch) is controlled by the video signal.

An operation (for setting a signal current, setting the signal current according to a reference current, and performing setting to enable the current source circuit 420 to output a signal current) for completing a write of the signal current to the current source circuit 420 is referred to as a setting operation. In addition, an operation for inputting a signal current to a pixel (operation of the current source circuit 420 to output the signal current) is referred to as an input operation. In FIG. 2, the control signals input to the first current source circuit 421 and the second current source circuit 422 are different from each other. Therefore, one of the first current source circuit 421 and the second current source circuit 422 performs the setting operation, and the other performs the input operation. Thus, the two operations can be executed at the same time in each column.

Note that the setting operation of the current source circuit may be performed an arbitrary number of times at arbitrary time and at arbitrary timing. Further, each of the signal line driver circuits of FIGS. 1 and 2 has been described for the case where the signal current proportional to the video signal is supplied to the signal line. However, the present invention is not limited to this. For example, a current needs to be supplied to a wiring different from the signal line. In this case, the switch 101 (signal current control switch) does not need to be arranged. A case where the switch is not arranged is shown in FIG. 34 as to FIG. 1, and the case is shown in FIG. 35 as to FIG. 2. In these cases, a current is output to a pixel current line. The video signal is output to the signal line.

In the present invention, one shift register has two roles. One role is to control a current source circuit. The other role is to control a circuit that controls video signals, that is, a circuit that operates to display an image, for example, to control a latch circuit, a sampling switch, the switch 101 (signal current control switch), or the like. In the present invention with the above structure, the circuit that controls a current source circuit and the circuit that controls a video signal do not need to be arranged, respectively, which enables reduction of the number of elements of the circuit to be arranged. Further, since the number of elements can be reduced, a layout area can be reduced. Thus, yield in a manufacturing process is improved, and cost-cutting can be realized. Further, reduction of the layout area can lead to a smaller frame, and thus, reduction in size of a casing can be realized.

Note that a shift register is comprised of a flip-flop circuit, a decoder circuit, or the like. In the case where the shift register is comprised of the flip-flop circuit, in general, a plurality of wirings are sequentially selected from the first column to the last column. On the other hand, in the case where the shift register is comprised of the decoder circuit or the like, a plurality of wirings are sequentially selected from the first column to the last column or selected at random. The shift register may select either the structure having a function capable of sequentially selecting a plurality of wirings or the structure having a function capable of selecting a plurality of wirings at random in accordance with the application.

Incidentally, in the case of selecting the structure having a function capable of selecting a plurality of wirings at random, set signals supplied to the current source circuit can be output randomly. Therefore, the setting operation of the current source circuit is not performed sequentially from the first column to the last column, and can be performed randomly. Thus, the period during which the current source circuit performs the setting operation can be set freely. Further, the influence of a leakage of charge held in a capacitor element in the current source circuit can be made inconspicuous. When the setting operation of the current source circuit can be performed at random as described above, in the case where there exists a defect accompanied with the setting operation of the current source circuit, the defect can be made inconspicuous.

Note that the present invention may be applied by replacing TFTs with transistors using ordinary monocrystal, transistors using SOI, organic transistors, or the like.

The present invention provides a signal line driver circuit including the current source circuit described above. Further, the present invention provides a light emitting device capable of suppressing the influence of variation in characteristics of TFTs constituting both pixels and driver circuits to enable a desired signal current to be supplied to light emitting elements by using pixels each having a circuit structure in which the influence of variation in characteristics of TFTs is suppressed.

BRIEF DESCRIPTION OF THE DRAWINGS

FIG. 30 is a circuit diagram of a reference constant current source.
FIG. 31 is a circuit diagram of a reference constant current source.

BEST MODE FOR EMBODYING THE INVENTION

Embodiment Mode 1

In this embodiment mode, a description will be made of a structure and an operation of a current source circuit provided to a signal line driver circuit of the present invention.

In the present invention, a signal input from a terminal a corresponds to a sampling pulse supplied from a shift register. However, depending on the structure or drive system of the current source circuit, the sampling pulse is not directly input, and instead, the signal supplied from an output terminal of a logical operator connected to a setting control line (not shown in FIG. 1) is input. One of two input terminals of the logical operator is input with the sampling pulse, and the other input terminal is input with the signal supplied from the setting control line. Thus, the setting of a current source circuit 420 is performed in accordance with the timing of the sampling pulse or the signal supplied from the output terminal of the logical operator connected to the setting control line.

Note that a shift register has a structure including, for example, flip-flop circuits (FFs) in a plurality of columns. A clock signal (S-CLK), a start pulse (S-SP), and an inverted clock signal (S-CLKb) are input to the shift register, and signals serially output according to the timing of the input signals are called sampling pulses.

Further, one of the two input terminals of the logical operator is input with the sampling pulse, and the other input terminal is input with the signal supplied from the setting control line. The logical operator conducts a logic operation for the input two signals to output a signal from the output terminal. Assuming that the logical operator is a NAND, in the timing chart shown in FIG. 14(C), a High signal may be input to the NAND from a control line in a period Th while a Low signal may be input to the NAND from the control line in other period.

The shift register is comprised of a flip-flop circuit, a decoder circuit, or the like. In the case where the shift register is comprised of the flip-flop circuit, in general, a plurality of wirings are sequentially selected from the first column to the last column. On the other hand, in the case where the shift register is comprised of the decoder circuit or the like, a plurality of wirings are sequentially selected from the first column to the last column or selected at random. The shift register may select either the structure having a function capable of sequentially selecting a plurality of wirings or the structure having a function capable of selecting a plurality of wirings at random in accordance with the application.

Figure 23A:
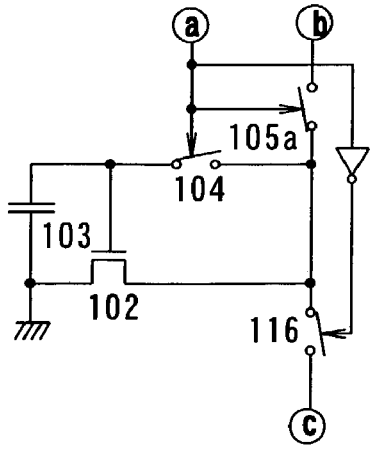
FIG. 23 is circuit diagrams of a current source circuit.

In FIG. 23(A), a circuit including switches 104, 105*a*, and 116, a transistor 102 (n-channel type), and a capacitor device 103 for retaining a gate-source voltage VGS of the transistor 102 corresponds to the current source circuit 420.

In the current source circuit shown in FIG. 23(A), the switch 104 and the switch 105*a* are turned ON by a sampling pulse input via the terminal a. Then, a current (reference current) is supplied via the terminal b from the reference constant current source 109 (hereinafter referred to as constant current source 109) connected to the current line, and a predetermined charge is retained in the capacitor device 103. The charge is retained until the current (reference current) flown from the constant current source 109 becomes identical with a drain current of the transistor 102.

Then, the switches 104 and 105*a* are turned OFF by the signal input via the terminal a. As a result, since the predetermined charge is retained in the capacitor device 103, the transistor 102 has a capability of flowing a current having a magnitude corresponding to that of the current (reference current). If the switch 101 (signal current control switch) and the switch 116 are turned into a conductive state, a current flows to a pixel connected to the signal line via the terminal c. At this time, since the gate voltage of the transistor 102 is set to a predetermined gate voltage by the capacitor device 103, a drain current corresponding to the current (reference current) flows to the drain region of the transistor 102. Thus, the magnitude of the current input to the pixel can be controlled without being influenced by the variation in characteristics of the transistors constituting the signal line driver circuit.

Note that, in the case where the switch 101 (signal current control switch) is not arranged, when the switch 116 is turned into a conductive state, a current is supplied to the pixel connected to the signal line via the terminal c.

The connection structure of the switches 104 and 105*a* is not limited to the structure shown in FIG. 23(A). For example, the structure may be such that: one of terminals of the switch 104 is connected to the terminal b, and the other terminal is connected to the gate electrode of the transistor 102; and one of terminals of the switch 105*a* is connected to the terminal b via the switch 104, and the other terminal is connected to the switch 116.

Figure 36A:
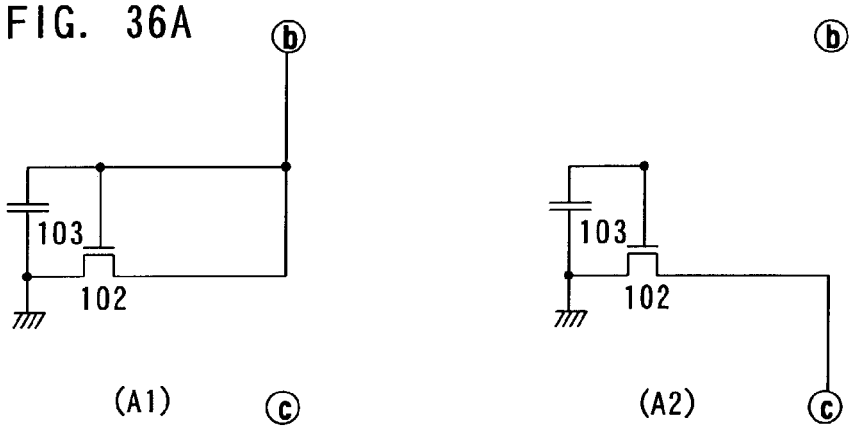
FIG. 36 is circuit diagrams of a current source circuit.

Alternatively, the switch 104 may be arranged between the terminal b and the gate electrode of the transistor 102, and the switch 105*a* may be arranged between the terminal b and the switch 116. That is, the number of switches and the number of wirings, which are arranged in the current source circuit and the connection are not particularly limited. Incidentally, referring to FIG. 36(A), switches may be arranged such that the connection is structured as shown in FIG. 36(A1) in the setting operation, and the connection is structured as shown in FIG. 36(A2) in the input operation.

In the current source circuit of FIG. 23(A), the signal setting operation (setting operation) cannot be performed simultaneously with the signal inputting operation (input operation) to the pixel.

Figure 23B:
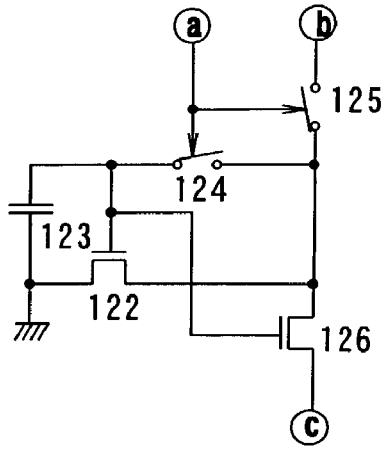

Referring to FIG. 23(B), a circuit including a switch 124, a switch 125, a transistor 122 (n-channel type), a capacitor device 123 for retaining a gate-source voltage VGS of the transistor 122, and a transistor 126 (n-channel type) corresponds to the current source circuit 420.

The transistor 126 functions as either a switch or a part of a current source transistor.

In the current source circuit shown in FIG. 23(B), the switch 124 and the switch 125 are turned ON by a sampling pulse input via the terminal a. Then, a current (reference current) is supplied via the terminal b from the constant current source 109 connected to the current line, and a predetermined charge is retained in the capacitor device 123. The charge is retained until the current (reference current) flown from the constant current source 109 becomes identical with a drain current of the transistor 122. Note that, when the switch 124 is turned ON, since a gate-source voltage VGS of the transistor 126 is set to 0 V, the transistor 126 is turned OFF.

Subsequently, the switches 124 and 125 are turned OFF by the signal input via the terminal a. As a result, since the predetermined charge is retained in the capacitor device 123, the transistor 122 has a capability of flowing a current having a magnitude corresponding to that of the current (reference current). If the switch 101 (signal current control switch) is turned into the conductive state, a current flows to a pixel connected to the signal line via the terminal c. This is because the gate voltage of the transistor 122 is set at a predetermined gate voltage by the capacitor device 123, and thus, a drain current corresponding to the signal current $I_{data}$ flows to the drain region of the transistor 122. Therefore, the magnitude of the current that is input to the pixel can be controlled without being influenced by the variation in characteristics of the transistors constituting the signal line driver circuit.

Note that, when the switches 124 and 125 have been turned OFF, a gate and a source of the transistor 126 do not have the same potential. As a result, since the charge retained in the capacitor device 123 is distributed also to the transistor 126, and the transistor 126 is automatically turned ON. Here, the transistors 122 and 126 are connected in series, and the gates thereof are connected to each other. Accordingly, the transistors 122 and 126 each serve as a multi-gate transistor. That is, a gate length L of the transistor varies between the setting operation and the input operation. Therefore, the value of the current supplied from the terminal b at the time of the setting operation can be made larger than the value of the current supplied from the terminal c at the time of the input operation. Thus, various loads (such as wiring resistances and cross capacitances) disposed between the terminal b and the reference constant current source can be charged even faster. Consequently, the setting operation can be completed quickly. In the case where the switch 101 (signal current control switch) is not arranged, when the switch 126 is turned into the conductive state, a current flows via the terminal c to the pixel connected to the signal line.

Figure 36B:
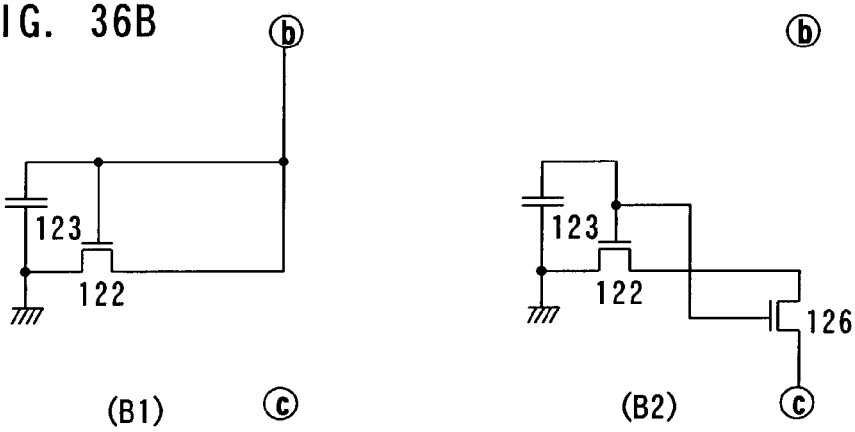

Further, the number of switches and the number of wirings, which are arranged in the current source circuit, and the connection are not particularly limited. Specifically, referring to FIG. 36(B), wirings and switches may be arranged such that the connection is structured as shown in FIG. 36(B1) in the setting operation, and the connection is structured as shown in FIG. 36(B2) in the input operation. In particular, in FIG. 36(B2), it is sufficient that the charge accumulated in a capacitor device 107 does not leak.

Note that, in the current source circuit shown in FIG. 23(B), the setting operation for conducting setting to make the current source circuit have a capability of flowing a signal current cannot be performed simultaneously with the input operation (output of a current to a pixel) for supplying the signal current to the pixel.

Figure 23C:
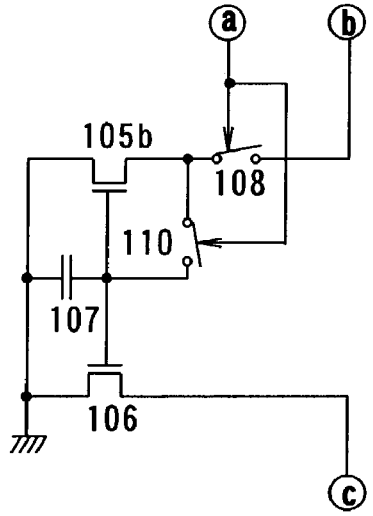

Referring to FIG. 23(C), a circuit including a switch 108, a switch 110, transistors 105*b* and 106 (n-channel type), and a capacitor device 107 for retaining gate-source voltages VGS of the transistors 150*b* and 106 corresponds to the current source circuit 420.

In the current source circuit shown in FIG. 23(C), the switch 108 and the switch 110 are turned ON by a sampling pulse input via the terminal a. Then, a current (reference current) is supplied via the terminal b from the constant current source 109 connected to the current line, and a predetermined charge is retained in the capacitor device 107. The charge is retained until the current (reference current) flown from the constant current source 109 becomes identical with a drain current of the transistor 105*b*. At this time, since the gate electrodes of the transistor 105*b* and of the transistor 106 are connected to each other, the gate voltages of the transistor 105*b* and the transistor 106 are retained by the capacitor device 107.

Then, the switches 108 and 110 are turned OFF by a signal input via the terminal a. At this time, since the predetermined charge is retained in the capacitor device 107, the transistor 106 has a capability of flowing a current having a magnitude corresponding to that of the current (reference current). If the switch 101 (signal current control switch) is turned to the conductive state, a current flows to a pixel connected to the signal line via the terminal c. This is because the gate voltage of the transistor 106 is set to a predetermined gate voltage by the capacitor device 107, and thus, a drain current corresponding to the current (reference current) flows to the drain region of the transistor 106. Thus, the magnitude of the current input to the pixel can be controlled without being influenced by the variation in characteristics of the transistors constituting the signal line driver circuit.

Note that, in the case where the switch 101 (signal current control switch) is not arranged, a current flows to the pixel connected to the signal line via the terminal c.

At this time, characteristics of the transistor 105*b* and the transistor 106 need to be the same to cause the drain current corresponding to the signal current to flow precisely to the drain region of the transistor 106. To be more specific, values such as mobilities and thresholds of the transistors 105*b* and 106 need to be the same. In addition, in FIG. 23(C), the value of W/L of each of the transistors 105*b* and 106 may be arbitrarily set, and a current proportional to the current supplied from the constant current source 109 may be supplied to the pixel.

Further, the value of W/L of the transistor 105*b* or the transistor 106 that is connected to the constant current source 109 is set high, whereby the write speed can be increased by supplying a large current from the constant current source 109.

Note that, with the current source circuit shown in FIG. 23(C), the setting operation for conducting setting to make the current source circuit have a capability of flowing a signal current can be performed simultaneously with the input operation for inputting the signal current to the pixel.

Figure 23D:
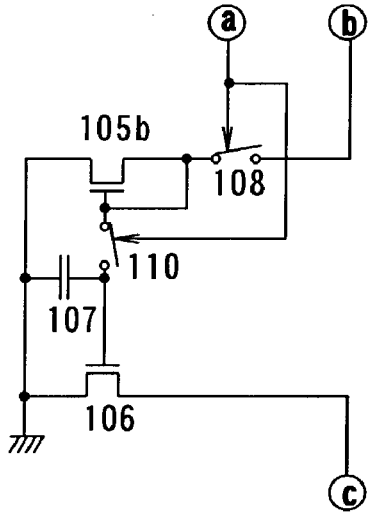
Figure 23E:
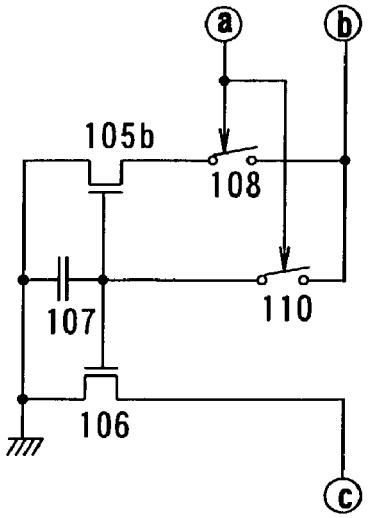

The current source circuit shown in each of FIGS. 23(D) and 23(E) has the same structure as that of the current source circuit of FIG. 23(C), except for the connection of the switch 110. In addition, since the operation of the current source circuit 420 of each of FIGS. 23(D) and 23(E) conforms to the operation of the current source circuit 420 of FIG. 23(C), a description thereof will be omitted here.

Figure 36C:
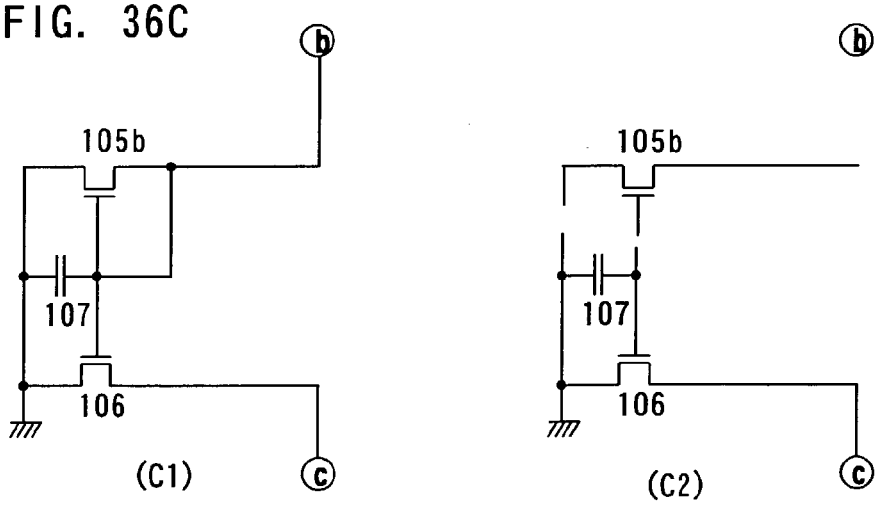

Note that, the number of switches and the number of wirings, which are arranged in the current source circuit and the connection are not particularly limited. Specifically, referring to FIG. 36(C), wirings and switches may be arranged such that the connection is structured as shown in FIG. 36(C1) in the setting operation, and the connection is structured as shown in FIG. 36(C2) in the input operation. In particular, in FIG. 36(C2), it is sufficient that the charge held in the capacitor device 107 does not leak.

Figure 37A:
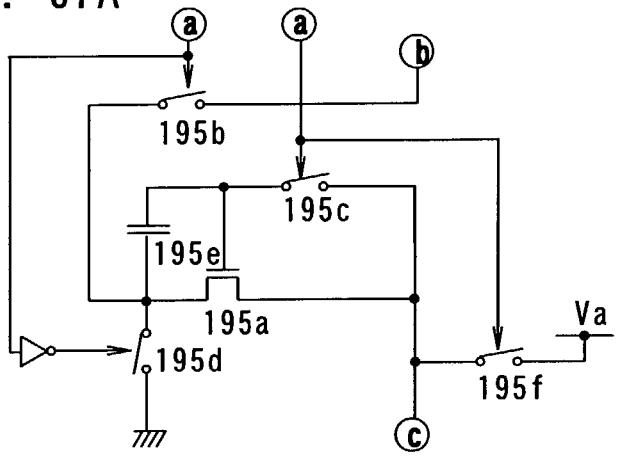
FIG. 37 is circuit diagrams of a current source circuit.

Referring to FIG. 37(A), a circuit including switches 195*b*, 195*c*, 195*d*, and 195*f*, a transistor 195*a*, and a capacitor device 195*e* corresponds to the current source circuit. In the current source circuit shown in FIG. 37(A), the switches 195*b, c, d*, and *f* are turned ON by a signal input via the terminal a. Then, a current is supplied via the terminal b from the constant current source 109 connected to the current line. A predetermined charge is retained in the capacitor device 195*e* until the signal current supplied from the constant current source 109 becomes identical with a drain current of the transistor 195*a*.

Then, the switches 195*b*, 195*c*, 195*d*, and 195*f* are turned OFF by the signal input via the terminal a. At this time, since the predetermined charge is retained in the capacitor device 195*e*, the transistor 195*a* has a capability of flowing a current having a magnitude corresponding to that of the signal current. This is because the gate voltage of the transistor 195*a* is set to a predetermined gate voltage by the capacitor device 195*a*, and thus, a drain current corresponding to a current (reference current) flows to the drain region of the transistor 195*a*. In this state, a current is supplied to the outside via the terminal c. Note that, in the current source circuit shown in FIG. 37(A), the operation for setting the current source circuit to have a capability of flowing a signal current cannot be performed simultaneously with the input operation for inputting the signal current to the pixel. Incidentally, when a switch controlled by the signal input via the terminal a is ON, and also, when a current is controlled not to flow from the terminal c, the terminal c needs to be connected to another wiring of the other potential. Assuming that the wiring potential is represented by Va, Va may have any value as long as Va is a potential sufficient to flow a current flowing from the terminal b as it is. A power supply voltage Vdd may be adopted as an example.

Figure 37B:
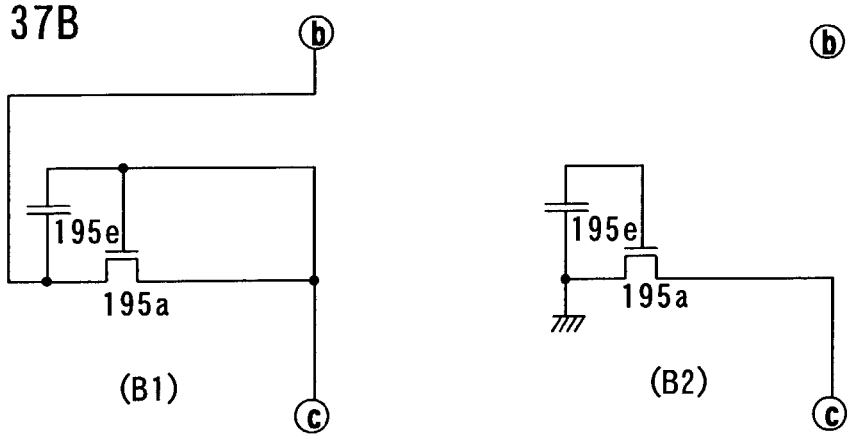
Figure 37C:
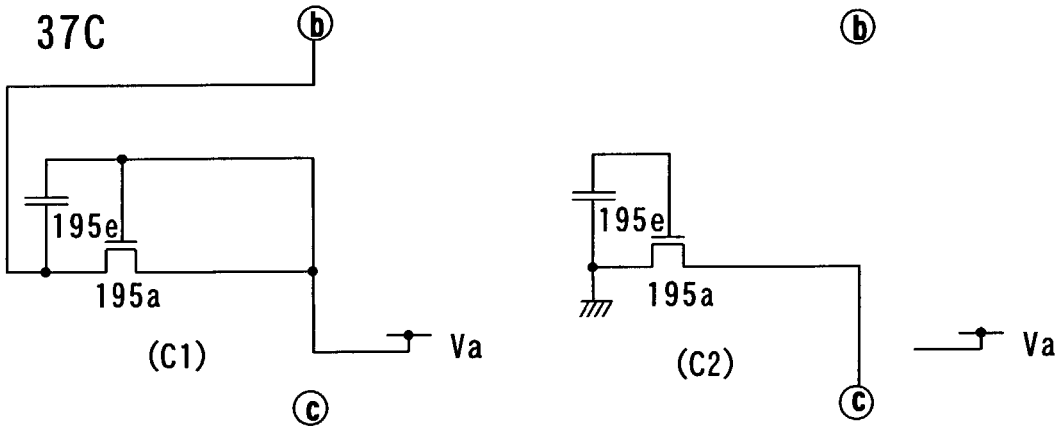

Note that, the number of switches, the number of wirings, and the connection are not particularly limited. Specifically, referring to FIGS. 37(B) and 37(C), wirings and switches may be arranged such that the connection is structured as shown in either FIG. 37(B1) or 37(C1) in the setting operation, and the connection is structured as shown in either FIG. 37(B2) or 37(C2) in the input operation.

Further, in the current source circuits 420 of FIGS. 23(A) and 23(C) to 23(E), the current-flow directions (directions from the pixel to the signal line driver circuit) are the same. The conductivity type of each of the transistors 102, 105*b*, and 106 may be of p-channel type.

Figure 24A:
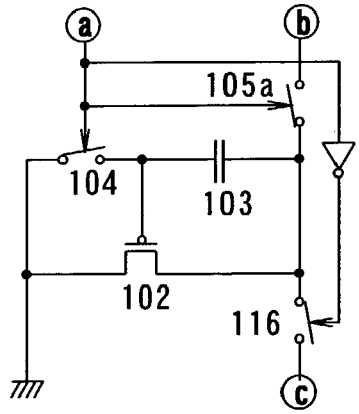
FIG. 24 is circuit diagrams of a current source circuit.
Figure 24B:
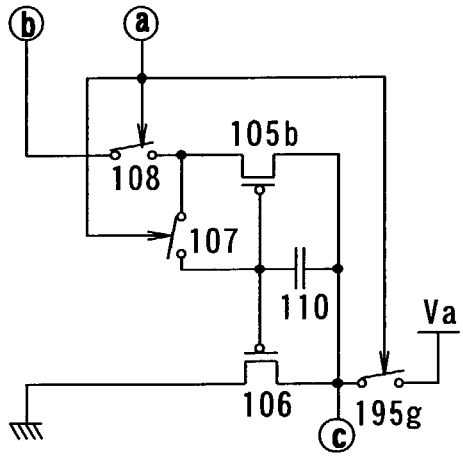
Figure 24C:
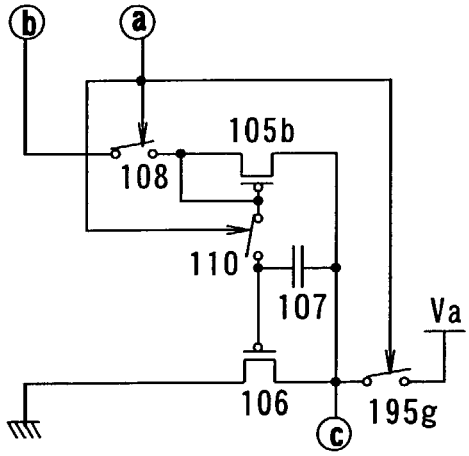
Figure 24D:
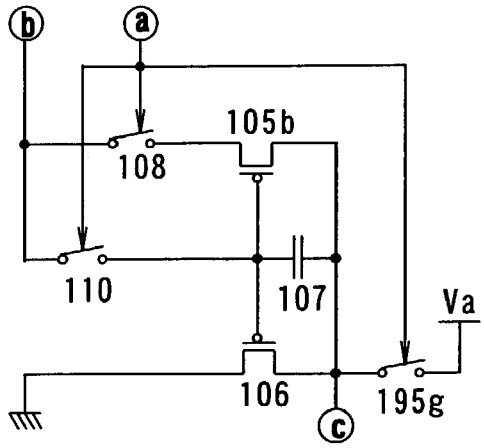

FIG. 24(A) shows a circuit diagram in which the current-flow direction (direction from the pixel to the signal line driver circuit) is the same, and the transistor 102 shown in FIG. 23(A) is set to be of p-channel type. In FIG. 23(A), with the capacitor device arranged between the gate and the source, even when the source potential varies, the gate-source voltage can be maintained. Further, FIGS. 24(B) to 24(D) show circuit diagrams in which the current-flow directions (directions from the pixel to the signal line driver circuit) are the same, and the transistors 105*b* and 106 shown in FIGS. 23(C) to 23(E) are set to be of p-channel type.

Figure 38A:
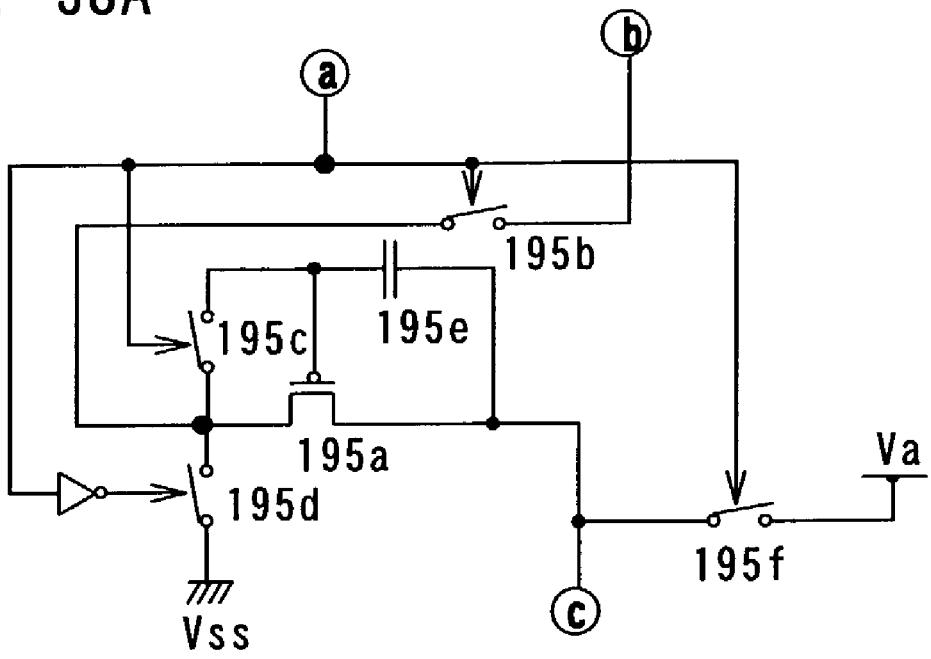
FIG. 38 is circuit diagrams of a current source circuit.
Figure 38B:
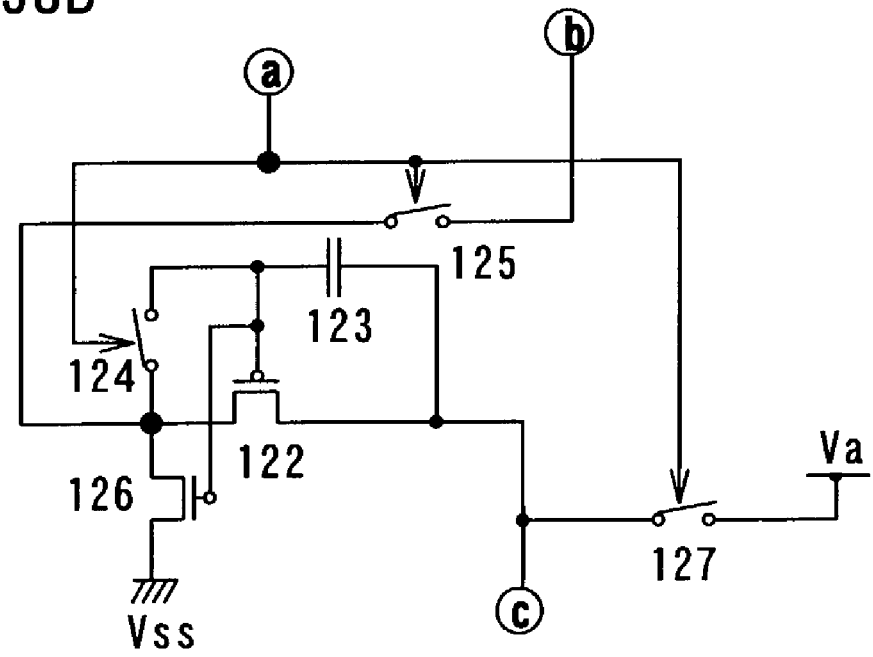
Figure 39A:
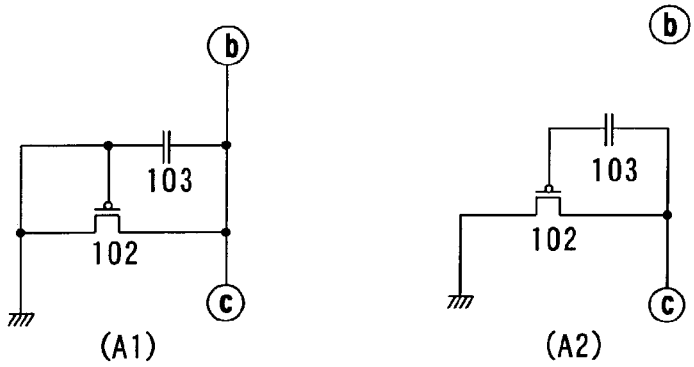
FIG. 39 is circuit diagrams of a current source circuit.
Figure 39B:
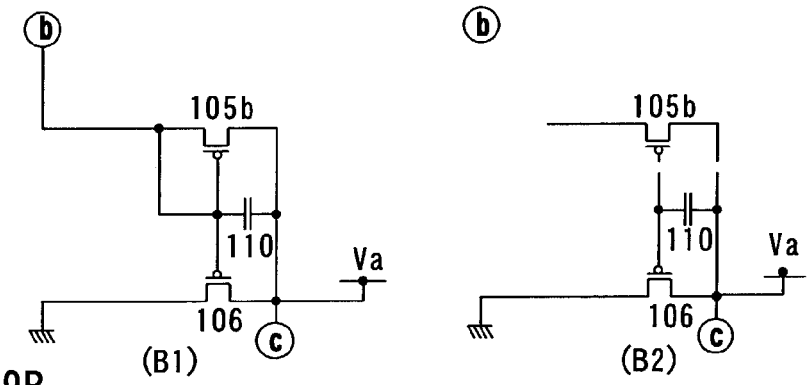
Figure 39C:
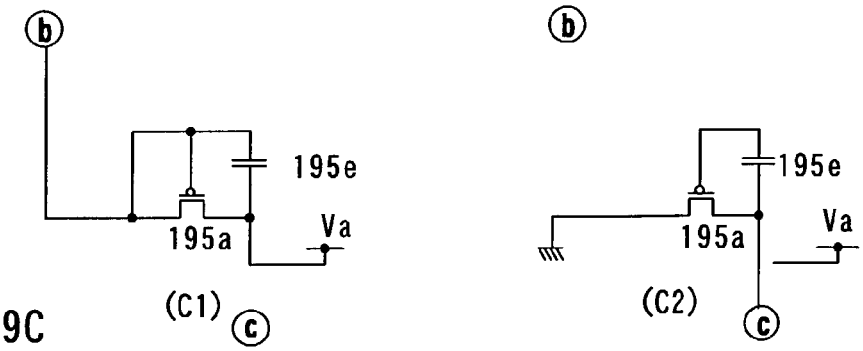
Figure 39D:
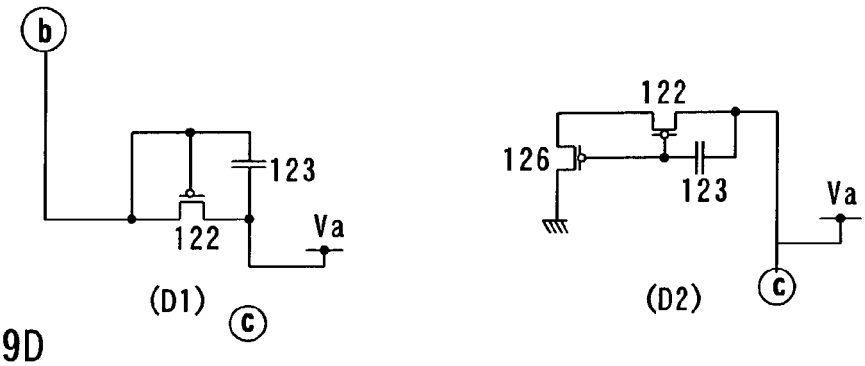

FIG. 38(A) shows a case where the transistor 195*a* is set to be of p-channel type in the structure of FIG. 37. FIG. 38(B) shows a case where the transistors 122 and 126 are set to be of p-channel type in the structure of FIG. 23(B).

Referring to FIG. 40, a circuit including switches 104 and 116, a transistor 102, a capacitor device 103, and the like corresponds to the current source circuit.

Figure 40A:
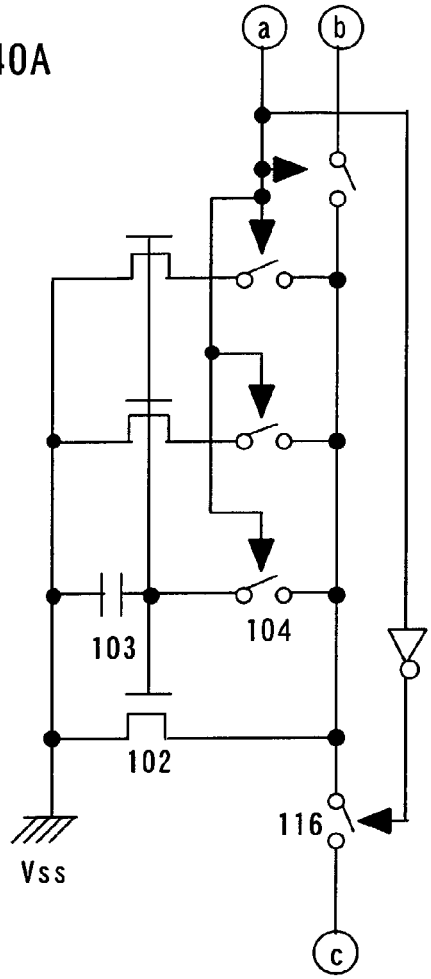
FIG. 40 is circuit diagrams of a current source circuit.
Figure 40B:
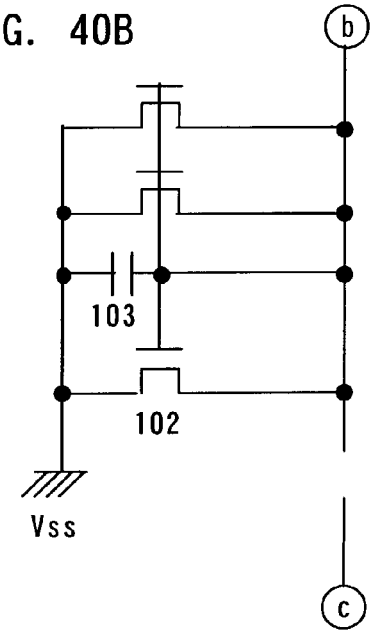
Figure 40C:
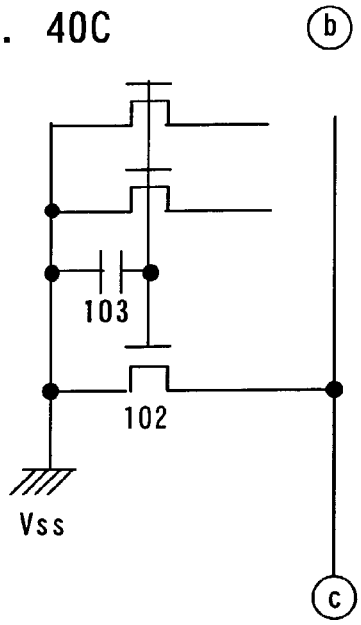

FIG. 40(A) corresponds to the circuit of FIG. 23(A) which is partly modified. In the current source circuit of FIG. 40(A), the transistor gate width W varies between the setting operation of the current source and the input operation. Specifically, the connection is structured as shown in FIG. 40(B) in the setting operation while the connection is structured as shown in FIG. 40(C) in the input operation. Thus, the gate width W differs. Therefore, the value of the current supplied from the terminal b at the time of the setting operation can be made larger than the value of the current supplied from the terminal c at the time of the input operation. Thus, various loads (such as wiring resistances and cross capacitances) disposed between the terminal b and the reference constant current source can be charged even faster. Consequently, the setting operation can be completed quickly. Note that, FIG. 40 shows the circuit of FIG. 23(A) which is partly modified. In addition, the circuit can be easily applied to, for example, other circuits shown in FIG. 23 and to the circuits shown in FIG. 24, FIG. 37, FIG. 39, FIG. 38, and the like.

Note that, in each of the current source circuits shown in FIGS. 23, 24, and 37, a current flows from the pixel to the signal line driver circuit. However, the current not only flows from the pixel to the signal line driver circuit, but also may flow from the signal line driver circuit to the pixel. The direction of the current flow depends on the pixel structure. In the case where the current flows from the signal line driver circuit to the pixel, Vss (low potential power source) may be changed to Vdd (high potential power source), and the transistors 102, 105*b*, 106, 122, and 126 may be set to be of p-channel type in FIG. 23. Also in FIG. 24, Vss may be changed to Vdd, and the transistors 102, 105*b*, and 106 may be of n-channel type.

Note that, in all the current source circuits described above, the arranged capacitor device may not be arranged by being substituted by, for example, a gate capacitance of a transistor.

In the circuits of FIGS. 23(A) to 23(E) and 38(A) and 38(B), wirings and switches may be arranged such that the connection is structured as shown in FIGS. 39(A1) to 39(D1) in the setting operation, and the connection is structured as shown in FIGS. 39(A2) to 39(D2) in the input operation. The number of switches and the number of wirings are not particularly limited.

Hereinafter, a description will be made in detail regarding the operations of the current source circuits of FIGS. 23(A), 24(A), 23(C) to 23(E), and 24(B) to 24(D). To begin with, the operations of the current source circuits of FIGS. 23(A) and 24(A) will be described with reference to FIG. 19.

Figure 19A:
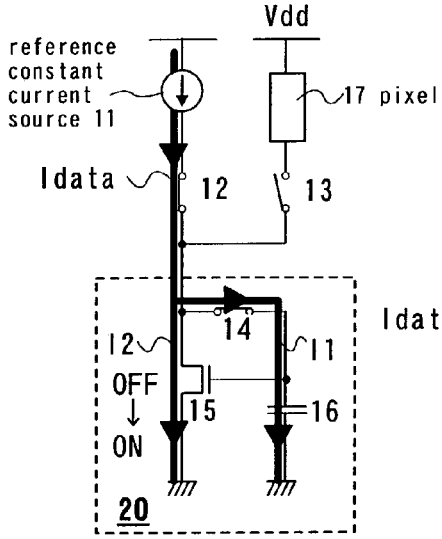
FIG. 19 is explanatory views of operations of a current source circuit.
Figure 19B:
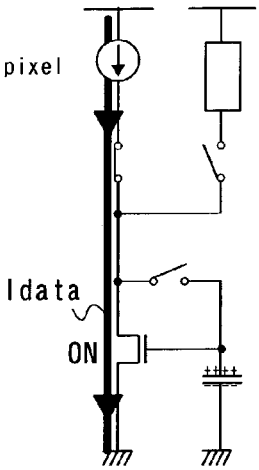
Figure 19C:
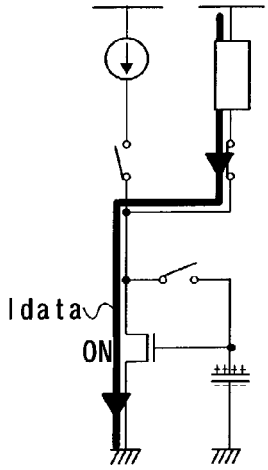
Figure 19D:
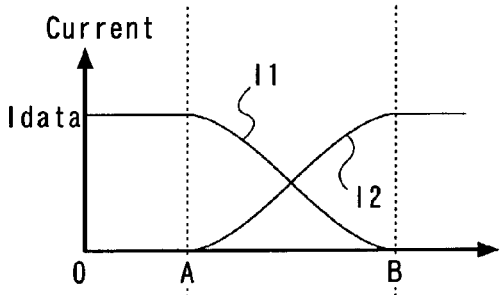
Figure 19E:
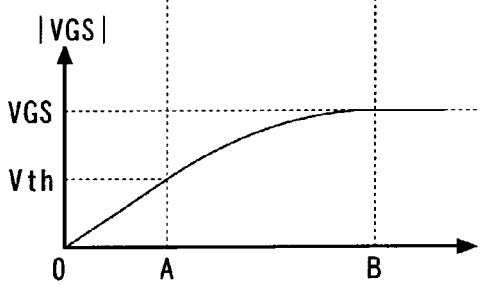

FIGS. 19(A) to 19(C) schematically show paths of a current flowing among circuit elements. FIG. 19(D) shows the relationship between the current flowing through each path and the time in writing the signal current to the current source circuit. FIG. 19(E) shows the relationship between the voltage accumulated in a capacitor device 16, that is, the gate-source voltage of a transistor 15, and the time in writing the signal current to the current source circuit. In the circuit diagrams of FIGS. 19(A) to 19(C), numeral 11 denotes a reference constant current source (hereinafter referred to as constant current source), switches 12 to 14 each are a device having a switching function, numeral 15 denotes a transistor, numeral 16 denotes a capacitor device, and numeral 17 denotes a pixel. Further, the circuit including the switch 14, the transistor 15, and the capacitor device 16 corresponds to a current source circuit 20.

A source region of the transistor 15 is connected to Vss, and a drain region thereof is connected to the constant current source 11. One of electrodes of the capacitor device 16 is connected to Vss (the source of the transistor 15), and the other electrode is connected to the switch 14 (the gate of the transistor 15). The capacitor device 16 plays a role of holding the gate-source voltage of the transistor 15.

The pixel 17 is formed of a light emitting element, a transistor, or the like. The light emitting element includes an anode, a cathode, and a light emitting layer sandwiched between the anode and the cathode. The light emitting layer can be formed of a known light emitting material. Further, the light emitting layer has two structures: a single layer structure and a laminate structure, and any one of the structures may be used. Luminescence in the light emitting layer includes light emission (fluorescence) in returning from a singlet excited state to a normal state and light emission (phosphorescence) in returning from a triplet excited state to a normal state. Either one or both of the two types of light emission may be used. Further, the light emitting layer is formed of a known material such as an organic material or an inorganic material.

In practice, the current source circuit 20 is provided in the signal line driver circuit. A current corresponding to the signal current flows via, for example, a circuit element included in the signal line or the pixel, from the current source circuit 20 provided in the signal line driver circuit. However, since FIG. 19 is a diagram for briefly explaining the outline of the relationship among the constant current source 11, the current source circuit 20, and the pixel 17, a detailed illustration of the structure is omitted.

First, an operation (setting operation) of the current source circuit 20 for retaining the signal current $I_{data}$ will be described by using FIGS. 19(A) and 19(B). Referring to FIG. 19(A), the switches 12 and 14 are turned ON, and the switch 13 is turned OFF. The signal current is supplied from the constant current source 11, and flows to the current source circuit 20 from the constant current source 11. At this time, the current flows separately through current paths 11 and 12 in the current source circuit 20, as shown in FIG. 19(A). FIG. 19(D) shows the relationship. Needless to say, the relationship is expressed as $I_{data}=I_1+I_2$.

The moment the current starts to flow from the constant current source 11, since no charge is held in the capacitor device 16, the transistor 15 is OFF. Accordingly, $I_2=0$ and $I_{data}=I_1$ are established.

Charge is gradually accumulated into the capacitor device 16, and a potential difference begins to occur between both electrodes of the capacitor device 16 (FIG. 19(E)). When the potential difference between both the electrodes has reached $V_{th}$ (point A in FIG. 19(E)), the transistor 15 is turned ON, and $I_2>0$ is established. As described above, since $I_{data}=I_1+I_2$, while $I_1$ gradually decreases, the current keeps flowing. Charge accumulation is continuously performed in the capacitor device 16.

The potential difference between both the electrodes of the capacitor device 16 serves as the gate-source voltage of the transistor 15. Thus, charge accumulation in the capacitor device 16 continues until the gate-source voltage of the transistor 15 reaches a desired voltage, that is, a gate-source voltage that allows the transistor 15 to be flown with the current $I_{data}$. When charge accumulation terminates (B point in FIG. 19(E)), the current 12 stops flowing. Further, since the TFT 15 is fully ON, $I_{data}=I_2$ is established (FIG. 19(B)).

Next, an operation (input operation) for inputting the signal current $I_{data}$ to the pixel will be described by using FIG. 19(C). In FIG. 19(C), the switch 13 is turned ON, and the switches 12 and 14 are turned OFF. Since a predetermined charge is held in the capacitor device 16, the transistor 15 is ON. A current corresponding to the signal current flows to Vss via the switch 13 and transistor 15, and a predetermined signal current is supplied to the pixel. At this time, when the transistor 15 is set to operate in a saturation region, even if the source-drain voltage of the transistor 15 varies, a constant current is supplied to the light emitting element.

In the current source circuit 20 shown in FIG. 19, as shown in FIGS. 19(A) to 19(C), the operation is divided into an operation (setting operation; corresponding to FIGS. 19(A) and 19(B)) for completing a write of the signal current $I_{data}$ to the current source circuit 20, and an operation (input operation; corresponding to FIG. 19(C)) for inputting the signal current $I_{data}$ to the pixel). Then, in the pixel, a current is supplied to the light emitting element in accordance with the input signal current $I_{data}$.

The current source circuit 20 of FIG. 19 is not capable of performing the setting operation and the input operation simultaneously. In the case where the setting operation and the input operation need to be performed simultaneously, at least two current source circuits are preferably provided to each of a plurality of signal lines each of which is connected with a plurality of pixels and which are provided in a pixel portion. However, if the setting operation can be performed within a period during which the signal current $I_{data}$ is not input to the pixel, only one current source circuit may be provided for each signal line (each column).

Figure 19F:
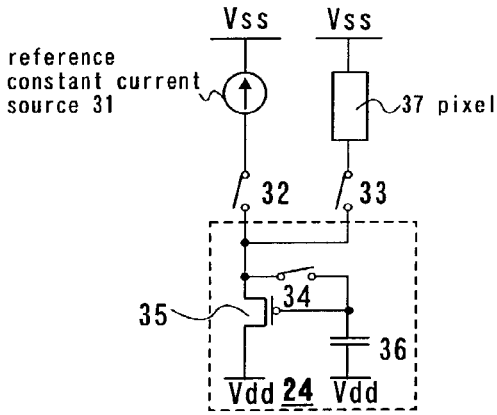

Although the transistor 15 shown in each of FIGS. 19(A) to 19(C) is of n-channel type, the transistor 15 may be of p-channel type, of course. A circuit diagram for the case where the transistor 15 is of p-channel type is shown in FIG. 19(F). Referring to FIG. 19(F), numeral 31 denotes a reference constant current source, switches 32 to 34 each are a device having a switching function, numeral 35 denotes a transistor, numeral 36 denotes a capacitor device, and numeral 37 denotes a pixel. The circuit including the switch 34, the transistor 35, and the capacitor device 36 corresponds to a current source circuit 24.

The transistor 35 is of p-channel type. One of a source region and a drain region of the transistor 35 is connected to Vdd, and the other is connected to the constant current source 31. One of electrodes of the capacitor device 36 is connected to Vdd, and the other electrode is connected to the switch 36. The capacitor device 36 plays a role of holding the gate-source voltage of the transistor 35.

Operation of the current source circuit 24 of FIG. 19(F) is similar to the operation of the current source circuit 20 described above, except for the current-flow direction, and thus, a description thereof will be omitted here. In the case of designing the current source circuit in which the polarity of the transistor 15 is changed without changing the current-flow direction, the circuit diagram of FIG. 23 may be referenced.

Figure 41:
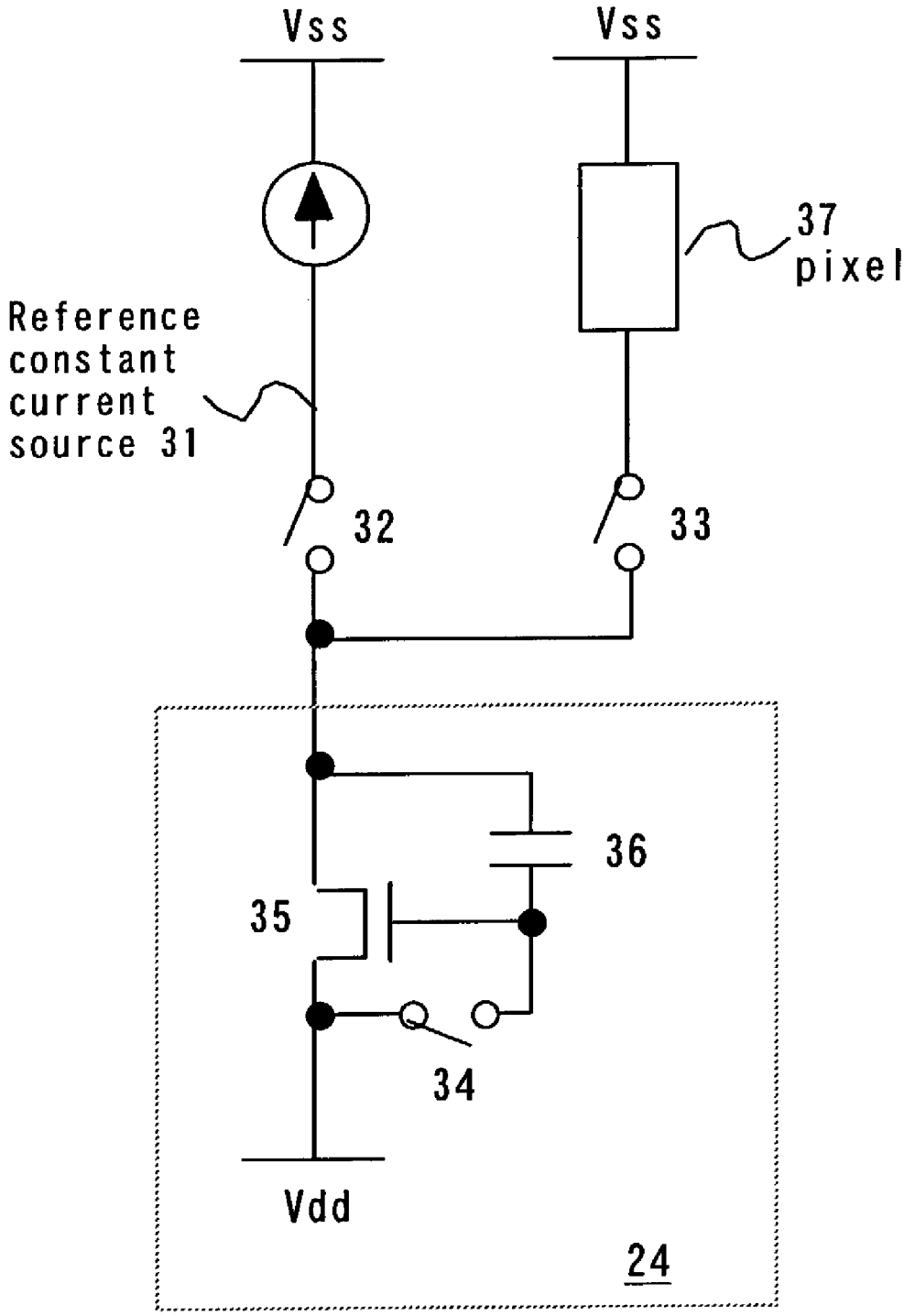
FIG. 41 is circuit diagrams of a current source circuit.

Note that in FIG. 41, the current-flow direction is the same as in FIG. 19(F), in which the transistor 35 is of n-channel type. The capacitor device 36 is connected between the gate and the source of the transistor 35. The source potential of the transistor 35 varies between the setting operation and the input operation. However, even when the source potential of the transistor 35 varies, since the gate-source voltage is retained, the operation is normally implemented.

Figure 20A:
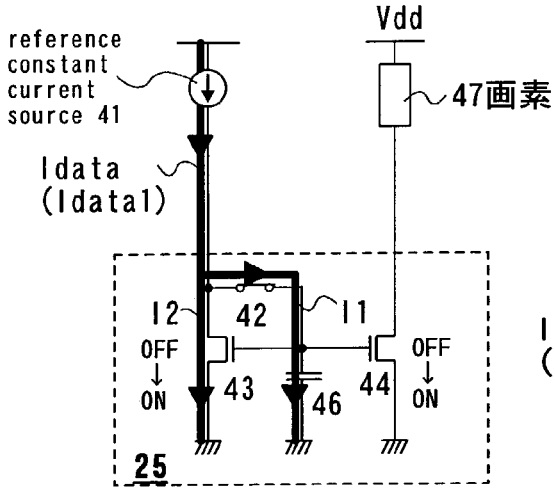
FIG. 20 is explanatory views of operations of a current source circuit.
Figure 20B:
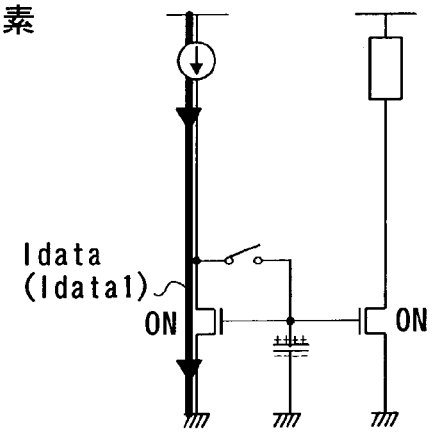
Figure 20C:
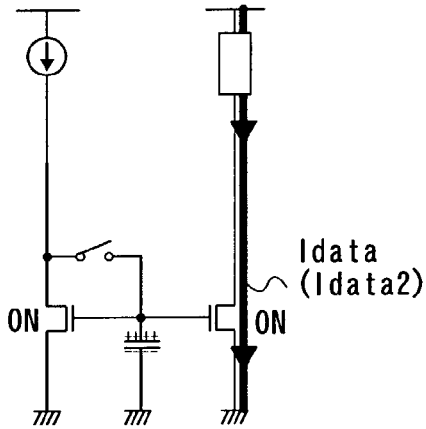
Figure 20D:
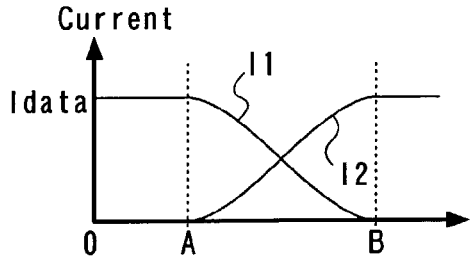
Figure 20E:
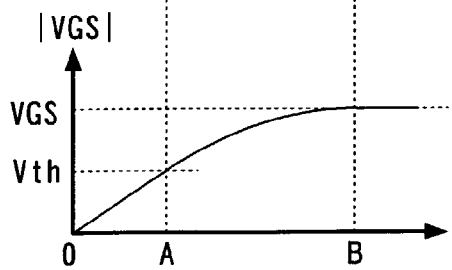

Next, operations of the current source circuits shown in FIGS. 23(C) to 23(E) and FIGS. 24(B) to 24(D) will be described by using FIGS. 20 and 21. FIGS. 20(A) to 20(C) schematically show paths through which a current flows among circuit elements. FIG. 20(D) shows the relationship between the current flowing through each path and the time in writing the signal current to the current source circuit. FIG. 20(E) shows the relationship between the voltage accumulated in a capacitor device 46, that is, the gate-source voltages of transistors 43 and 44, and the time in writing the signal current to the current source circuit. Further, in the circuit diagrams of FIGS. 20(A) to 20(C), numeral 41 denotes a reference constant current source (hereinafter referred to as constant current source 41), a switch 42 is an element having a switching function, numerals 43 and 44 denote transistors, numeral 46 denotes a capacitor device, and numeral 47 denotes a pixel. The circuit including the switch 42, the transistors 43 and 44, and the capacitor device 46 corresponds to a current source circuit 25.

A source region of the n-channel transistor 43 is connected to Vss, and a drain region thereof is connected to the constant current source 41. A source region of the n-channel transistor 44 is connected to Vss, and a drain region thereof is connected to a terminal 48 of the pixel 47. One of electrodes of the capacitor device 46 is connected to Vss (the sources of the transistors 43 and 44), and the other electrode is connected to the gate electrodes of the transistors 43 and 44. The capacitor device 46 plays a role of holding gate-source voltages of the transistor 43 and the transistor 44.

Note that, in practice, the current source circuit 25 is provided in the signal line driver circuit. A current corresponding to the signal current flows via, for example, a circuit element included in the signal line or the pixel, to the light emitting element from the current source circuit 25 provided in the signal line driver circuit. However, since FIG. 20 is a diagram for briefly explaining the outline of the relationship among the constant current source 41, the current source circuit 25, and the pixel 47, a detailed illustration of the structure is omitted.

In the current source circuit 25 of FIG. 20, the sizes of the transistor 43 and the transistor 44 are important. Hereinafter, using different reference symbols, a case where the sizes of the transistors 43 and 44 are identical and a case where the sizes are mutually different will be described. Referring to FIGS. 20(A) to 20(C), the case where the sizes of the transistors 43 and 44 are mutually identical will be described by using the signal current $I_{data}$. The case where the sizes of the transistors 43 and 44 are mutually different will be described by using a signal current $I_{data1}$ and a signal current $I_{data2}$. Note that the sizes of the transistors 43 and 44 are determined using the value of W (gate width)/L (gate length) of each transistor.

First, the case where the sizes of the transistors 43 and 44 are mutually identical will be described. To begin with, operation for retaining the signal current $I_{data}$ in the current source circuit 20 will be described by using FIGS. 20(A) and 20(B). Referring to FIG. 20(A), when the switch 42 is turned ON, the signal current $I_{data}$ is set in the reference constant current source 41, and flows from the constant current source 41 to the current source circuit 25. At this time, since the signal current $I_{data}$ is flowing from the reference constant current source 41, the current flows separately through current paths $I_1$ and $I_2$ in the current source circuit 25, as shown in FIG. 20(A). FIG. 20(D) shows the relationship at this time. Needless to say, the relationship is expressed as $I_{data}=I_1+I_2$.

The moment the current starts to flow from the constant current source 41, since no charge is yet accumulated in the capacitor device 46, the transistors 43 and 44 are OFF. Accordingly, $I_2=0$ and $I_{data}=I_1$ are established.

Then, charge is gradually accumulated into the capacitor device 46, and a potential difference begins to occur between both electrodes of the capacitor device 46 (FIG. 20(E)). When the potential difference of both the electrodes has reached $V_{th}$ (point A in FIG. 20)), the transistors 43 and 44 are turned ON, and $I_2>0$ is established. As described above, since $I_{data}=I_1+I_2$, while $I_1$ gradually decreases, the current keeps flowing. Charge accumulation is continuously performed in the capacitor device 46.

The potential difference between both the electrodes of the capacitor device 46 serves as the gate-source voltage of each of the transistors 43 and 44. Thus, charge accumulation in the capacitor device 46 continues until the gate-source voltages of the transistors 43 and 44 each reach a desired voltage, that is, a gate-source voltage that allows the transistor 44 to be flown with the current $I_{data}$. When charge accumulation terminates (B point in FIG. 20(E)), the current $I_2$ stops flowing. Further, since the transistors 43 and 44 are fully ON, $I_{data}=I_2$ is established (FIG. 20(B)).

Next, an operation for inputting the signal current $I_{data}$ to the pixel will be described by using FIG. 20(C). First, the switch 42 is turned OFF. Since predetermined charge is retained in the capacitor device 46, the transistors 43 and 44 are ON. A current identical with the signal current $I_{data}$ flows from the pixel 47. Thus, the signal current $I_{data}$ is input to the pixel. At this time, when the transistor 44 is set to operate in a saturation region, even if the source-drain voltage of the transistor 44 varies, the current flowing in the pixel can be flown without variation.

In the case of a current mirror circuit shown in FIG. 20, even when the switch 42 is not turned OFF, a current can be flown to the pixel 47 by using the current supplied from the constant current source 41. That is, the setting operation for setting a signal for the current source circuit 25 can be implemented simultaneously with the operation (input operation) for inputting a signal to the pixel.

Next, a case where the sizes of the transistors 43 and 44 are mutually different will be described. An operation of the current source circuit 25 is similar to the above-described operation; therefore, a description thereof will be omitted here. When the sizes of the transistors 43 and 44 are mutually different, the signal current $I_{data1}$ set in the reference constant current source 41 is inevitably different from the signal current $I_{data2}$ that flows to the pixel 47. The difference therebetween depends on the difference between the values of W (gate width)/L (gate length) of the transistors 43 and 44.

In general, the W/L value of the transistor 43 is preferably set larger than the W/L value of the transistor 44. This is because the signal current $I_{data1}$ can be increased when the W/L value of the transistor 43 is set large. In this case, when the current source circuit is set with the signal current $I_{data1}$, loads (cross capacitances, wiring resistances) can be charged. Thus, the setting operation can be completed quickly.

The transistors 43 and 44 of the current source circuit 25 in each of FIGS. 20(A) to 20(C) are of n-channel type, but the transistors 43 and 44 of the current source circuit 25 may be of p-channel type. Here, FIG. 21 shows a circuit diagram in which the transistors 43 and 44 are of p-channel type.

Figure 21:
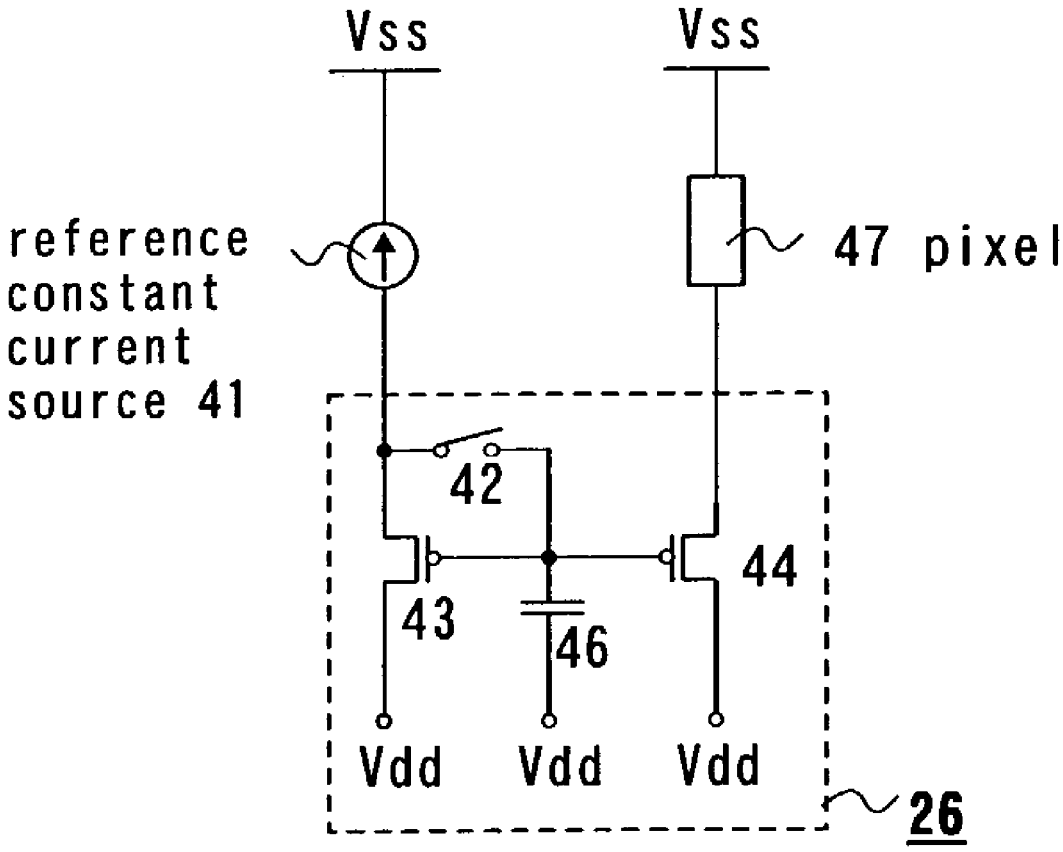
FIG. 21 is an explanatory view of operations of a current source circuit.

Referring to FIG. 21, numeral 41 denotes a constant current source, a switch 42 is a semiconductor element having a switching function, numerals 43 and 44 denote transistors (p-channel type), numeral 46 denotes a capacitor device, and numeral 47 denotes a pixel. In this embodiment mode, the switch 42, the transistors 43 and 44, and the capacitor device 46 form an electric circuit corresponding to a current source circuit 26.

A source region of the p-channel transistor 43 is connected to Vdd, and a drain region thereof is connected to the constant current source 41. A source region of the p-channel transistor 44 is connected to Vdd, and a drain region thereof is connected to a terminal 48 of the pixel 47. One of electrodes of the capacitor device 46 is connected to Vdd (source), and the other electrode is connected to the gate electrodes of the transistors 43 and 44. The capacitor device 46 plays a role of holding gate-source voltages of the transistors 43 and 44.

Operation of the current source circuit 24 of FIG. 21 is similar to that shown in each of FIGS. 20(A) to 20(C) except for the current-flow direction, and thus, a description thereof will be omitted here. In the case of designing the current source circuit in which the polarities of the transistors 43 and 44 are changed without changing the current-flow direction, the circuit diagram of FIG. 23 may be referenced.

In addition, the transistor polarity can be changed without changing the current-flow direction. This conforms to the operation illustrated in FIG. 36, so that a description thereof will be omitted here.

In summary, in the current source circuit of FIG. 19, the current having the same magnitude as that of the signal current $I_{data}$ set in the current source flows to the pixel. In other words, the signal current $I_{data}$ set in the constant current source is identical in value with the current flowing to the pixel. The current is not influenced by variation in characteristics of the transistors provided in the current source circuit.

Figure 6A:
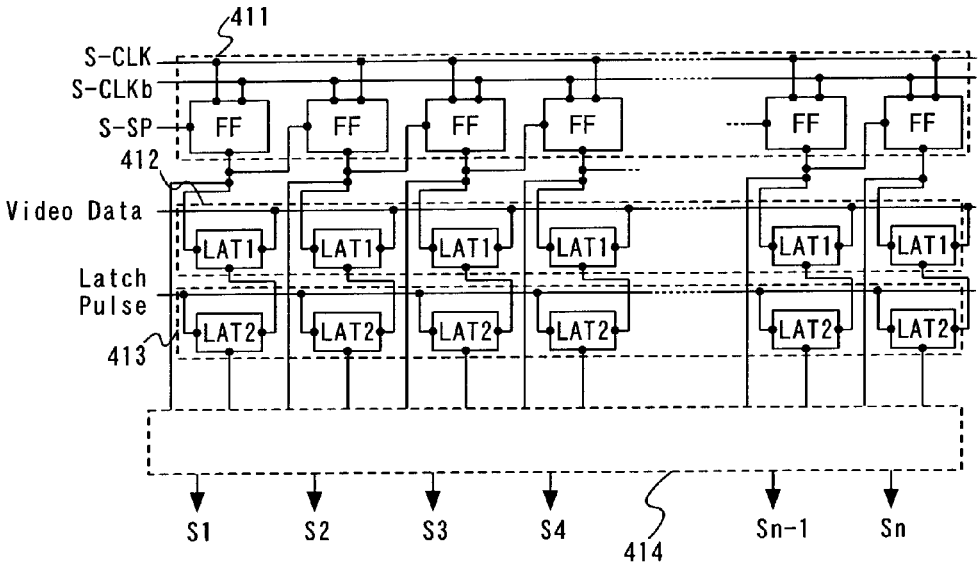
FIG. 6 is a view of a signal line driver circuit (1-bit).
Figure 6B:
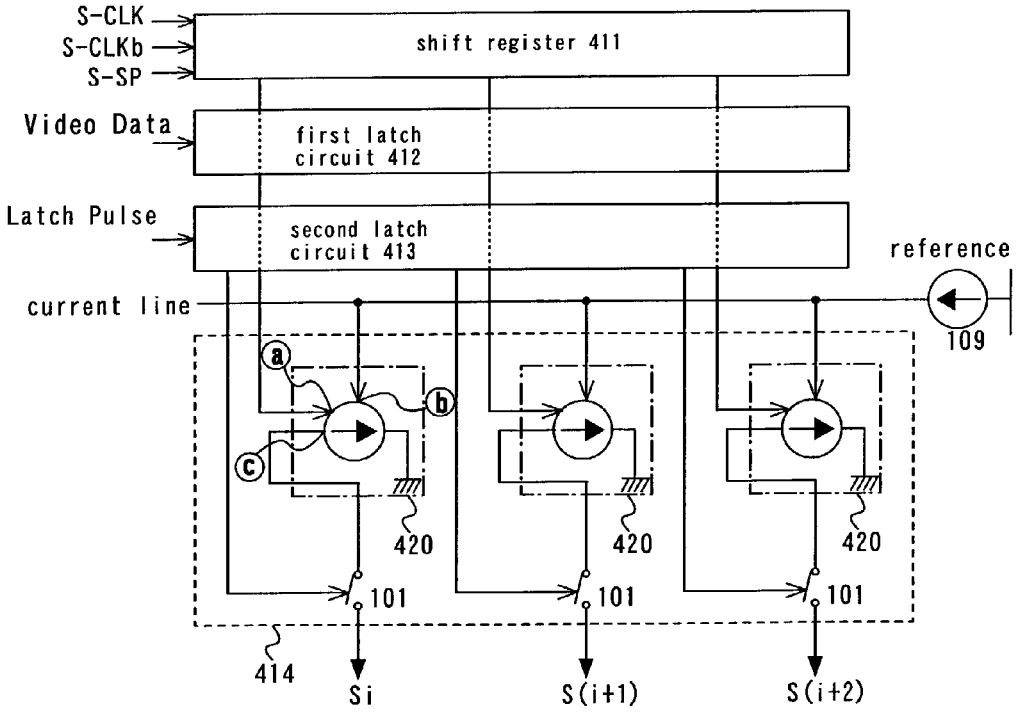

In each of the current source circuits of FIG. 19 and FIG. 6(B), the signal current $I_{data}$ cannot be output to the pixel from the current source circuit in a period during which the setting operation is performed. Thus, two current source circuits are preferably provided for each signal line, in which an operation (setting operation) for setting a signal is performed to one of the current source circuits, and an operation (input operation) for inputting $I_{data}$ to the pixel is performed using the other current source circuit.

Incidentally, in the case where the setting operation and the input operation are not performed at the same time, only one current source circuit may be provided for each column. The current source circuit of each of FIGS. 37(A) and 38(A) is similar to the current source circuit of FIG. 19, except for the connection and current-flow paths. The current source circuit of FIG. 40(A) is similar to the current source circuit of FIG. 19, except for the difference in magnitude between the current supplied from the constant current source and the current flowing from the current source circuit. The current source circuits of FIGS. 23(B) and 38(B) are similar to the current source circuit of FIG. 19, except for the difference in magnitude between the current supplied from the constant current source and the current flowing from the current source circuit. Specifically, in the structure of FIG. 40(A), only the gate width W of the transistor is different between the setting operation and the input operation; in the structure of each of FIGS. 23(B) and 38(B), only the gate length L is different between the setting operation and the input operation; and others are similar to those of the structure of the current source circuit in FIG. 19.

On the other hand, in each of the current source circuits of FIGS. 20 and 21, the signal current $I_{data}$ set in the constant current source and the value of the current flowing to the pixel are dependent on the sizes of the two transistors provided in the current source circuit. In other words, the signal current $I_{data}$ set in the constant current source and the current flowing to the pixel can be arbitrarily changed by arbitrarily designing the sizes (W (gate width)/L (gate length)) of the two transistors provided in the current source circuit. However, output of precise signal current $I_{data}$ to the pixel is difficult in the case where variation is caused in the characteristics of the two transistors, such as threshold values and mobilities.

Further, in each of the current source circuits of FIGS. 20 and 21, the signal can be input to the pixel in the period during which the setting operation is performed. That is, the operation (setting operation) for setting the signal can be performed simultaneously with the operation (input operation) for inputting the signal to the pixel. Thus, unlike the current source circuit of FIG. 19, two current source circuits do not need to be provided in a single signal line.

The present invention with the above structure can suppress the influence of variation in the TFT characteristics and supply a desired current to the outside.

Embodiment Mode 2

The above has described that, for the current source circuit shown in FIG. 19 (or, FIG. 40(A), 23(B), 38(B), or the like), preferably, two current source circuits are provided for each signal line (each column), in which one of the current source circuits is used to perform the setting operation, and the other current source circuit is used to perform the setting operation. This is because the setting operation and the input operation cannot be performed simultaneously. In this embodiment mode, the structure and operation of either the first current source circuit 421 or the second current source circuit 422 shown in FIG. 2 will be described with reference to FIG. 25.

Note that the signal line driver circuit includes the current source circuit 420, the shift register, the latch circuits, and the like.

In the present invention, a setting signal input from a terminal a corresponds to a sampling pulse from a shift register. That is, the setting signal in FIG. 2 corresponds to the sampling pulse supplied from the shift register. The present invention performs setting of the current source circuit 420 in accordance with the timing of the sampling pulse from the shift register.

However, the sampling pulse is not input in certain structure of a current source circuit or driving method. The signal supplied from an output terminal of a logical operator that is connected to a setting control lime (not shown in FIG. 2). One of two input terminals of the logical operator is input with the signal supplied from the sampling pulse and the other is input with the signal from setting control line.

The current source circuit 420 is controlled by a setting signal input via the terminal a; is supplied with a current (reference current) from the terminal b; and outputs a current proportional to the current (reference current) from the terminal c.

Figure 25A:
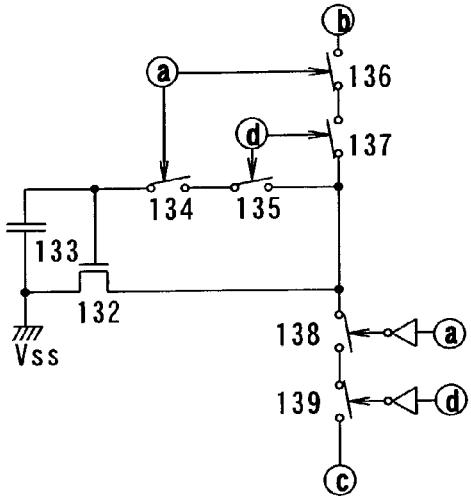
FIG. 25 is circuit diagrams of a current source circuit.

Referring to FIG. 25(A), a circuit including switches 134 to 139, a transistor 132 (n-channel type), and a capacitor device 133 for retaining a gate-source voltage VGS of the transistor 132 corresponds to the first current source circuit 421 or the second current source circuit 422.

In the first current source circuit 421 or the second current source circuit 422, the switch 134 and the switch 136 are turned ON by the signal input via the terminal a. Further, the switch 135 and the switch 137 are turned ON by the signal input from the control line via the terminal d. Then, a current (reference current) is supplied via the terminal b from the reference constant current source 109 connected to the current line, and a predetermined charge is retained in the capacitor device 133. The charge is retained in the capacitor device 133 until the current (reference current) that flows from the constant current source 109 becomes identical with a drain current of the transistor 132.

Subsequently, the switches 134 to 137 are turned OFF by the signals input through the terminals a and d. As a result, since the predetermined charge is retained in the capacitor device 133, the transistor 132 has a capability of flowing a current having a magnitude corresponding to that of the signal current $I_{data}$. If the switch 101 (signal current control switch), the switch 138, and the switch 139 are turned to the conductive state, current flows to a pixel connected to the signal line via a terminal c. At this time, since the gate voltage of the transistor 132 is maintained at a predetermined gate voltage by the capacitor device 133, a drain current corresponding to the signal current $I_{data}$ flows to the drain region of the transistor 132. Thus, the magnitude of the current flown through the pixel can be controlled without being influenced by the variation in characteristics of the transistors constituting the signal line driver circuit.

In the case where the switch 101 (signal current control switch) is not arranged, when the switches 138 and 139 are turned to the conductive state, current flows to the pixel connected to the signal line via the terminal c.

Figure 25B:
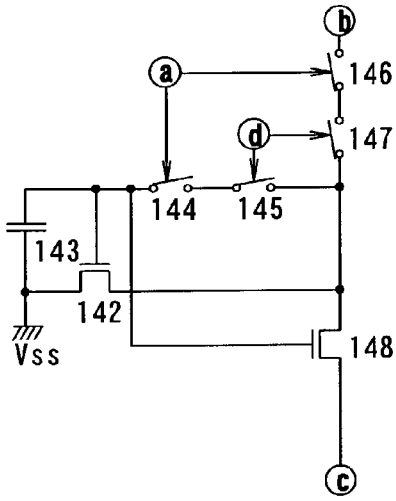

Referring to FIG. 25(B), a circuit including switches 144 to 147, a transistor 142 (n-channel type), a capacitor device 143 for retaining a gate-source voltage VGS of the transistor 142, and a transistor 148 (n-channel type) corresponds to the first current source circuit 421 or the second current source circuit 422.

In the first current source circuit 421 or the second current source circuit 422, the switch 144 and the switch 146 are turned ON by the signal input via the terminal a. Further, the switch 145 and the switch 147 are turned ON by the signal input from the control line via the terminal d. Then, a current (reference current) is supplied via the terminal b from the constant current source 109 connected to the current line, and charge is retained in the capacitor device 143. The charge is retained in the capacitor device 143 until the current (reference current) that is flown from the constant current source 109 becomes identical with a drain current of the transistor 142. When the switch 144 and the switch 145 are turned ON, since a gate-source voltage VGS of the transistor 148 is set to 0 V, the transistor 148 is automatically turned OFF.

Subsequently, the switches 144 to 147 are turned OFF by the signals input via the terminals a and d. As a result, since the predetermined charge is retained in the capacitor device 143, the transistor 142 has a capability of flowing a current having a magnitude corresponding to that of the signal current $I_{data}$. If the switch 101 (signal current control switch) is turned to the conductive state, current is supplied to a pixel connected to the signal line via the terminal c. At this time, the gate voltage of the transistor 142 is previously set to a predetermined gate voltage by the capacitor device 143, and a drain current corresponding to the signal current $I_{data}$ flows to the drain region of the transistor 142. Thus, the magnitude of the current flown through the pixel can be controlled without being influenced by the variation in characteristics of the transistors constituting the signal line driver circuit.

When the switches 144 and 145 are turned OFF, a gate and a source of the transistor 142 do not have the same potential. As a result, since the charge retained in the capacitor device 143 is distributed also to the transistor 148, and the transistor 148 is automatically turned ON. Here, the transistors 142 and 148 are coupled in series, and the gates thereof are connected to each other. Therefore, the transistors 142 and 148 each operate as a multi-gate transistor. That is, a gate length L of the transistor differs between the setting operation and the input operation. Thus, the value of current supplied from the terminal b in the setting operation can be made larger than the value of current supplied from the terminal c in the input operation. Thus, various loads (such as wiring resistance and cross capacitance) disposed between the terminal b and the reference constant current source can be charged even faster. Consequently, the setting operation can be completed quickly. In the case where the switch 101 (signal current control switch) is not arranged, when the switches 144 and 145 are turned OFF, current flows to the pixel connected to the signal line via the terminal c.

Note that FIG. 25(A) corresponds to a structure in which the terminal d is added to the structure of FIG. 23(A). FIG. 25(B) corresponds to a structure in which the terminal d is added to the structure of FIG. 23(B). Thus, the structures of FIGS. 23(A) and 23(B) are added with switches arranged in series, thereby being modified to those of FIGS. 25(A) and 25(B) each of which is added with the terminal d. The structure of the current source circuit shown in FIG. 23, 24, 38, 37, or 40 can be arbitrarily used by arranging two switches in series in the first current source circuit 421 or the second current source circuit 422.

Figure 2:
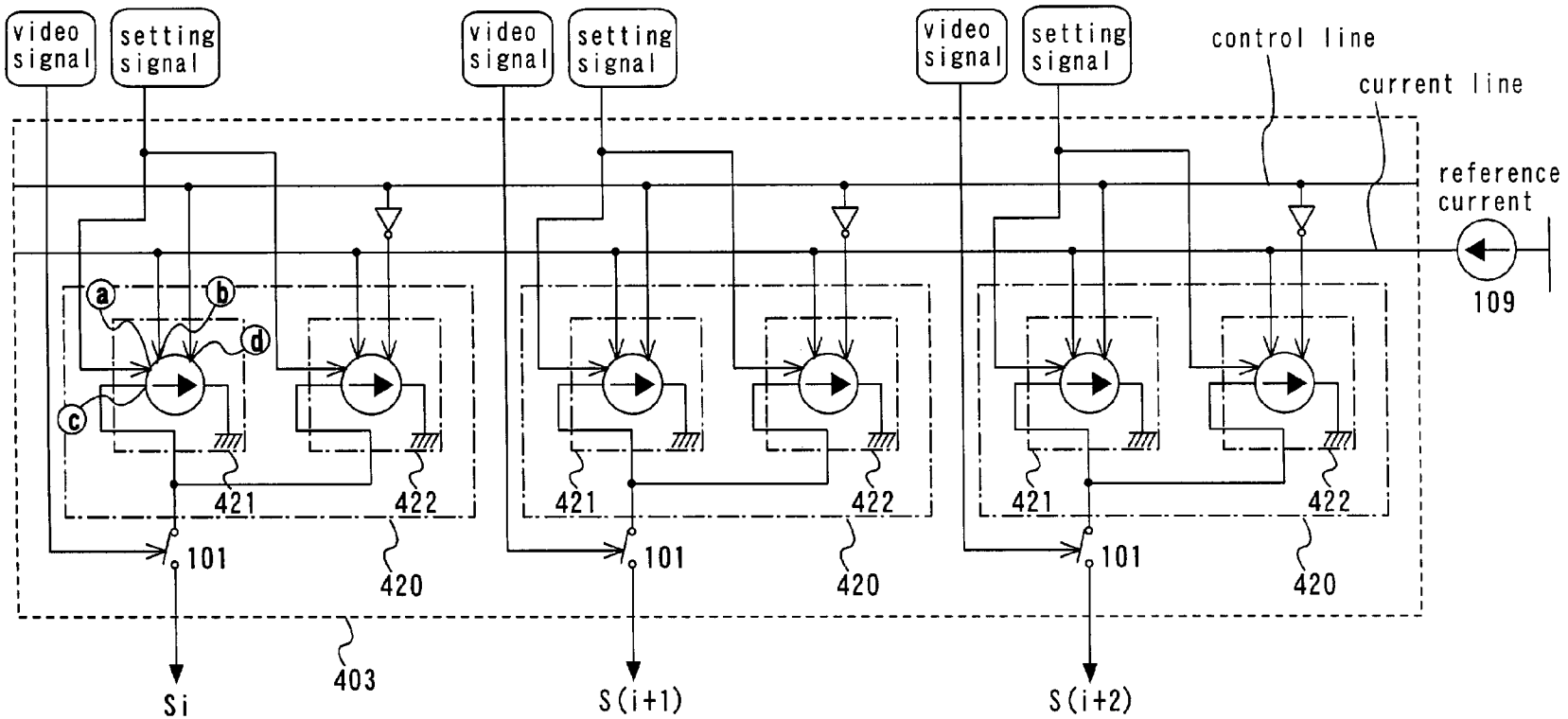
FIG. 2 is a view of a signal line driver circuit.

The structure in which the current source circuit 420 including for each signal line the two current source circuits, namely, the first and second current source circuits 421 and 422, is shown in FIG. 2. However, the present invention is not limited to this. The number of current source circuits per one signal line is not particularly limited, and can be set arbitrarily. A plurality of current source circuits may be set such that constant current sources are provided corresponding thereto, and that signal currents are set to the current source circuits by the constant current sources. For example, three current source circuits 420 may be provided for each signal line. Then, a signal current may be set by different reference constant current sources 109 for the respective current source circuits 420. For example, it may be such that a 1-bit reference constant current source is used to set a signal current for one of the current source circuits 420, a 2-bit reference constant current source is used to set a signal current for one of the current source circuits 420, and a 3-bit reference constant current source is used to set a signal current for one of the current source circuits 420. Thus, 3-bit display can be performed.

The present invention with the above structure can suppress the influence of variation in TFT characteristics and supply a desired current to the outside.

This embodiment mode may be arbitrarily combined with Embodiment Mode 1.

Embodiment Mode 3

In this embodiment mode, the structure of a light emitting device including the signal line driver circuit of the present invention will be described using FIG. 15.

Figure 15A:
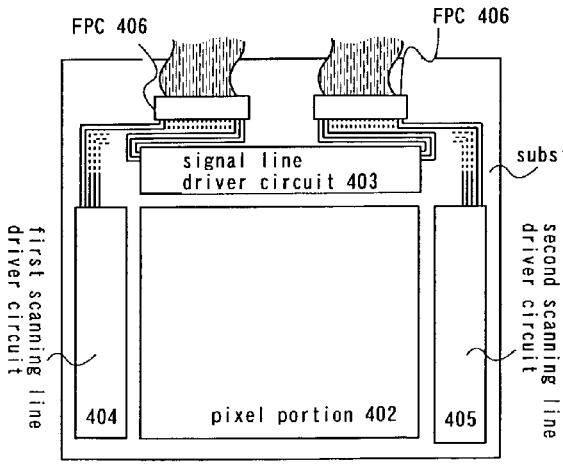
FIG. 15 is views of a light emitting device.

Referring to FIG. 15(A), the light emitting device includes a pixel portion 402 including a plurality of pixels arranged in matrix on a substrate 401, and includes a signal line driver circuit 403 and first and second scanning line driver circuits 404 and 405 in the periphery of the pixel portion 402. While the signal line driver circuit 403 and the two scanning line driver circuits 404 and 405 are provided in FIG. 15(A), the present invention is not limited to this. The number of driver circuits may be arbitrarily designed depending on the pixel structure. Signals are supplied from the outside to the signal line driver circuit 403 and the first and second scanning line driver circuits 404 and 405 via FPCs 406.

Figure 15B:
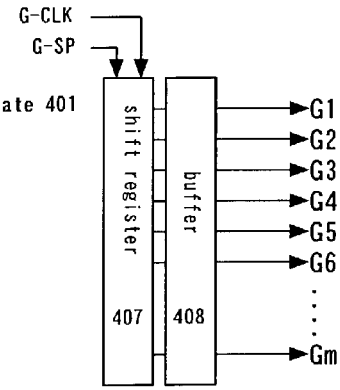

The structures and operations of the first and second scanning line driver circuits 404 and 405 will be described using FIG. 15(B). The first and second scanning line driver circuits 404 and 405 each include a shift register 407 and a buffer 408. The shift register 407 sequentially outputs sampling pulses in accordance with a clock signal (G-CLK), a start pulse (S-SP), and an inverted clock signal (G-CLKb). Thereafter, the sampling pulses amplified in the buffer 408 are input to scanning lines, and the scanning lines are set to be in a selected state for each line. Signals are sequentially written to pixels controlled by the selected signal lines.

Note that the structure may be such that a level shifter circuit is arranged between the shift register 407 and the buffer 408. Disposition of the level shifter circuit enables the voltage amplitude to be increased.

This embodiment mode may be arbitrarily combined with Embodiment Modes 1 and 2.

Embodiment Mode 4

In this embodiment mode, the detailed structure and operation of the signal line driver circuit 403 shown in FIG. 15(A) will be described. In this embodiment mode, the signal line driver circuit 403 used in the case of performing 1-bit digital gradation display will be described.

First, the case corresponding to FIG. 1 will be described. In addition, a case of line-sequential drive will be described here.

FIG. 6(A) is a schematic view of the signal line driver circuit 403 used in the case of performing 1-bit digital gradation display. The signal line driver circuit 403 includes a shift register 411, a first latch circuit 412, a second latch circuit 413, and a constant current circuit 414.

Operations will be briefly described. The shift register 411 is constituted by, for example, a plurality of flip-flop circuits (FFs). In accordance with the timing of a clock signal (S-CLK), a start pulse (S-SP), and an inverted clock signal (S-CLKb), sampling pulses are sequentially output.

The sampling pulses, which have been output from the shift register 411, are input to the first latch circuit 412. Digital video signals have been input to the first latch circuit 412, and a video signal is retained in each column in accordance with the input timing of the sampling pulse.

In the first latch circuit 412, upon completion of video-signal retaining operations in columns to the last column, during a horizontal return period, a latch pulse is input to the second latch circuit 413, and video signals retained in the first latch circuit 412 are transferred in batch to the second latch circuit 413. As a result, one-line video signals retained in the second latch circuit 413 are input to the constant current circuit 414 at the same time.

While the video signals retained in the second latch circuit 413 are being supplied to the constant current circuit 414, sampling pulses are again output in the shift register 411. Thereafter, the operation is iterated, and one-frame video signals are processed. There may be a case where the constant current circuit 414 plays a role of converting a digital signal into an analog signal.

In the present invention, the sampling pulses that are output from the shift register 411 are input to the constant current circuit 414.

In the constant current circuit 414, a plurality of current source circuits 420 are provided. FIG. 6(B) outlines the signal line driver circuit relating to three signal lines in i-th to (i+2)-th columns.

The current source circuit 420 is controlled by a signal input through a terminal a. In addition, the current source circuit 420 is supplied with a current via a terminal b from a reference constant current source 109 connected to a current line. A switch 101 (signal current control switch) is provided between the current source circuit 420 and a pixel connected to a signal line Sn, and the switch 101 (signal current control switch) is controlled by the video signal. In the case where the video signal is a bright signal, a current is supplied from the current source circuit 420 to the pixel. On the contrary, in the case where the video signal is a dark signal, the switch 101 (signal current control switch) is controlled not to supply a current to the pixel. That is, the current source circuit 420 has a capability of flowing a predetermined current, and whether the current is supplied to the pixel or not is controlled by the switch 101 (signal current control switch).

In the present invention, the signal input to the current source circuit 420 through the terminal a corresponds to the sampling pulse supplied from the shift register Depending on the structure or drive system of the current source circuit, the sampling pulse is not directly input, and instead, a signal supplied from an output terminal of a logical operator connected to a setting control line (not shown in FIG. 6) is input.

One of two input terminals of the logical operator is input with the sampling pulse, and the other input terminal is input with the signal supplied from the setting control line. Thus, the setting of the current source circuit 420 is performed in accordance with the timing of the sampling pulse or the signal supplied from the output terminal of the logical operator connected to the setting control line.

Note that the signal line driver circuit having the setting control line and the logical operator is shown in FIG. 42. In the structure shown in FIG. 42, a switch or the like may be arranged instead of the logical operator.

Further, as to the structure of the current source circuit 420, the structure of the current source circuit 420 shown in FIG. 23, FIG. 24, FIG. 38, FIG. 37, FIG. 40, or the like can be arbitrarily taken.

Figure 43:
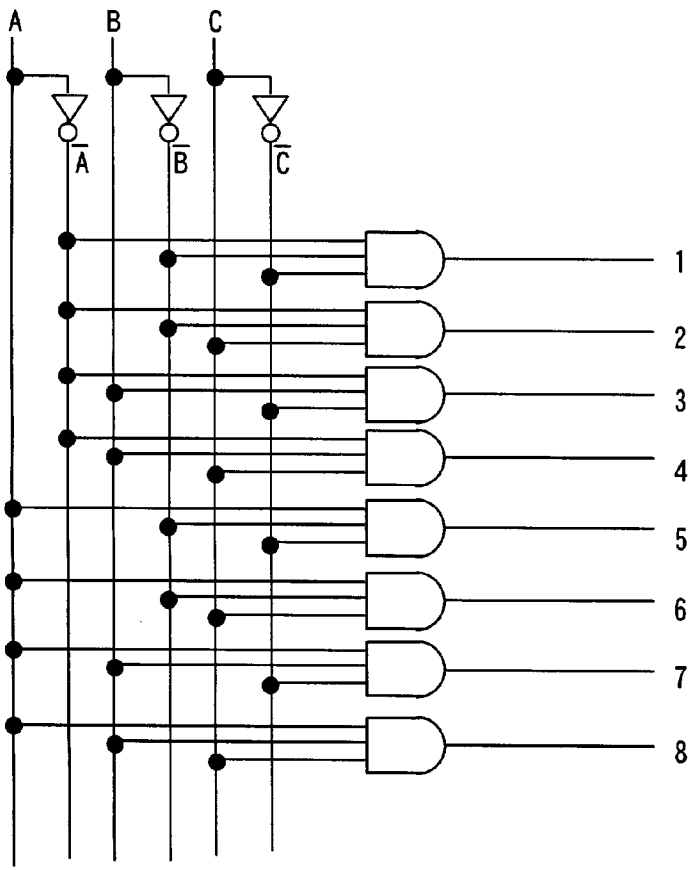
FIG. 43 is view of a shift register.

Moreover, one or a plurality of structures may be adopted for the current source circuit 420. Note that, in the case where the structures shown in FIGS. 23(A) and 24(A) are used for the current source circuit 420, a setting operation cannot be conducted while an input operation is conducted. Therefore, the setting operation needs to be performed while the input operation is not performed. Incidentally, there is a case where periods during which the input operation is not performed are dotted about one frame. Thus, in such a case, it is not preferable that columns are sequentially selected but preferable that an arbitrary column can be selected. Therefore, it is desirable that a decoder circuit or the like capable of conducting random selection is used as a shift register. In FIG. 43, the decoder circuit is shown as an example. When the decoder circuit shown in FIG. 43 is used, the setting operation of the current source circuit is not performed from the first column to the last column in order, and can be performed randomly. Then, the length of the time for conducting the setting operation can be freely set long.

Figure 44A:
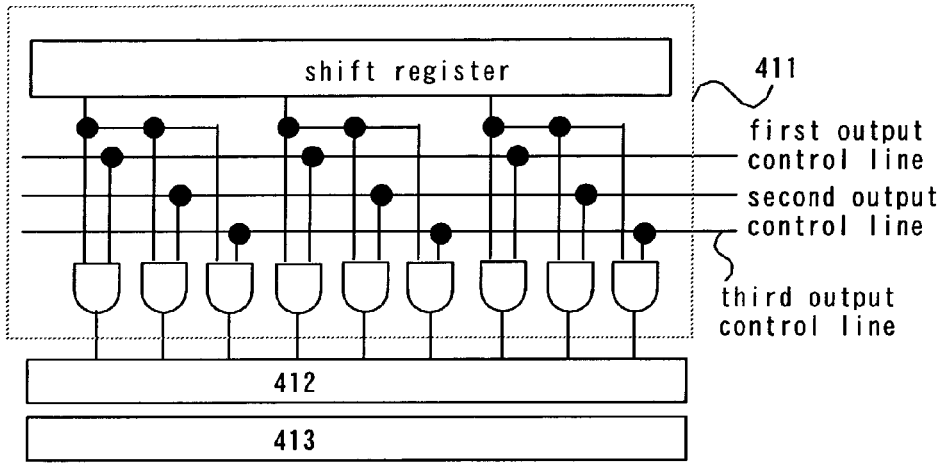
FIG. 44 is views of a shift register and a timing chart.
Figure 44B:
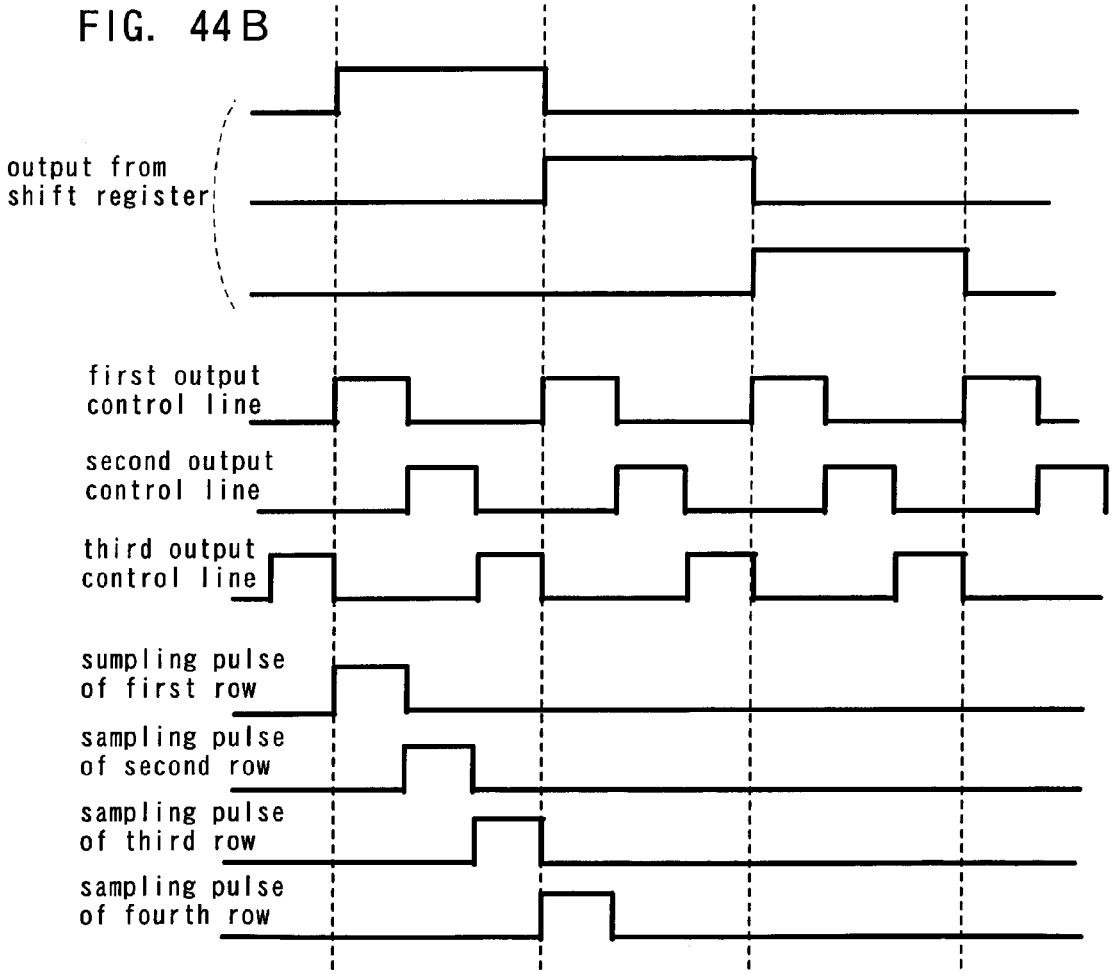

Aside from the above decoder circuit, the circuit shown in FIG. 44(A) may be used. In FIG. 44(A), pulses output from a shift register and signals supplied from output control lines (first to third output control lines) are input to logical operators. As shown in FIG. 44(B), the pulses of the respective output control lines are controlled, whereby sampling pulses can be output from the first column to the last column in order. That is, a waveform similar to that in the prior art can be output.

Figure 45A:
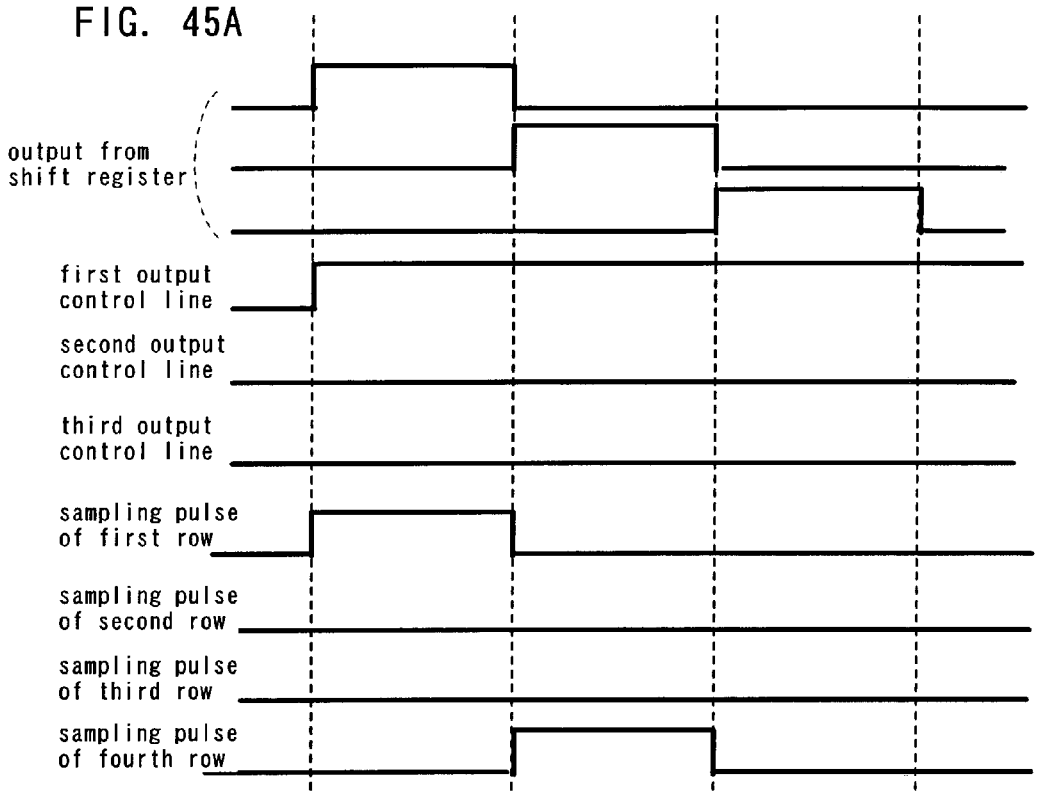
FIG. 45 is a timing chart.
Figure 45B:
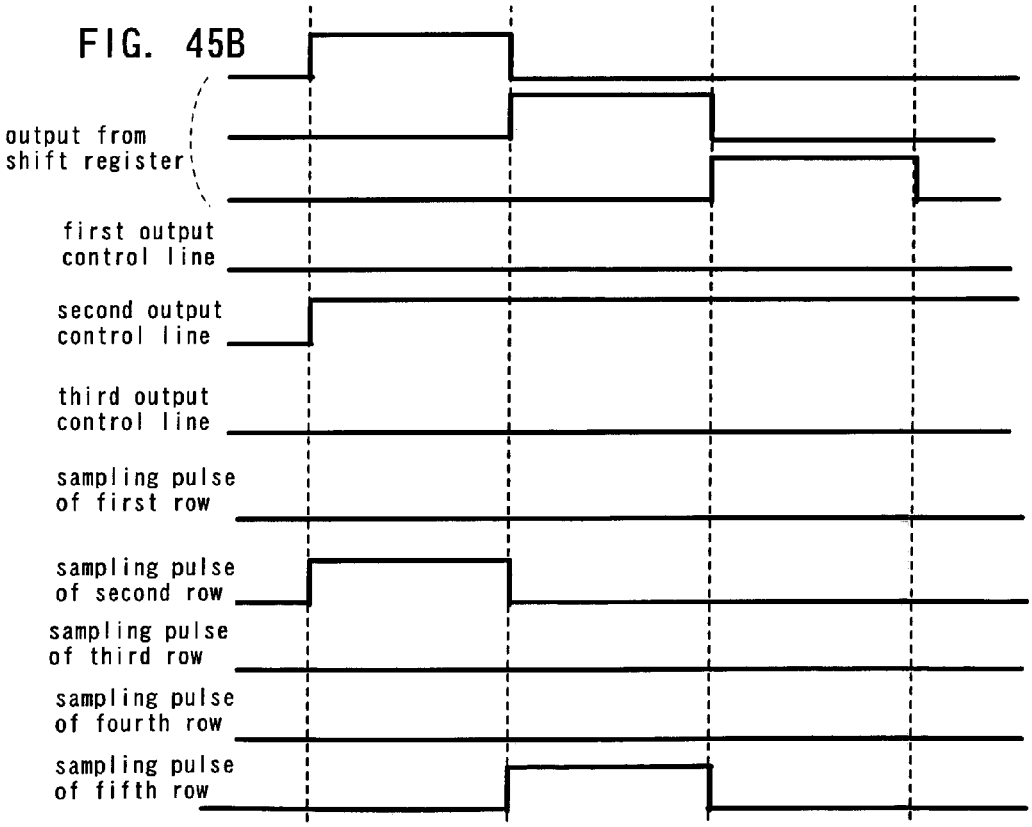

Further, when an operation different from that in the prior art needs to be performed, as shown in FIG. 45(A), the second and third output control lines are turned in a non-selected state in the state in which the first output control line is in a selected state. Then, a first-column sampling pulse is output for a period longer than that in the prior art. Therefore, after the first-column sampling pulse is output, a fourth-column sampling pulse is output. Similarly, as shown in FIG. 45(B), in the state in which the second output control line is in a selected state, the first and third output control lines are turned in a non-selected state. Then, a second-column sampling pulse is output for a period longer than that in the prior art. Thus, after the second-column sampling pulse is output, a fifth-column sampling pulse is output. In the above structure, random selection is not completely performed from the first column to the last column, but only a certain specific column can be selected for a period longer than that in a general case. Therefore, the setting operation of the current source circuit can be performed more freely.

Figure 46:
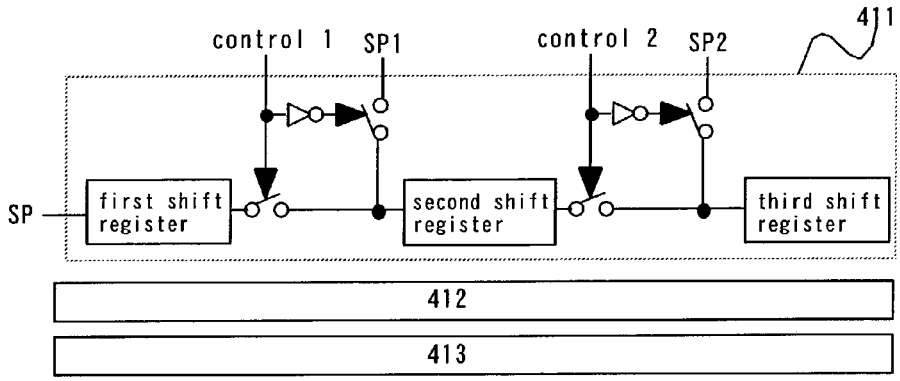
FIG. 46 is view of a shift register.

Further, the circuit shown in FIG. 46 may be used. In FIG. 46, the operation is controlled through a control 1 and a control 2. When the control 1 and the control 2 are turned in a selected state, a switch arranged between a first shift register and a second shift register is in a conductive state, and a switch arranged between the second shift register and a third shift register is in a conductive state. In other words, there is obtained a state in which the first shift register, the second shift register, and the third shift register are connected with one another. In such a state, when a start pulse signal is input to SP, the pulse from the first shift register shifts to the second shift register, and the pulse from the second shift register shifts to a third shift register. That is, a waveform similar to that in the prior art can be output. Then, when an operation different from that in the prior art needs to be conducted, the control 1 is turned in a non-selected state. Thus, the switch arranged between the first shift register and the second shift register is in a non-conductive state, and a switch arranged between the second shift register and SP1 is in a conductive state. Then, the start pulse signal is input to not SP but SP1. Thus, a sampling pulse is output from the second shift register. That is, the sampling pulse starts to be output from the midway column among the first to last columns. When another different operation needs to be conducted, the control 2 is turned in a non-selected state. Thus, the switch arranged between the second shift register and the third shift register is in a non-conductive state, and a switch arranged between the third shift register and SP2 is in a conductive state. Then, the start pulse signal is input to SP2. Thus, a sampling pulse starts to be output from the third shift register. As described above, in the structure of FIG. 46, random selection is not completely performed from the first column to the last column, but only columns in a certain specific range can be selected. At this time, a frequency of a clock signal is lowered, whereby selection for a period longer than that in the prior art becomes possible. Therefore, the setting operation of the current source circuit can be conducted more freely.

When the column or current source circuit can be selected randomly or freely on some level to perform the setting operation of the current source circuit as described above, various advantages are exhibited. For example, in the case where periods during which the setting operation can be performed are dotted in one frame, when an arbitrary column can be selected, the degree of freedom is increased, and the setting operation period can be set long. Another advantage is that the influence of charge leakage in the capacitor device (corresponding to, for example, a capacitor device 103 in FIG. 23(A), a capacitor device 123 in FIG. 23(B), or a capacitor device 107 in FIG. 23(B)) arranged in the current source circuit 420 can be made inconspicuous.

The capacitor device is arranged in the current source circuit 420. Incidentally, the capacitor device may be substituted by a gate capacitance of the transistor. A predetermined charge is accumulated in the capacitor device through the setting operation for the current source circuit. Ideally, the setting operation for the current source circuit may be performed only once when the power source is input. Specifically, when the signal line driver circuit is operated, the setting operation may be performed only once during the initial period of the operation. This is because the amount of charge accumulated in the capacitor device does not need to be varied depending on, for example, the operation state and the time, and is not varied. In practice, however, various noises may enter the capacitor device, or a leak current flows from the transistor connected to the capacitor device. As a result, the amount of charge accumulated in the capacitor device may gradually vary as time passes. When the charge amount varies, the current to be output from the current source circuit, that is, the current to be input to the pixel also varies. As a result, the luminance of the pixel varies. To prevent the variation in the charge accumulated in the capacitor device, there arises a need that the setting operation for the current source circuit is periodically performed in a certain cycle, the charge is refreshed, the varied charge is returned to the original state, and the proper amount of charge is restored.

Suppose, in the case where the variation amount of charge accumulated in the capacitor device is large, the setting operation for the current source circuit is performed, the charge is refreshed, the varied charge is returned to the original state, and the proper amount of charge is restored. In association with this, the variation is increased in the amount of the current output from the current source circuit. Thus, when the setting operation is sequentially performed from the first column, a case may occur in which there develops a display disturbance at a degree that the variation in the amount of the current output from the current source circuit is recognizable by the human eye. That is, a case may occur in which there develops a display disturbance at a degree that the variation in the luminance of the pixel, which is caused sequentially from the first column, is recognizable by the human eye. In this case, when the setting operation is not sequentially performed from the first column but performed at random, the variation in the amount of the current output from the current source circuit can be made inconspicuous. As described above, the random selection for the plurality of wirings produces various advantages.

On the other hand, in the case where the structure shown in any of FIGS. 23(C) to (E) is used for the current source circuit 420, the setting operation and the input operation can be performed at the same time. However, also in the case of using the current source circuit capable of simultaneously performing the setting operation and the input operation, fluctuation of the amount of the current output from the current source circuit can be made inconspicuous, and the period for conducting the setting operation can be set long. Thus, random selection is very effective.

Figure 47:
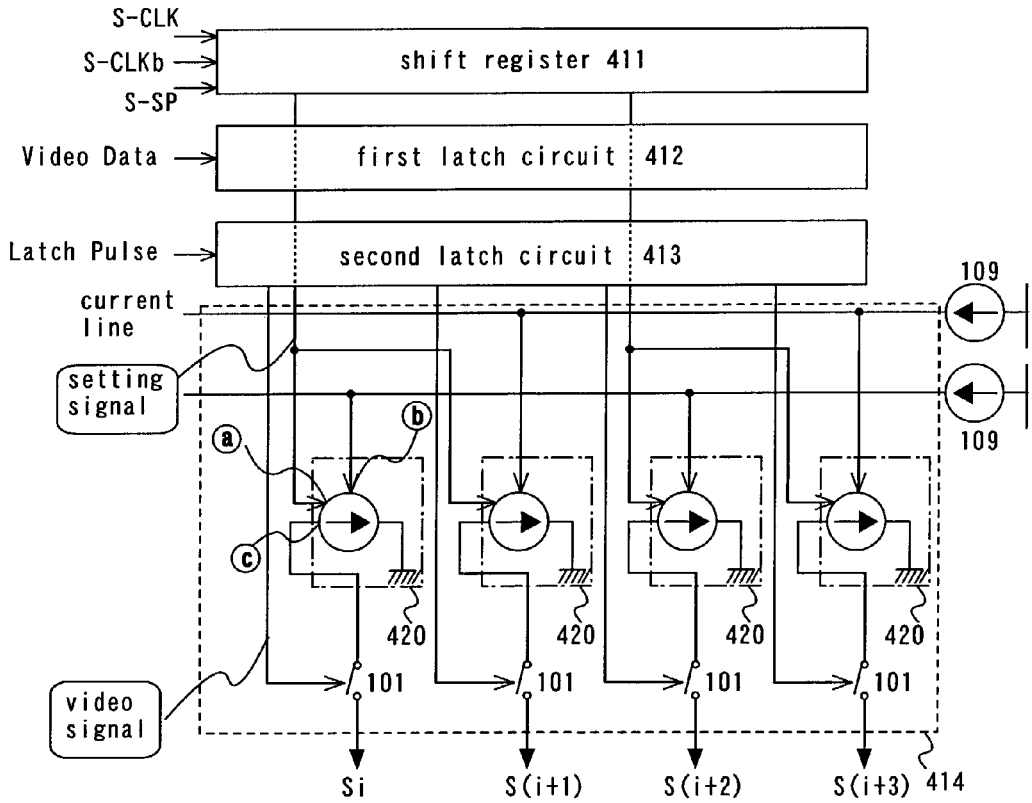
FIG. 47 is a view of a signal line driver circuit.

With reference to FIG. 6(B), although the setting operation is performed for each column, the present invention is not limited to this. As shown in FIG. 47, the setting operation may be simultaneously performed for a plurality of columns. Here, to perform the setting operation for a plurality of columns at a time is referred to as to make multi phases. Referring to FIG. 47, while two reference constant current sources 109 are arranged, the setting operation may be performed for the two reference constant current sources through differently arranged reference constant current sources.

Hereinafter, a description will be made of the detailed structure and operation of the constant current circuit 414 shown in FIG. 6(B).

Figure 3:
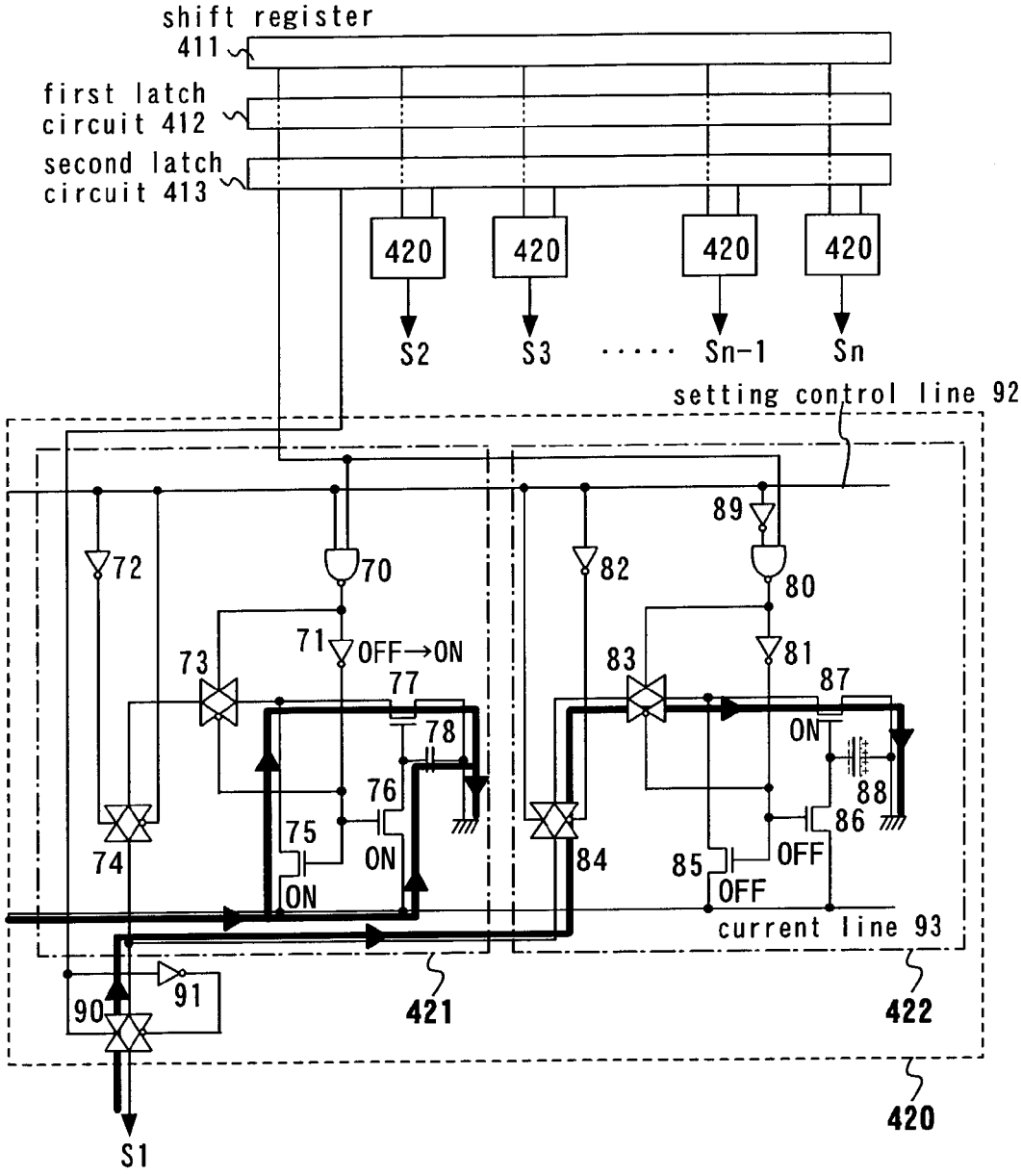
FIG. 3 is views of a signal line driver circuit (1-bit).
Figure 4:
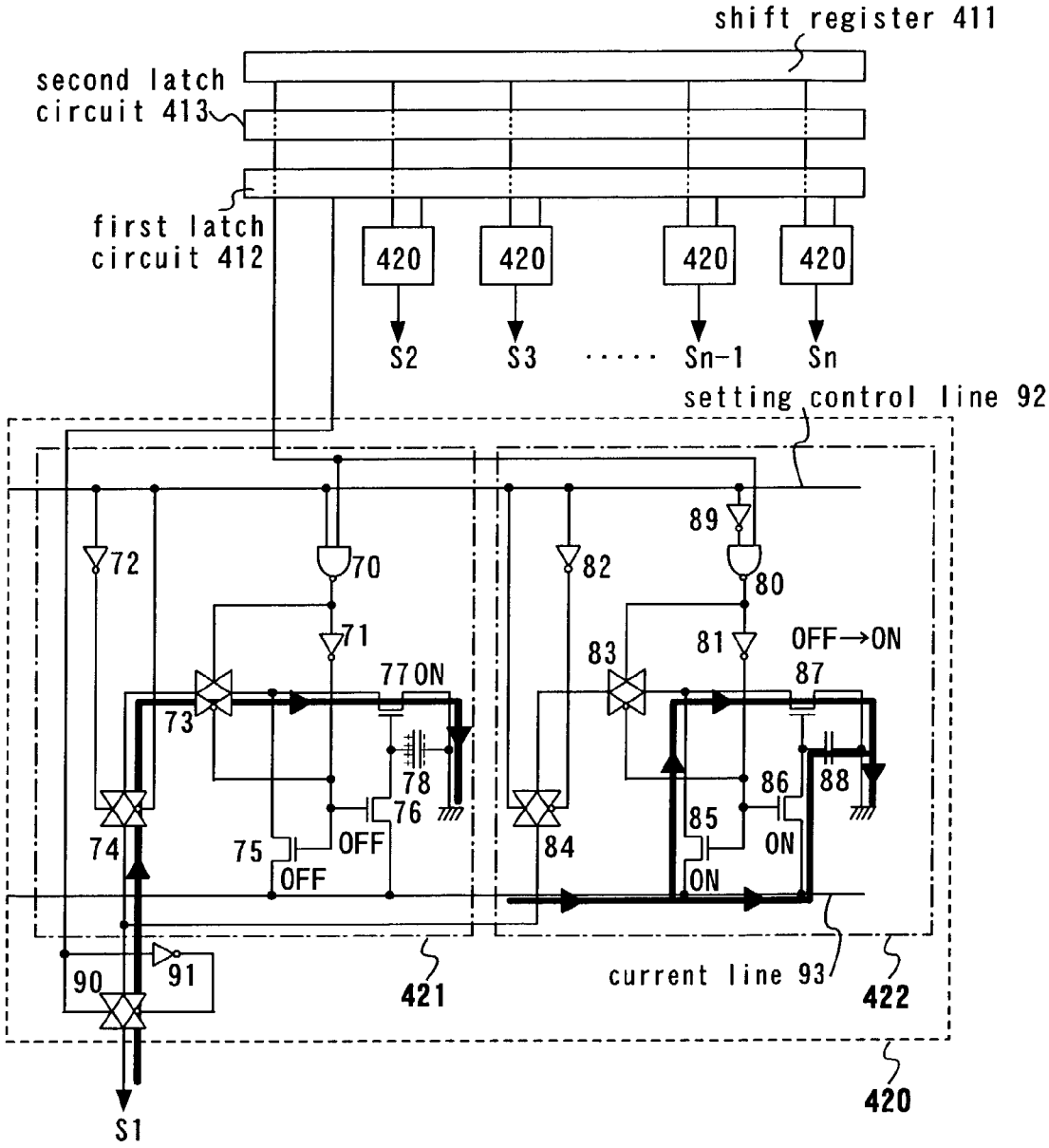
FIG. 4 is a view of a signal line driver circuit (1-bit).
Figure 48:
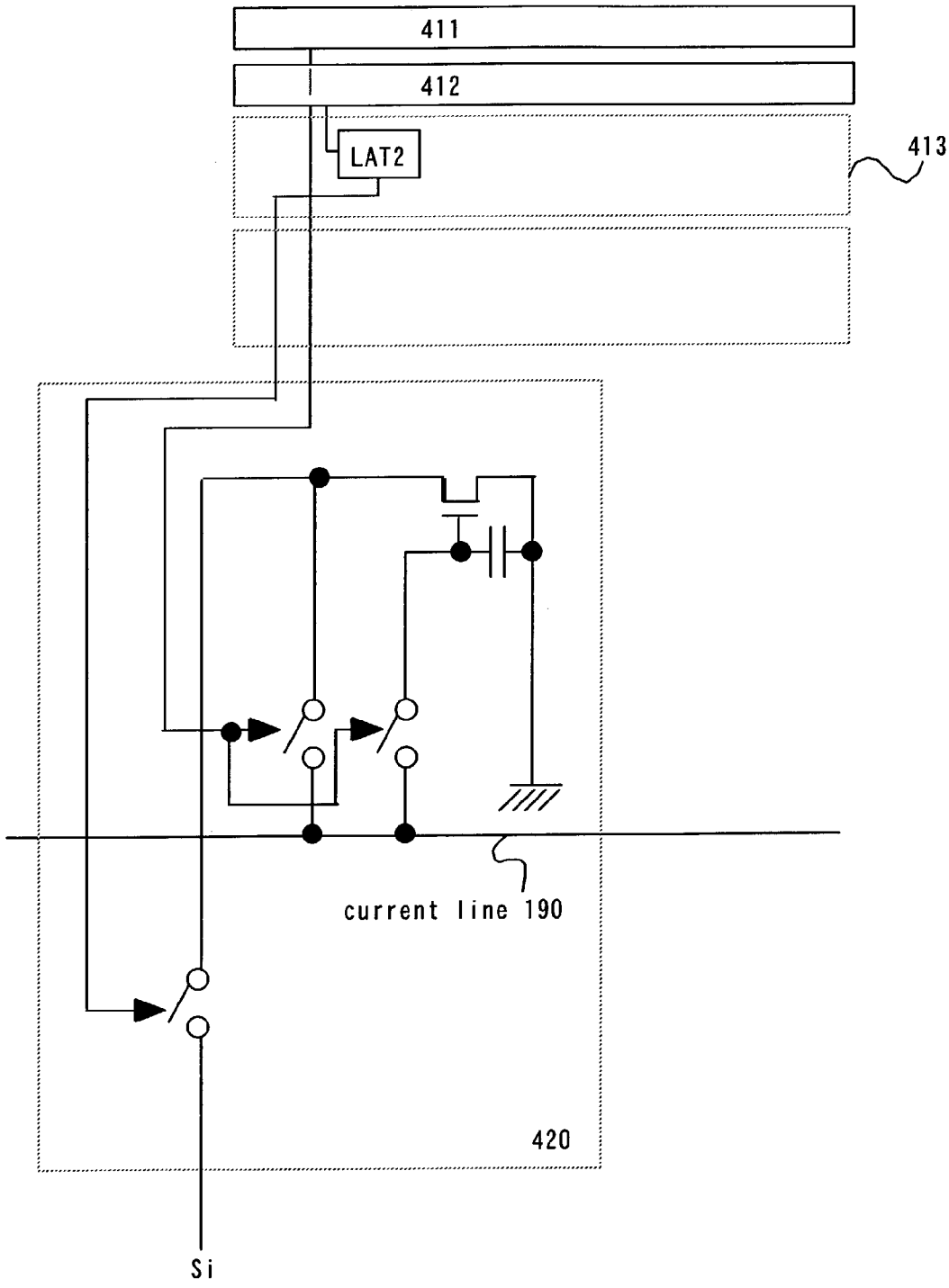
FIG. 48 is a view of a signal line driver circuit.

Here, FIG. 5 shows a circuit in the case where the structure of FIG. 23(C) is applied to the portion of a current source circuit. FIG. 48 shows a circuit in the case where the structure of FIG. 23(A) is applied to the portion of a current source circuit. FIGS. 3 and 4 each show a circuit in which a plurality of (two) current source circuits are arranged in one column as shown in FIG. 2, the circuit being in the case where the structure of FIG. 23(A) is applied to the portion of a current source circuit. First, the structures shown in FIGS. 3 and 4 are explained.

At first, a description will be made of the constant current circuit 414 having a current source circuit with the structure shown in FIG. 6(A). Note that, in the structure shown in FIG. 6(A), the setting operation for making a signal held in the current source circuit and the operation for inputting a signal from the current source circuit to a pixel (input operation) cannot be performed at the same time. Therefore, it is preferable that two current source circuits are provided for each signal line and that the setting operation is conducted in one of the current source circuits while the input operation is conducted in the other current source circuit.

In the current source circuit 420 provided in each column in FIGS. 3 and 4, whether a predetermined signal current is output to a signal line Si (1 i n) or not is controlled in accordance with information of a digital video signal input from the second latch circuit 413.

In FIG. 3, the current source circuit 420 has a first current source circuit 421 and a second current source circuit 422. Then, one of the first current source circuit 421 and the second current source circuit 422 conducts a setting operation, and the other current source circuit conducts an input operation. The first current source circuit 421 and the second current source circuit 422 each have a plurality of circuit elements. The first current source circuit 421 has a NAND 70, an inverter 71, an inverter 72, an analog switch 73, an analog switch 74, transistors 75 to 77, and a capacitor element 78. Then, the second current source circuit 422 has a NAND 80, an inverter 81, an inverter 82, an inverter 89, an analog switch 83, an analog switch 84, transistors 85 to 87, and a capacitor element 88. In this embodiment mode, the transistors 75 to 77 and the transistors 85 to 87 are all of n-channel type.

In the first current source circuit 421, input terminals of the NAND 70 are connected to the shift register 411 and to a control line 92, and an output terminal of the NAND 70 is connected to an input terminal of the inverter 71. An output terminal of the inverter 71 is connected to gate electrodes of the transistor 75 and the transistor 76.

The analog switch has four terminals. By the signals input to two of the four terminals, conductivity or non-conductivity is established between the rest of two terminals.

Conductivity or non-conductivity is selected for the analog switch 73 by the signal input from the output terminal of the NAND 70 and the signal input from the output terminal of the inverter 71. An input terminal of the inverter 72 is connected to the control line 92. Then, conductivity or non-conductivity is selected for the analog switch 74 by the signals input from the control line 92 and the output terminal of the inverter 72.

One of a source region and a drain region of the transistor 75 is connected to a current line 93, and the other region is connected to one of a source region and a drain region of the transistor 77. One of a source region and a drain region of the transistor 76 is connected to the current line 93, and the other region is connected to one of terminals of the capacitor element 78 and a gate electrode of the transistor 77. One of a source region and a drain region of the transistor 77 is connected to Vss, and the other region is connected to the analog switch 73.

A reference constant current source (not shown) is connected to the current line 93.

One of electrodes of the capacitor element 78 is connected to Vss, and the other electrode is connected to the gate electrode of the transistor 77. The capacitor element 78 plays a role of holding a gate-source voltage of the transistor 77.

In the second current source circuit 422, an input terminal of the inverter 89 is connected to the control line 89. Then, an output terminal of the inverter 89 is connected to one of input terminals of the NAND 80. Further, the other input terminal of the NAND 80 is connected to the shift register 411. An output terminal of the NAND 80 is connected to an input terminal of the inverter 81. An output terminal of the inverter 81 is connected to gate electrodes of the transistor 85 and the transistor 86.

Conductivity or non-conductivity is selected for the analog switch 83 by the signal input from the output terminal of the NAND 80 and the signal input from the output terminal of the inverter 81. Further, an input terminal of the inverter 82 is connected to the control line 92. Then, conductivity or non-conductivity is selected for the analog switch 84 by the signals input from the control line 92 and an output terminal of the inverter 82.

One of a source region and a drain region of the transistor 85 is connected to the current line 93, and the other region is connected to one of a source region and a drain region of the transistor 87. One of a source region and a drain region of the transistor 86 is connected to the current line 93, and the other region is connected to one of terminals of the capacitor element 88 and to a gate electrode of the transistor 87. One of the source region and the drain region of the transistor 87 is connected to Vss, and the other region is connected to the analog switch 83.

One of electrodes of the capacitor element 88 is connected to Vss, and the other electrode is connected to the gate electrode of the transistor 87. The capacitor element 88 plays a role of holding a gate-source voltage of the transistor 87.

Here, the operation of the current source circuit in FIG. 3 is described with reference to FIG. 28.

Figure 28:
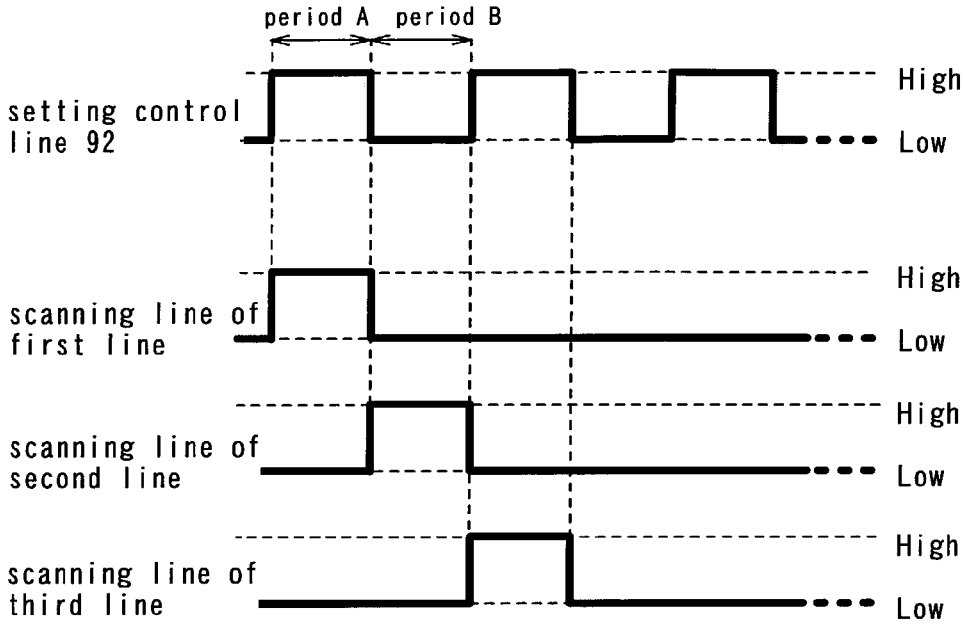
FIG. 28 is an explanatory timing chart of a driving method of a current source circuit.

FIG. 28 is a timing chart of the setting control line 92 and scanning lines of first to third lines. The operation of the current source circuit 420 in a period A is described with reference to FIG. 3, and the operation of the current source circuit 420 in a period B is described with reference to FIG. 4. In the period A, the setting operation is conducted in the first current source circuit 421, and the input operation is conducted in the second current source circuit 422. In the period B, the input operation is conducted in the first current source circuit 421, and the setting operation is conducted in the second current source circuit 422.

First, the operation of the current source circuit 420 in the period A will be explained. At first, the operation of the first current source circuit 421 for conducting the setting operation is explained.

In the period A, the signal input from the setting control line 92 is High. Then, sampling pulses (corresponding to signals of High) are sequentially input from the shift register 411 to respective columns. The NAND 70 conducts logic operation to the signals (both the signals are High) input from the shift register 411 and the setting control line 92 to output Low. The inverter 71 conducts logic operation to the input signal (Low) to output High.

Signals (High) are input to the gate electrodes of the transistors 75 and 76 from the output terminal of the inverter 71, and then, the transistors 75 and 76 are turned ON. Thereafter, the current supplied from the current line 93 flows through the capacitor element 78 via the transistors 75 and 76 to reach Vss. Then, charge starts to be accumulated in the capacitor element 78.

Subsequently, the charge is gradually accumulated in the capacitor element 78, and the potential difference starts to be developed between the electrodes. When the potential difference reaches Vth, the transistor 77 is turned ON from OFF. In the capacitor element 78, the accumulation of the charge is continued until the potential difference between both the electrodes, namely, the gate-source voltage of the transistor 77 reaches a desired voltage. In other words, the accumulation of the charge is continued until the voltage enough for a signal current to flow through the transistor 77 is reached. With the lapse of time, the accumulation of the charge is completed.

At this time, the analog switch 73 and the analog switch 74 are in an OFF state.

Next, a description will be made of the operation of the second current source circuit 422 for conducting the input operation (output of a current to a pixel). Note that, in the second current source circuit 422, the setting operation has already been conducted, and a predetermined charge is held in the capacitor element 88.

In the period A, the signal input from the setting control line 92 is High. The inverter 89 conducts logic operation to the input signal (High) to output Low. The NAND 80 conducts logic operation to the signals input from the inverter 89 and the shift register 411 to output High. The inverter 81 conducts logic operation to the input signal (High) to output Low.

Signals (Low) are input to the gate electrodes of the transistors 85 and 86 from the output terminal of the inverter 81, and then, the transistors 85 and 86 are turned OFF.

On the other hand, the analog switch 83 is turned ON by the signal (High) input from the output terminal of the NAND 80 and the signal (Low) input from the output terminal of the inverter 81. The analog switch 84 is turned ON by the signal (High) input from the setting control line 92 and the signal (Low) input from the output terminal of the inverter 82.

The predetermined charge is held in the capacitor element 88, and the transistor 87 is in an ON state. In this state, a drain current of the transistor 87 is equal to a signal current.

The analog switch 90 is turned ON or OFF by the signal input from the second latch circuit 413 and the signal input from the inverter 90. In the structure shown in FIG. 3, when a signal of High is input from the second latch circuit 413, the analog switch 90 is turned ON, and when a signal of Low is input from the second latch circuit 413, the analog switch 90 is turned OFF.

Here, assume that the signal of High is input from the second latch circuit 413 and that the analog switch 90 is in an ON state. Then, a current flows through the signal line (S1) and the transistor 87 to reach Vss. The current value at this time is equal to the value of a signal current. In other words, a predetermined signal current is supplied to the pixel connected to the signal line (S1).

At this time, if the transistor 87 is made to operate in a saturation region, the current supplied to the pixel does not change even when the source-drain voltage of the transistor 87 is changed.

Next, the operation of the current source circuit 420 in the period B is described with reference to FIG. 4. At first, a description is made of the operation of the first current source circuit 421 for conducting the input operation (output of a current to a pixel). Note that, in the first current source circuit 421, the setting operation has already been conducted, and a predetermined charge is held in the capacitor element 78.

In the period B, the signal input from the setting control line 92 is Low. The NAND 70 conducts logic operation to the signals input from the shift register 411 and the setting control line 92 to output High. The inverter 71 conducts logic operation to the input signal (High) to output Low.

Signals (Low) are input to the gate electrodes of the transistors 75 and 76 from the output terminal of the inverter 71, and then, the transistors 75 and 76 are turned OFF.

On the other hand, the analog switch 73 is turned ON by the signal (High) input from the output terminal of the NAND 70 and the signal (Low) input from the output terminal of the inverter 71. Further, the analog switch 74 is turned ON by the signal (Low) input from the setting control line 92 and the signal (High) input from the output terminal of the inverter 72.

The predetermined charge is held in the capacitor element 78, and the transistor 77 is in an ON state. In this state, a drain current of the transistor 77 is equal to a signal current.

Here, assume that the signal of High is input from the second latch circuit 413 and that the analog switch 90 is in an ON state. Then, a current flows through the signal line (S1) and the transistor 77 to reach Vss. The current value at this time is equal to the value of a signal current. In other words, a predetermined signal current is supplied to the pixel connected to the signal line (S1).

At this time, if the transistor 77 is made to operate in a saturation region, the current supplied to the pixel does not change even when the source-drain voltage of the transistor 77 is changed.

Next, a description will be made of the operation of the second current source circuit 422 for conducting the setting operation in the period B.

In the period B, the signal input from the setting control line 92 is Low. The inverter 89 conducts logic operation to the input signal (Low) to output High. The NAND 80 conducts logic operation to the signals (one of the signals is High) input from the inverter 89 and the shift register 411 to output Low. Then, the inverter 81 conducts logic operation to the input signal (Low) to output High.

Signals (High) are input to the gate electrodes of the transistors 85 and 86 from the output terminal of the inverter 81, and the transistors 85 and 86 are turned ON. Thereafter, the current supplied from the current line 93 flows through the capacitor element 88 via the transistors 85 and 86 to reach Vss. Then, charge starts to be accumulated in the capacitor element 88.

Subsequently, the charge is gradually accumulated in the capacitor element 88, and the potential difference starts to be developed between the electrodes. When the potential difference between both the electrodes reaches Vth, the transistor 87 is turned ON from OFF. In the capacitor element 88, the accumulation of the charge is continued until the potential difference between both the electrodes, namely, the gate-source voltage of the transistor 87 reaches a desired voltage. In other words, the accumulation of the charge is continued until the voltage enough for a signal current to flow through the transistor 87 is reached.

At this time, the analog switches 83 and 84 are in an OFF state.

Note that the setting operation and the input operation are switched every one line in the operation described above with reference to FIG. 28. However, the present invention is not limited to this. The setting operation and the input operation may be switched every several lines.

Note that the transistors of the current source circuit 420 shown in either FIG. 3 or 4 are all of n-channel type here, but the present invention is not limited to this. P-channel transistors can be used in the current source circuit 420 shown in FIG. 3 or 4. Note that the operation of the current source circuit 420 in the case of using p-channel transistors is the same as the above-described operation except the point in that the direction in which a current flows is changed and the point in that the capacitor element is connected to not Vss but Vdd.

Further, the case where Vss is not replaced with Vdd when p-channel transistors are used in the current source circuit 420 shown in FIG. 3 or 4, that is, the case where the direction in which a current flows does not change, can be applied easily with the comparison between FIG. 23 and FIG. 24. Further, the transistor that is operated as a mere switch may have either polarity.

Subsequently, the structure and the operation of the constant current circuit 414, which are different from those in the above, are described with reference to FIG. 5. In the current source circuit 420 provided in each column, whether a predetermined signal current Idata is output to the signal line Si ($1 \leqq i < n$) is controlled in accordance with information of a digital video signal input from the second latch circuit 413.

Note that the structure of FIG. 5 corresponds to a circuit in which one current source circuit is arranged for one column.

Figure 5A:
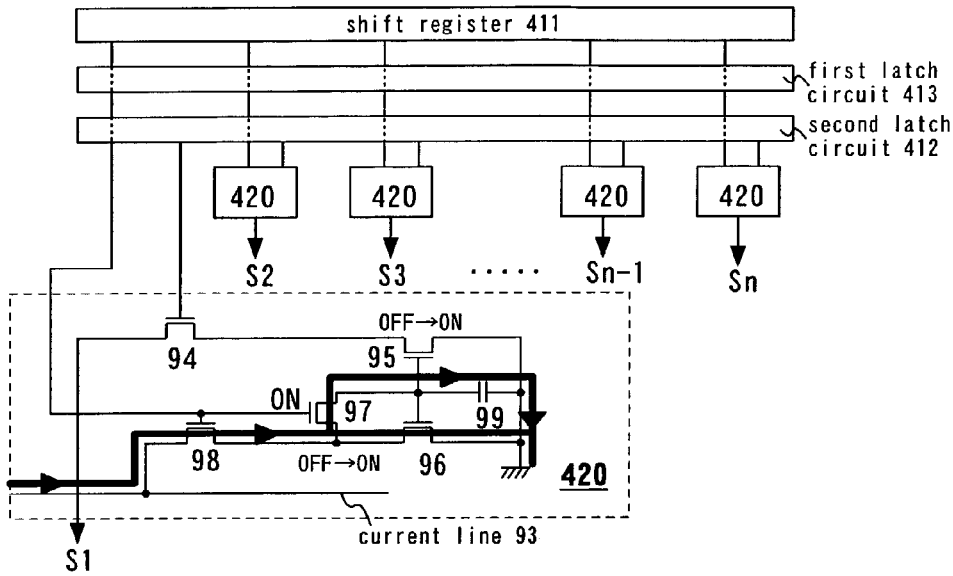
FIG. 5 is a view of a signal line driver circuit (1-bit).
Figure 5B:
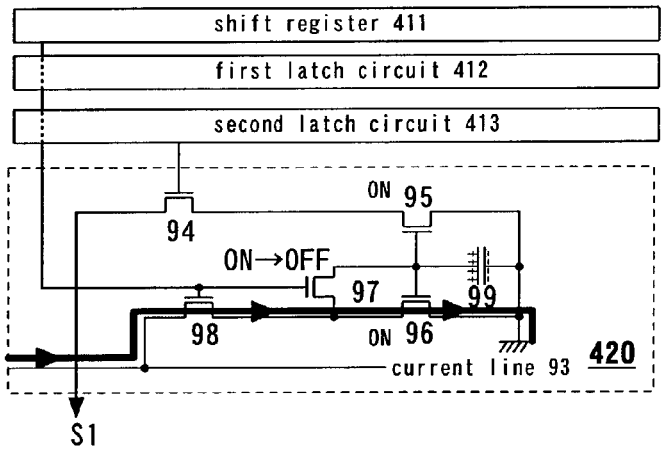
Figure 5C:
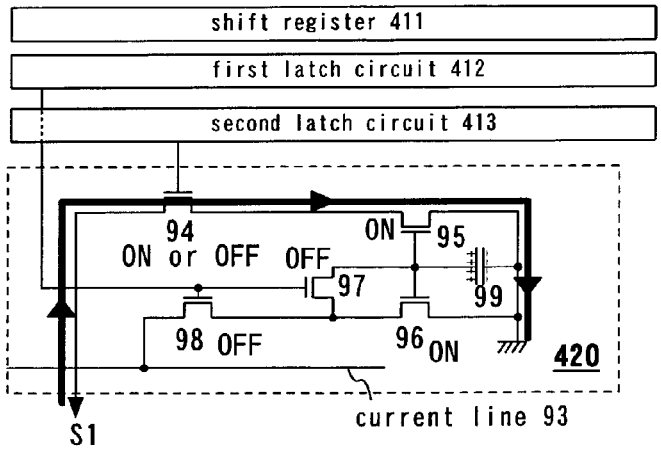

In FIGS. 5(A) to (C), the current source circuit 420 has transistors 94 to 97 and a capacitor element 99. In this embodiment mode, the transistors 94 to 97 are all of n-channel type.

A gate electrode of the transistor 94 is input with the signal from the second latch circuit 413. Further, one of a source region and a drain region of the transistor 94 is connected to the source signal line (S1), and the other region is connected to one of a source region and a drain region of the transistor 95. Sampling pulses are input to gate electrodes of the transistor 97 and the transistor 98 from the shift register 411. One of a source region and a drain region of the transistor 97 is connected to one of a source region and a drain region of the transistor 96, and the other region is connected to one of electrodes of the capacitor element 99. One of a source region and a drain region of the transistor 98 is connected to the current line 93, and the other region is connected to one of the source region and the drain region of the transistor 96.

One of electrodes of the capacitor element 99 is connected to gate electrodes of the transistor 95 and the transistor 96, and the other electrode is connected to Vss. The capacitor element 99 plays a role of holding gate-source voltages of the transistor 95 and the transistor 96.

One of the source region and the drain region of the transistor 95 is connected to Vss, and the other region is connected to one of the source region and the drain region of the transistor 94. One of the source region and the drain region of the transistor 95 is connected to Vss, and the other region is connected to one of the source region and the drain region of the transistor 98.

Here, the operation of the current source circuit 420 shown in FIG. 5 is explained with reference to FIG. 5(A) to FIG. 5(C).

First, the sampling pulses are input to the gate electrodes of the transistors 97 and 98 from the shift register 411, and both the transistors are turned ON. Then, the current supplied from the current line 93 flows to the capacitor element 99 through the transistors 98 and 97. At this time, a signal is not input to the gate electrode of the transistor 94 from the second latch circuit 413, and the transistor 94 is in an OFF state.

Charge is gradually accumulated in the capacitor element 99, and the potential difference starts to be developed between the electrodes. When the potential difference between both the electrodes reaches Vth, the transistors 95 and 96 are turned ON.

In the capacitor element 99, the accumulation of the charge is continued until the potential difference between both the electrodes, namely, the gate-source voltages of the transistors 95 and 96 reach desired voltages. In other words, the accumulation of the charge is continued until the voltage enough for a current corresponding to a signal current to flow through the transistors 95 and 96 is reached (FIG. 5(A)).

With the lapse of time, the accumulation of the charge is completed (FIG. 5(B)).

Subsequently, the transistor 94 is turned ON by the signal (corresponding to a digital video signal) that is input from the second latch circuit 413. At this time, a sampling pulse is not input to the gate electrode of the transistor 94 from the shift register 411, and the transistors 97 and 98 in on OFF state. Then, since a predetermined charge is held in the capacitor element 99, the transistors 95 and 96 are in an ON state. Thus, a current flows through the signal line (S1) via the transistors 94 and 95 in a direction toward Vss. The current value at this time is equal to the value of a signal current. In other words, a predetermined signal current is supplied to the pixel connected to the signal line (S1).

At this time, if the transistor 95 is made to operate in a saturation region, the current supplied to the pixel does not change even when the source-drain voltage of the transistor 95 is changed.

Further, the transistors of the current source circuit 420 shown in FIG. 5 are all of n-channel type in this embodiment mode, but the present invention is not limited to this. P-channel transistors can be used in the current source circuit 420 shown in FIG. 5. Note that the operation of the current source circuit 420 in the case of using p-channel transistors is the same as the above-described operation except the point in that a direction in which a current flows is changed and the point in that the capacitor element is connected to not Vss but Vdd.

Moreover, as shown in FIG. 21, FIG. 23(C) to FIG. 23(E), FIG. 24(B) to FIG. 24(D), and the like, circuit elements of the current source circuit 420 may have different connection structures. The operation of the current source circuit 420 at this time is the same as the operation of the current source circuit 420 explained with reference to FIG. 5, and thus, a description thereof is omitted in this embodiment mode.

Further, the case where Vss is not replaced with Vdd when p-channel transistors are used in the current source circuit 420 shown in FIG. 5, that is, the case where the direction in which a current flows does not change, can be applied easily with the comparison between FIG. 23 and FIG. 24. Note that the transistor that is operated as a mere switch may have either polarity.

Note that the structure in FIG. 5 shows a circuit in which one current source circuit is arranged for one column. In this case, when the structure shown in FIG. 23(A) or 24(A) is used for the current source circuit 420, a setting operation cannot be conducted while an input operation (output of a current to a pixel) is conducted. Therefore, the setting operation needs to be performed while the input operation (output of a current to a pixel) is not performed. On the other hand, when the structure shown in one of FIGS. 23(C) to 23(E) is used for the current source circuit 420, the setting operation and the input operation can be simultaneously performed even in the case where one current source circuit is arranged for one column.

Figure 42A:
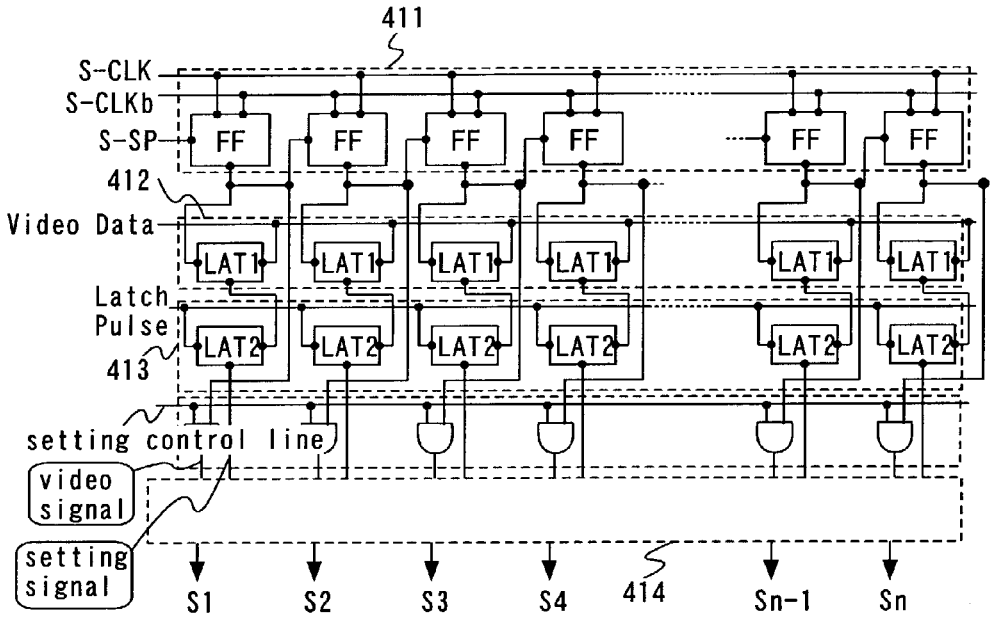
FIG. 42 is a view of a signal line driver circuit.
Figure 42B:
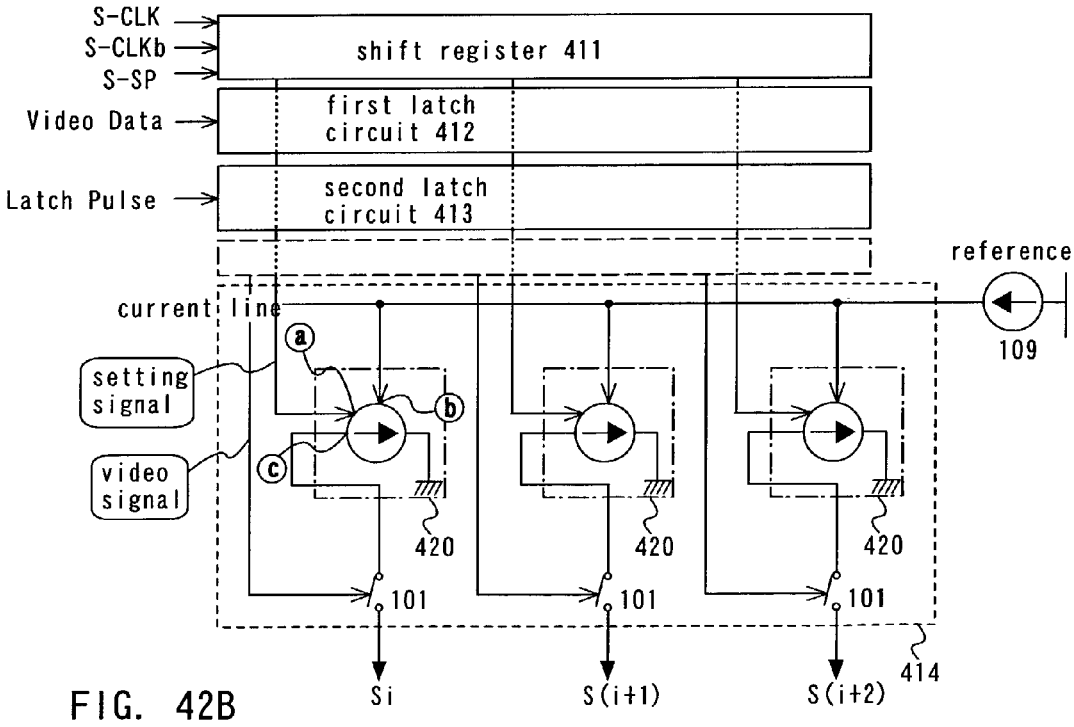
Figure 49:
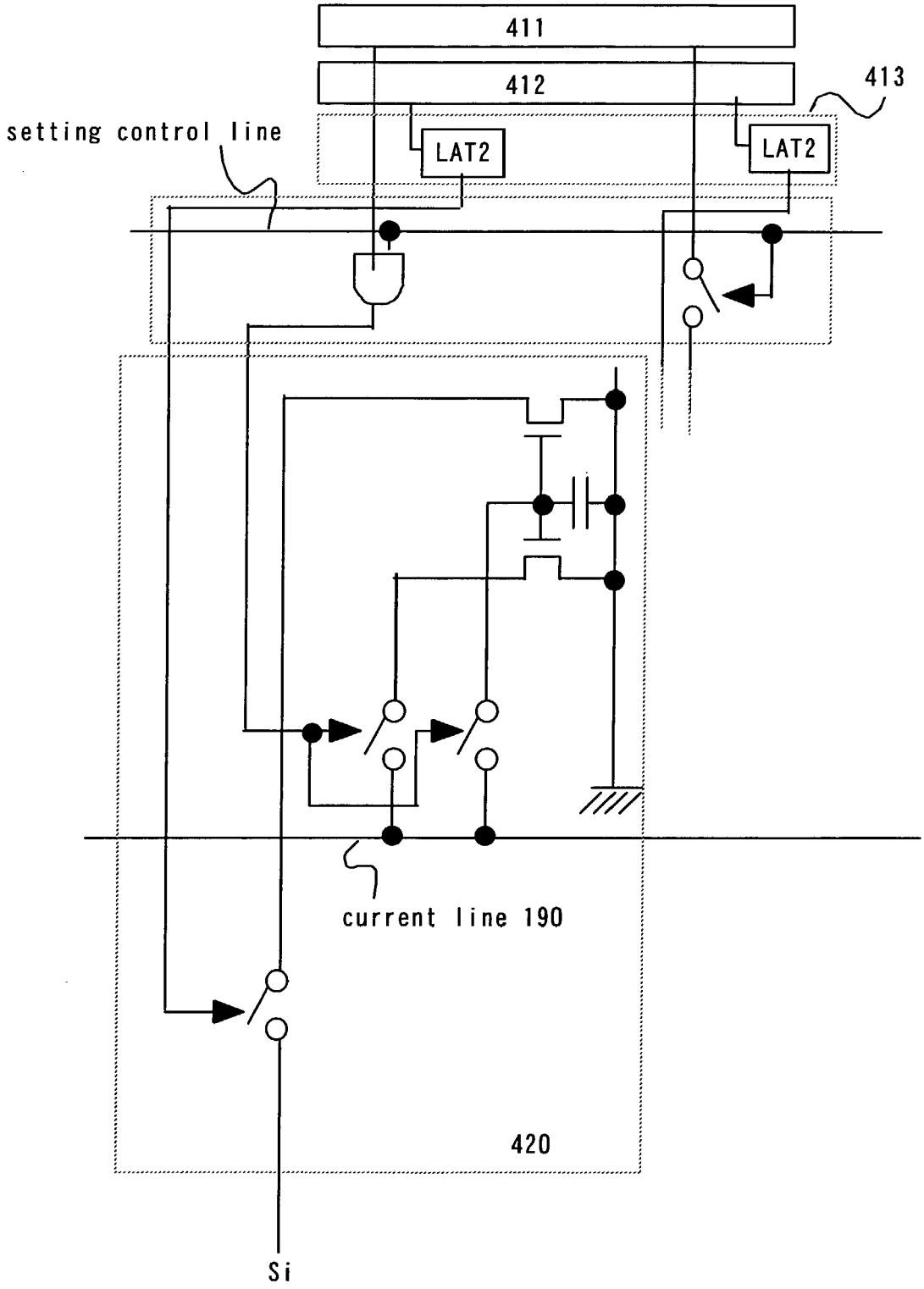
FIG. 49 is a view of a signal line driver circuit.
Figure 50:
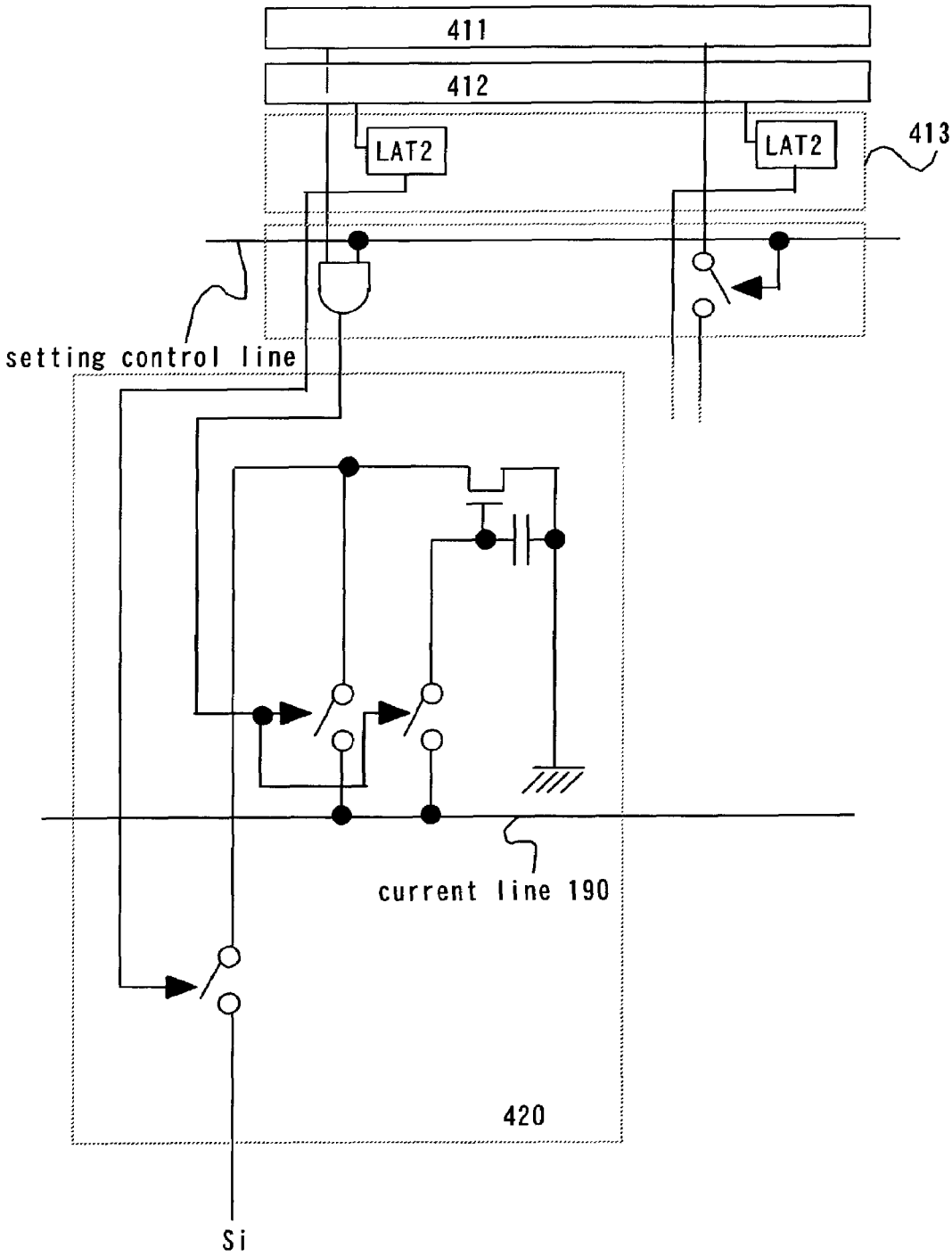
FIG. 50 is a view of a signal line driver circuit.
Figure 51:
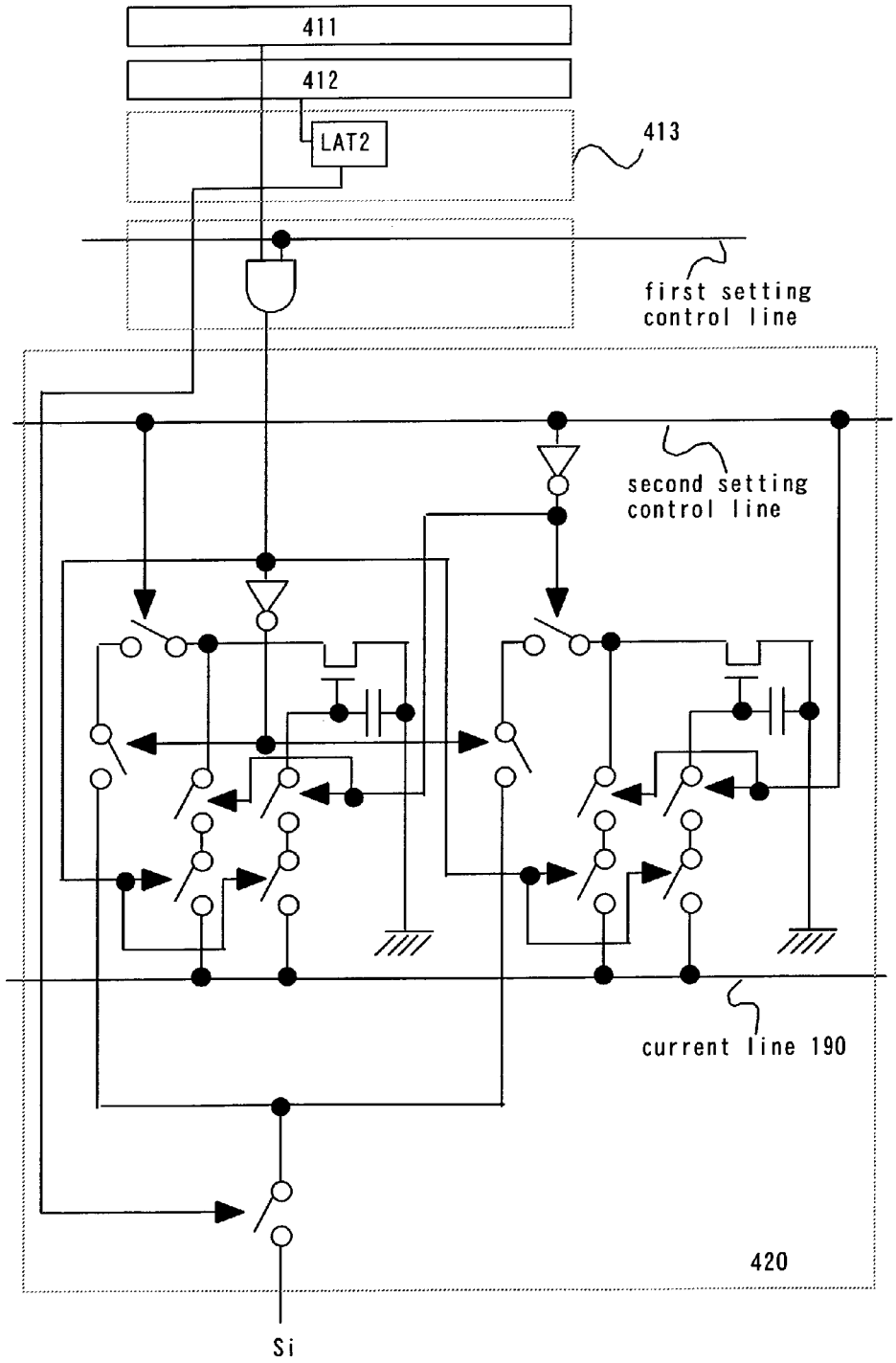
FIG. 51 is a view of a signal line driver circuit.

Subsequently, the detailed structure of the constant current circuit 414 shown in FIGS. 42(A) and (B) is shown in FIG. 49, FIG. 50 and FIG. 51. Here, FIG. 49 shows the structure in which the circuit shown in FIG. 1 is applied to the portion corresponding to the constant current circuit 414 in FIG. 42(B), and further shows the structure in which FIG. 23(C) is applied to the portion of the current source circuit. FIG. 50 shows the structure in which the circuit shown in FIG. 1 is applied to the portion corresponding to the constant current circuit 414 in FIG. 42(B), and further shows the structure in which FIG. 23(A) is applied to the portion of the current source circuit. FIG. 51 shows the structure in which the circuit shown in FIG. 2 is applied to the portion corresponding to the constant current circuit 414 in FIG. 42(B), and further shows the structure in which FIG. 23(A) is applied to the portion of the current source circuit.

Note that, in the structure shown in each of FIG. 49 and FIG. 50, a logical operator is arranged, but a switch or the like may be arranged instead of the logical operator. The logical operator controls a changeover about whether the setting operation of the current source circuit is performed or not, and thus, may use any circuit as long as the circuit capable of performing control for changing the setting operation is adopted. Further, in FIG. 51, whether the setting operation of the current source circuit is performed or not is changed in accordance with the control of the signal supplied from a first setting control line. Further, the signal supplied from a second setting control line is controlled, whereby it is controlled that which current source circuit conducts the setting operation and which current source circuit conducts the input operation between two current source circuits arranged for each column.

Figure 34:
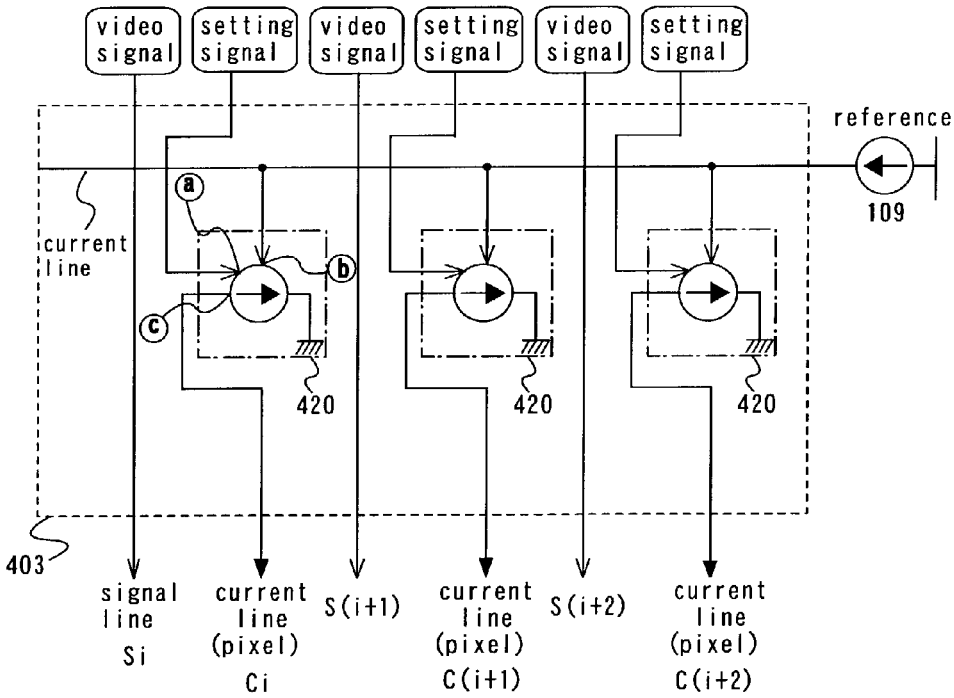
FIG. 34 is a signal line driver circuit.
Figure 52A:
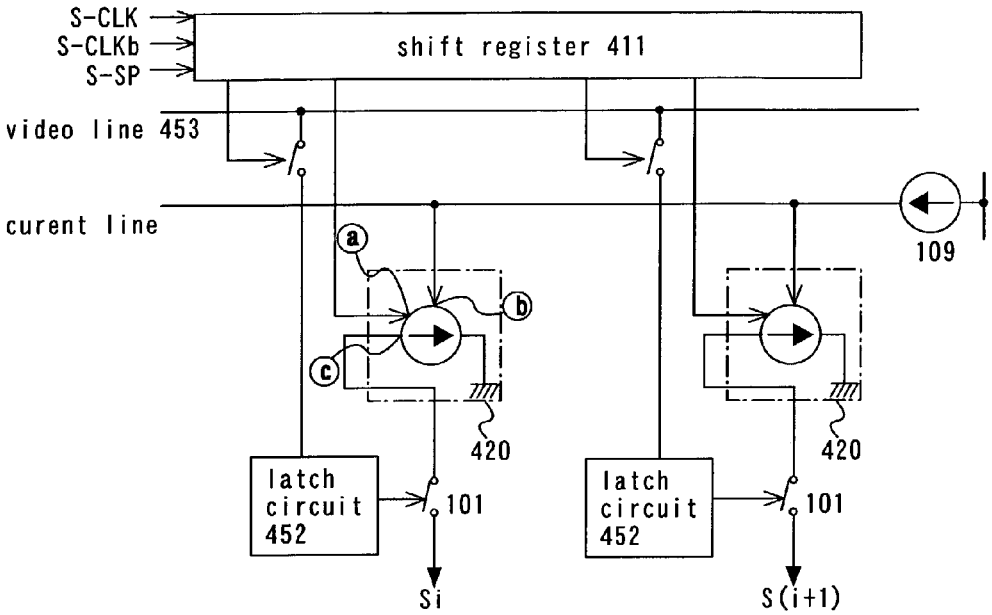
FIG. 52 is a view of a signal line driver circuit.

Subsequently, the case adapted for FIG. 34 is described. So far, the case of line-sequential drive has been described. Hereinafter, the case of dot-sequential drive will be described. In FIG. 52(A), a video signal supplied from a video line is sampled in accordance with a timing of the sampling pulse supplied from the shift register 411. Further, the setting of the current source circuit 420 is performed in accordance with the timing of the sampling pulse supplied from the shift register 411. As an example, the dot-sequential drive is performed in the case with the structure of FIG. 52(A).

Note that, as to the signal input to the current source circuit 420 through a terminal a, the sampling pulse is not directly input, and the signal supplied from an output terminal of a logical operator connected to a setting control line (not shown in FIG. 52(A)) is input depending on the structure or drive system of the current source circuit. One of two input terminals of the logical operator is input with the sampling pulse, and the other input terminal is input with the signal supplied from the setting control line. That is, the setting of the current source circuit 420 is performed in accordance with the timing of the sampling pulse or the signal supplied from the output terminal of the logical operator connected to the setting control line.

Note that, in the case where: only in the period during which the sampling pulse is output, and the video signal is supplied from the video line, a switch 101 (signal current control switch) is turned to the ON state; and no sampling pulse is output, no video signal is supplied from the video line, and then, the switch 101 (signal current control switch) is turned to the OFF state, operation is not conducted precisely. This is because the switch for inputting a current remains in the ON state in the pixel. In this state, when the switch 101 (signal current control switch) is set to the OFF state, since the current is not input to the pixel, the signal cannot be input precisely.

A latch circuit 452 is arranged so that the video signal supplied from the video line can be retained and that the state of the switch 101 (signal current control switch) can be retained. The latch circuit 452 may either be constituted only by a capacitor device and a switch or be constituted by an SRAM circuit. In this way, the sampling pulse is output, the video signal is supplied from the video line for each column, the switch 101 (signal current control switch) is set to the ON state or the OFF state in accordance with the video signal, and the supply of the current to the pixel is controlled. Thus, the dot-sequential drive can be implemented.

Figure 52B:
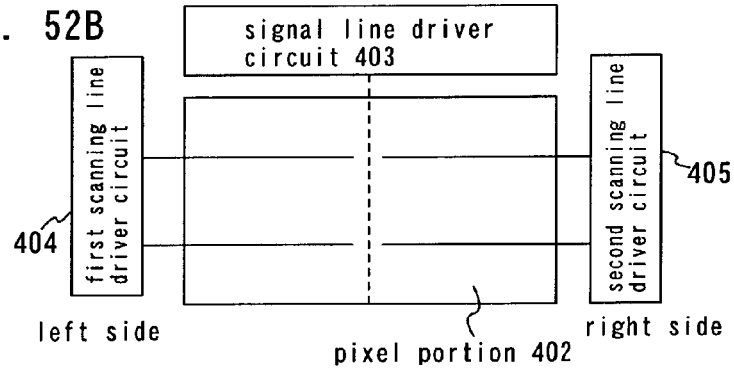
Figure 52C:
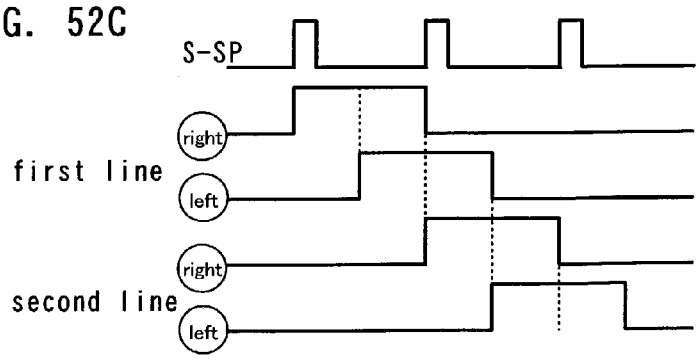

However, when selection is sequentially performed from the first column to the last column, a period for inputting the signal to the pixel is relatively long in a column on the side of the first column among the first column to the last column. On the other hand, when the video signal is input, the subsequent line pixel is immediately selected in a column on the side of the last column among the first column to the last column. As a result, a period for inputting the signal to the pixel becomes short. In this case, as shown in FIG. 52(B), the period for inputting the signal to the pixel can be prolonged by dividing the scanning line arranged in a pixel portion 402 at the center. In this case, one scanning line driver circuit is arranged on each of the left and right sides of the pixel portion 402, and the scanning line driver circuit is used to drive the pixel. In this way, periods for inputting the signal to the right pixel and the left pixel can be differentiated from each other even among the pixels arranged in the same line. Further, FIG. 52(C) shows output waveforms of the scanning line driver circuits arranged left and right in the first and second lines, and a start pulse (S-SP) for the shift register 411. According to the operations thus performed, the period for inputting the signal even to the left pixel can be prolonged, and the dot-sequential drive is thus facilitated.

Regardless of whether the line-sequential drive or the dot-sequential drive is performed, the setting operation for the current source circuit 420 may be performed for the current source circuit arranged in an arbitrary column with an arbitrary timing and for an arbitrary number of times. Ideally, however, only the setting-dedicated setting operation may be performed only once as long as a predetermined charge is stored in the capacitor device connected between the gate and the source of the transistor arranged in the current source circuit 420. Alternatively, the setting operation may be performed when the predetermined charge retained in the capacitor device has discharged (varied). Further, as to the setting operation for the current source circuit 420, the setting operation may be performed for the current source circuits 420 in all the columns using time. That is, the setting operation may be performed for the current source circuits 420 in all the columns within one frame period. Alternatively, it may be such that the setting operation is performed only for the current source circuits 420 in several columns within one frame period, as a result of which the setting operation is performed for the current source circuits 420 in all the columns for several frame periods or more.

As above, while the case where one current source circuit is arranged in each column has been described, the present invention is not limited to this, and a plurality of current source circuits may be arranged.

Figure 87:
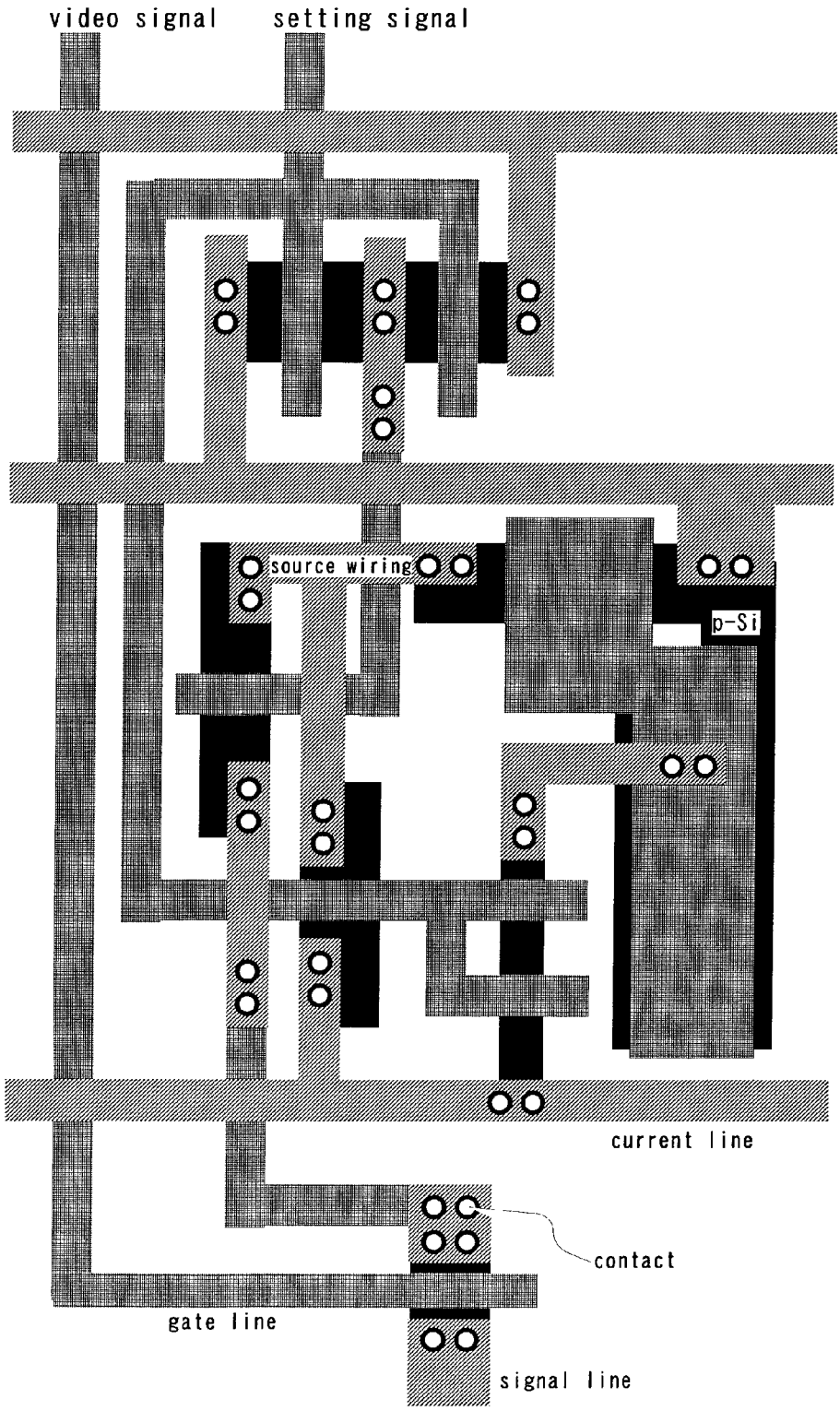
FIG. 87 is a layout view of a current source circuit.
Figure 88:
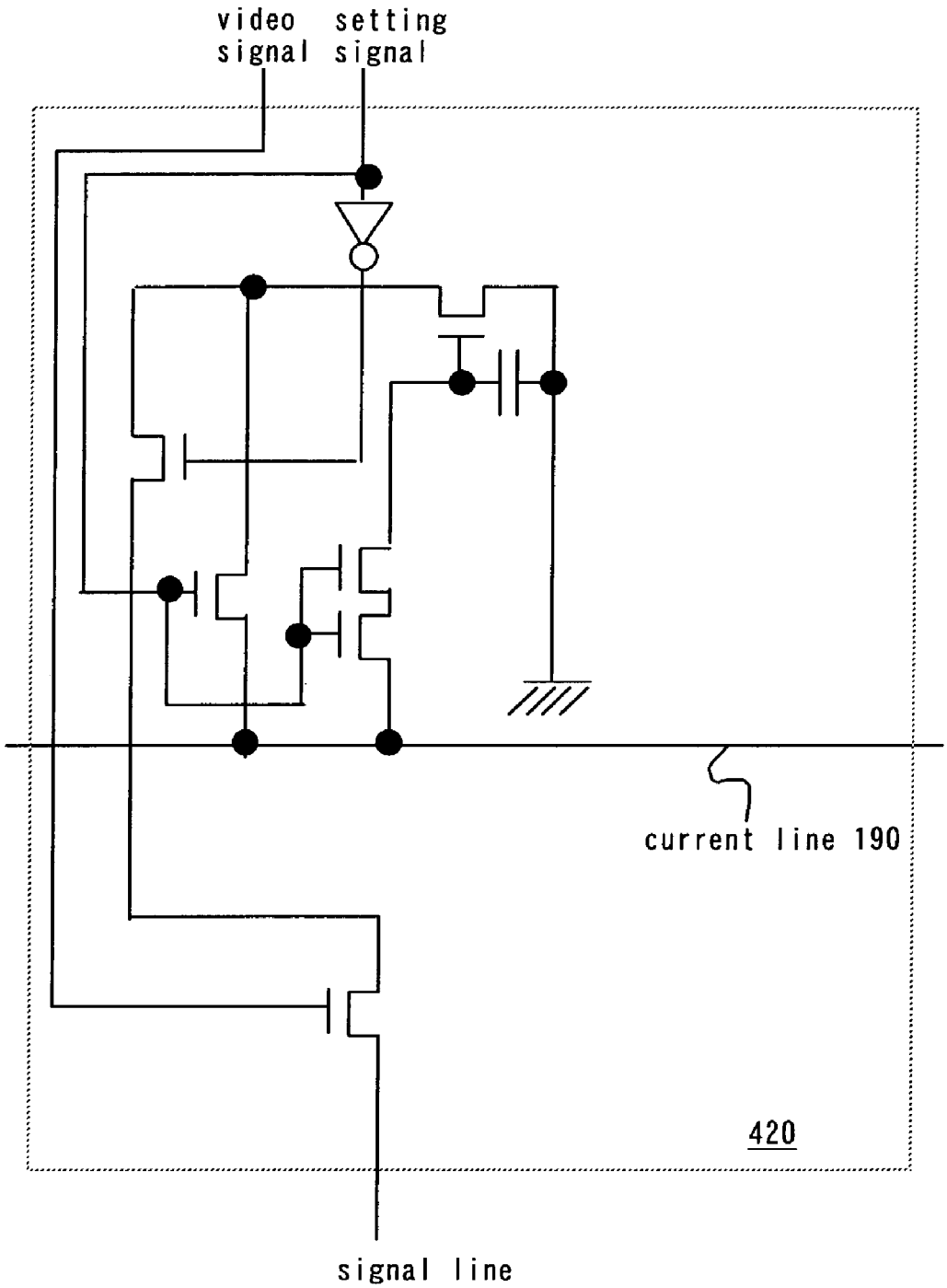
FIG. 88 is a circuit diagram of a current source circuit.

Furthermore, regarding the current source circuit in the signal line driver circuit according to the present invention, a layout diagram is shown in FIG. 87, and a corresponding circuit diagram is shown in FIG. 88.

The present invention having the above structure can suppress the influence of variation in characteristics of TFTs and supply a desired current to the outside.

This embodiment mode may be arbitrarily combined with Embodiment Modes 1 to 3.

Embodiment Mode 5

In this embodiment mode, the detailed structure and operation of the signal line driver circuit 403 shown in FIG. 15(A) will be described. In this embodiment mode, a description is made of the signal line driver circuit 403 used in the case of performing 3-bit digital gradation display.

Figure 26:
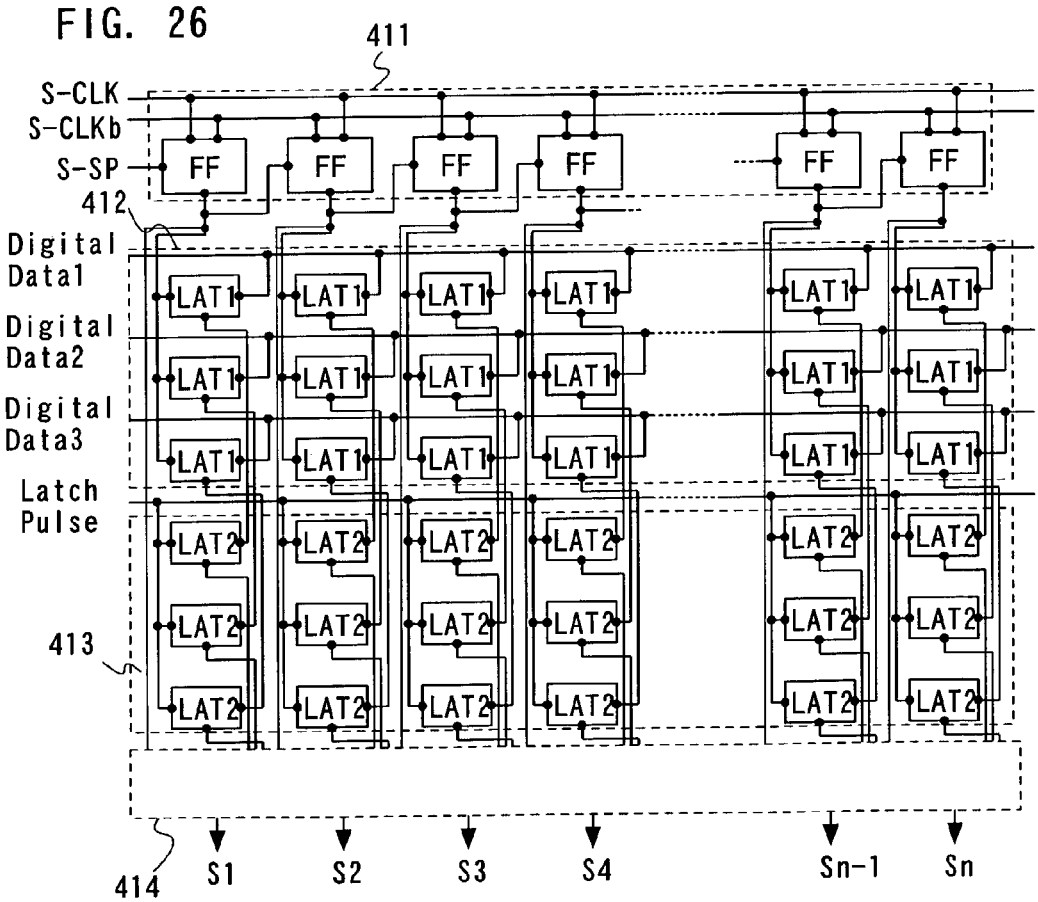
FIG. 26 is a view of a signal line driver circuit (3-bit).

FIG. 26 is a schematic view of the signal line driver circuit 403 in the case of performing the 3-bit digital gradation display. The signal line driver circuit 403 includes a shift register 411, a first latch circuit 412, a second latch circuit 413, and a constant current circuit 414.

The operation will be briefly described. The shift register 411 is formed using, for example, a plurality of flip-flop circuits (FFs), and is input with a clock signal (S-CLK), a start pulse (S-SP), and an inverted clock signal (S-CLKb). In accordance with the timing of these signals, sampling pulses are sequentially output therefrom.

The sampling pulses, which have been output from the shift register 411, are input to the first latch circuit 412. 3-bit digital video signals (Digital Data 1 to Digital Data 3) have been input to the first latch circuit 412, and a video signal is retained in each column in accordance with the timing at which the sampling pulse is input.

In the first latch circuit 412, upon completion of video-signal retaining in columns to the last column, during a horizontal return period, a latch pulse is input to the second latch circuit 413, and the 3-bit digital video signals (Digital Data 1 to Digital Data 3) retained in the first latch circuit 412 are transferred in batch to the second latch circuit 413. Then, the 3-bit digital video signals (Digital Data 1 to Digital Data 3) for one line, which are retained in the second latch circuit 413, are input to the constant current circuit 414 at a time.

While the 3-bit digital video signals (Digital Data 1 to Digital Data 3) retained in the second latch circuit 413 are input to the constant current circuit 414, sampling pulses are again output in the shift register 411. Thereafter, the operation is iterated, and video signals for one frame are thus processed.

Figure 27:
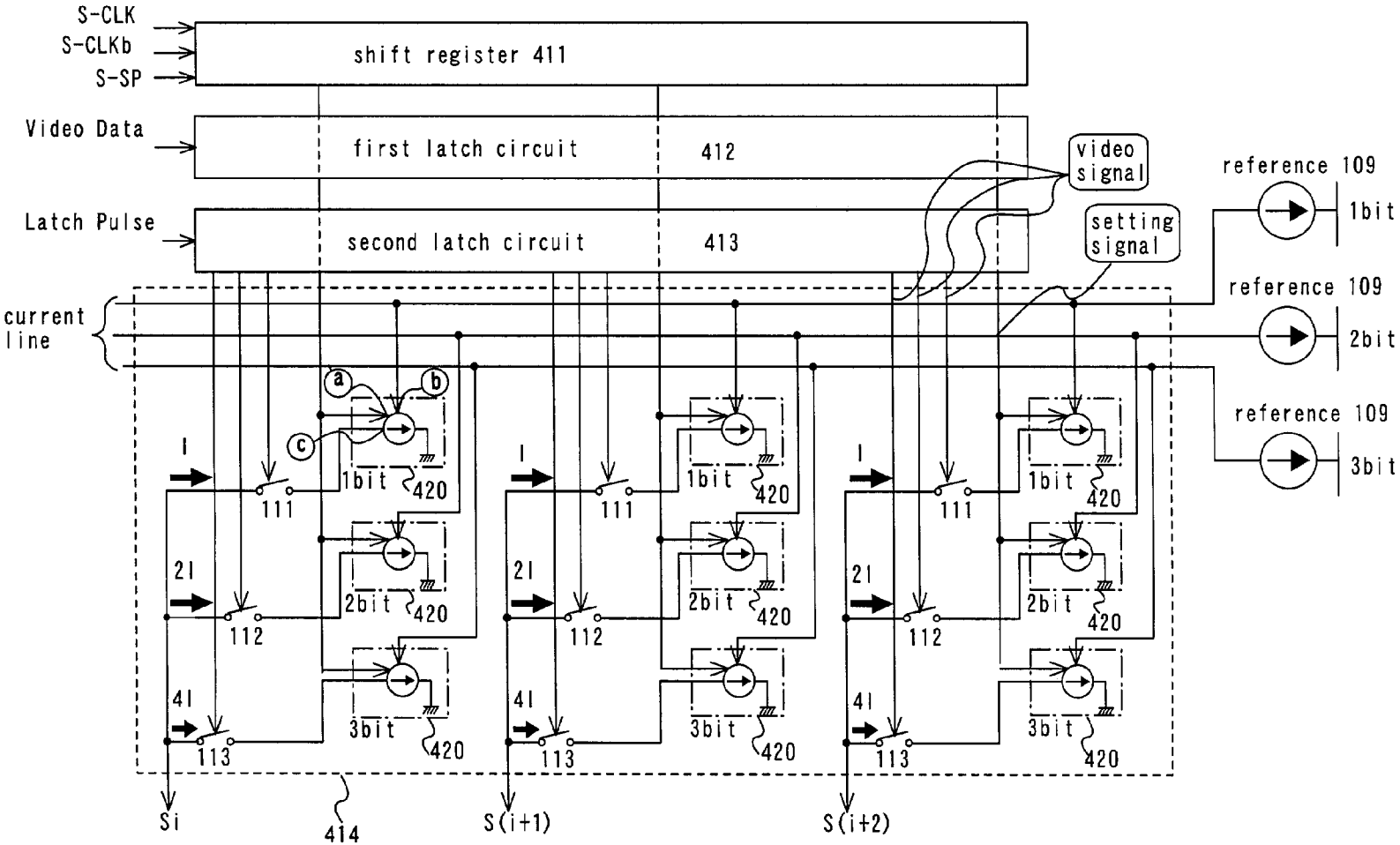
FIG. 27 is a view of a signal line driver circuit (3-bit).

There is a case where the constant current circuit 414 plays a role of converting a digital signal into an analog signal. In the constant current circuit 414, a plurality of current source circuits 420 are provided. FIG. 27 is a schematic view of the signal line driver circuit related to the three signal lines in i-th to (i+2)-th columns.

Note that FIG. 27 shows the case where a reference constant current source 109 corresponding to each bit is arranged.

Each current source circuit 420 has a terminal a, a terminal b, and a terminal c. The current source circuit 420 is controlled by a signal input through the terminal a. Further, current is supplied via the terminal b from the reference constant current source 109 connected to a current line. Switches (signal current control switches) 111 to 113 are provided between the current source circuit 420 and a pixel connected to a signal line Sn, and the switches (signal current control switches) 111 to 113 are controlled by 1-bit to 3-bit video signals. In the case where the video signal is a bright signal, a current is supplied from the current source circuit to the pixel. On the contrary, in the case where the video signal is a dark signal, the switches (signal current control switches) 111 to 113 are controlled not to supply current to the pixel. That is, the current source circuit 420 has a capability of flowing a predetermined current, and the switches (signal current control switches) 111 to 113 control whether the current is supplied to the pixel or not.

Note that the signal input to the current source circuit 420 through the terminal a corresponds to the sampling pulse supplied from the shift register. The sampling pulse is not directly input, and the signal supplied from an output terminal of a logical operator connected to a setting control line (not shown in FIG. 27) is input depending on the structure or drive system of the current source circuit. One of two input terminals of the logical operator is input with the sampling pulse, and the other input terminal is input with the signal supplied from the setting control line. That is, the setting of the current source circuit 420 is performed in accordance with the timing of the sampling pulse or the signal supplied from the output terminal of the logical operator connected to the setting control line.

In FIG. 27, when the current source circuit 420 arranged for each signal line is comprised of the circuit as shown in FIG. 23(A) or (B), the signal input from the output terminal of the logical operator connected to the control line corresponds to a set signal. Further, when the current source circuit 420 arranged for each signal line is comprised of the circuit as shown in each of FIGS. 23(C) to (E), the sampling pulse from the shift register corresponds to a set signal.

Figure 53:
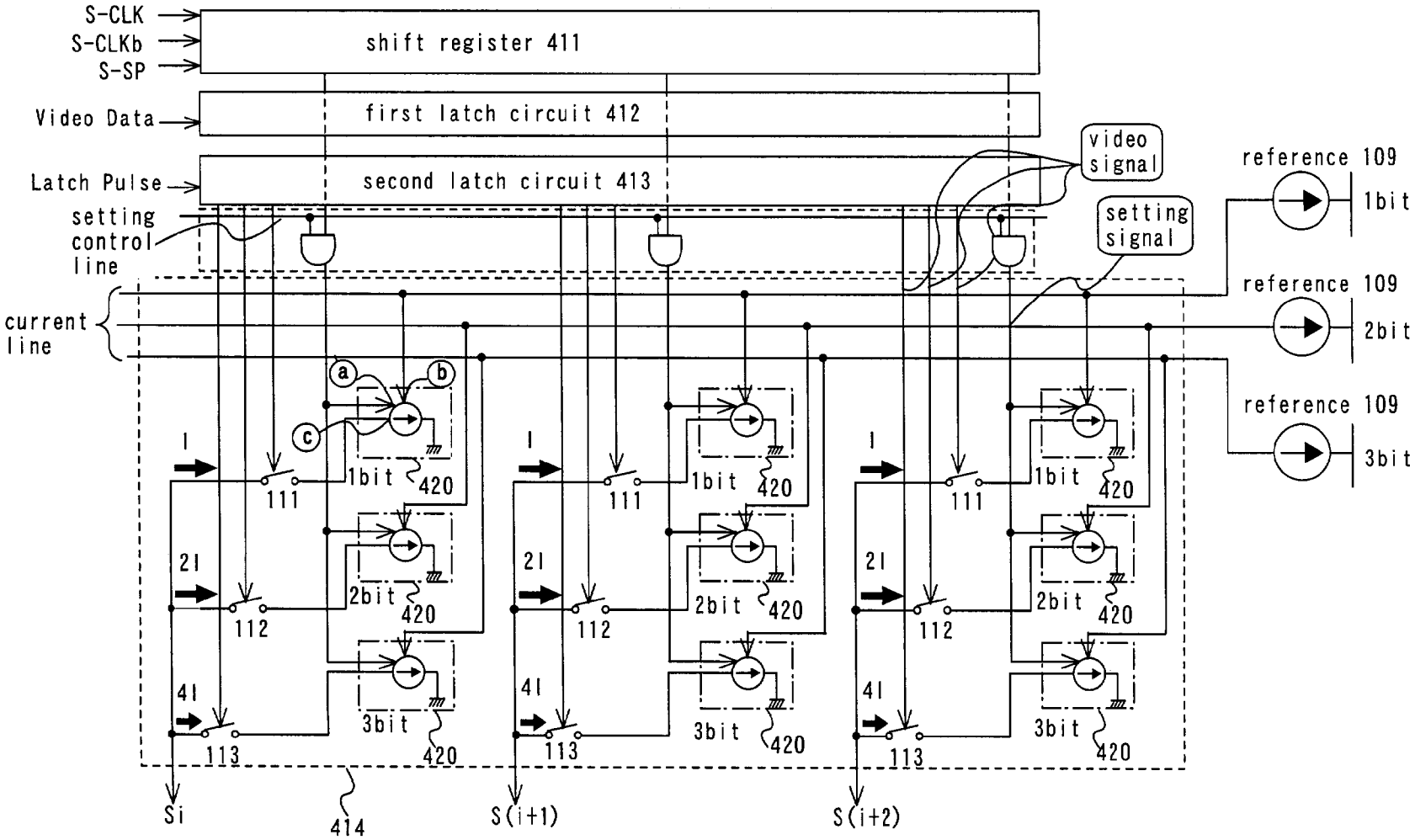
FIG. 53 is a view of a signal line driver circuit.

A structure in which the above-described setting control line and logical operator are used in the structure shown in FIG. 27 is shown in FIG. 53. Note that, in FIG. 53, logical operators are arranged, but switches or the like may be used instead of the logical operators.

Note that the current line and the reference constant current source are arranged in correspondence with each bit in FIG. 27 or FIG. 53. Then, the total of the values of the currents supplied from the current sources for respective bits is supplied to the signal line. That is, the constant current source circuit 414 also has a function of digital-analog conversion.

Figure 54:
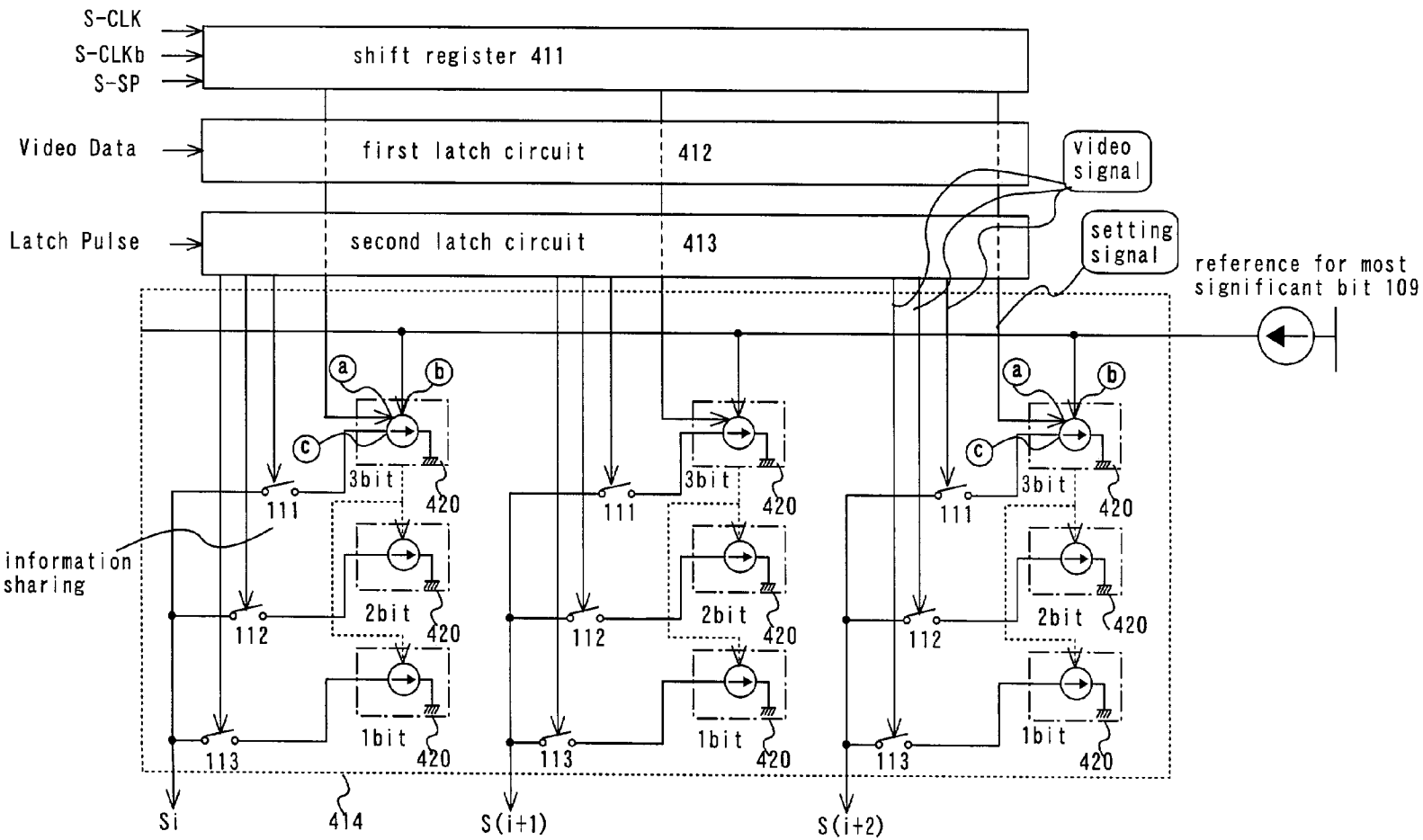
FIG. 54 is a view of a signal line driver circuit.

In the signal line driver circuit shown in FIG. 27 or 53, although dedicated reference constant current sources 109 are respectively arranged for the 1-bit to 3-bit, the present invention is not limited to this. As shown in FIG. 54, reference constant current sources 109 the number of which is smaller than the number of bits may be arranged. For example, it may be such that only the reference constant current source 109 for the most significant bit (3-bit in this case) is arranged; one current source circuit selected from a plurality of current source circuits arranged in one column is set; and using the current source circuit for which the setting operation has already been performed, the operation is performed for other current source circuits. In other words, setting information may be shared among the plurality of current source circuits arranged in one column.

For example, a setting operation is performed only for a 3-bit current source circuit 420. Then, using the current source circuit 420 for which the setting operation has been performed, information is shared with other 1-bit and 2-bit current source circuits 420. More specifically, among current source circuits 420, the gate terminal of each current-supply transistor (corresponding to a transistor 102 in FIG. 23(A)) is connected, and also the source terminal is connected. As a result, gate-source voltages of information-sharing transistors (current-supply transistors) become identical.

Referring to FIG. 54, the setting operation is performed not for the current source circuits of the least significant bit (1-bit here), but for the current source circuits of the most significant bit (3-bit here). Then, by using the current source circuits of the most significant bit for which the setting operation has already been performed, information is shared with other current source circuits. Thus, when the setting operation is performed for the current source circuits of a greater-value bit, the influence of variation in characteristics of inter-bit current source circuits can be reduced. Suppose the setting operation is performed for the current source circuits of the least significant bit (1-bit here), information is shared among the current source circuits of the upper bits. In this case, when the characteristics of the respective current source circuits vary, the values of currents of the upper bits lack precision. This is because since upper-bit current source circuits produce outputs having great current values, even when a small variation has occurred in their characteristics, the influence of the variation is magnified, and also output current values are also varied great. In contrast, in the case where the setting operation is performed for the current source circuits of the most significant bit (3-bit here), and information related thereto is shared with the current source circuits of the lower bits, even when the characteristics of the respective current source circuits have varied, since output current values are small, differences in the current value due to variation are small, and the influence is small.

In this embodiment mode, three current source circuits 420 are provided for each signal line because of an explanation with an example of the case of conducting 3-bit digital gradation display. When signal currents supplied from the three current source circuits 420 connected to one signal line are set to 1:2:4, the size of the current can be controlled at $2^3=8$ levels.

The structure of the current source circuit 420 may arbitrarily use the structure of the current source circuit 420 shown in FIG. 23, FIG. 24, FIG. 37, FIG. 38, FIG. 40 or the like. Not only one structure but also a plurality of structures may be adopted for the current source circuits 420.

Hereinafter, as an example, the detailed structure and operation of the constant current circuit 414 in FIGS. 27 and 54 are shown with reference to FIGS. 7, 8, 29 and 55. In a current source circuit 420 provided in each column of FIG. 7, whether or not a predetermined signal current is output to a signal line Si ($1 \leqq i \leqq n$) is controlled according to information contained in a digital video signal input from a second latch circuit 413.

Figure 1:
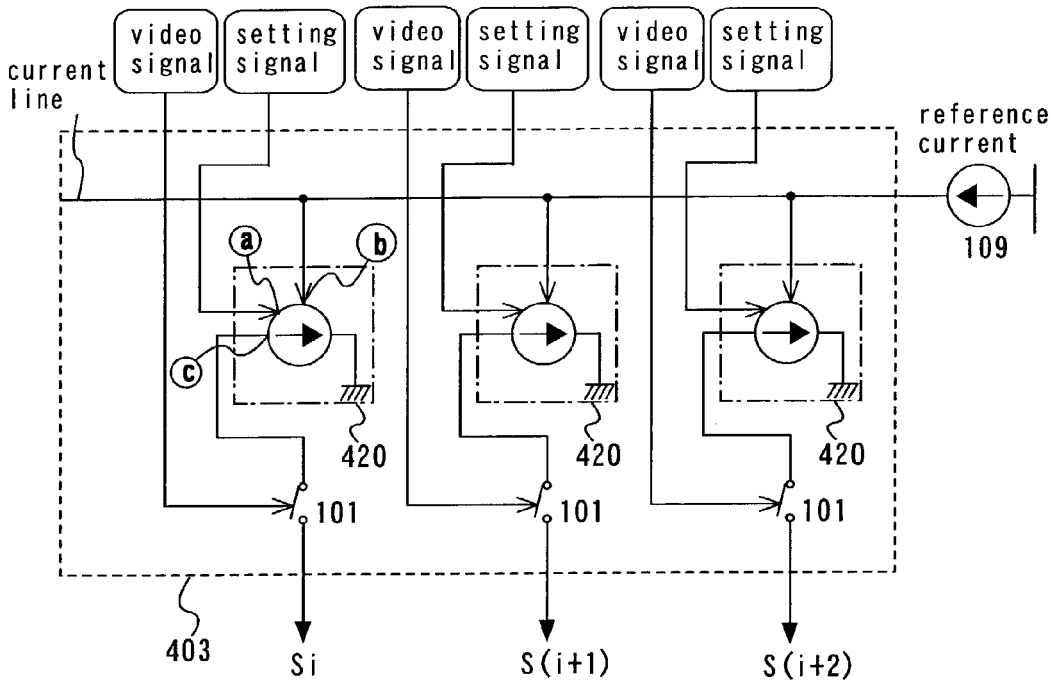
FIG. 1 is a view of a signal line driver circuit.
Figure 7:
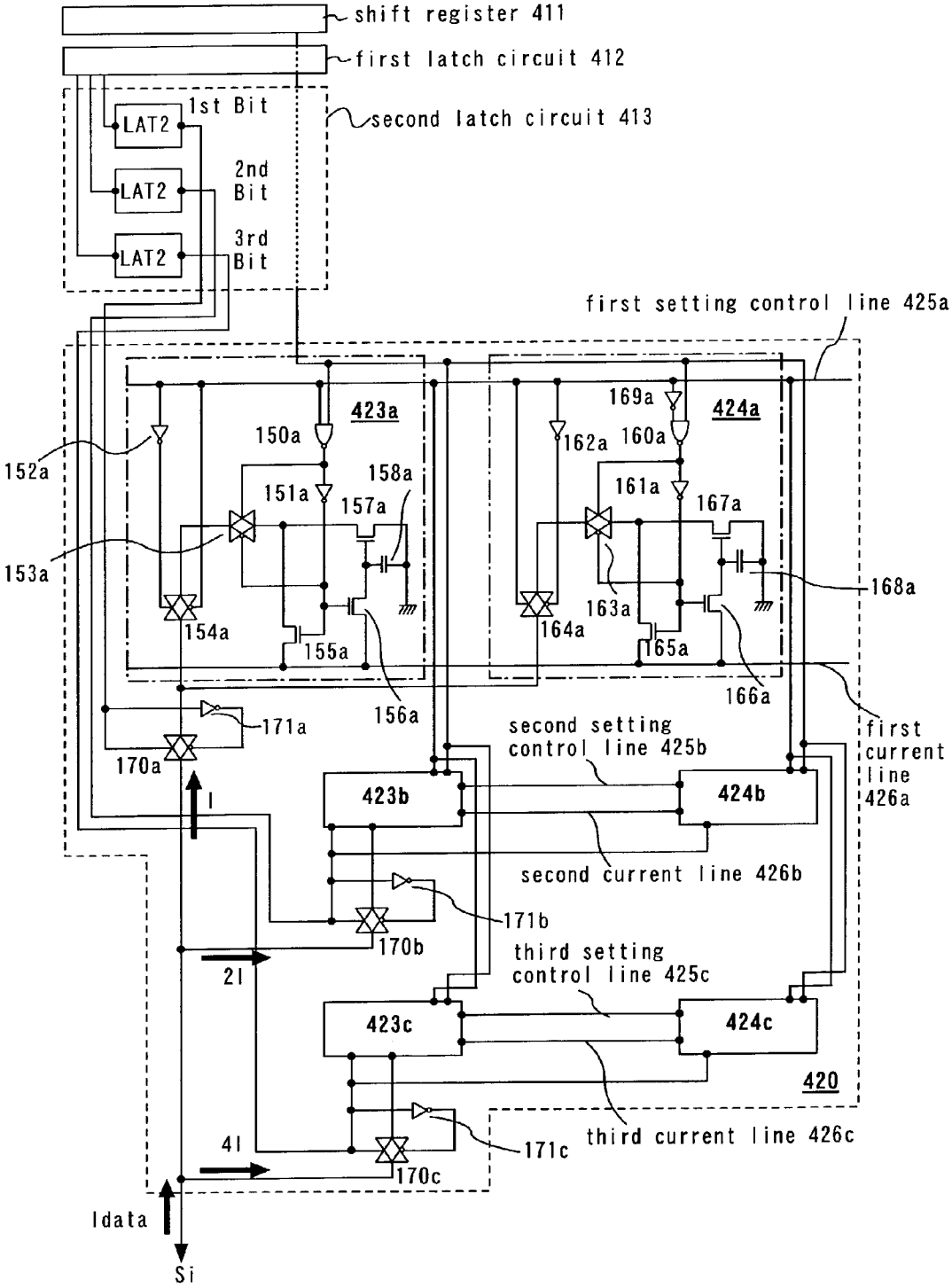
FIG. 7 is a view of a signal line driver circuit (3-bit).
Figure 8:
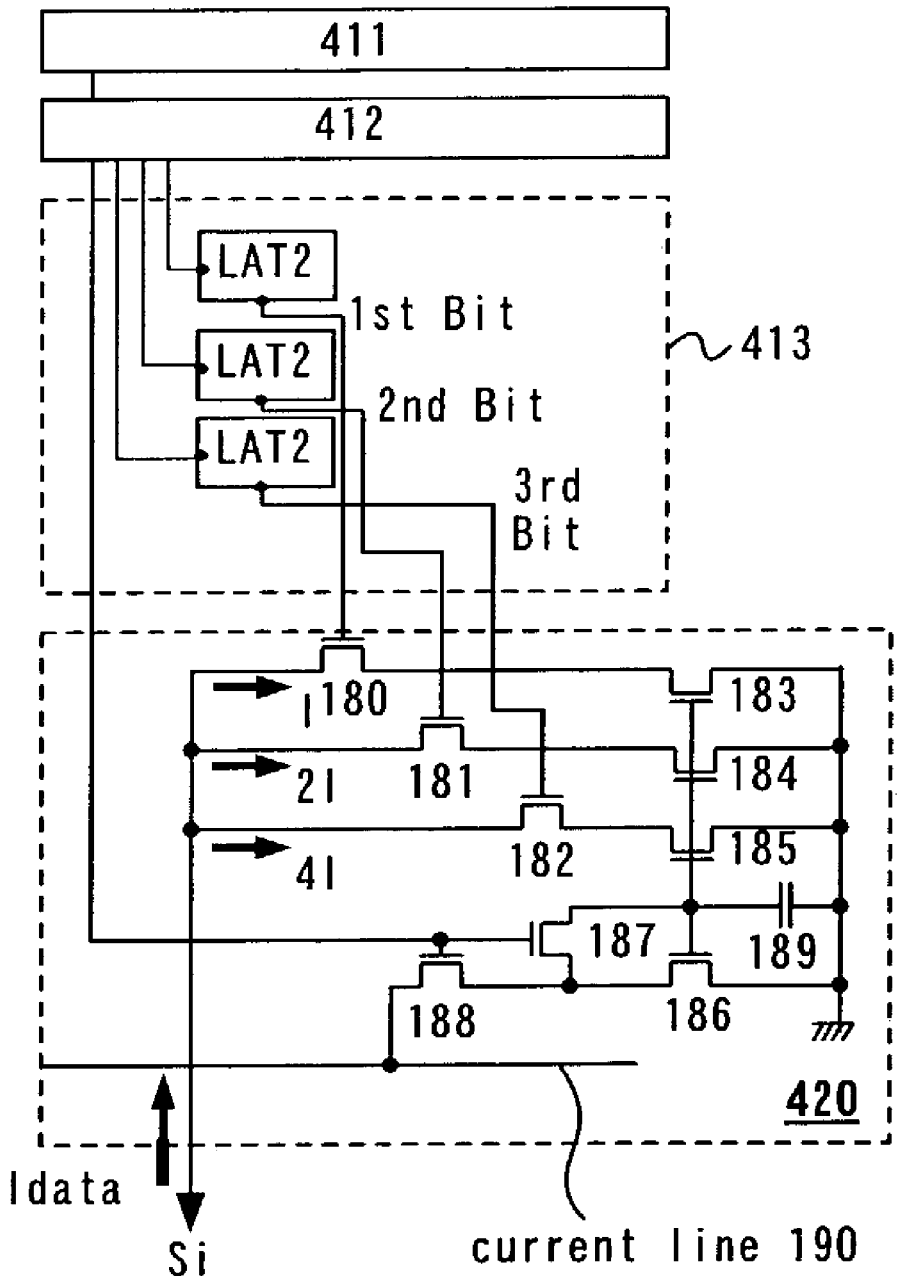
FIG. 8 is a view of a signal line driver circuit (3-bit).
Figure 29:
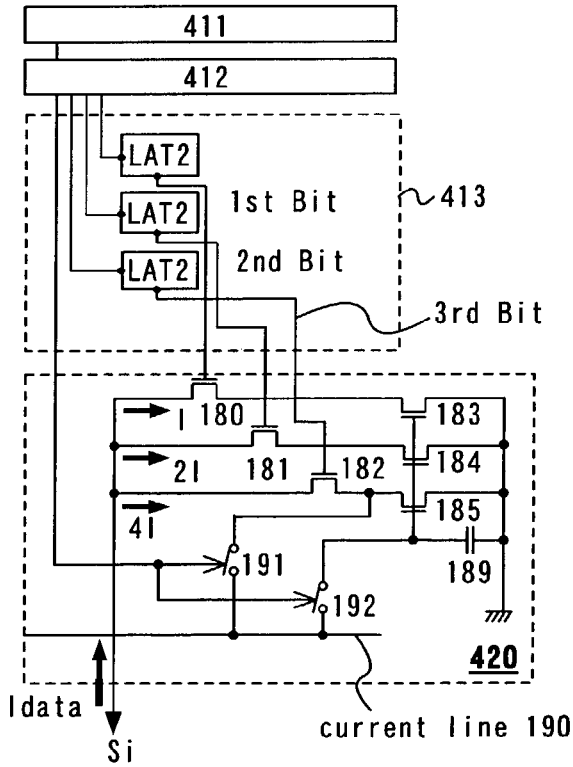
FIG. 29 is a view of a signal line driver circuit (3-bit).
Figure 55:
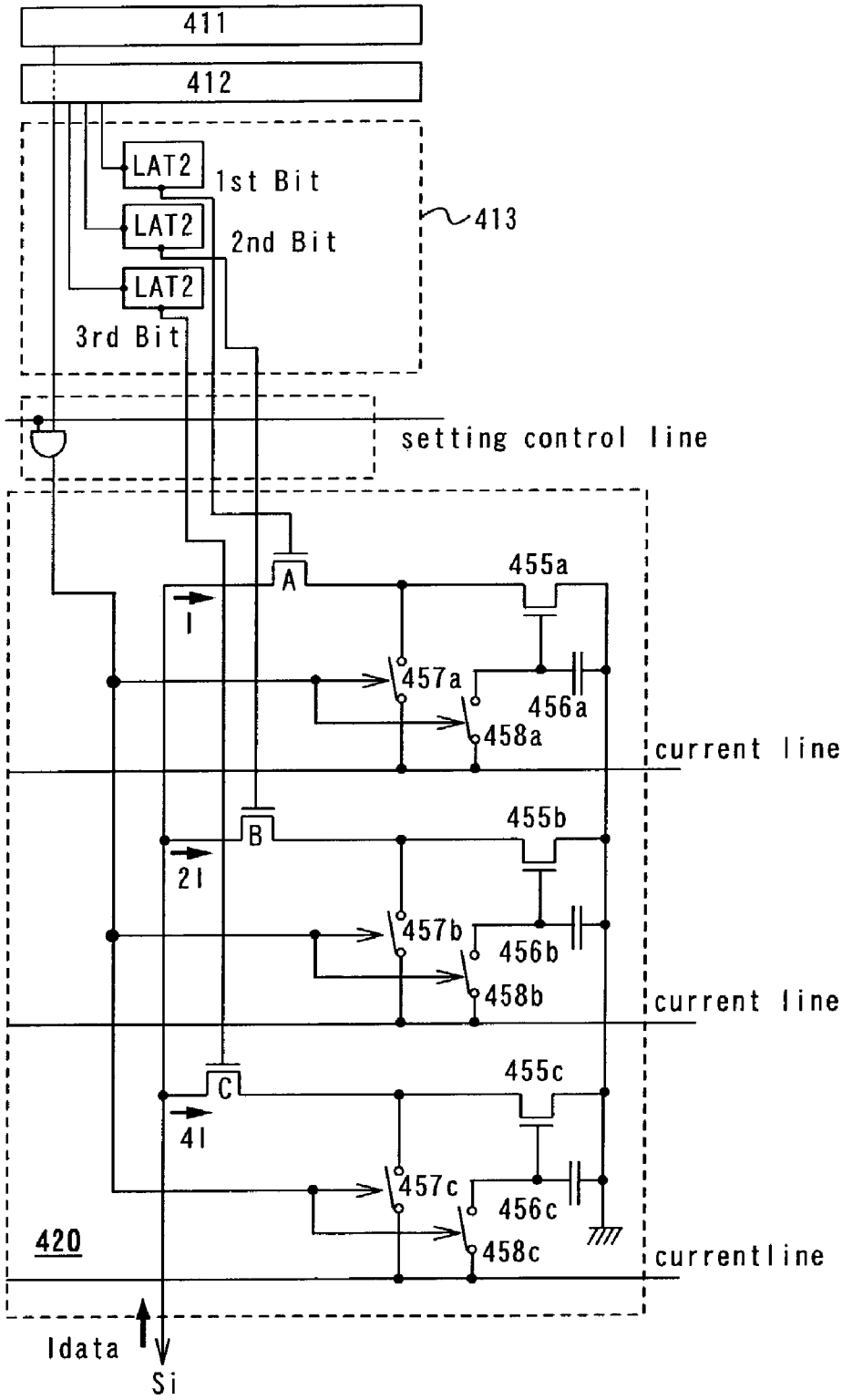
FIG. 55 is a view of a signal line driver circuit.

FIG. 55 is a circuit diagram in the case where: reference constant current sources 109 the number of which is equal to the number of bits are arranged; the constant current circuit of FIG. 1 is applied to the signal line driver circuit shown in FIG. 27; and the structure of FIG. 23(A) is applied to the current source circuit. In FIG. 55, the setting operation is performed with transistors A to C being turned OFF. This is for preventing a current leakage. Alternatively, switches may be arranged in series with the transistors A to C, in which the switches are turned OFF in the setting operation. Further, FIG. 7 is a circuit diagram in the case where: reference constant current sources 109 the number of which is equal to the number of bits are arranged; the constant current circuit of FIG. 2 is applied to the signal line driver circuit shown in FIG. 27; and the structure of FIG. 23(A) is applied to the current source circuit. FIG. 8 is a circuit diagram in the case where: reference constant current sources 109 the number of which is smaller than the number of bits are arranged; the constant current circuit of FIG. 1 is applied to the signal line driver circuit shown in FIG. 54; and the structure of FIG. 23(C) is applied to the current source circuit. FIG. 29 is a circuit diagram in the case where: reference constant current sources 109 the number of which is smaller than the number of bits are arranged; the constant current circuit of FIG. 1 is applied to the signal line driver circuit shown in FIG. 54; and the structure of FIG. 23(A) is applied to the current source circuit.

The current source circuit 420 has a first current source circuit 423*a* and a second current source circuit 424*a* which are controlled in accordance with a 1-bit digital video signal, a first current source circuit 423*b* and a second current source circuit 424*b* which are controlled in accordance with a 2-bit digital video signal, and a first current source circuit 423*c* and a second current source circuit 424*c* which are controlled in accordance with a 3-bit digital video signal. Further, the current source circuit 420 has an analog switch 170*a* and an inverter 171*a*, an analog switch 170*b* and an inverter 171*b*, and an analog switch 170*c* and an inverter 171*c*.

The first current source circuits 423*a* to 423*c* and the second current source circuits 424*a* to 424*c* conduct a setting operation while conducting an operation for inputting a signal to a pixel (input operation, output of a current to a pixel). The first current source circuits 423*a* to 423*c* and the second current source circuits 424*a* to 424*c* each have a plurality of circuit elements. In FIG. 7, the circuit diagrams of the first current source circuit 423*a* and the second current source circuit 424*a* are shown, and the circuit diagrams of the first current source circuits 423*b*, 423*c* and the second current source circuits 424*b*, 424*c* are not shown because they conform to the circuit diagrams of the first current source circuit 423*a* and the second current source circuit 424*a*.

The first current source circuit 423*a* has a NAND 150*a*, an inverter 151*a*, an inverter 152*a*, an analog switch 153*a*, an analog switch 154*a*, transistors 155*a* to 157*a*, and a capacitor element 158*a*. The second current source circuit 424*a* has a NAND 160*a*, an inverter 161*a*, an inverter 162*a*, an inverter 169*a*, an analog switch 163*a*, an analog switch 164*a*, transistors 165*a* to 167*a*, and a capacitor element 168*a*. In this embodiment mode, the transistors 155*a* to 157*a* and the transistors 165*a* to 167*a* are all of n-channel type.

In the first current source circuit 423*a*, an input terminal of the NAND 150*a* is connected to the shift register 411 and a first control line 425*a*, and an output terminal of the NAND 150*a* is connected to an input terminal of the inverter 151*a*. An output terminal of the inverter 151*a* is connected to gate electrodes of the transistor 155*a* and the transistor 156*a*.

Conductivity or non-conductivity is selected for the analog switch 153*a* by the signal input from the output terminal of the NAND 150*a* and the signal input from the output terminal of the inverter 151*a*. An input terminal of the inverter 152*a* is connected to the first control line 425*a*. Then, conductivity or non-conductivity is selected for the analog switch 154*a* by the signals input from the first control line 425*a* and an output terminal of the inverter 152*a*.

One of a source region and a drain region of the transistor 155*a* is connected to a first current line 426*a*, and the other region is connected to one of a source region and a drain region of the transistor 157*a*. One of a source region and a drain region of the transistor 156*a* is connected to the first current line 426*a*, and the other region is connected to one of terminals of the capacitor element 158*a* and a gate electrode of the transistor 157*a*. One of the source region and the drain region of the transistor 157*a* is connected to Vss, and the other region is connected to the analog switch 153*a*.

One of the terminals of the capacitor element 158*a* is connected to Vss, and the other terminal is connected to the gate electrode of the transistor 157*a*. The capacitor element 158*a* plays a role of holding a gate-source voltage of the transistor 157*a*.

In the second current source circuit 424*a*, an input terminal of the inverter 169*a* is connected to the first control line 425*a*. An output terminal of the inverter 169*a* is connected to one of input terminals of the NAND 160*a*. Further, the other input terminal of the NAND 160*a* is connected to the shift register 411. An output terminal of the NAND 160*a* is connected to an input terminal of the inverter 161*a*. An output terminal of the inverter 161*a* is connected to gate electrodes of the transistor 165*a* and the transistor 166*a*.

Conductivity or non-conductivity is selected for the analog switch 163*a* by the signal input from the output terminal of the NAND 160*a* and the signal input from the output terminal of the inverter 161*a*. Further, an input terminal of the inverter 162*a* is connected to the first control line 425*a*. Conductivity or non-conductivity is selected for the analog switch 164*a* by the signals input from the first control line 425*a* and an output terminal of the inverter 162*a*.

One of a source region and a drain region of the transistor 165*a* is connected to the first current line 426*a*, and the other region is connected to one of a source region and a drain region of the transistor 167*a*. One of a source region and a drain region of the transistor 166*a* is connected to the first current line 426*a*, and the other region is connected to one of terminals of the capacitor element 168*a* and a gate electrode of the transistor 167*a*. One of the source region and the drain region of the transistor 167*a* is connected to Vss, and the other region is connected to the analog switch 163*a*.

One of the terminals of the capacitor element 168*a* is connected to Vss, and the other terminal is connected to the gate electrode of the transistor 167*a*. The capacitor element 168*a* plays a role of holding a gate-source voltage of the transistor 167*a*.

The operations of the first current source circuit 423*a* and the second current source circuit 424*a* which are shown in FIG. 7 are the same as those of the first current source circuit 421 and the second current source circuit 422 which are shown in FIG. 3 and FIG. 4, and thus, an explanation thereof is omitted in this embodiment mode.

Note that, in the current source circuit 420 shown in FIG. 7, the total of the signal current supplied from the first current source circuit 423*a* or the second current source circuit 424*a*, the signal current supplied from the first current source circuit 423*b* or the second current source circuit 424*b*, and the signal current supplied from the first current source circuit 423*c* or the second current source circuit 424*c* flows to the signal line Si. That is, when the signal current supplied from the first current source circuit 423*a* or the second current source circuit 424*a*, the signal current supplied from the first current source circuit 423*b* or the second current source circuit 424*b*, and the signal current supplied from the first current source circuit 423*c* or the second current source circuit 424*c* are set to 1:2:4, the size of the current can be controlled at $2^3$=8 levels.

In the current source circuit 420 shown in FIG. 7, ON/OFF of analog switches 170*a* to 170*c* is selected according to the 3-bit digital video signal. Assuming that all the analog switches 170*a* to 170*c* are turned ON, the current supplied to the signal line corresponds to the sum of the signal current supplied from the first current source circuit 423*a* or the second current source circuit 424*a*, the signal current supplied from the first current source circuit 423*b* or the second current source circuit 424*b*, and the signal current supplied from the first current source circuit 423*c* or the second current source circuit 424*c*. Further, if only the analog switch 170*a* has been turned ON, only the signal current supplied from the first current source circuit 423*a* or the second current source circuit 424*a* is supplied to the signal line.

The values of the currents supplied from the current source circuits differ from one another, and thus, it is required that the values of the currents that flow through the first current line 426*a* to the third current line 426*c* are set to 1:2:4.

Here, the transistors of the current source circuit 420 shown in FIG. 7 are all of n-channel type, but the present invention is not limited to this. P-channel transistors can be used in the current source circuit 420. The operation of the current source circuit 420 in the case of using p-channel transistors is the same as the above-described operation except the point in that the direction in which a current flows is changed and the point in that the capacitor element is connected to not Vss but Vdd, and thus, a description thereof is omitted.

Further, in FIG. 7, the detailed circuit structures of the current source circuits 423*b*, 423*c* and the current source circuits 424*b*, 424*c* are omitted. However, not the current source circuit with the structure shown in FIG. 23(A) but the current source circuit with the structure shown in any of FIGS. 23(C) to (E) may be used for the current source circuits 423*b*, 423*c* and the current source circuits 424*b*, 424*c*. That is, the current source circuit used in the signal line driver circuit used in the case of conducting digital gradation display with a plurality of bits can be designed by combining a plurality of structures.

Further, the case where Vss is not replaced with Vdd when p-channel transistors are used in the current source circuit, that is, the case where the direction in which a current flows does not change, can be applied easily with the comparison between FIG. 23 and FIG. 24. Further, the polarity of the transistor that is operated as a mere switch is not particularly limited.

Subsequently, the structure and the operation of the constant current circuit 414, which are different from those in the above, are described with reference to FIG. 8. In the current source circuit 420 in FIG. 8, whether a predetermined signal current is output to the signal line Si ($1 \leqq i \leqq n$) is controlled in accordance with information of a digital video signal input from the second latch circuit 413.

The current source circuit 420 includes transistors 180 to 188 and a capacitor device 189. In this embodiment mode, the transistors 180 to 188 are all of n-channel type.

A 1-bit digital video signal is input to a gate electrode of the transistor 180 from the second latch circuit 413. One of a source region and a drain region of the transistor 180 is connected to the source signal line (Si), and the other is connected to one of a source region and a drain region of the transistor 183.

A 2-bit digital video signal is input to a gate electrode of the transistor 181 from the second latch circuit 413. One of a source region and a drain region of the transistor 181 is connected to the source signal line (Si), and the other is connected to one of a source region and a drain region of the transistor 184.

A 3-bit digital video signal is input to a gate electrode of the transistor 182 from the second latch circuit 413. One of a source region and a drain region of the transistor 182 is connected to the source signal line (Si), and the other is connected to one of a source region and a drain region of the transistor 185.

One of the source region and the drain region of each of the transistors 183 to 185 is connected to Vss, and the other is connected to one of the source region and the drain region of each of the transistors 180 to 182. One of a source region and a drain region of the transistor 186 is connected to Vss, and the other is connected to one of a source region and a drain region of the transistor 188.

Gate electrodes of the transistor 187 and the transistor 188 are input with signals from the shift register 411. One of a source region and a drain region of the transistor 187 is connected to one of the source region and the drain region of the transistor 186, and the other region is connected to one of electrodes of the capacitor element 189. One of the source region and the drain region of the transistor 188 is connected to a current line 190, and the other region is connected to one of the source region and the drain region of the transistor 186.

One of the electrodes of the capacitor device 189 is connected to the gate electrodes of the transistors 183 to 186, and the other electrode is connected to Vss. The capacitor device 189 plays a role of retaining the gate-source voltages of the transistors 183 to 186.

The current source circuit 420 shown in FIG. 8 conforms to the current source circuit 420 that is explained with reference to FIG. 5 in terms of operation except the point in that the transistors 180, 181, 183, and 184 are additionally designed. Therefore, an explanation of the operation of the current source circuit 420 shown in FIG. 8 is omitted.

Note that the current source circuit shown in FIG. 8 shows the case where the reference constant current sources 109 the number of which is smaller than the number of bits are arranged as shown in FIG. 54.

Further, in the current source circuit 420 shown in FIG. 8, the total of drain currents of the transistors 183 to 185 flows to the signal line Si. Here, the respective drain currents of the transistors 183 to 185 are set to 1:2:4, and the size of the current is controlled at $2^3$=8 levels. That is, the difference among the values of the currents supplied from the transistors 183 to 185 arises from the design in which the W/L values of the transistors 183 to 185 are set to 1:2:4, and respective ON currents are set to 1: 2:4.

Subsequently, in the current source circuit 420, ON/OFF of the transistors 180 to 182 is selected according to the 3-bit digital video signal. For example, when all the transistors 180 to 182 are turned ON, the current supplied to the signal line corresponds to the sum of the drain currents of the transistors 183 to 185. When only the transistor 180 has been turned ON, only the drain current of the transistor 183 is supplied to the signal line.

As described above, the gate terminals of the transistors 183 to 185 are connected to each other, whereby setting-operation information can be shared. Here, the information is shared among the transistors arranged in the same column, but the present invention is not limited to this. For example, the setting-operation information may be shared also with transistors in a different column. That is, the transistor gate terminals may be connected to the different column transistors in order to use setting-operation information in common.

Thus, the number of current source circuits to be set can be reduced. Consequently, time required for the setting operation can be reduced. In addition, since the number of circuits can be reduced, the layout area can be made small.

FIG. 29 shows the current source circuit 420 a circuit structure of which differs from that in FIG. 8. The current source circuit 420 shown in FIG. 29 has a structure in which switches 191, 192 are arranged instead of the transistors 186 to 188.

Then, in the current source circuit 420 shown in FIG. 29, the operation is the same as that of the current source circuit 420 shown in FIG. 27 except the point in that the current supplied from the reference constant current source (not shown) connected to the current line 190 flows to the capacitor element 189 when the switches 191 and 192 are turned ON. Thus, the explanation is omitted.

Note that the setting operation of the current source circuit is performed with the transistor 182 being in an OFF state. This is for preventing a current leakage. Alternatively, it may be such that a switch 203 is arranged in series with the transistor 182, and the switch 203 is turned OFF during the setting operation and turned ON during the time other than the setting operation. The current source circuit at this time is shown in FIG. 56.

Figure 56:
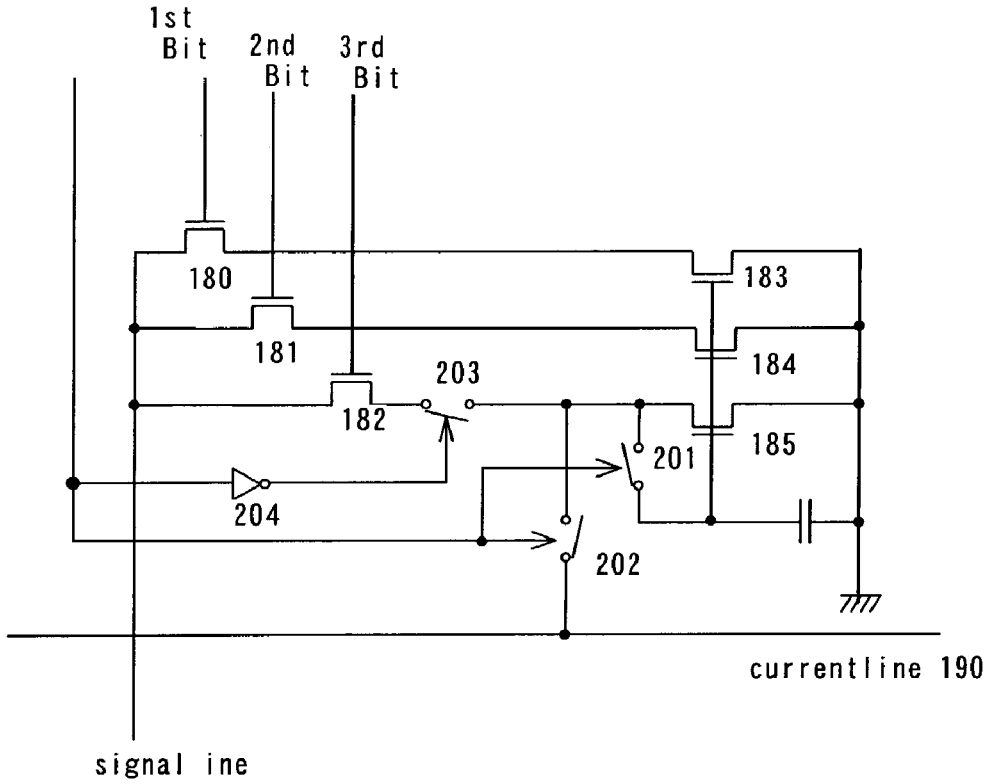
FIG. 56 is a view of a signal line driver circuit.

Note that the transistors of the current source circuit 420 in each of FIG. 8, FIG. 29, and FIG. 56 are all of n-channel type, but the present invention is not limited to this. P-channel transistors may be used in the current source circuit 420. Note that the operation of the current source circuit in the case of using p-channel transistors is the same as the above-described operation except the point in that the direction in which a current flows is changed and the point in that the capacitor element is connected to not Vss but Vdd, and thus, an explanation thereof is omitted here.

Further, the case where Vss is not replaced with Vdd when the current source circuit is structured by using p-channel transistors, that is, the case where the direction in which a current flows does not change, can be applied easily with the comparison between FIG. 23 and FIG. 24. Further, attainment of multi-phase or conduction of dot-sequential drive can be easily realized.

Further, the description is made of the structure and the operation of the signal line diver circuit in the case of performing 3-bit digital gradation display in this embodiment mode. However, the present invention is not limited to 3 bits, and display with an arbitrary number of bits can be performed. Further, this embodiment mode can be arbitrarily combined with Embodiment Modes 1 to 4.

Figure 57:
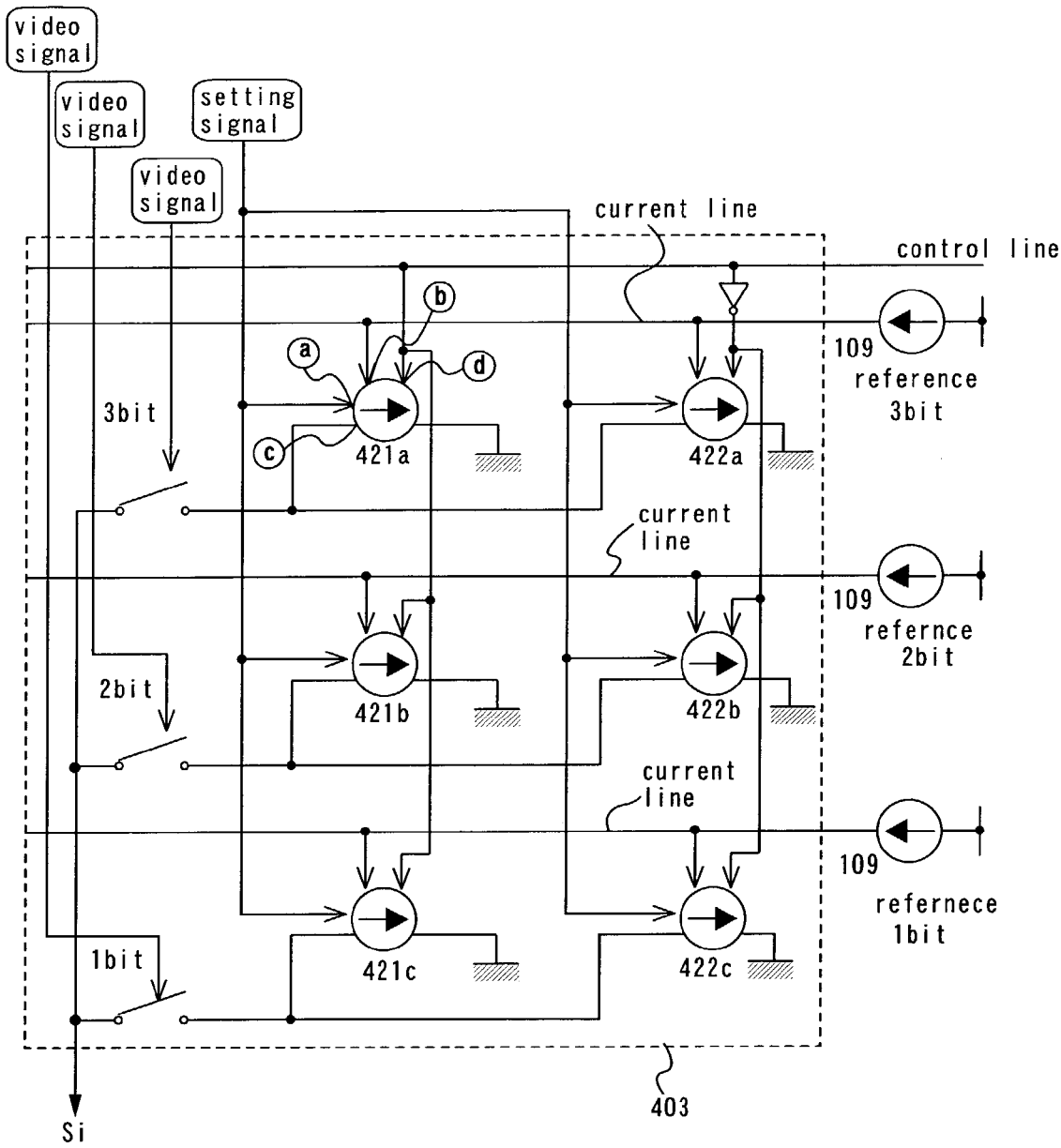
FIG. 57 is a view of a signal line driver circuit.
Figure 58:
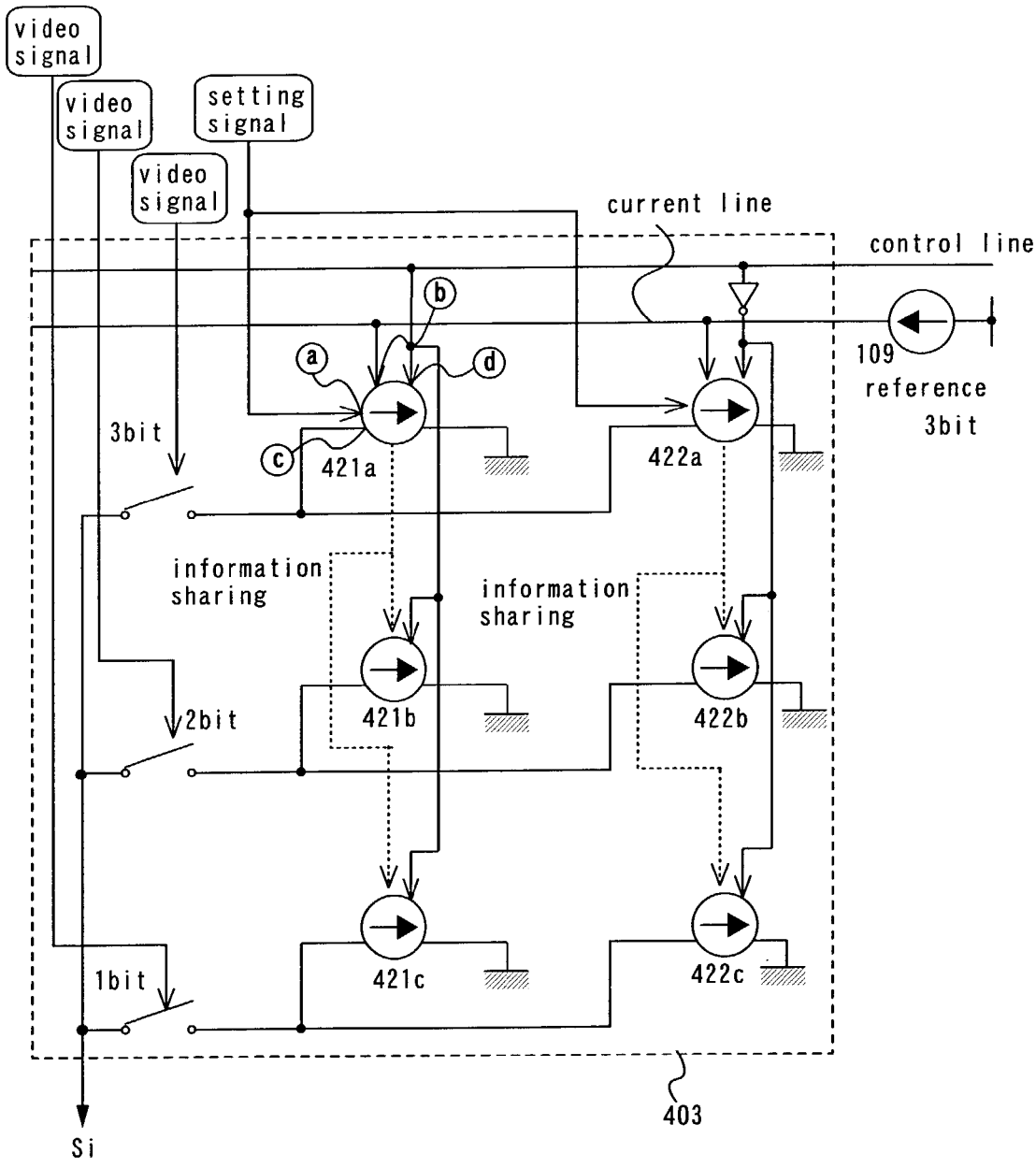
FIG. 58 is a view of a signal line driver circuit.

Note that, in FIG. 27, one current source circuit corresponding to each bit is arranged for one signal line as shown in FIG. 1. However, as shown in FIG. 2, a plurality of current control circuits corresponding to each bit may be arranged for one signal line driver circuit. The diagram at this time is FIG. 57. Note that the structure of FIG. 7 corresponds to the diagram of the case where the structure of FIG. 57 is applied to the structure of FIG. 27. Similarly, in FIG. 54, setting information is shared among a plurality of current source circuits. The diagram at this time is FIG. 58.

Next, the detailed structure of the circuit shown in FIG. 53 is shown in FIG. 59, FIG. 60, FIG. 61, and FIG. 62. In the circuit shown in FIG. 53, a setting control line and logical operators are arranged, and the timing to conduct the setting operation of the current source circuit is controlled by using the setting control line and the logical operators.

Figure 59:
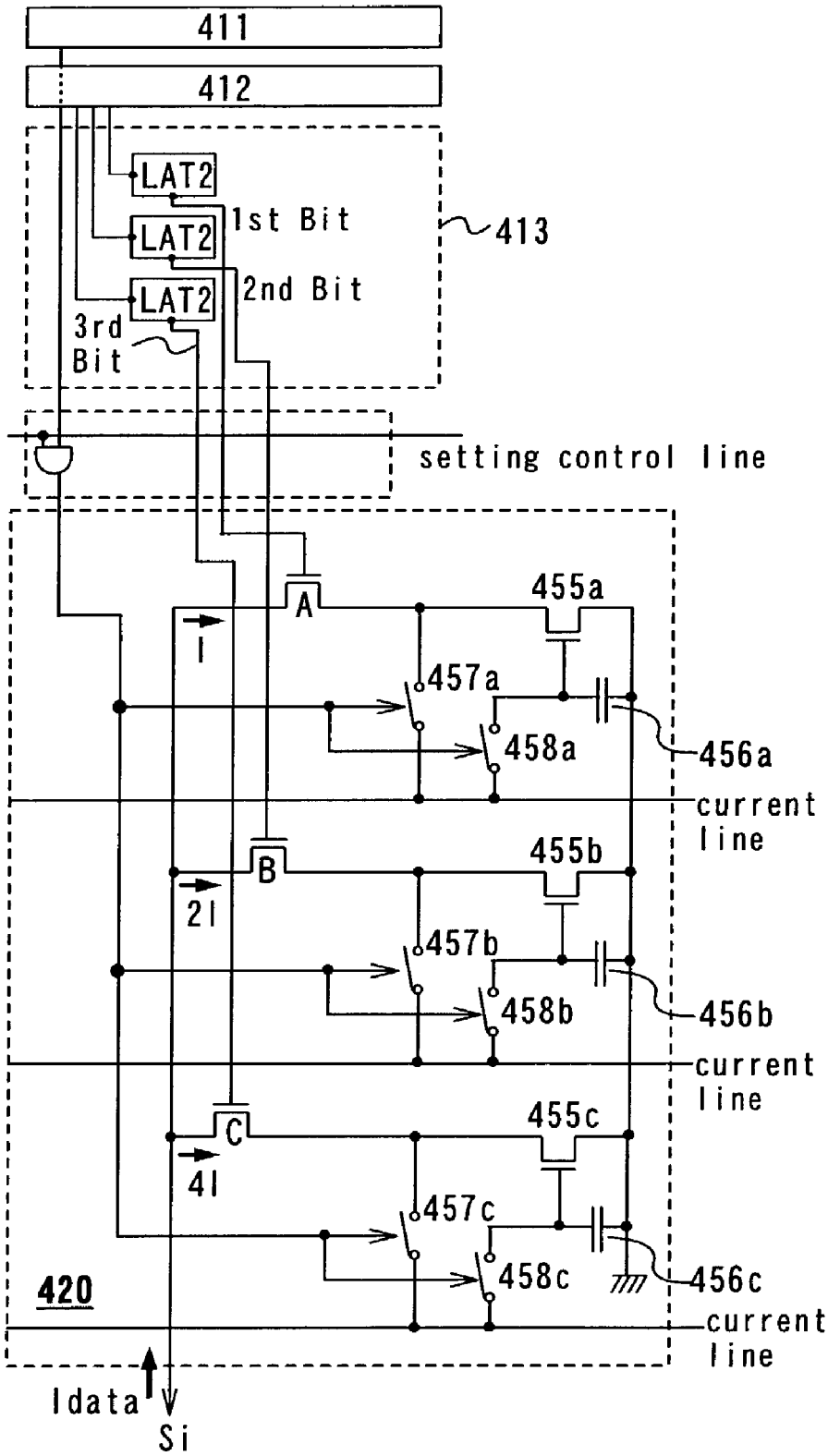
FIG. 59 is a view of a signal line driver circuit.

FIG. 59 is a circuit diagram of the case where: reference constant current sources 109 the number of which is equal to the number of bits are arranged; the constant current circuit shown in FIG. 1 is applied to the signal line driver circuit shown in FIG. 53; and the structure of FIG. 23(A) is used for the current source circuit. In the structure shown in FIG. 59, transistors A to C are turned OFF at the time of the setting operation. This is for preventing a current leakage. Alternatively, it may be such that switches are arranged in series with the transistors A to C and that the switches are turned OFF at the time of the setting operation. FIG. 59 corresponds to FIG. 55 based on the correspondence between the structure of FIG. 27 and the structure of FIG. 53. That is, the structure of FIG. 59 corresponds to FIG. 53, and the structure of FIG. 55 corresponds to FIG. 27.

Figure 60:
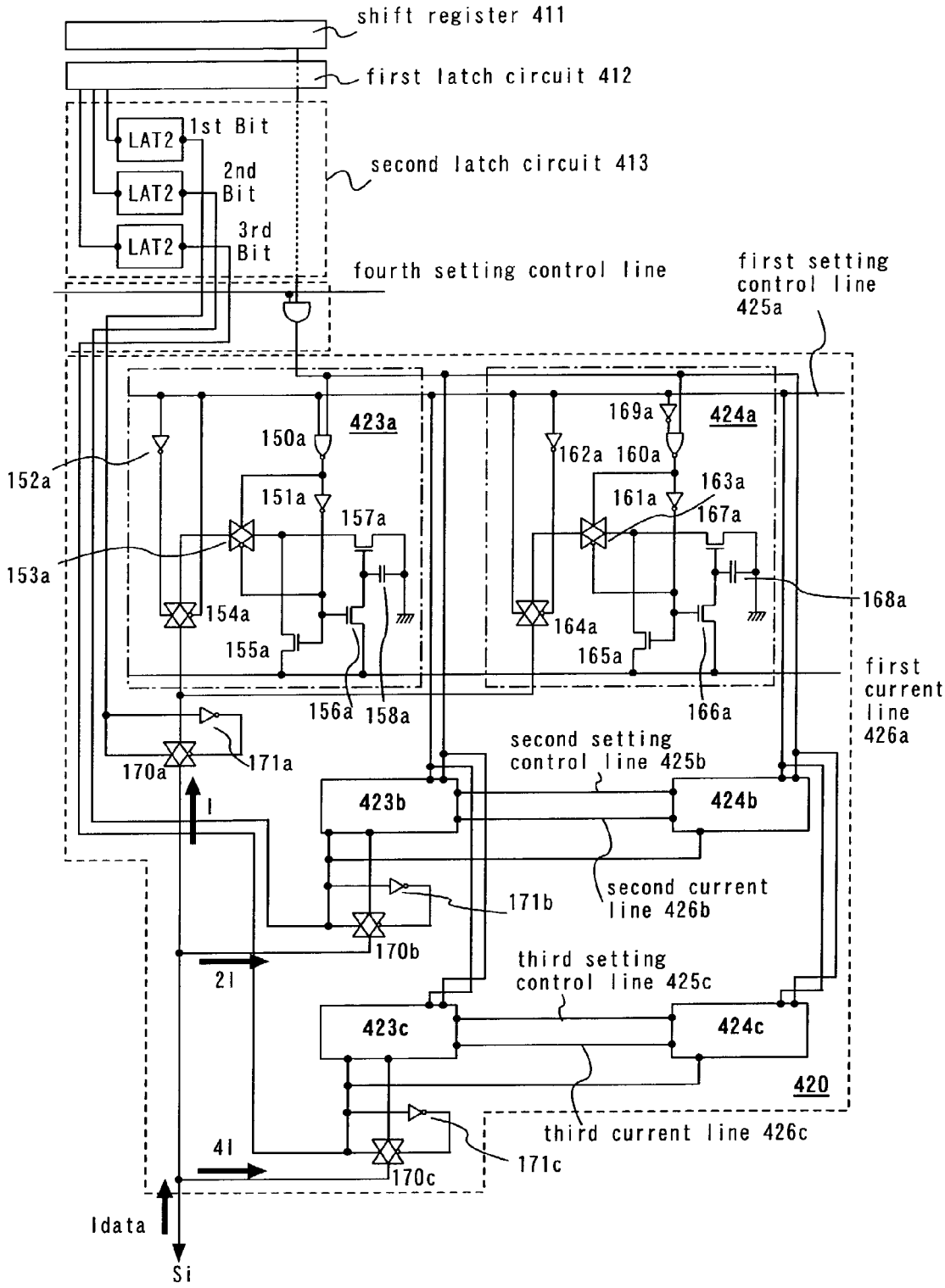
FIG. 60 is a view of a signal line driver circuit.

FIG. 60 is a circuit diagram of the case where: reference constant current sources 109 the number of which is equal to the number of bits are arranged; the constant current circuit shown in FIG. 2 is applied to the signal line driver circuit shown in FIG. 53; and the structure of FIG. 23(A) is used for the current source circuit. FIG. 60 corresponds to FIG. 7 based on the correspondence between the structure of FIG. 27 and the structure of FIG. 53. That is, the structure of FIG. 60 corresponds to FIG. 53, and the structure of FIG. 7 corresponds to FIG. 27.

Figure 61:
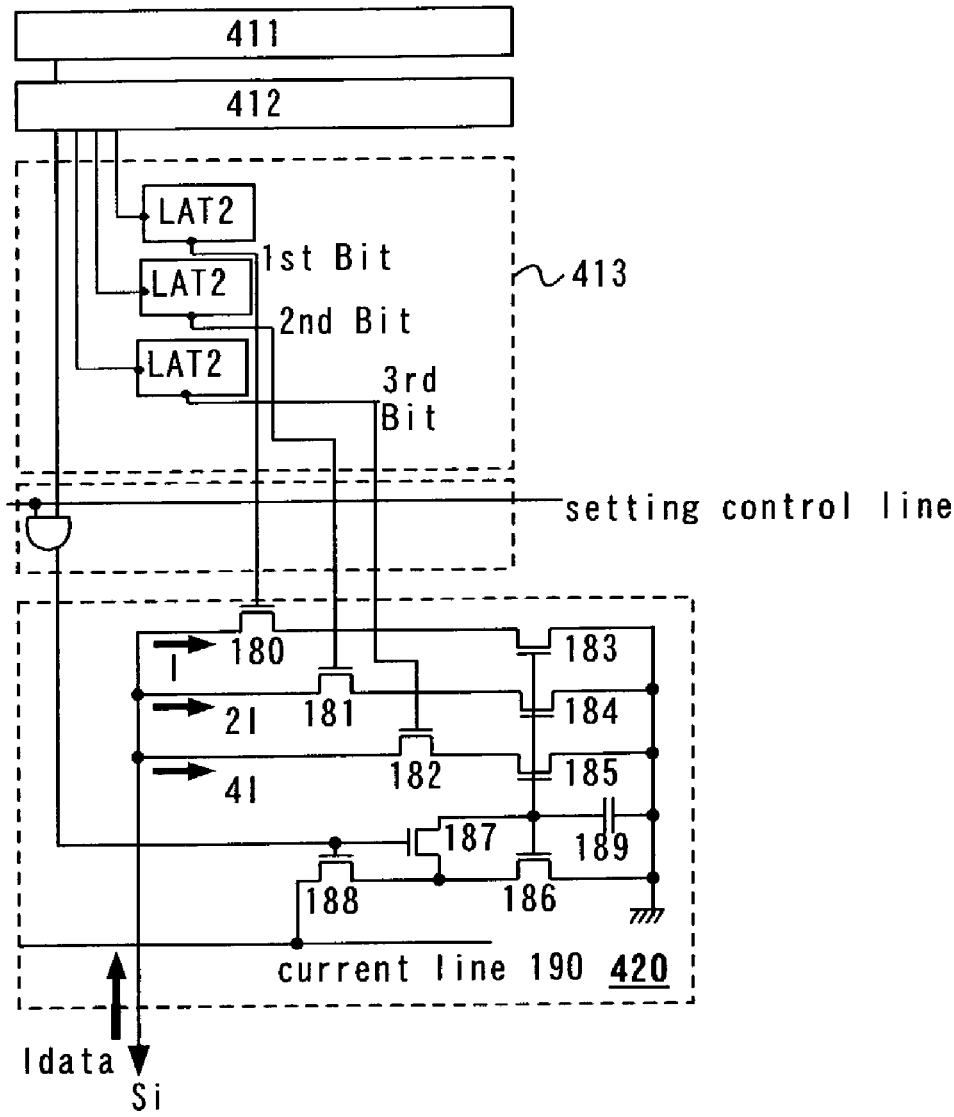
FIG. 61 is a view of a signal line driver circuit.

FIG. 61 is a circuit diagram of the case where: reference constant current sources 109 the number of which is smaller than the number of bits are arranged; information is shared as in the structure shown in FIG. 54 and the constant current circuit shown in FIG. 1 is applied with respect to the signal line driver circuit shown in FIG. 53; and the structure of FIG. 23(C) is used for the current source circuit. FIG. 61 corresponds to FIG. 8 based on the correspondence between the structure of FIG. 27 and the structure of FIG. 54, and the structure of FIG. 53.

Figure 62:
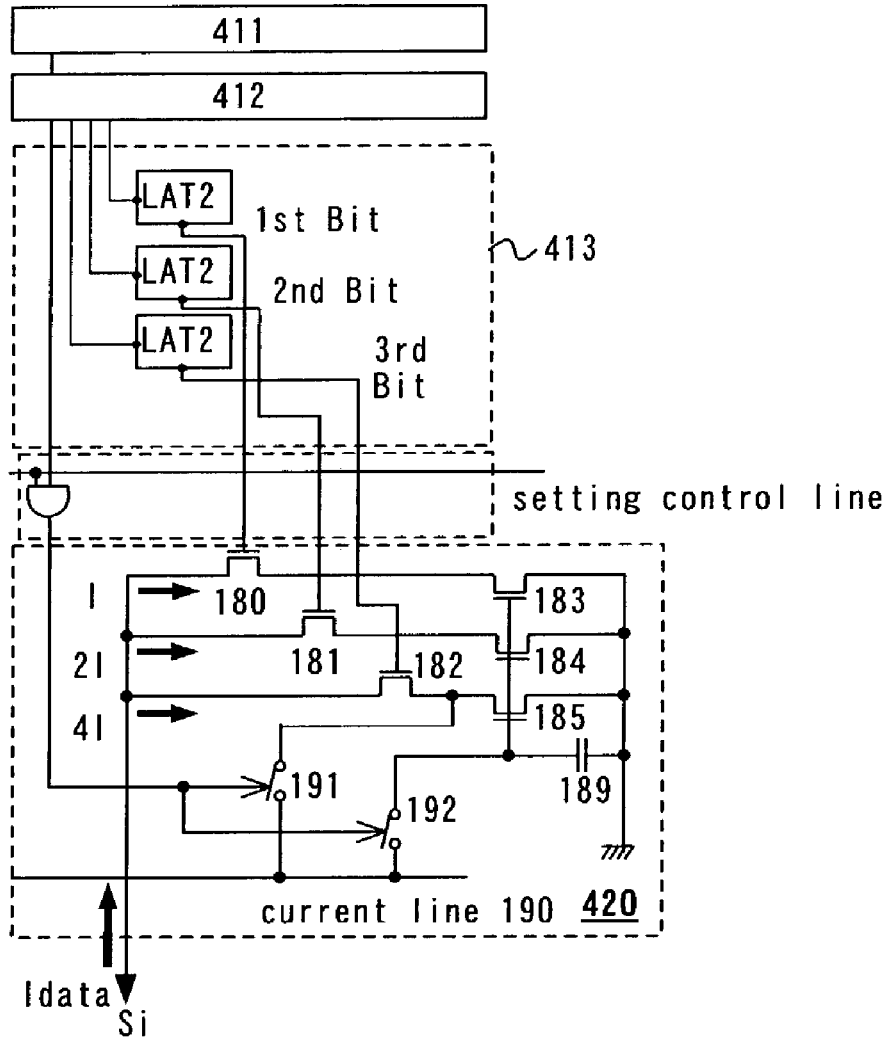
FIG. 62 is a view of a signal line driver circuit.

FIG. 62 is a circuit diagram of the case where: reference constant current sources 109 the number of which is smaller than the number of bits are arranged; information is shared as in the structure shown in FIG. 54 and the constant current circuit shown in FIG. 1 is applied with respect to the signal line driver circuit shown in FIG. 53; and the structure of FIG. 23(A) is used for the current source circuit. FIG. 62 corresponds to FIG. 29 based on the correspondence between the structure of FIG. 27 and the structure of FIG. 54, and the structure of FIG. 53.

Note that logical operators are arranged in each of FIG. 59, FIG. 60, FIG. 61, and FIG. 62, but switches or the like may be used instead of the logical operators. The logical operator only controls a changeover about whether the setting operation of the current source circuit is performed or not, and thus, may use any circuit as long as the circuit capable of performing control for the changeover is adopted. Incidentally, in FIG. 60, whether the setting operation of the current source circuit is performed or not is changed by using a fourth setting control line, and which current source circuit is subjected to the setting operation and which current source circuit is subjected to the input operation are determined by using first to third setting control lines. Further, the setting operation of the current source circuit may be performed not in the order of the first column to the last column but at random. In this case, the circuit such as the decoder circuit shown in FIG. 43 may be used as the shift register 411. Moreover, the circuits shown in FIG. 44, FIG. 45, and FIG. 46 may be used.

Embodiment Mode 6

The reference constant current source 109 for supplying a current to the current source circuit may either be integrally formed with a signal line driver circuit on a substrate or be arranged on the outside of the substrate by using, for example, an IC. When integrally forming the current source circuit on the substrate, it may be formed using any one of the current source circuits shown in, for example, FIGS. 23 to 25, 38, 37, and 40. Alternatively, it may be such that only one transistor is arranged, and the current value is controlled in accordance with a voltage applied to a gate. In this embodiment mode, the structure and the operation of the reference constant current source 109 will be described.

As an example, FIG. 30 shows the simplest case, that is, a case where: the method of applying a voltage to the gate of the transistor to adjust the gate voltage is employed; and three current lines are necessary. If only one current line is required, transistors 1840 and 1850 and the corresponding current lines may be simply eliminated from the structure of FIG. 30. In FIG. 30, the magnitude of a current is controlled by adjusting the gate voltages applied to a transistor 1830 and the transistors 1840 and 1850 from the outside via a terminal f. At this time, when the transistors 1830, 1840, and 1850 are designed with the values of W/L being set to 1:2:4, the respective ON currents are set to 1:2:4.

Next, a description will be made of the case where a current is supplied from the terminal f in FIG. 31(A). As shown FIG. 30, in the case where the gate voltage is applied to perform adjustment, the current value may be varied in accordance with temperature characteristics and the like. However, when the current is input as shown in FIG. 31(A), the influence can be suppressed.

In the structures shown in FIGS. 30 and 31(A), while a current is flowing through the current lines, a voltage or current needs to be kept flowing from the terminal f. However, when a current does not need to be flown through the current lines, a voltage or current does not need to be kept being input from the terminal f.

In addition, as shown in FIG. 31(B), switches and a capacitor device may be added. In this case, even while a current is supplied to the current lines, the supply from the reference IC (a current or voltage that is input from the terminal f) can be terminated, and power consumption is therefore reduced. In the structures shown in FIGS. 30 and 31, information is shared with other current source transistors arranged in the reference constant current source. Specifically, the gate terminals of the transistors 1830, 1840, and 1850 are mutually connected.

Figure 32:
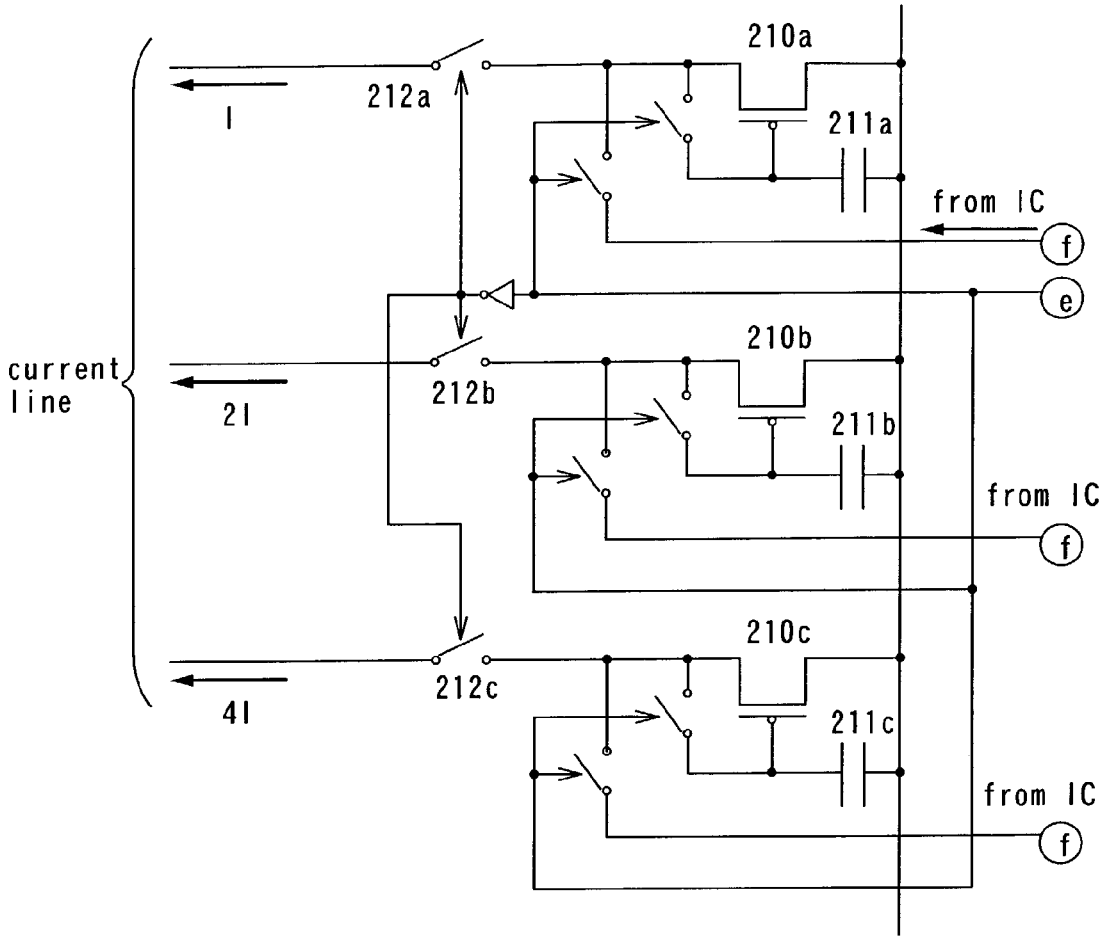
FIG. 32 is a circuit diagram of a reference constant current source.

Then, FIG. 32 shows a case where the setting operation is performed for each current source circuit. In FIG. 27, a current is input from a terminal f, and the timing is controlled by a signal supplied from a terminal e. Note that, any one of the structures shown in, for example, FIGS. 23, 24, 38, 37, and 40 may be applied to the circuit shown in FIG. 27. The circuit shown in FIG. 32 corresponds to an example in which the circuit of FIG. 23(A) is applied. Thus, the setting operation and the input operation cannot be performed simultaneously. Therefore, in the case of this circuit, the setting operation for the reference constant current source needs to be performed with a timing at which a current does not need to be flown through the current line.

Figure 33:
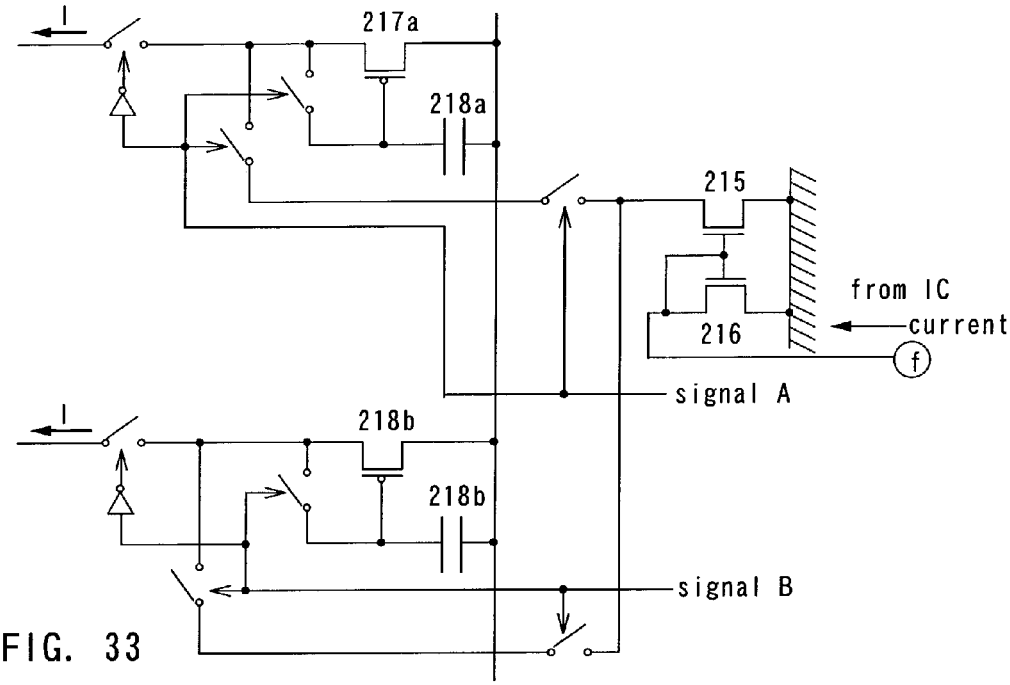
FIG. 33 is circuit diagrams of a reference constant current source.

FIG. 33 shows an example of a polyphased reference constant current source 109. Specifically, the example corresponds to the reference constant current source 109 to which the structure of FIG. 47 is applied. In the polyphased case, circuits of FIGS. 32, 30, and 31 may also be applied. However, since the value of current supplied to the current line is the same, the setting operation is performed for respective current source circuits by using the single current, thereby enabling a reduction in the number of currents that are to be input from the outside.

This embodiment mode may be arbitrarily combined with Embodiment Modes 1 to 5.

Embodiment Mode 7

In the above embodiment modes, primarily, the case where the signal current control switch exists has been described. In this embodiment mode, a description will be made of a case where the signal current control switch is not provided, that is, a case where a current (constant current) disproportional to a video signal is supplied to a wiring different from a signal line. In this case, the switch 101 (signal current control switch) does not need to be arranged.

Note that the case where the signal current control switch does not exist is similar to the case where the signal current control switch exists, except for the absence of the signal current control switch. Thus, the case will be briefly described, and descriptions of the similar portions will be omitted here.

Figure 35:
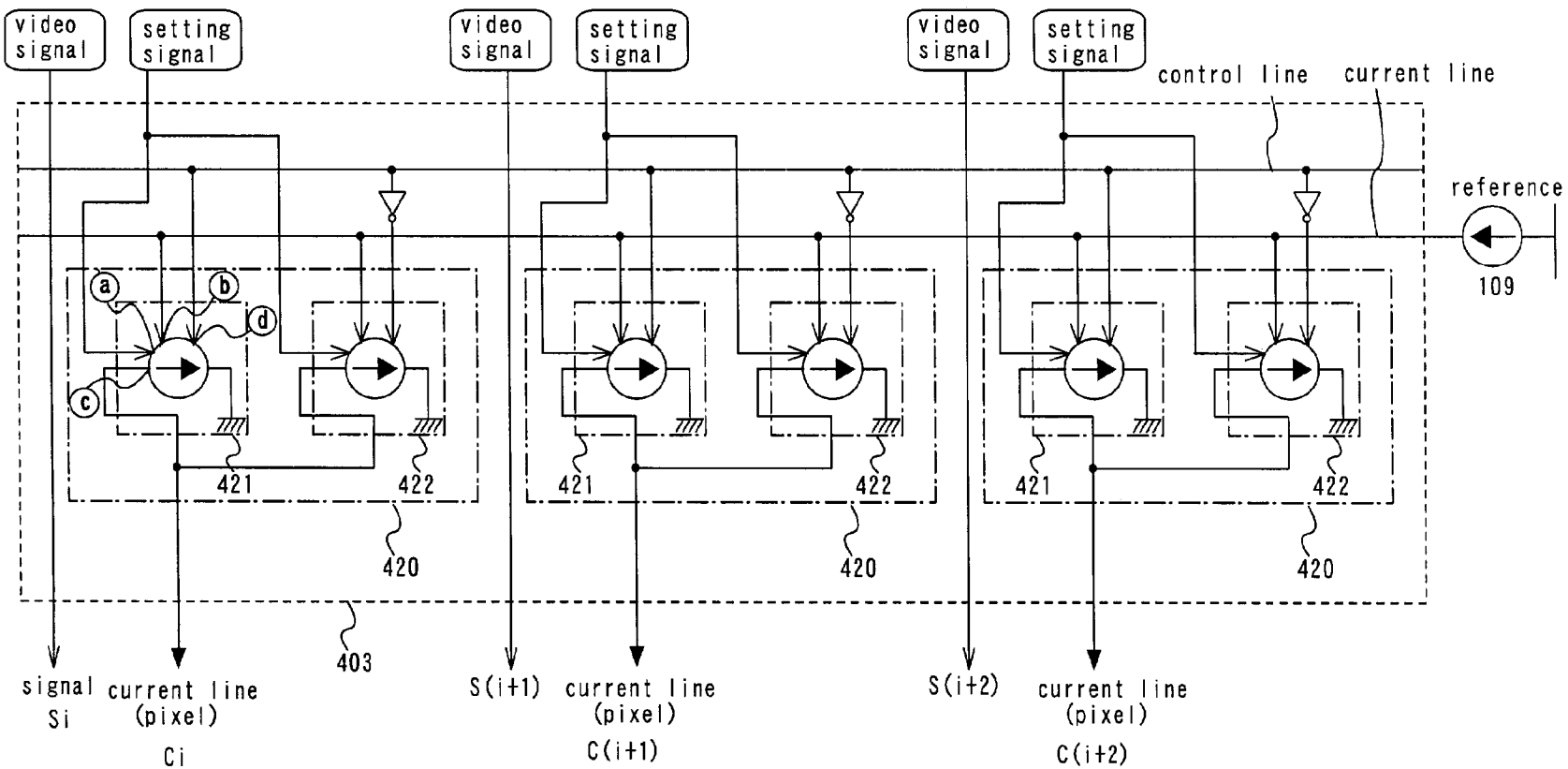
FIG. 35 is a signal line driver circuit.
Figure 63A:
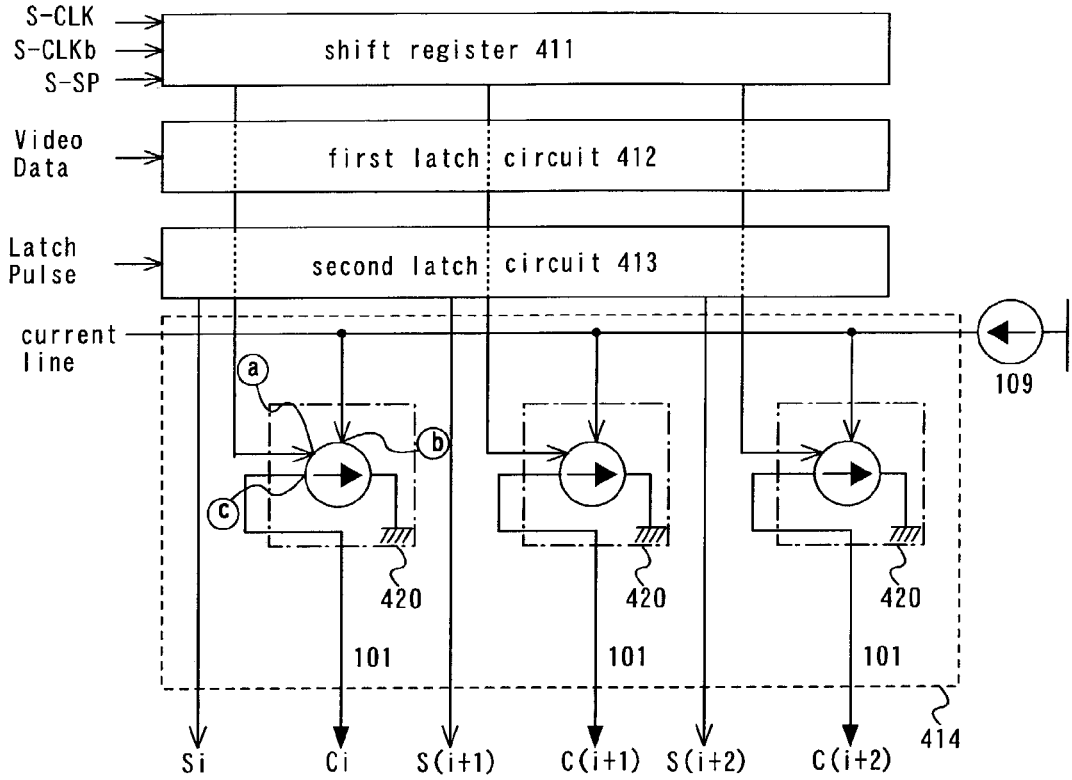
FIG. 63 is a view of a signal line driver circuit.

For comparison between the case where the signal current control switch is arranged and the case where the switch is not arranged, FIG. 34 shows a structure corresponding to FIG. 1, and FIG. 35 shows a structure corresponding to FIG. 2. FIG. 63(A) shows a structure corresponding to FIG. 6(B). According to the embodiment modes described above, the signal current control switch is controlled by the video signal to output the current to the signal line. In this embodiment mode, however, the current is output to a pixel current line, and the video signal is output to the signal line.

Figure 63B:
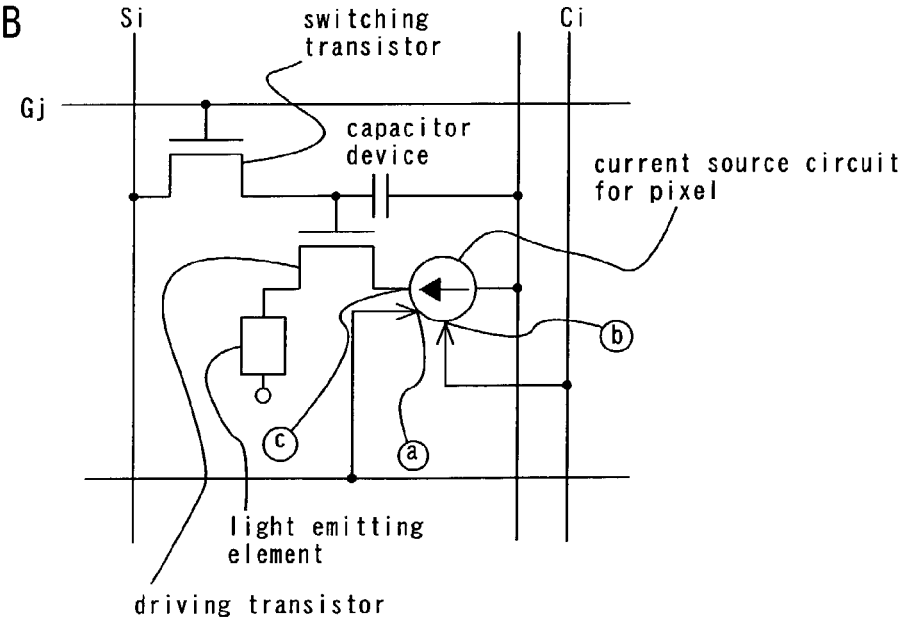

A schematic view of the pixel structure in the above case is shown in FIG. 63(B). Next, a pixel operating method will be briefly described. First, when a switching transistor is ON, a video signal is passed through a signal line, is input to a pixel, and is then stored into a capacitor device. A driving transistor is turned ON or OFF depending on the value of the video signal. On the other hand, a current source circuit has a capability of flowing a constant current. Hence, when the driving transistor is ON, the constant current flows to a light emitting element, and the light emitting element emits light. When the driving transistor is OFF, since no current flows to the light emitting element, the light emitting element does not emit light. In this manner, an image is displayed. In this case, however, only two states, namely, emission and non-emission, can be displayed. Thus, multi-gradation is implemented using, for example, a time gradation method or area gradation method.

Note that, for the portion of the current source circuit, any one of circuits of, for example, FIGS. 23, 24, 37, 38, and 40 is used. The setting operation may be performed to enable the current source circuit to be flown with a constant current. When performing the setting operation for the current source circuit of the pixel, the operation is performed by inputting the current through a pixel current line. The setting operation for the current source circuit of the pixel may be performed an arbitrary number of times at arbitrary time and an arbitrary timing. The setting operation for the current source circuit arranged in the pixel can be performed completely independent of an operation for displaying an image. Preferably, the setting operation is performed when charge stored in the capacitor device provided in the current source circuit leaks.

Figure 64:
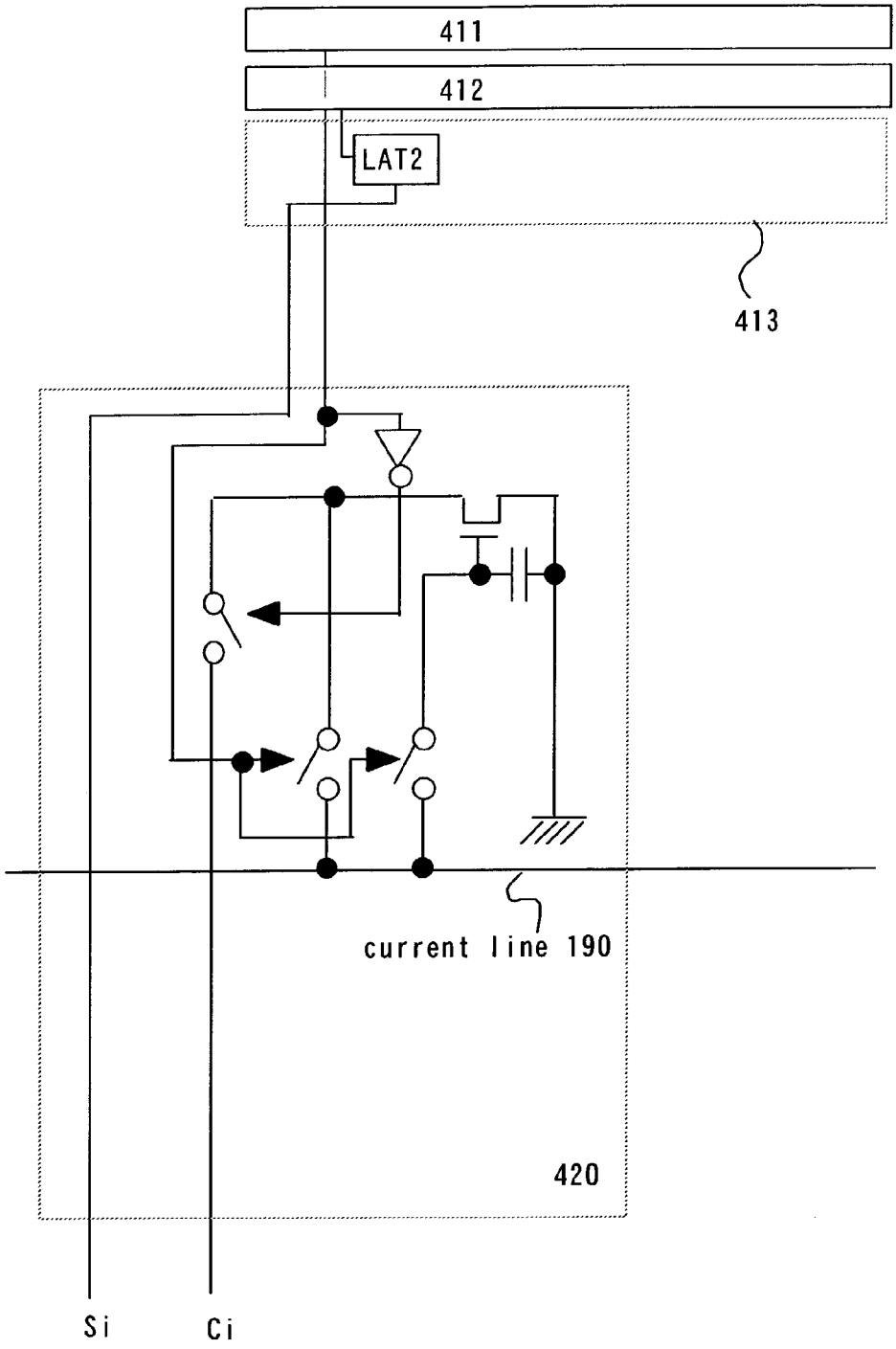
FIG. 64 is a view of a signal line driver circuit.
Figure 65:
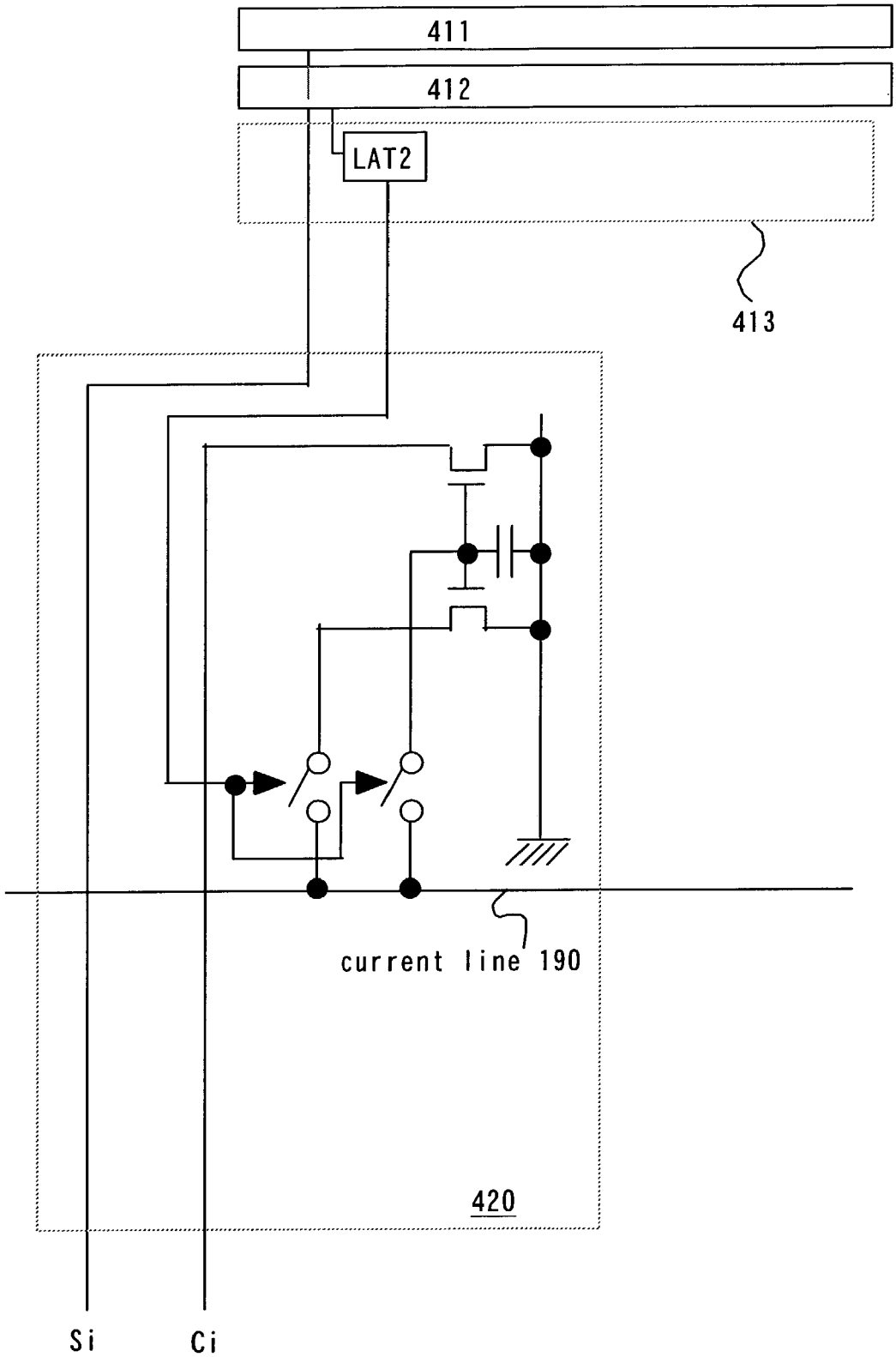
FIG. 65 is a view of a signal line driver circuit.
Figure 66:
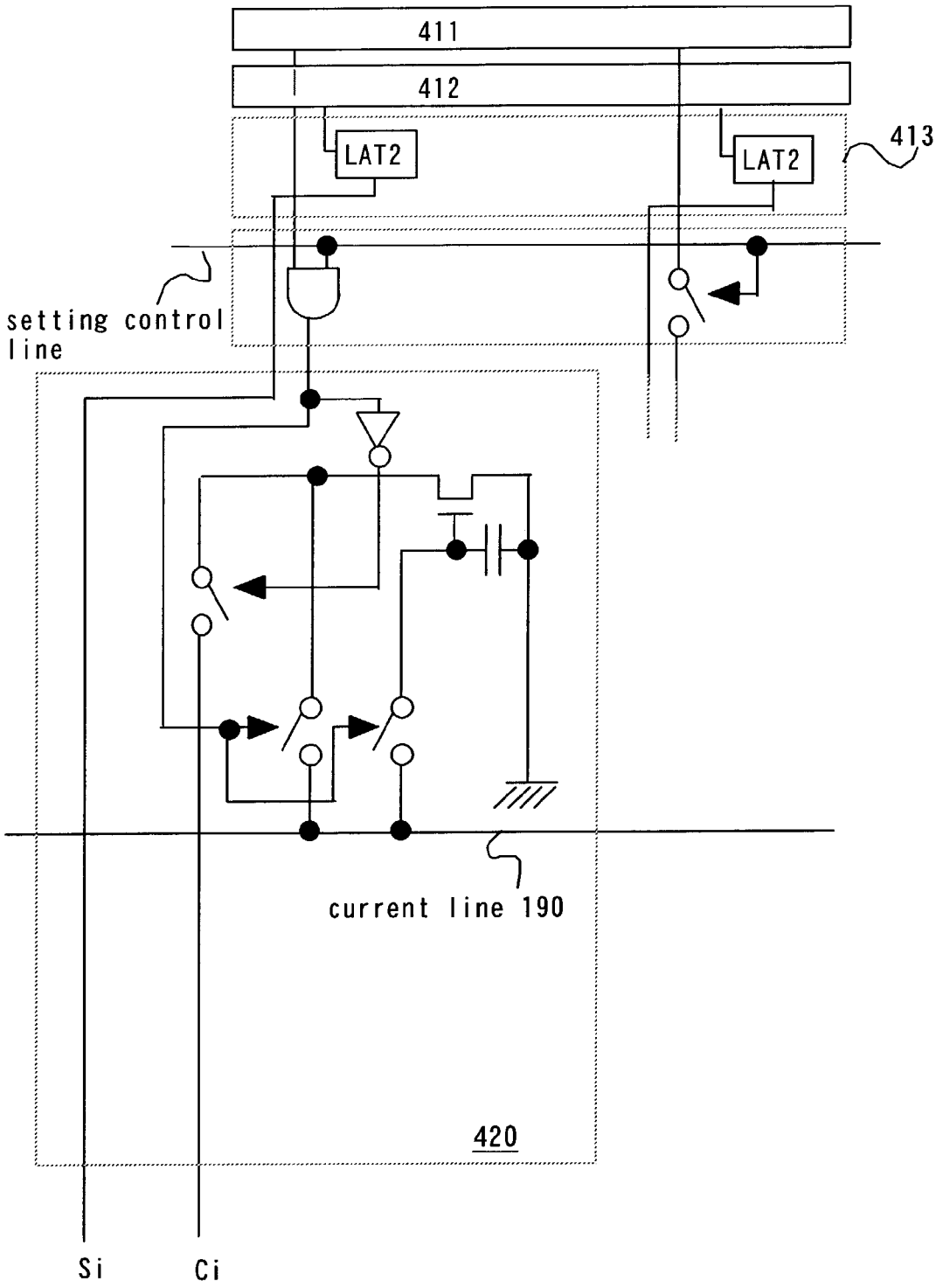
FIG. 66 is a view of a signal line driver circuit.
Figure 67:
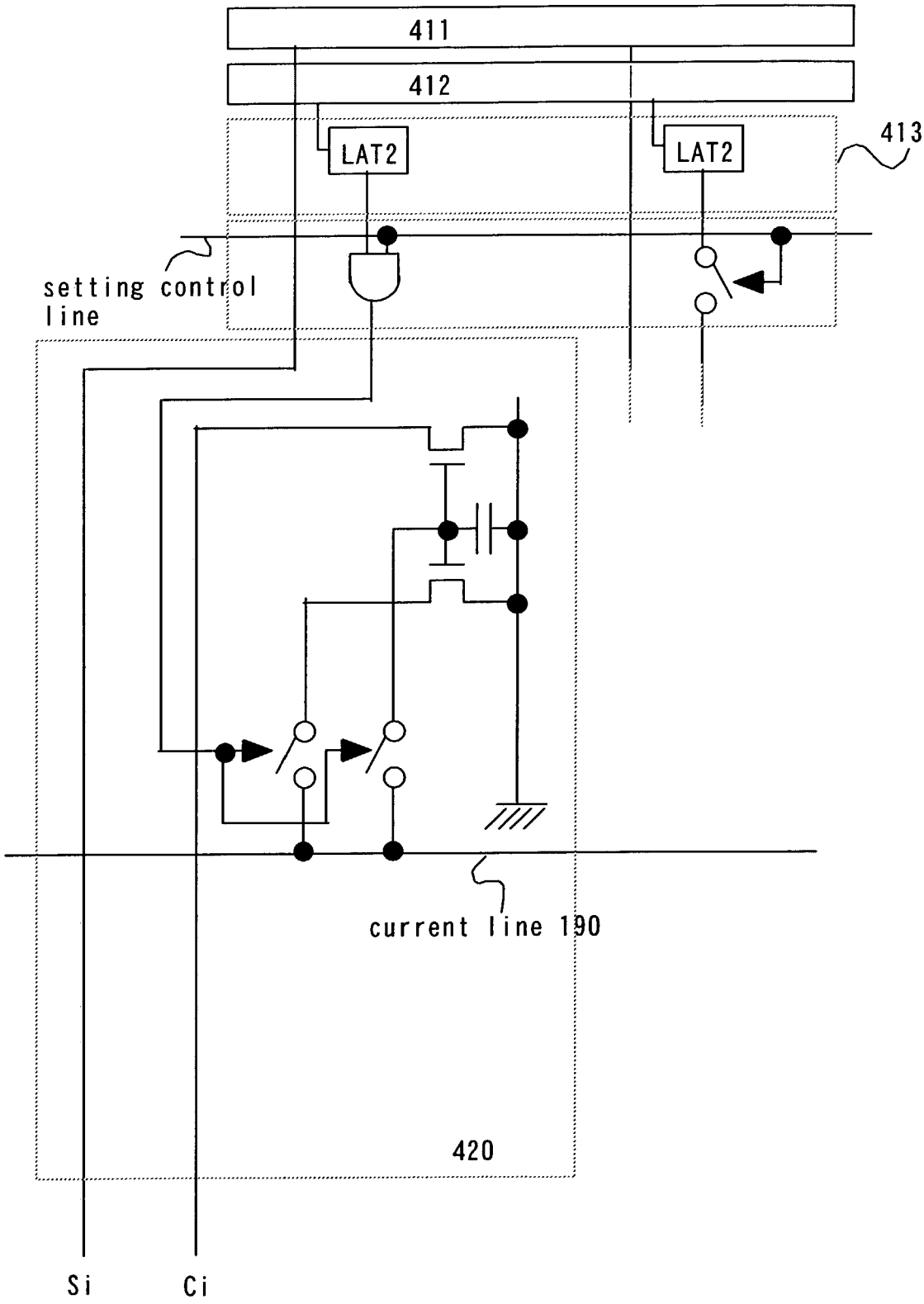
FIG. 67 is a view of a signal line driver circuit.

Next, the detailed structure of a constant current circuit 414 of FIG. 63(A) is shown in FIGS. 64 and 65. Further, the case where a setting control line and a logical operator are arranged to the structure of FIGS. 64 or 65, which enables the control of the timing of performing the setting operation for the current source circuit in the signal line driver circuit, is shown in FIGS. 66 or 67. Shown in each of FIGS. 64 and 66 is the circuit in the case where FIG. 23(A) is applied to the portion of a current source circuit. Shown in each of FIGS. 65 and 67 is the circuit in the case where FIG. 23(E) is applied to the portion of a current source circuit. Note that the logical operator is arranged in FIGS. 66 and 67, but it may be substituted by a switch or the like.

Figure 68:
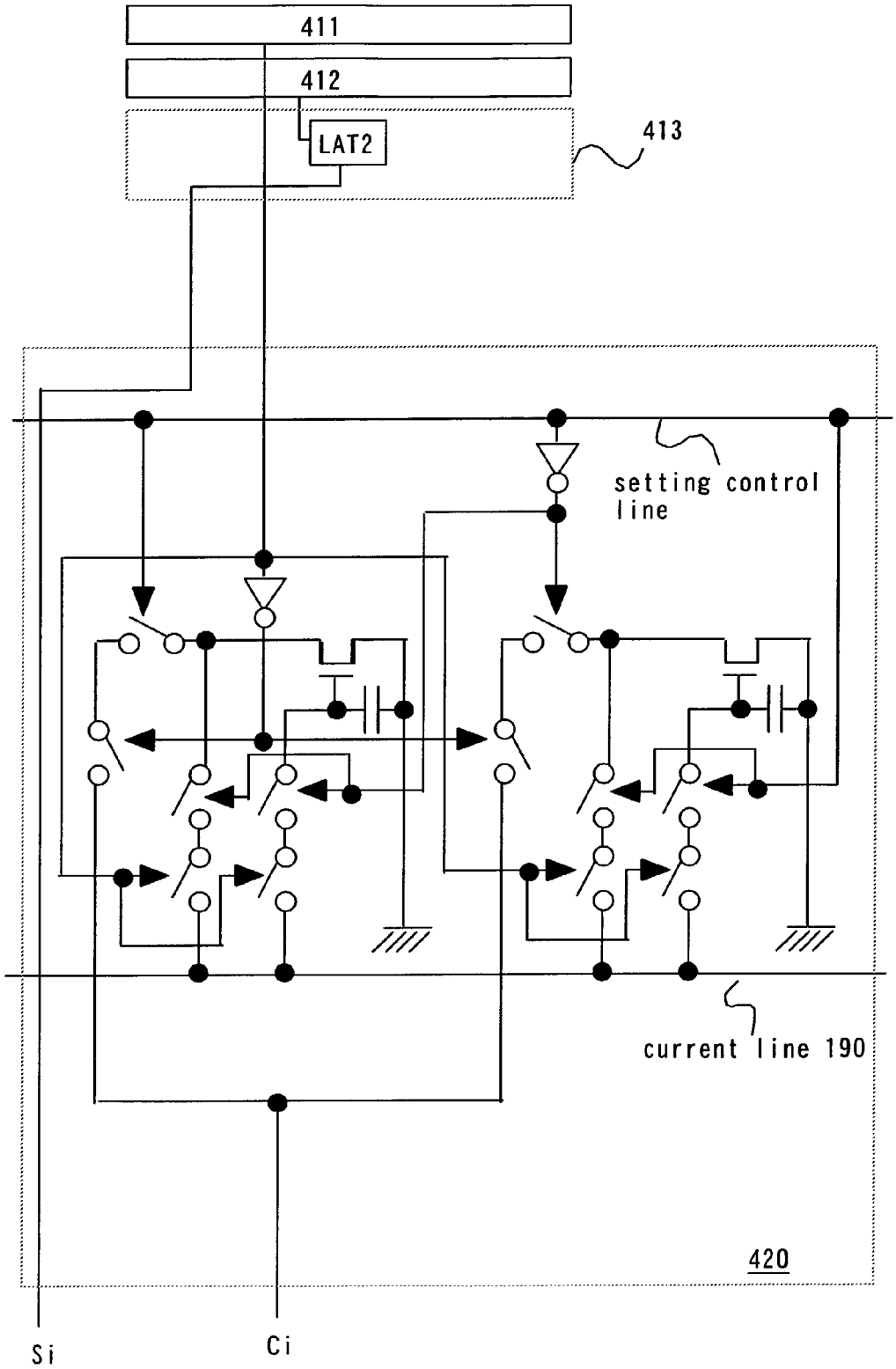
FIG. 68 is a view of a signal line driver circuit.
Figure 69:
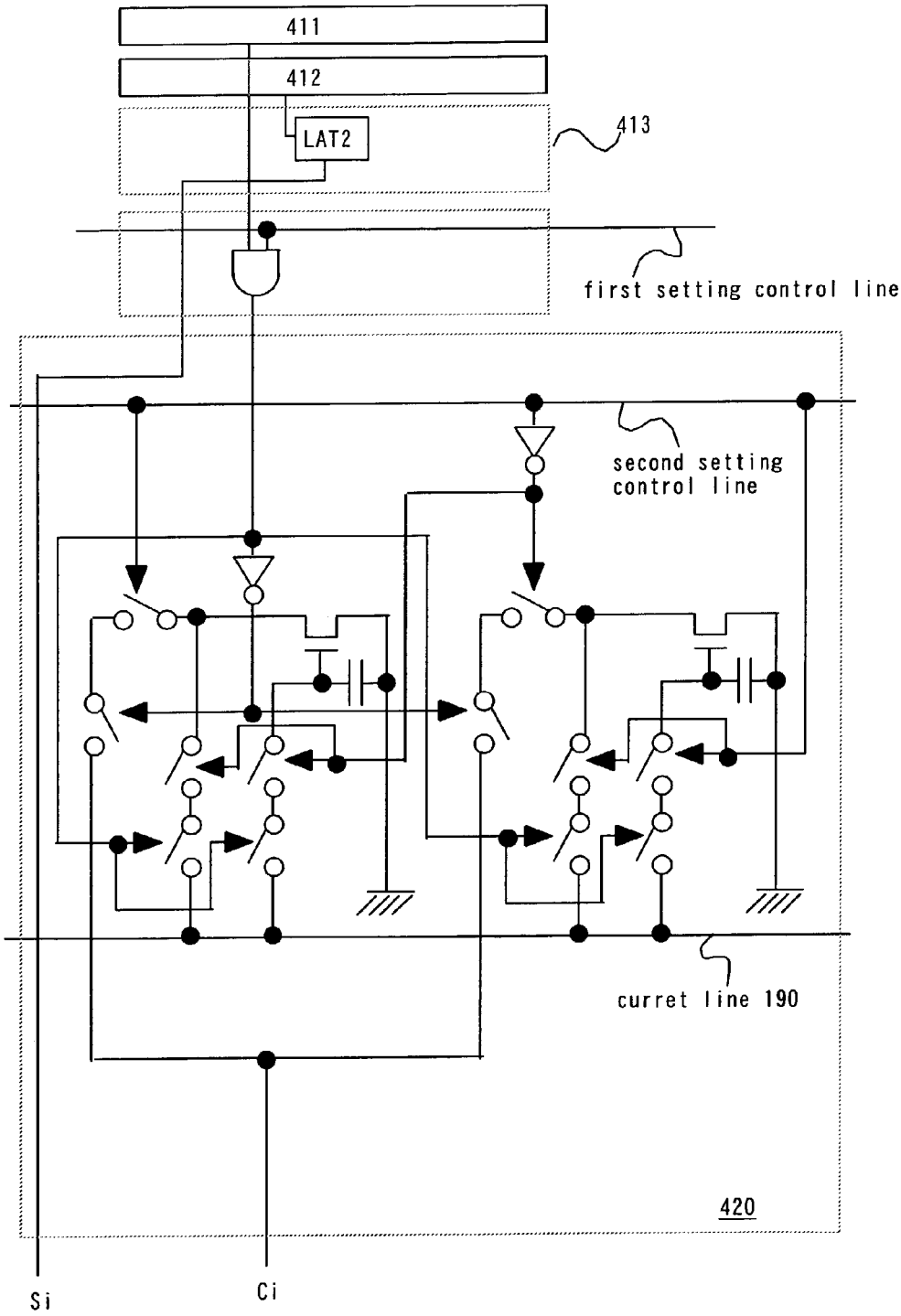
FIG. 69 is a view of a signal line driver circuit.

In addition, a case is considered in which the structure of FIG. 35 is applied to the portion of the current source circuit of FIG. 63(A). The detailed structure of the constant current circuit 414 in the above case is shown in FIG. 68. Further, a case where a setting control line and a logical operator are arranged to the structure of FIG. 68, which enables the control of the timing of performing the setting operation for the current source circuit in the signal line driver circuit is shown in FIG. 69. Here, FIGS. 68 and 69 each show a circuit in the case where FIG. 23(A) is applied to the portion of the current source circuit. In FIG. 68, the setting operation is performed for one of the current sources by controlling the setting control line, and the input operation can be simultaneously performed with the other current source. Similarly, in FIG. 69, the setting operation is performed for one of the current sources by controlling the second setting control line, and the input operation can be simultaneously performed with the other current source. In addition, the timing of performing the setting operation for the current source circuit in the signal line driver circuit can be controlled by controlling the first setting control line.

As described above, the case where the signal current control switch does not exist is similar to the case where the signal current control switch exists, except for the absence of the signal current control switch. Thus, a detailed description thereof will be omitted.

This embodiment mode may be arbitrarily combined with Embodiment Modes 1 to 6.

Embodiment Mode 8

Figure 70A:
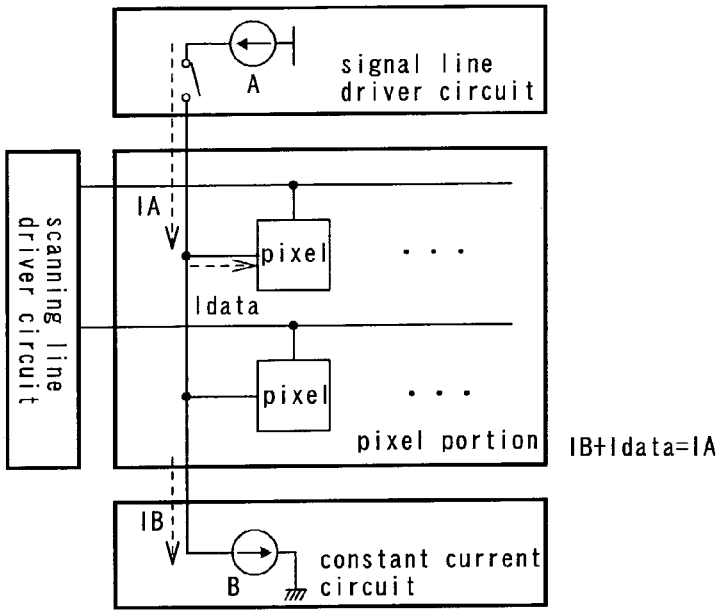
FIG. 70 is a view of a signal line driver circuit.

An embodiment mode of the present invention will be described with reference to FIG. 70. In FIG. 70(A), a signal line driver circuit is arranged above a pixel portion, a constant current circuit is arranged below the pixel portion, a current source A is arranged in the signal line driver circuit, and a current source B is arranged in the constant current circuit. When currents supplied from the current sources A, B are set as IA, IB, and a signal current supplied to a pixel is set as Idata, IA=IB+Idata is established. Then, when a signal current is written into the pixel, it is set such that currents are supplied from both the current sources A, B.

At this time, the setting operation of the current source B is performed by using the current source A. The current obtained by subtracting the current of the current source B from the current of the current source A flows to the pixel. Therefore, the setting operation of the current source B is conducted by using the current source A, whereby various influences such as noise can be made smaller.

Figure 70B:
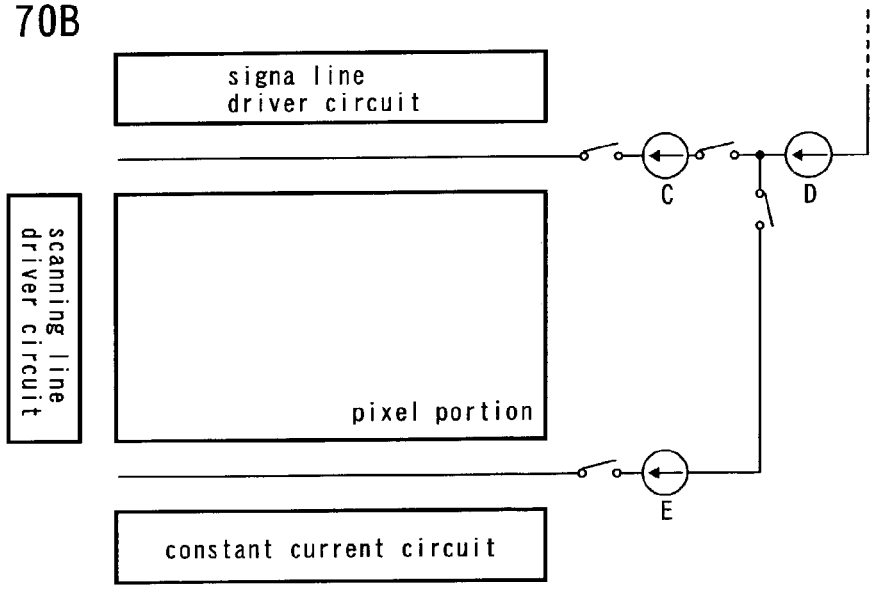

In FIG. 70(B), reference constant current sources (hereinafter referred to as constant current sources) C, E are arranged above and below the pixel portion. The setting operation of the current source circuits arranged in the signal line driver circuit and in the constant current circuit is performed by using the current sources C, E. A current source D corresponds to a current source for setting the current sources C, E, and a reference current is supplied to the current source D from the outside.

Note that, in FIG. 70(B), the constant current circuit arranged in the lower portion may be replaced with a signal line driver circuit. Thus, the signal line driver circuits can be arranged in both the upper and lower portions. The respective signal line driver circuits take charge of control of the upper and lower halves of a screen (the entire pixel portion). As a result, pixels for two lines can be controlled simultaneously. Thus, it becomes possible to take a long time for the setting operation (signal input operation) of the current source of the signal line driver circuit, the pixel, the current source of the pixel, and the like. Therefore, the setting can be made with more accuracy.

This embodiment mode can be arbitrarily combined with Embodiment Modes 1 to 7.

Embodiment 1

Figure 14A:
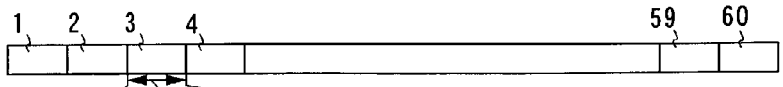
FIG. 14 is explanatory views of a driving method.

In this embodiment, the time gradation method will be described in detail by using FIG. 14. In display devices such as liquid crystal display devices and light emitting devices, a frame frequency is normally about 60 Hz. That is, as shown in FIG. 14(A), screen rendering is performed about 60 times per second. This enables flickers (flickering of a screen) not to be recognized by the human eye. At this time, a period during which screen rendering is performed once is called one frame period.

As an example, in this embodiment, a description will be made of a time gradation method disclosed in the publication as Patent Document 1. In the time gradation method, one frame period is divided into a plurality of subframe periods. In many cases, the number of divisions at this time is identical to the number of gradation bits. For the sake of a simple description, a case where the number of divisions is identical to the number of gradation bits is shown. Specifically, since the 3-bit gradation is employed in this embodiment, an example is shown in which one frame period is divided into three subframe periods SF1 to SF3 (FIG. 14(B)).

Each of the subframe periods includes an address (writing) period Ta and a sustain (light emission) period (Ts). The address period is a period during which a video signal is written to a pixel, and the length thereof is the same among respective subframe periods. The sustain period is a period during which the light emitting element emits light or does not emit light in response to the video signal written in the address period. At this time, the sustain periods Ts1 to Ts3 are set at a length ratio of Ts1:Ts2:Ts3=4:2:1. More specifically, the length ratio of n sustain periods is set to $2^{(n-1)}:2^{(n-2)}:\ldots:2^1:2^0$. Depending on which one of the sustain periods a light emitting element performs emission or non-emission in, the length of the period during which each pixel emits light in one frame period is determined, and the gradation representation is thus performed.

Next, a specific operation of a pixel employing the time gradation method will be described. In this embodiment, a description thereof will be made referring to the pixel shown in FIG. 16(B). A current input method is applied to the pixel shown in FIG. 16(B).

First, the following operation is performed during the address period Ta. A first scanning line 602 and a second scanning line 603 are selected, and TFTs 606 and 607 are turned ON. A current flowing through a signal line 601 at this time is used as a signal current $I_{data}$. Then, when a predetermined charge has been accumulated in a capacitor device 610, selection of the first scanning line 602 and the second scanning line 603 is terminated, and the TFTs 606 and 607 are turned OFF.

Subsequently, the following operation is performed in the sustain period Ts. A third scanning line 604 is selected, and a TFT 609 is turned ON. Since the predetermined charge that has been written is stored in the capacitor device 610, the TFT 608 is already turned ON, and a current identical with the signal current $I_{data}$ flows thereto from a current line 605. Thus, a light emitting element 611 emits light.

Figure 14B:
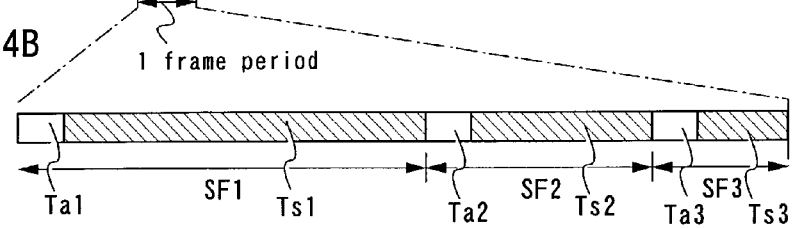
Figure 14C:
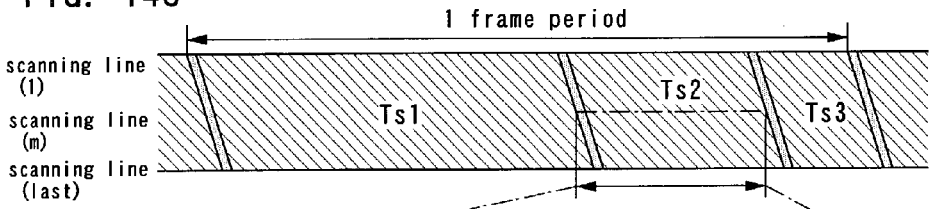

The operations described above are performed in each subframe period, thereby forming one frame period. According to this method, the number of divisions for subframe periods may be increased to increase the number of display gradations. Also, the order of the subframe periods does not necessarily need to be the order from an upper bit to a lower bit as shown in FIGS. 14(B) and 14(C), and the subframe periods may be disposed at random within one frame period. In addition, the order may be variable within each frame period.

Figure 14D:
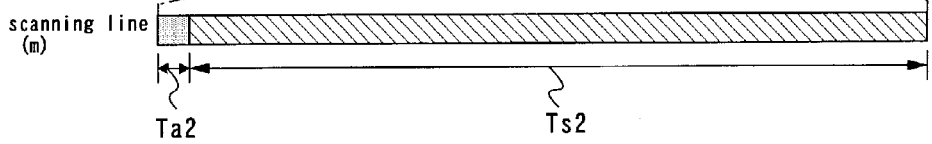

Further, a subframe period SF2 of an m-th scanning line is shown in FIG. 14(D). As shown in FIG. 14(D), in the pixel, upon termination of an address period Ta2, a sustain period Ts2 is immediately started.

Next, the timing of performing the setting operation for the current source circuit in the signal line driver circuit will be described.

Note that it is described in the above embodiment mode that the current source circuit has the method in which a setting operation and an input operation can be simultaneously performed and the method in which these operations cannot be simultaneously performed.

In the former current source circuit capable of simultaneously performing the setting operation and the input operation, the timing of conducting each operation is not particularly limited. This is also the same in the case where a plurality of current source circuits are arranged in one column as shown in FIG. 2, FIG. 54, or the like. However, in the latter current source circuit not capable of simultaneously performing the setting operation and the input operation, the timing of conducting the setting operation needs to be devised. In the case of adopting the time gradation method, the setting operation needs to be performed while the output operation is not performed. For example, in the case of the structure of the driver portion of FIG. 1 and the pixel with the structure of FIG. 16(B), the setting operation needs to be conducted in the period except the address period Ta in any scanning line in a pixel portion. Further, in the case of the structure of the driver portion of FIG. 34 and the pixel with the structure of FIG. 63(B), the setting operation of the current source circuit arranged in the driver portion needs to be conducted in the period during which the setting operation is not conducted for the current source circuit arranged in the pixel.

Note that, at this time, a frequency of a shift register that controls the current source circuit may be set at a low speed in some cases. Thus, the setting operation of the current source circuit can be performed for an enough time with accuracy.

Alternatively, the setting operation of the current source circuit may be performed at random by using the circuit shown in FIG. 43 or the like as the circuit (shift register) for controlling the current source circuit. Further, the circuits of FIG. 44, FIG. 45, FIG. 46, and the like may also be used. Then, even if the periods during which the setting operation can be performed are dotted about one frame, the periods are effectively utilized, thereby being capable of performing the setting operation. Further, it may be such that the setting operation for all the current source circuits is not conducted in one frame period but conducted in several frame periods or more. From the above, the setting operation of the current source circuit can be performed for an enough time with accuracy.

Figure 16A:
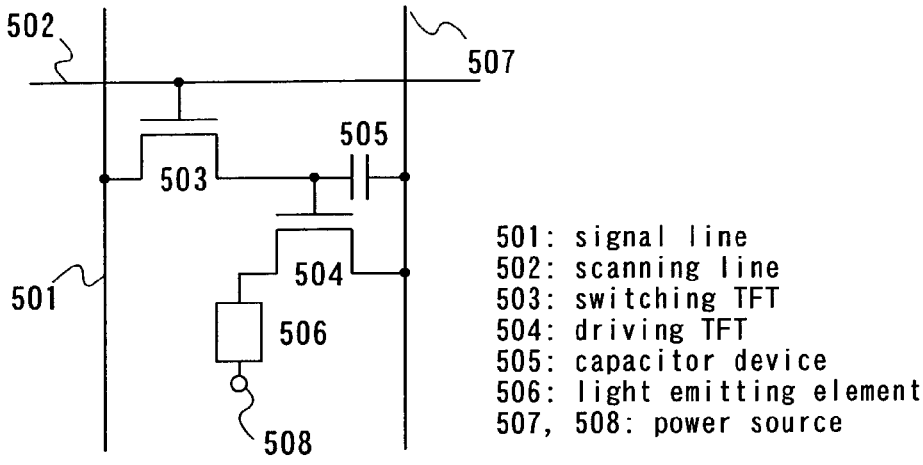
FIG. 16 is circuit diagrams of pixels of a light emitting device.
Figure 16B:
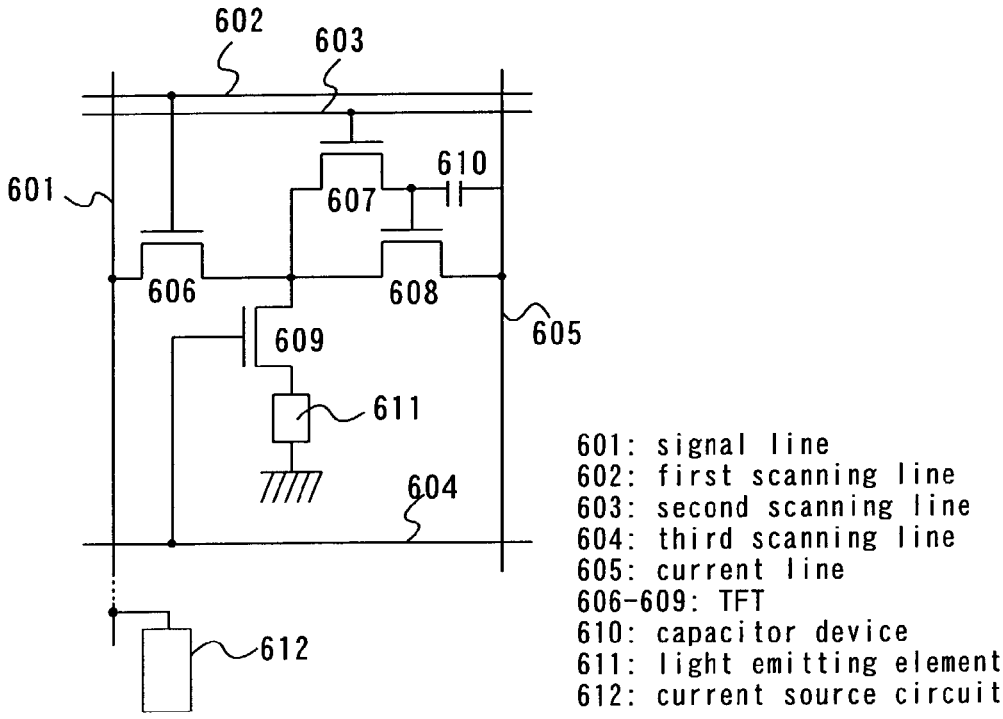
Figure 17A:
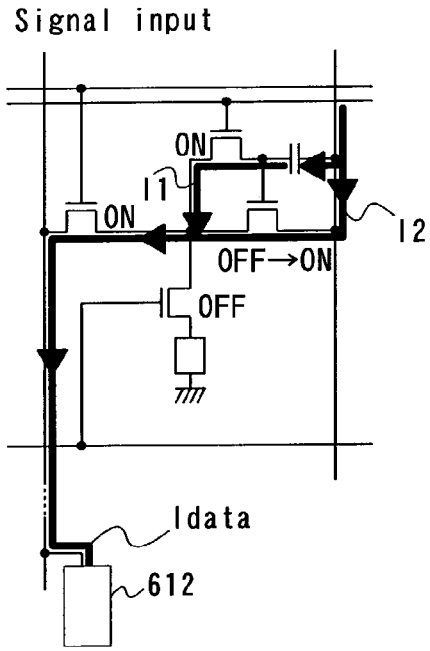
FIG. 17 is explanatory views of operations of a pixel of the light emitting device.
Figure 17B:
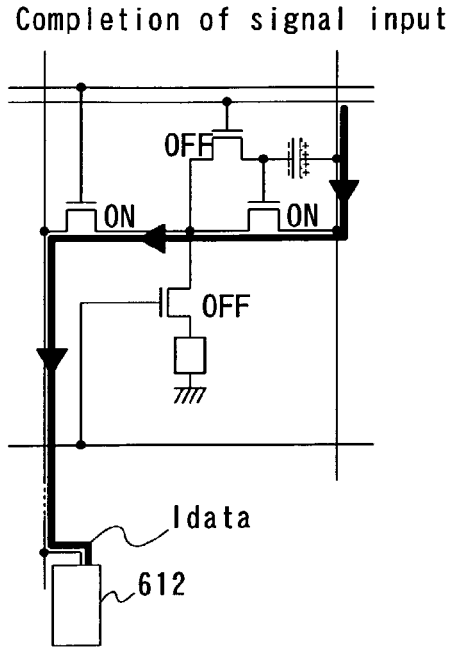
Figure 17C:
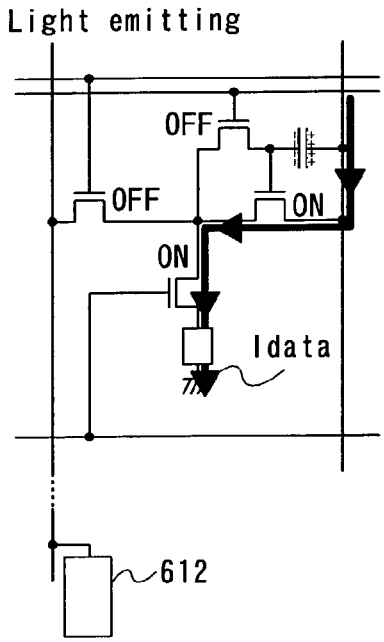
Figure 17D:
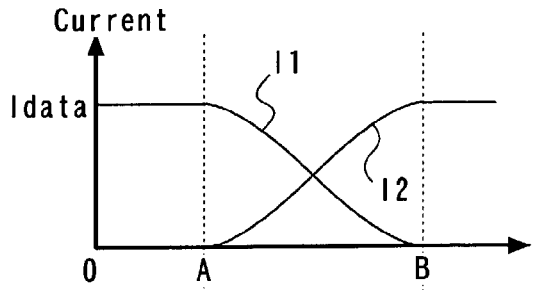
Figure 17E:
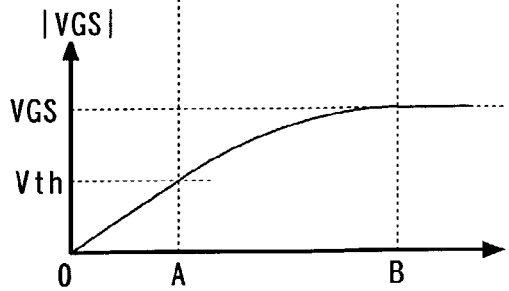
Figure 18A:
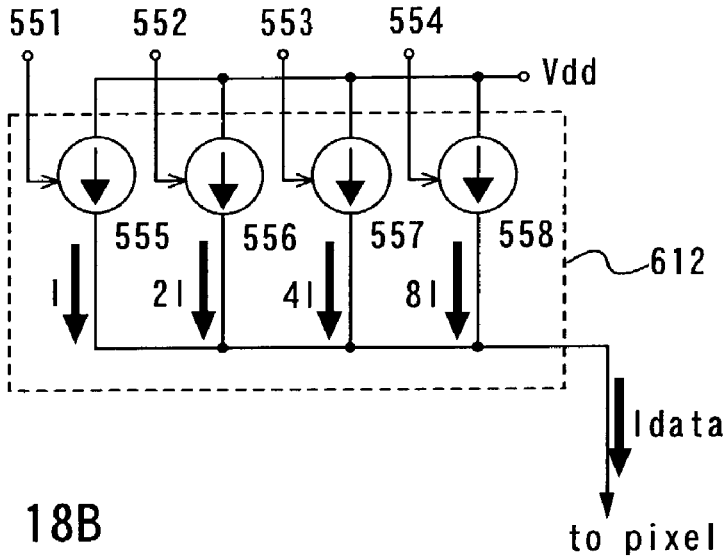
FIG. 18 is views of a current source circuit.
Figure 18B:
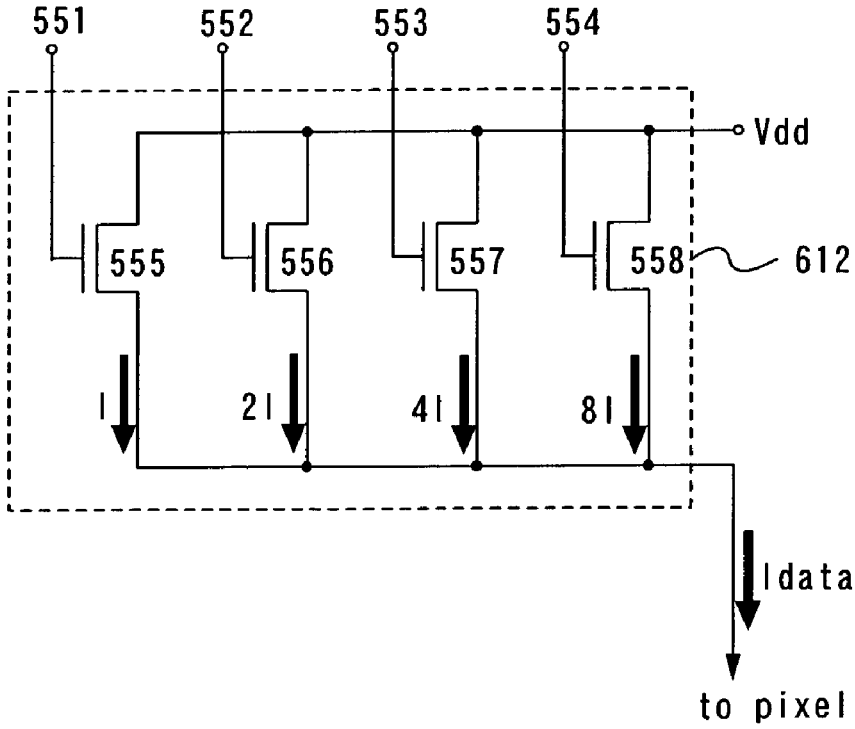

Note that in the case of the structure of the driver portion of FIG. 1 and the pixel with the structure of FIG. 16(B), the input operation may be conducted in the period during which the scanning line in the pixel portion is selected (address period Ta). Further, in the case of the structure of the driver portion of FIG. 1 and the pixel with the structure of FIG. 63(B), the setting operation of the current source circuit arranged in the driver portion may be conducted in the period during which the setting operation is not conducted for the current source circuit arranged in the pixel.

This embodiment can be arbitrarily combined with Embodiment Modes 1 to 8.

Embodiment 2

In this embodiment, example structures of pixel circuits provided in the pixel portion will be described with reference to FIGS. 13 and 71.

Note that the present invention may be applied to a pixel of any structure as long as the structure includes a current input portion.

Figure 13A:
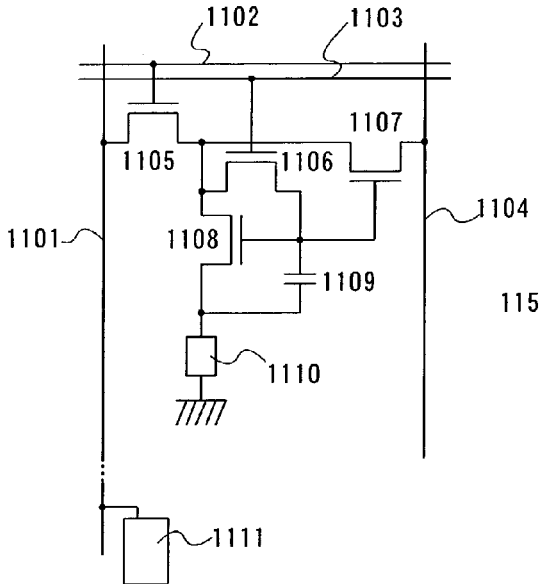
FIG. 13 is circuit diagrams of pixels of a light emitting device.

A pixel shown in FIG. 13(A) includes a signal line 1101, first and second scanning lines 1102 and 1103, a current line (power supply line) 1104, a switching TFT 1105, a holding TFT 1106, a driving TFT 1107, a conversion driving TFT 1108, a capacitor device 1109, and a light emitting element 1110. The signal line 1101 is connected to a current source circuit 1111.

Note that the current source circuit 1111 corresponds to the current source circuit 420 arranged in the signal line driver circuit 403.

In the pixel of FIG. 13(A), the gate electrode of the switching TFT 1105 is connected to the first scanning line 1102, a first electrode thereof is connected to the signal line 1101, and a second electrode thereof is connected to a first electrode of the driving TFT 1107 and a first electrode of the conversion driving TFT 1108. The gate electrode of the holding TFT 1106 is connected to the second scanning line 1103, a first electrode thereof is connected to the signal line 1102, and a second electrode thereof is connected to the gate electrode of the driving TFT 1107 and the gate electrode of the conversion driving TFT 1108. A second electrode of the driving TFT 1107 is connected to the current line (power supply line) 1104, and a second electrode of the conversion driving TFT 1108 is connected to one of the electrodes of the light emitting element 1110. The capacitor device 1109 is connected between the gate electrode of the conversion driving TFT 1108 and a second electrode thereof, and retains a gate-source voltage of the conversion driving TFT 1108. The current line (power supply line) 1104 and the other electrode of the light emitting element 1110 are respectively input with predetermined potentials and have mutually different potentials.

Note that the pixel of FIG. 13(A) corresponds to the case where a circuit of FIG. 38(B) is applied to a pixel. However, since the current-flow direction is different, the transistor polarity is opposite. The driving TFT 1107 of FIG. 13(A) corresponds to a TFT 126 of FIG. 38(B), the conversion driving TFT 1108 of FIG. 13(A) corresponds to a TFT 122 of FIG. 38(B), and the holding TFT 1106 of FIG. 13(A) corresponds to the TFT 124 of FIG. 38(B).

Figure 13B:
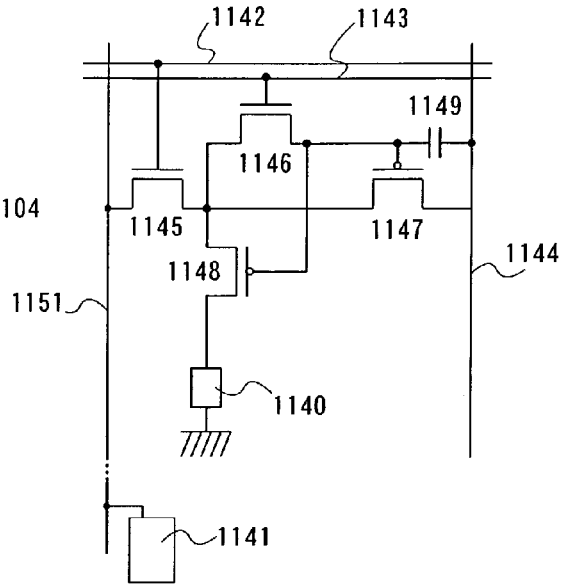

A pixel shown in FIG. 13(B) includes a signal line 1151, first and second scanning lines 1142 and 1143, a current line (power supply line) 1144, a switching TFT 1145, a holding TFT 1146, a conversion driving TFT 1147, a driving TFT 1148, a capacitor device 1149, and a light emitting element 1140. The signal line 1151 is connected to a current source circuit 1141.

Note that the current source circuit 1141 corresponds to the current source circuit 420 arranged in the signal line driver circuit 403.

In the pixel of FIG. 13(B), the gate electrode of the switching TFT 1145 is connected to the first scanning line 1142, a first electrode thereof is connected to the signal line 1151, and a second electrode thereof is connected to a first electrode of the driving TFT 1148 and a first electrode of the conversion driving TFT 1148. The gate electrode of the holding TFT 1146 is connected to the second scanning line 1143, a first electrode thereof is connected to the first electrode of the driver TFT 1148, and a second electrode thereof is connected to the gate electrode of the driving TFT 1148 and the gate electrode of the conversion driving TFT 1147. A second electrode of the conversion driving TFT 1147 is connected to the current line (power supply line) 1144, and a second electrode of the conversion driving TFT 1147 is connected to one of the electrodes of the light emitting element 1140. The capacitor device 1149 is connected between the gate electrode of the conversion driving TFT 1147 and a second electrode thereof, and retains a gate-source voltage of the conversion driving TFT 1147. The current line (power supply line) 1144 and the other electrode of the light emitting element 1140 are respectively input with predetermined potentials and have mutually different potentials.

Note that the pixel of FIG. 13(B) corresponds to the case where a circuit of FIG. 6(B) is applied to a pixel. However, since the current-flow direction is different, the transistor polarity is opposite. The conversion driving TFT 1147 of FIG. 13(B) corresponds to a TFT 122 of FIG. 6(B), the driving TFT 1148 of FIG. 13(B) corresponds to a TFT 126 of FIG. 6(B), and the holding TFT 1146 of FIG. 13(B) corresponds to the TFT 124 of FIG. 6(B).

Figure 13C:
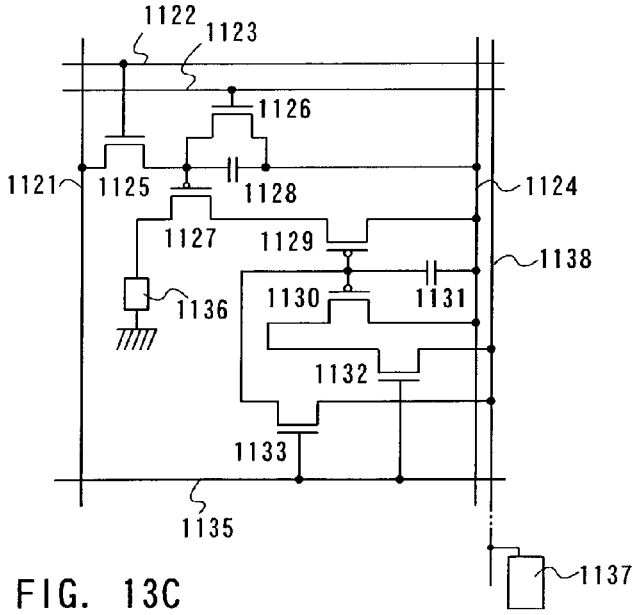

A pixel shown in FIG. 13(C) includes a signal line 1121, a first scanning line 1122, a second scanning line 1123, a third scanning line 1135, a current line (power supply line) 1124, a switching TFT 1125, a pixel current line 1138, an erasing TFT 1126, a driving TFT 1127, a capacitor device 1128, a current-supply TFT 1129, a mirror TFT 1130, a capacitor device 1131, a current-input TFT 1132, a holding TFT 1133, and a light emitting element 1136. The pixel current line 1138 is connected to a current source circuit 1137.

In the pixel of FIG. 13(C), the gate electrode of the switching TFT 1125 is connected to the first scanning line 1122, a first electrode of the switching TFT 1125 is connected to the signal line 1121, and a second electrode of the switching TFT 1125 is connected to the gate electrode of the driving TFT 1127 and a first electrode of the erasing TFT 1126. The gate electrode of the erasing TFT 1126 is connected to the second scanning line 1123, and a second electrode of the erasing TFT 1126 is connected to the current line (power supply line) 1124. A first electrode of the driving TFT 1127 is connected to one of the electrodes of the light emitting element 1136, and a second electrode of the driving TFT 1127 is connected to a first electrode of the current-supply TFT 1129. A second electrode of the current-supply TFT 1129 is connected to the current line 1124. One of the electrodes of the capacitor device 1131 is connected to the gate electrode of the current-supply TFT 1129 and the gate electrode of the mirror TFT 1130 and the other electrode thereof is connected to the current line (power supply line) 1124. A first electrode of the mirror TFT 1130 is connected to the current line 1124, and a second electrode of the mirror TFT 1130 is connected to a first electrode of the current-input TFT 1132. A second electrode of the current-input TFT 1132 is connected to the current line (power supply line) 1124, and the gate electrode of the current-input TFT 1132 is connected to the third scanning line 1135. The gate electrode of the current holding TFT 1133 is connected to the third scanning line 1135, a first electrode of the current holding TFT 1133 is connected to the pixel current line 1138, a second electrode of the current holding TFT 1133 is connected to the gate electrode of the current-supply TFT 1129 and the gate electrode of the mirror TFT 1130. The current line (power supply line) 1124 and the other electrode of light emitting element 1136 are respectively input with predetermined potentials and have mutually different potentials.

In this case, the current source circuit 1137 corresponds to the current source circuit 420 arranged in the signal line driver circuit 403.

Note that the pixel of FIG. 13(C) corresponds to the case where the circuit of FIG. 23(E) is applied to the pixel of FIG. 63(B). However, since the current-flow direction is different, the transistor polarity is opposite. As described above, the erasing TFT 1126 is additionally provided in the pixel of FIG. 13(C). The disposition of the erasing TFT 1126 enables the length of the lightening period to be freely controlled.

The switching TFT 1125 serves to control the supply of the video signal to the pixel. The erasing TFT 1126 serves to cause charge retained in the capacitor device 1131 to be discharged. The conductivity/non-conductivity of the driving TFT 1127 is controlled according to the charge retained in the capacitor device 1131. The current-supply TFT 1129 and the mirror TFT 1130 together form a current mirror circuit. The current line 1124 and the other electrode of the light emitting element 1136 are respectively input with predetermined potentials and mutually have potential differences.

To be more specific, when the switching TFT 1125 is turned ON, a video signal is input to the pixel through the signal line 1121 and is held in the capacitor device 1128. The driving TFT 1127 is turned ON or OFF depending on the value of the video signal. Thus, when the driving TFT 1127 is ON, a constant current flows to the light emitting element, and the light emitting element emits light. When the driving TFT 1127 is OFF, no current flows to the light emitting element, and the light emitting element does not emit light. In this manner, an image is displayed.

In addition, the current source circuit of FIG. 13(C) is structured by the current-supply TFT 1129, the mirror TFT 1130, the capacitor device 1131, the current-input TFT 1132, and the holding TFT 1133. The current source circuit includes a capacity of making a constant current flow. Current is passed through the pixel current line 1138 and is then input to the current source circuit, and the setting operation is performed. Thus, even when variation occurs in the characteristics of the transistors constituting the current source circuit, variation does not occur in the magnitude of current that flows from the current source circuit to the light emitting element. The setting operation for the current source circuit of the pixel can be performed independent of the operations of the switching TFT 1125 and the driving TFT 1127.

Figure 71A:
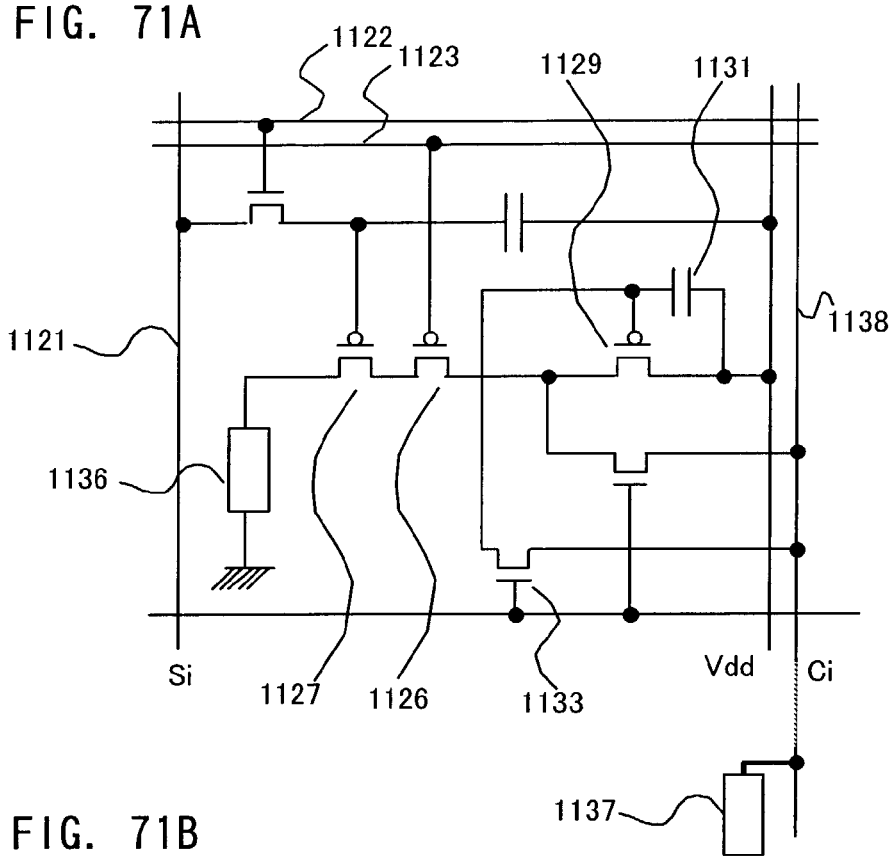
FIG. 71 is a circuit diagram of a pixel.

A pixel of FIG. 71(A) corresponds to the case where the circuit of FIG. 23(A) is applied to the pixel of FIG. 63(B). However, since the current-flow direction is different, the transistor polarity is opposite. The pixel of FIG. 71(A) includes a current-supply TFT 1129, a capacitor device 1131, a holding TFT 1133, and a pixel current line 1138 (Ci). The pixel current line 1138 (Ci) is connected to a current source circuit 1137. Note that the current source circuit 1137 corresponds to the current source circuit 420 arranged in the signal line driver circuit 403.

Figure 71B:
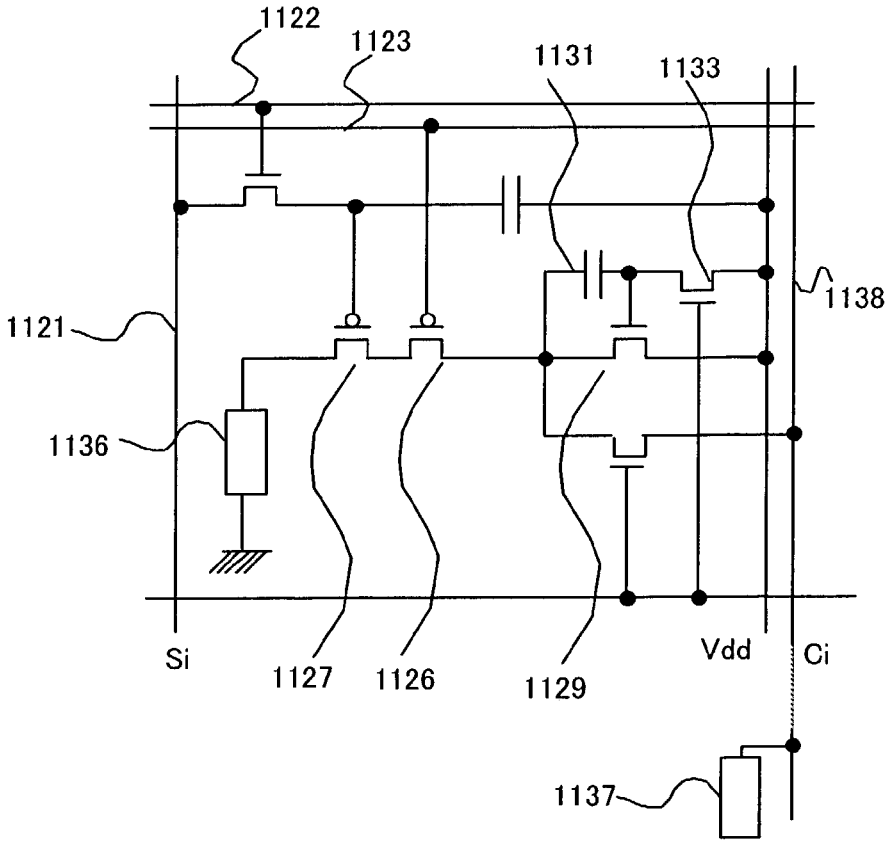

A pixel of FIG. 71(B) corresponds to the case where the circuit of FIG. 24(A) is applied to the pixel of FIG. 63(B). However, since the current-flow direction is different, the transistor polarity is opposite. The pixel of FIG. 71(B) includes a current-supply TFT 1129, a capacitor device 1131, a holding TFT 1133, and a pixel current line 1138 (Ci). The pixel current line 1138 (Ci) is connected to a current source circuit 1137. Note that the current source circuit 1137 corresponds to the current source circuit 420 arranged in the signal line driver circuit 403.

The pixel of FIG. 71(A) and the pixel of FIG. 71(B) are mutually different in the polarities of the respective current-supply TFTs 1129. Because of the difference in the polarities, connections of the capacitor device 1131 and the holding TFT 1133 are different.

As described above, there exist pixels having various structures. Incidentally, the pixels described above can be broadly classified into two types. The first type inputs a current corresponding to the video signal to the signal line. This type corresponds to the structures of FIGS. 13(A), 13(B), and the like. In this case, the signal line driver circuit includes the signal current control switch, as shown in FIGS. 1 and 2.

The other type inputs a video signal to the signal line, and inputs to the pixel current line a constant current unrelated to the video signal, that is, the pixel as shown in FIG. 63(B). The structure corresponds to FIGS. 13(C), 71(A), 71(B), and the like. In this case, the signal line driver circuit does not include the signal current control switch, as shown in FIGS. 34 and 35.

Next, timing charts corresponding to the above-described pixel types will be described. First, cases where digital gradation and time gradation are combined will be described. However, it is variable depending on the pixel type or the structure of the signal line driver circuit. That is, as described above, there occurs, in some cases, a difference in timing between the case where the setting operation and the input operation for the current source circuit in the signal line driver circuit can be performed simultaneously and the case where the setting operation and the input operation cannot be performed simultaneously.

First, the pixel type in which the current corresponding to the video signal is input to the signal line will be described. The pixel is assumed to be shown in FIGS. 13(A) or 13(B). The signal line driver circuit is assumed to have the structure of FIG. 6(B).

In the case where the setting operation and the input operation for the current source circuit of the signal line driver circuit can be simultaneously performed, a description is made of the case where the circuit shown in FIG. 1 is applied to the constant current circuit 414 in FIG. 6(B) and FIG. 23(C) is applied to the portion of a current source circuit, that is, the case of FIG. 5. Note that the description is the same in the circuits of FIG. 3 and FIG. 4 for the case where the setting operation and the input operation can be simultaneously performed.

Figure 72:
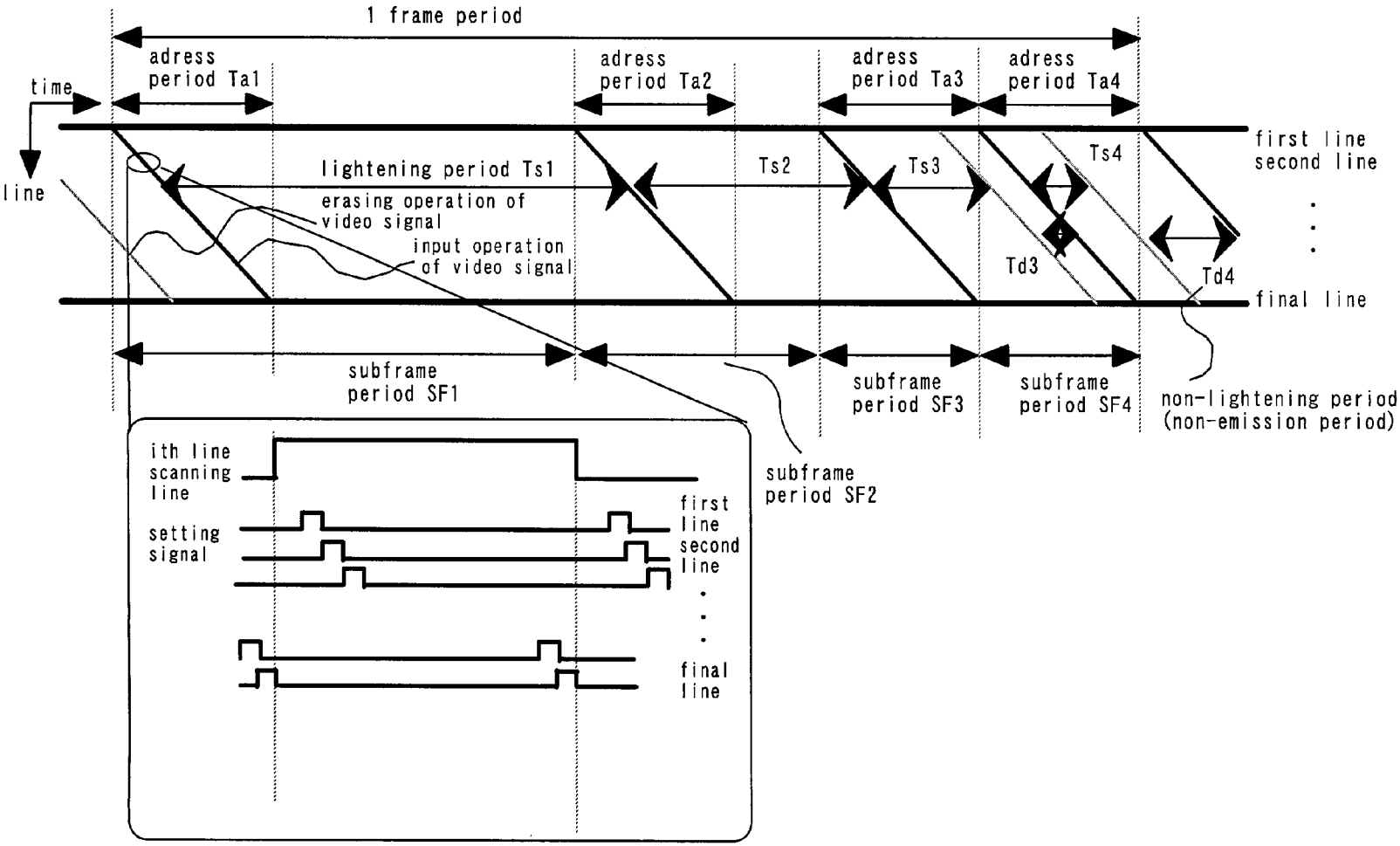
FIG. 72 is a timing chart.

The timing chart in this case is shown in FIG. 72. Also assumed are that 4-bit gradation is represented, and that the number of subframes is four for the convenience of simplifying the description. First, a first subframe period SF1 starts. A scanning line (the first scanning line 1102 shown in FIG. 13(A), or the first scanning line 1132 shown in FIG. 13(B)) is selected on a line basis, and current is input through a signal line (signal line 1101 in FIG. 13(A) or capacitor device 1131 in FIG. 13(B)). The current has a value corresponding to that of the video signal. Upon termination of a lightening period Ts1, a subsequent subframe period SF2 starts, and scanning is performed similar to the case of the subframe period SF1. Thereafter, a subsequent subframe period SF3 starts, and scanning is performed similarly. However, sinc period Ts3 is shorter than an address period Ta3, light is forced not to be emitted. That is, the input video signal is erased or current is controlled not to flow to the light emitting element. To erase the video signal, the second scanning line (second scanning line 1103 in FIG. 13(A) or second scanning line 1133 in FIG. 13(B)) is selected on a line basis. As a result, the video signal is erased to cause the light emitting element to be in the non-emission state. Then, a subsequent subframe period SF4 starts. Also in this stage, scanning is performed similar to the case of the subframe period SF3; and the light emitting element is brought into the non-emission state similarly.

Described above is the timing chart relevant to the image display operation, that is, pixel operation. Next, the timing of the setting operation for the current source circuit arranged in the signal line driver circuit will be described.

It is assumed that the current source circuit here is one capable of simultaneously performing the setting operation and the input operation. In the case where a pixel is of type in which a current corresponding to a video signal is input to a signal line, the input operation (output of the current to the pixel) of the current source circuit in the signal line driver circuit is performed in the address period (T1, Ta2 or the like) in each subframe period. Then, the setting operation of the current source circuit in the signal line driver circuit is controlled by a sampling pulse from the shift register 411.

The sampling pulses output from the shift register are output to all the columns while a scanning line (gate line) of a certain line is selected. Therefore, as shown in FIG. 72, the setting operation of the current source circuit in the signal line driver circuit is conducted synchronously with the sampling pulse output from the shift register.

Next, a description is made of the case where a setting control line and logical operators are arranged in a signal line driver circuit as shown in FIG. 42. Then, in the case where the setting operation and the input operation can be simultaneously performed with respect to the current source circuit in the signal line driver circuit, a description is made of the case where the circuit shown in FIG. 1 is applied to the constant current circuit 414 in FIG. 42 and FIG. 23(C) is applied to the portion of a current source circuit, that is, the case of FIG. 49.

Figure 73:
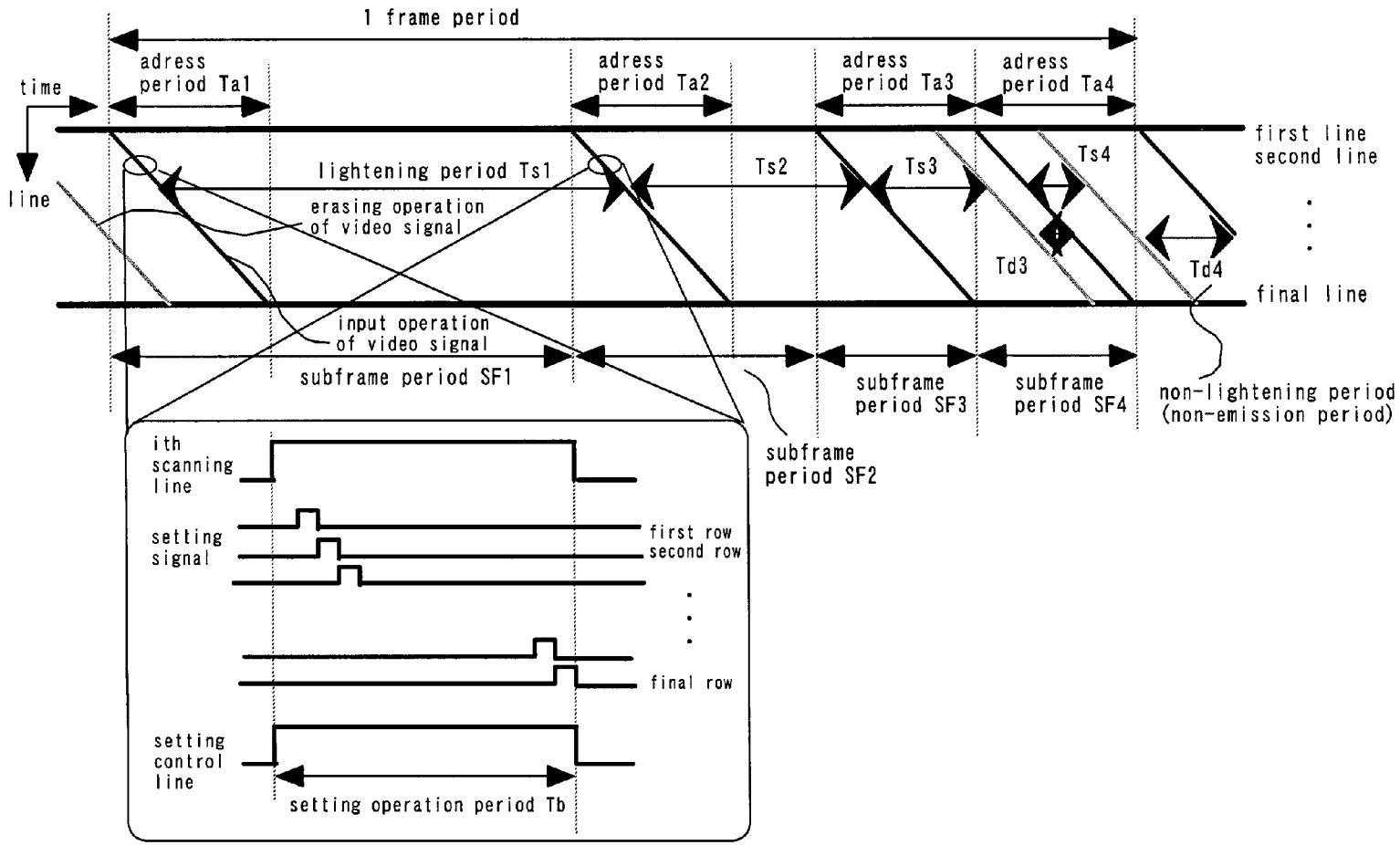
FIG. 73 is a timing chart.
Figure 74:
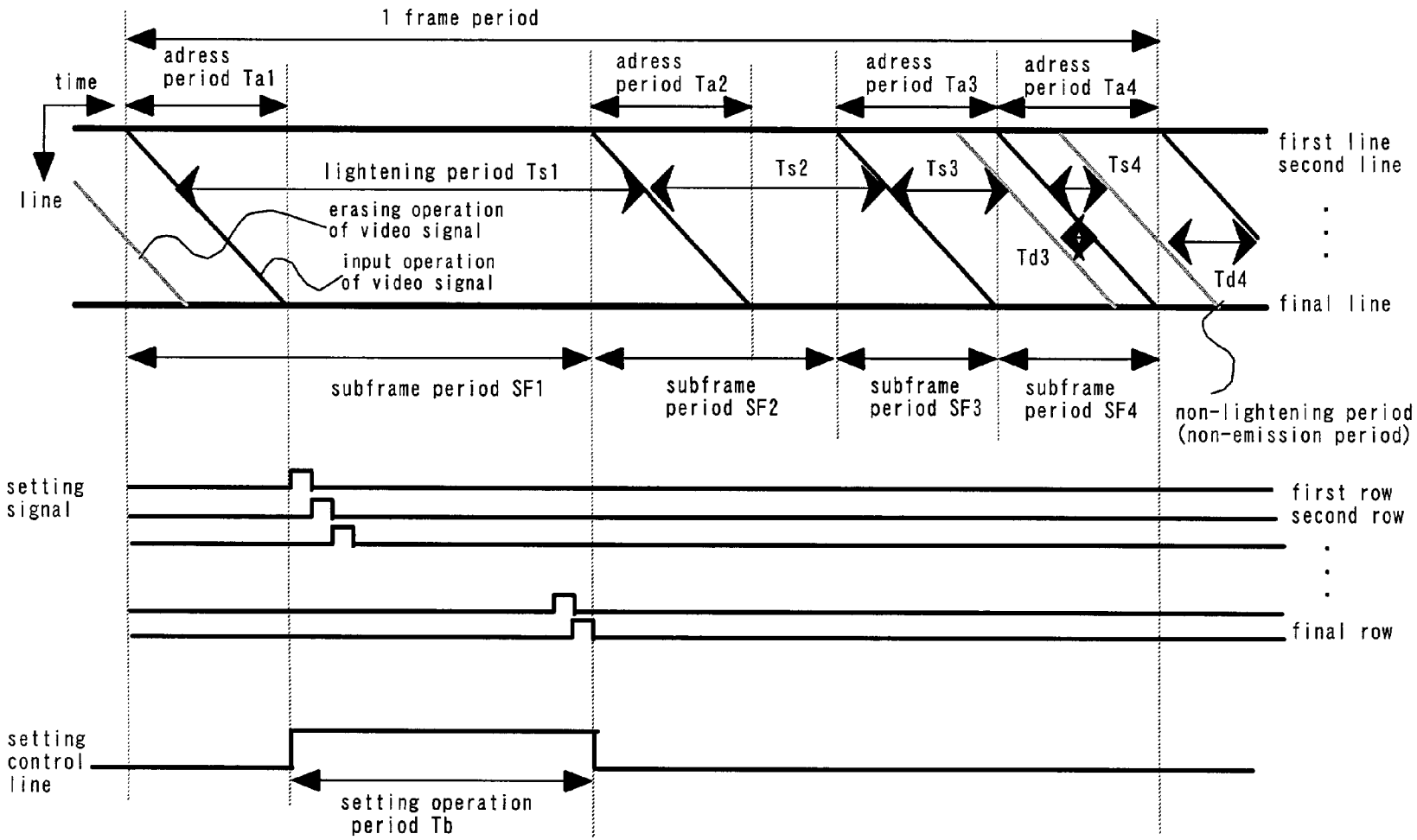
FIG. 74 is a timing chart.
Figure 75:
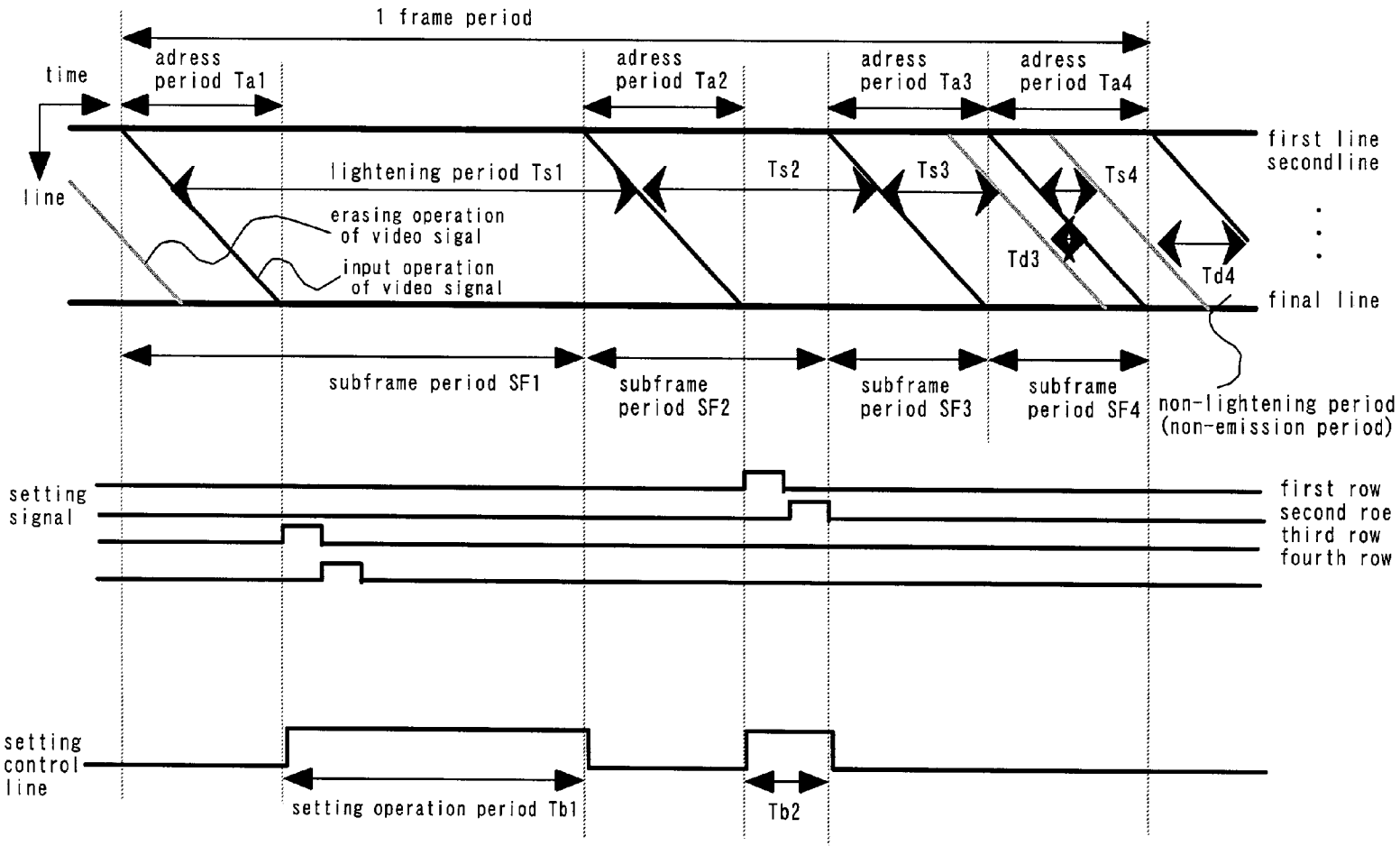
FIG. 75 is a timing chart.

The timing charts at this time are shown in FIG. 73, FIG. 74 and FIG. 75.

First, the image display operation, that is, the operation on a switching transistor, a driving transistor, and the like of a pixel is substantially the same as that in the case of FIG. 72 described above, and thus, an explanation thereof is omitted.

Next, a description is made of the timing of the setting operation of the current source circuit arranged in the signal line driver circuit. In the case of FIG. 72, the setting operation of the current source circuit in the signal line driver circuit is conducted in a selection period of the scanning line (gate line) of each line in each address period.

In FIG. 73, whether the setting operation of the current source circuit is conducted or not can be controlled by the setting control line. Therefore, a setting operation period Tb is provided only when the scanning line (gate line) of a certain line in a certain address period is selected, and the setting operation can be performed in the setting operation period Tb.

In this way, the number of times in which the setting operation is conducted for the current source circuit arranged in the signal line driver circuit can be reduced. Therefore, power consumption can be reduced.

Note that a capacitor element connected between a gate and a source of a certain transistor is arranged in the current source circuit 420. Charge is accumulated in the capacitor element through the setting operation of the current source circuit. Ideally, it is sufficient that the setting operation of the current source circuit is conducted only once when a power source is input. This is because the amount of the charge accumulated in the capacitor element does not need to be changed in accordance with the operation state, time, and the like, and does not change. Accordingly, it is sufficient that the setting operation of the current source circuit in the signal line driver circuit is conducted arbitrary times at an arbitrary timing.

However, in actuality, various noises enter the capacitor element, or a leak current of the transistor connected to the capacitor element flows through the capacitor element. As a result, the amount of the charge accumulated in the capacitor element may change with time. When the charge amount changes, the current output from the current source circuit, that is, the current input to the pixel also changes. As a result, luminance of the pixel changes. Thus, in order not to fluctuate the charge accumulated in the capacitor element, there arises a need that the setting operation of the current source circuit is performed in a certain cycle to thereby refresh the charge.

The operation for refreshing the charge accumulated in the capacitor element may be conducted any number of times in one frame period. Alternatively, the operation may be conducted once in several frame periods.

Note that the setting operation of the current source circuit is performed once in each of the address periods Ta1 and Ta2 in FIG. 73. How often the setting operation is conducted may be appropriately determined in accordance with the conservation situation of the charge in the capacitor element of the current source circuit.

Next, FIG. 74 shows the case where the timing of the setting operation of the current source circuit arranged in the signal line driver circuit is different from that in FIG. 73.

In FIG. 74, an address period (period during which the input operation of the current source circuit in the signal line driver circuit is conducted) is separated from a setting operation period of the current source circuit of the signal line driver circuit. That is, by utilizing the setting control line, the setting operation of the current source circuit is not conducted in the address period, that is, in the input operation of the current source circuit. Further, the setting operation of the current source circuit is conducted in the period between one address period and another address period, that is, the period during which the input operation of the current source circuit is not performed.

The setting operation and the input operation of the current source circuit in the signal line driver circuit are separately performed as described above, whereby the operation speed of each operation can be changed. That is, the frequency of the sampling pulse output from the shift register 411 can be changed. Therefore, only in the case of conducting the setting operation of the current source circuit in the signal line driver circuit, the operation of the shift register 411 can be performed slowly. As a result, the setting operation of the current source circuit can be performed for a sufficient time, and the setting operation can be conducted with more accuracy.

Accordingly, the case of FIG. 74 may adopts the structure in which the setting operation and the input operation cannot be performed simultaneously with respect to the current source circuit in the signal line driver circuit.

Note that even when the shift register 411 is operated for conducting the setting operation of the current source circuit, no influence is imparted to the pixel if the scanning line (gate line) in the pixel is not selected. That is, since the scanning line (gate line) is not selected in the address period, no influence is imparted to the pixel.

Further, in the case where the shift register 411 is the circuit capable of selecting a plurality of wirings at random as in FIG. 43, FIG. 44, FIG. 45, FIG. 46, or the like, the setting operation for all the current source circuits does not need to be finished in the period between one address period and another address period, that is, one period during which the input operation of the current source circuit is not conducted. In other words, the setting operation for all the current source circuits may be finished in several frame periods. Alternatively, in the case where there exist a plurality of periods, each of which is between one address period and another address period, in one frame period, the setting operation of the current source circuit may be conducted by using some periods selected from those periods. The timing chart at this time is shown in FIG. 75.

Figure 76:
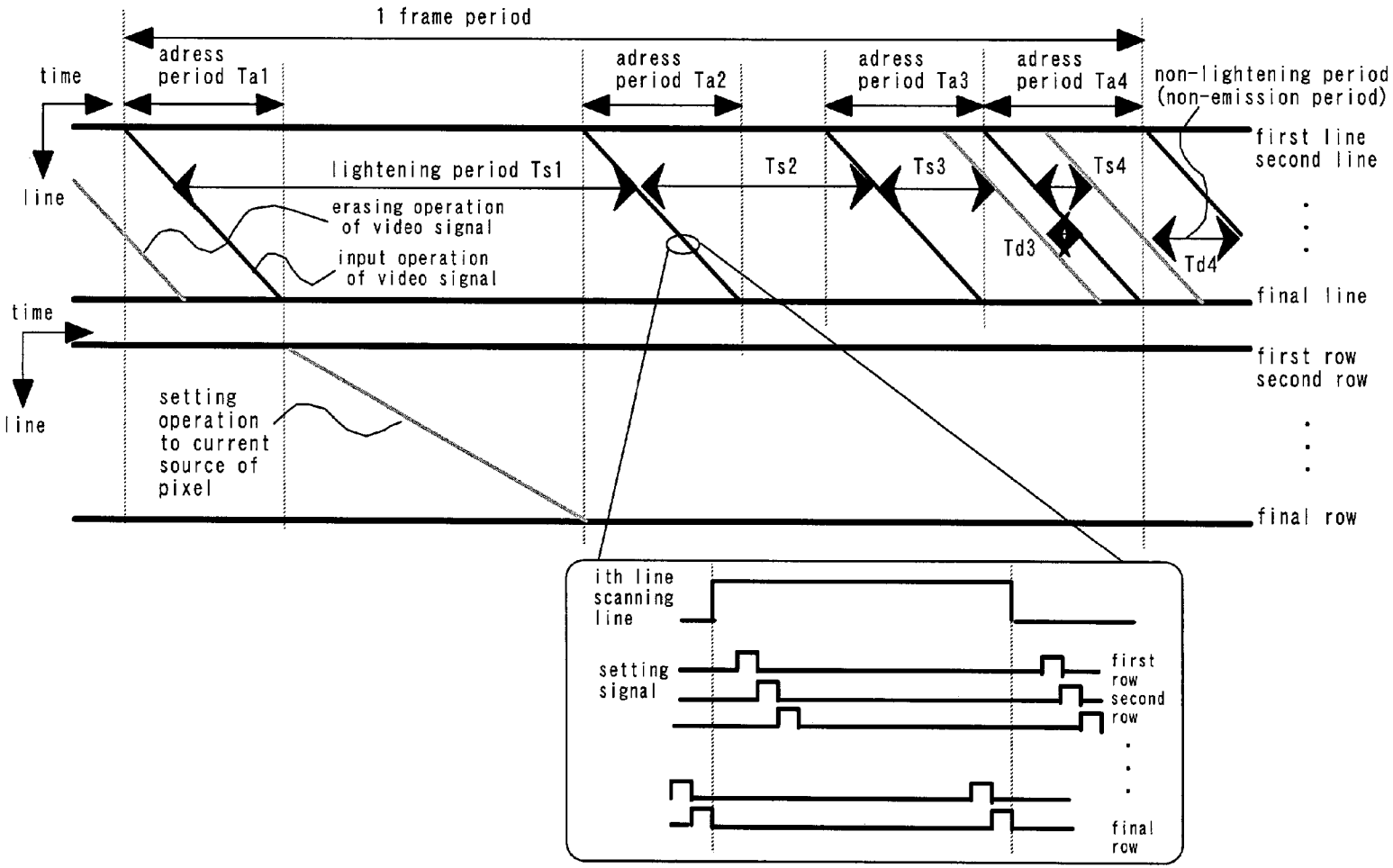
FIG. 76 is a timing chart.

Next, a description will be given of the pixel type that inputs a video signal to the signal line and then inputs a constant current unrelated to the video signal to the pixel current line. The signal line driver circuit is assumed to have the structure of FIG. 63(A). The pixel is assumed to have the structure of, for example, FIG. 63(B), 13(C), 71(A), or 71(B). In this pixel structure, however, the setting operation needs to be performed also for the current source circuit in the pixel. Thus, the timing chart is variable depending on whether the current source circuit of the pixel can simultaneously perform the setting operation and the input operation. FIG. 76 shows a timing chart in the case where the setting operation and the input operation of the current source circuit of the pixel can be performed simultaneously, that is, the case where the pixel has the structure of FIG. 13(C).

First, the image display operation, that is, operations related to the switching transistor of the pixel, the driving transistor, and the like will be described below. Since the operations are almost the same as those in the case of FIG. 72, they will be briefly described.

First, a first subframe period SF1 starts. A scanning line (first scanning line 1122 in FIG. 13(C)) is selected on a line basis, and a video signal is input through a signal line (1121 in FIG. 13(C)). The video signal is ordinarily a voltage, but it may be a current. Upon termination of a lightening period Ts1, a subsequent subframe period SF2 starts, and scanning is performed similar to the case of SF1. Then, a subsequent subframe period SF3 starts, and scanning is performed similarly. However, since the length of a lightening period Ts3 is shorter than the length of an address period Ta3, light is forced not to be emitted. That is, the input video signal is erased or current is controlled not to flow to the light emitting element. To erase the input video signal, the second scanning line (second scanning line 1123 in FIG. 13(C)) is selected on a line basis. As a result, the video signal is erased, and the driving TFT 1127 is brought into the OFF state. Thus, the light emitting element can be brought into the non-emission state. Then, a subsequent subframe period SF4 starts. Also in this stage, scanning is performed as in the case of SF3 and the light emitting element is brought into the non-emission state similarly.

Next, the setting operation for the current source circuit of the pixel will be described. In the case of FIG. 13(C), the setting operation and the input operation for the current source circuit of the pixel can be performed simultaneously. Accordingly, the setting operation for the current source circuit of the pixel can be performed with an arbitrary timing.

The setting operation of the current source circuit in the signal line driver circuit may be conducted at any time in the case where the setting operation can be performed simultaneously with the input operation (setting operation of the current source circuit of the pixel). In the case where the setting operation of the current source circuit in the signal line driver circuit cannot be performed simultaneously with the input operation (setting operation of the current source circuit of the pixel), the setting operation may be conducted in the period other than the period during which the input operation (setting operation of the current source circuit of the pixel) is conducted.

The case where the setting operation and the input operation (output of a current to the pixel, that is, the setting operation of the current source circuit of the pixel) of the current source circuit in the signal line driver circuit can be performed at the same time corresponds to the case where the circuit in FIG. 35 is applied to the constant current circuit 414 in FIG. 63(A), that is, the case of FIG. 68. Alternatively, the above case corresponds to the case where FIG. 34 is applied to the constant current circuit 414 in FIG. 63(A) and the current source circuit 420 corresponds to FIG. 23(C), FIG. 23(D), FIG. 23(E), or the like.

The case where the setting operation and the input operation (output of a current to the pixel, that is, the setting operation of the current source circuit of the pixel) of the current source circuit in the signal line driver circuit cannot be performed simultaneously corresponds to the case where FIG. 34 is applied to the constant current circuit 414 in FIG. 63(A) and the current source circuit 420 corresponds to FIG. 23(A), FIG. 23(B), or the like, that is, the case of FIG. 64.

Thus, FIG. 76 is a timing chart for the case where the setting operation and the input operation (output of a current to the pixel, that is, the setting operation of the current source circuit of the pixel) of the current source circuit in the signal line driver circuit cannot be performed simultaneously. Assuming that the setting operation of the current source circuit in the signal line driver circuit is performed in an address period, the setting operation of the current source circuit of the pixel is performed in the period between one address period and another address period.

In the case where the setting operation and the input operation (output of a current to the pixel, that is, the setting operation of the current source circuit of the pixel) of the current source circuit in the signal line driver circuit can be conducted simultaneously, the setting operation of the current source circuit of the pixel may be conducted in an arbitrary period.

In the case of FIG. 76, the setting operation of the current source circuit in the signal line driver circuit is performed in a selection period of the scanning line (gate line) of each line in each address period. Next, a description is made of a timing chart for the case where a setting control line and a logical operator are arranged as shown in FIG. 66 or FIG. 69. In FIG. 66 or FIG. 69, whether the setting operation of the current source circuit is performed or not can be controlled by the setting control line. Therefore, only when the scanning line (gate line) of a certain line in a certain address period is selected, the setting operation period Tb is provided, and the setting operation can be performed in the setting operation period Tb.

Figure 77:
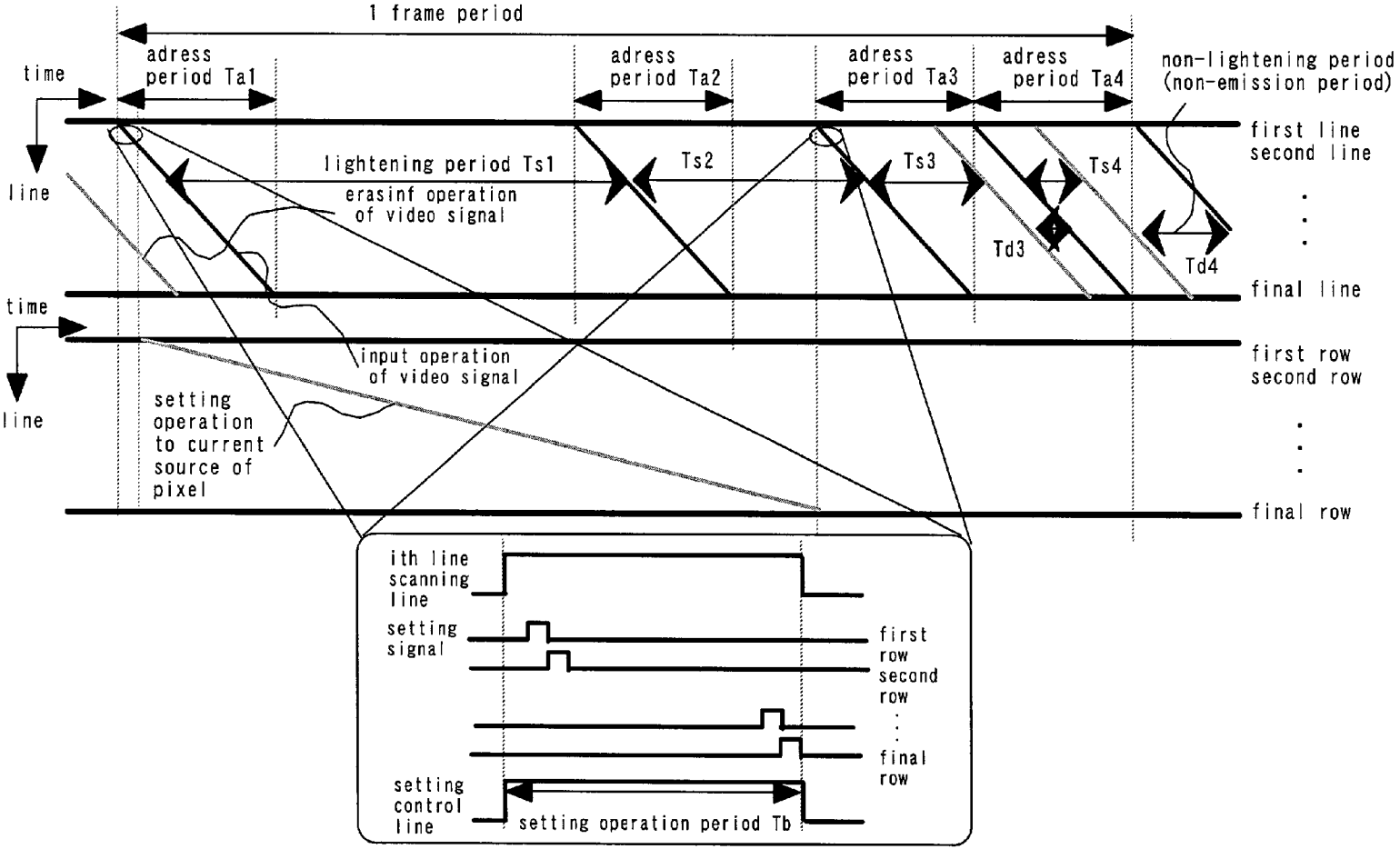
FIG. 77 is a timing chart.

Thus, FIG. 77 is a timing chart for the case where the setting operation and the input operation (output of a current to the pixel, that is, the setting operation of the current source circuit of the pixel) of the current source circuit in the signal line driver circuit cannot be performed simultaneously. The setting operation of the current source circuit in the signal line driver circuit is conducted in the first period among the address periods. In FIG. 77, the setting operation is conducted in the first periods of Ta1 and Ta2. Therefore, the setting operation of the current source circuit of the pixel is conducted in the other periods. That is, the setting operation of the current source circuit of the pixel (input operation of the current source circuit in the signal line driver circuit) can be performed also in the address period.

Further, from the above, the number of times of the setting operation of the current source circuit arranged in the signal line driver circuit can be reduced. Thus, power consumption can be reduced.

Note that the capacitor element connected between a gate and a source is arranged in the current source circuit 420. In the capacitor element, charge is accumulated through the setting operation of the current source circuit. Ideally, it is sufficient that the setting operation of the current source circuit is conducted only once when a power source is input. This is because the amount of the charge accumulated in the capacitor element does not need to be changed in accordance with the operation state, time, and the like, and does not change. Accordingly, it is sufficient that the setting operation of the current source circuit in the signal line driver circuit is conducted arbitrary number of times at an arbitrary timing.

However, in actuality, various noises enter the capacitor element, or a leak current of the transistor connected to the capacitor element flows through the capacitor element. As a result, the amount of the charge accumulated in the capacitor element may change with time. When the charge amount changes, the current output from the current source circuit, that is, the current input to the pixel also changes. As a result, luminance of the pixel changes. Thus, in order not to fluctuate the charge accumulated in the capacitor element, there arises a need that the setting operation of the current source circuit is performed in a certain cycle to thereby refresh the charge.

The operation for refreshing the charge accumulated in the capacitor element may be conducted any number of times in one frame period. Alternatively, the operation may be conducted once in several frame periods.

The setting operation of the current source circuit is performed once in each of the address periods Ta1 and Ta2 in FIG. 77. How often the setting operation is conducted may be appropriately determined in accordance with the conservation situation of the charge in the capacitor element of the current source circuit.

Figure 78:
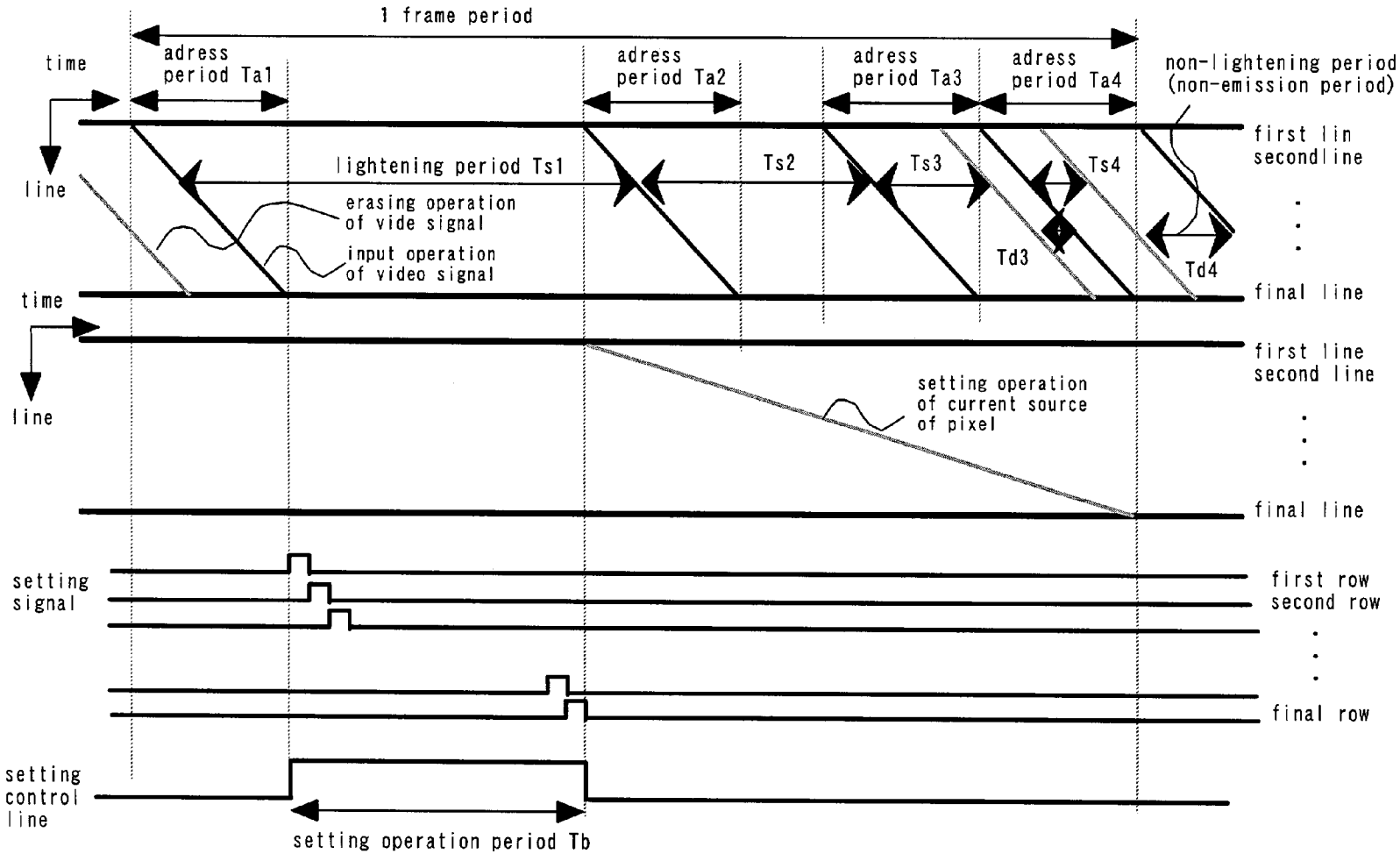
FIG. 78 is a timing chart.

Next, FIG. 78 shows the ease where the timing of the setting operation of the current source circuit arranged in the signal line driver circuit differs from that in FIG. 77.

In FIG. 78, by utilizing the setting control line, the setting operation of the current source circuit in the signal line driver circuit is not performed in the address period, and the setting operation of the current source circuit is performed in the period between one address period and another address period. Then, in the case where the input operation of the current source circuit in the signal line driver circuit (output of a current to the pixel, that is, the setting operation of the current source circuit of the pixel) cannot be performed simultaneously with the setting operation of the current source circuit in the signal line driver circuit, the input operation is performed in the period during which the setting operation is not performed. In the case where the setting operation and the input operation can be performed simultaneously, any timing of conducting the input operation of the current source circuit in the signal line driver circuit is adopted.

In this way, the setting operation of the current source circuit in the signal line driver circuit is performed in the period other than the address period, whereby the operation speed can be changed between the operation in the address period and the operation in the setting operation. That is, the frequency of the sampling pulse output from the shift register 411 can be changed. Therefore, only in the case where the setting operation of the current source circuit in the signal line driver circuit is conducted, the operation of the shift register 411 can be conducted slowly. As a result, the setting operation of the current source circuit can be performed for a sufficient time, and the setting operation can be conducted with more accuracy.

Note that, in order to perform the setting operation of the current source circuit, even though the shift register 411 is operated, no influence is imparted to the pixel if the scanning line (gate line) in the pixel is not selected. That is, since the scanning line (gate line) is not selected in the address period, no influence is imparted to the pixel.

Figure 79:
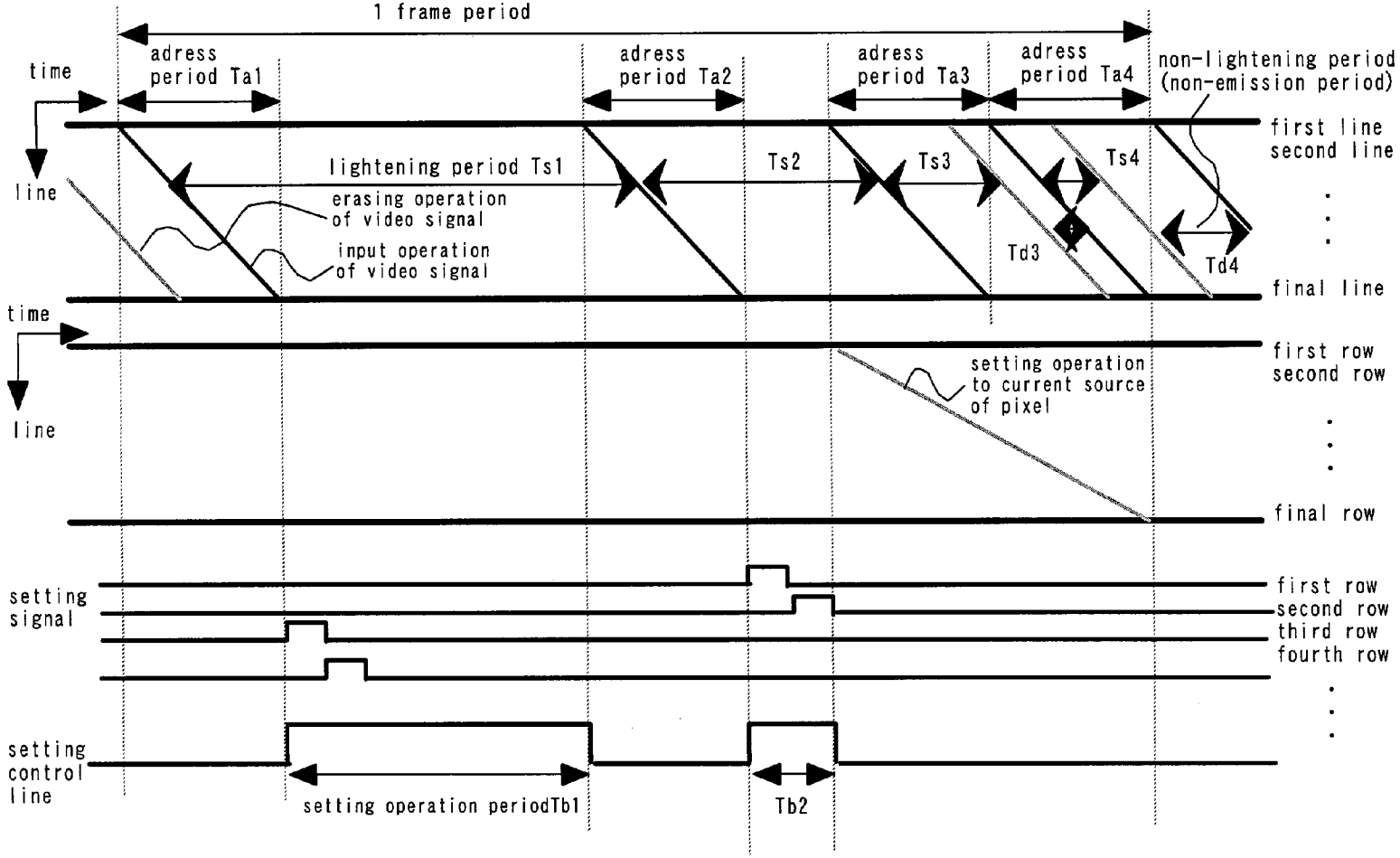
FIG. 79 is a timing chart.

Further, in the case where the shift register 411 is the circuit capable of selecting wirings at random as in FIG. 43, FIG. 44, FIG. 45, FIG. 46 or the like, the setting operation for all the current source circuits does not need to be finished in one period between one address period and another address period. That is, the setting operation for all the current source circuits may be finished in several frame periods. Alternatively, in the case where there exist a plurality of periods, each of which is between one address period and another address period, in one frame period, the setting operation of the current source circuit may be conducted by using some periods selected from those periods. The timing chart at this time is FIG. 79.

Figure 80:
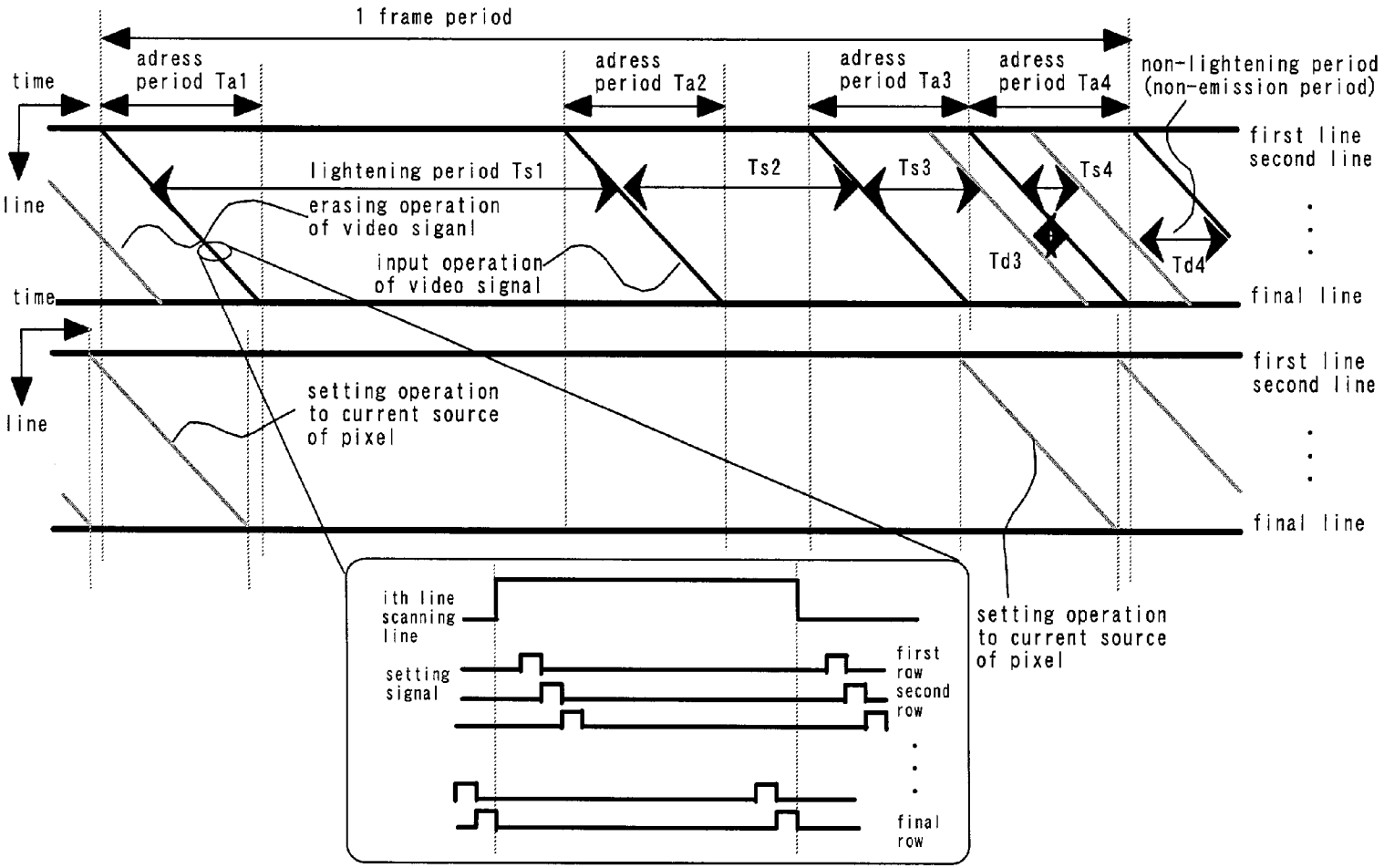
FIG. 80 is a timing chart.

Next, the timing chart for the case where: a pixel is of type in which a video signal is input to a signal line and a fixed current irrelevant to the video signal is input to a pixel current line; and the setting operation and the input operation of the current source circuit of the pixel cannot be performed simultaneously, that is, the case where the pixel corresponds to FIG. 71(A) or FIG. 71(B) is FIG. 80.

First, the image display operation, that is, the operation on the switching transistor, the driving transistor, and the like of the pixel is substantially the same as that in the case of FIG. 76, and thus is described in a simple manner.

First, a first subframe period SF1 starts. A scanning line (first scanning line 1122 in FIGS. 71(A) and 71(B)) is selected on a line basis, and a video signal is input through a signal line (1121 in FIGS. 71(A) and 71(B)). The video signal is ordinarily a voltage, but it may be a current. Upon termination of a lightening period Ts1, a subsequent subframe period SF2 starts, and scanning is performed similar to the case of SF1. Then, a subsequent subframe period SF3 starts, and scanning is performed similarly. However, since the length of a lightening period Ts3 is shorter than the length of an address period Ta3, light is forced not to be emitted. That is, the input video signal is erased or current is controlled not to flow to the light emitting element. To prevent the current from flowing to the light emitting element, the second scanning line (second scanning line 1123 in FIG. 13(C)) is selected on a line basis. As a result, the erasing TFT 1127 is brought into the OFF state, and the current-flow path is interrupted. Thus, the light emitting element can be brought into the non-emission state. Then, a subsequent subframe period SF4 starts. Also in this stage, scanning is performed as in the case of SF3 and the light emitting element is brought into the non-emission state similarly.

Next, a description is made of the setting operation to the current source circuit of the pixel. In the case of FIG. 71(A) and FIG. 71(B), the setting operation and the input operation of the current source circuit of the pixel cannot be performed simultaneously. Therefore, the setting operation of the current source circuit of the pixel may be conducted when the input operation of the current source circuit of the pixel is not performed, that is, when a current does not flow through the light emitting element.

The setting operation of the current source circuit in the signal line driver circuit may be performed at any time in the case where the setting operation can be performed simultaneously with the input operation (setting operation of the current source circuit of the pixel). In the case where the setting operation of the current source circuit in the signal line driver circuit cannot be conducted simultaneously with the input operation (setting operation of the current source circuit of the pixel), the setting operation may be conducted in the period other than the period during which the input operation (setting operation of the current source circuit of the pixel) is conducted.

The case where the setting operation and the input operation (output of a current to the pixel, namely, the setting operation of the current source circuit of the pixel) of the current source circuit in the signal line driver circuit can be performed at the same time corresponds to the case where the constant current circuit 414 in FIG. 63(A) corresponds to the circuit in FIG. 35, that is, the case of FIG. 68. Alternatively, the above case corresponds to the case where the constant current source 414 in FIG. 63(A) corresponds to FIG. 34, and also, the current source circuit 420 corresponds to FIG. 23(C), FIG. 23(D), FIG. 23(E) or the like.

The case where the setting operation and the input operation (output of a current to the pixel, that is, the setting operation of the current source circuit of the pixel) of the current source circuit of the signal line driver circuit cannot be performed simultaneously corresponds to the case where the constant current circuit 414 in FIG. 63(A) corresponds to FIG. 34, and the current source circuit 420 corresponds to FIG. 23(A), FIG. 23(B), or the like, that is, the case of FIG. 64(A).

Thus, FIG. 80 is the timing chart for the case where the setting operation and the input operation (output of a current to the pixel, that is, the setting operation of the current source circuit of the pixel) of the current source circuit of the signal line driver circuit can be performed at the same time. The setting operation of the current source circuit in the signal line driver circuit is performed in the address period. The setting operation of the current source circuit of the pixel may be conducted while the input operation of the current source circuit of the pixel is not conducted, that is, during a non-lightening period (non-light emission period) (Td3, Td4) in which a current does not flow through the light emitting element. The setting operation of the current source circuit in the signal line driver circuit may be performed in the other period. The non-lightening period (non-light emission period) (Td3, Td4) may overlap the address period in many cases.

In the case of FIG. 80, the setting operation of the current source circuit of the signal line driver circuit is performed in a selection period of the scanning line (gate line) of each line in each address period. Next, there is described a timing chart in the case where a setting control line and a logical operator exist as in FIG. 66 or FIG. 69. In FIG. 66 or FIG. 69, whether the setting operation of the current source circuit is conducted or not can be controlled by the setting control line. Therefore, only when the scanning line (gate line) of a certain line in a certain address period is selected, a setting operation period Tb is provided, and the setting operation can be performed in the setting operation period Tb.

Figure 81:
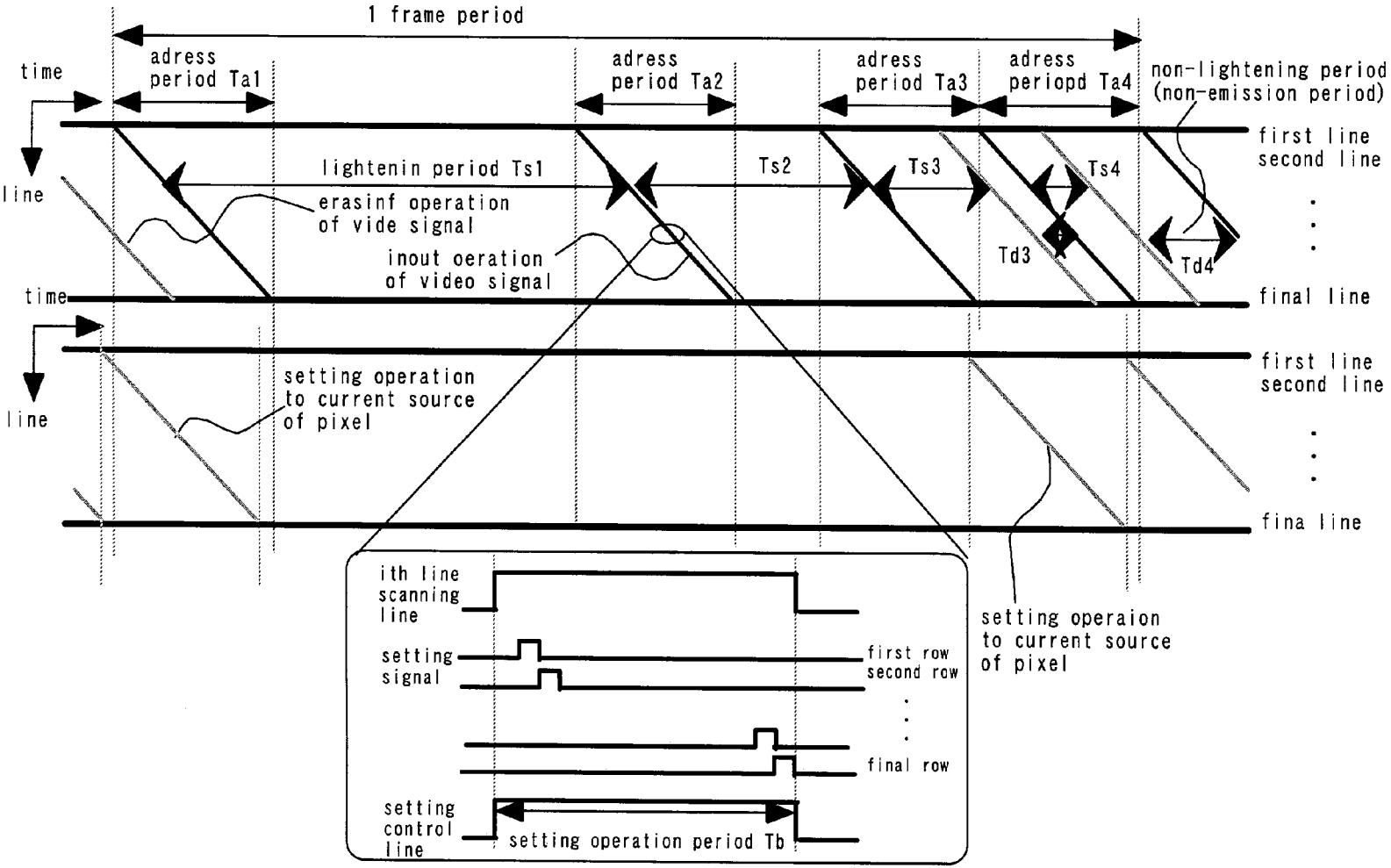
FIG. 81 is a timing chart.

Thus, FIG. 81 is the timing chart for the case where the setting operation and the input operation (output of a current to the pixel, that is, the setting operation of the current source circuit of the pixel) of the current source circuit in the signal line driver circuit cannot be performed simultaneously. The setting operation of the current source circuit in the signal line driver circuit is conducted in the period during which the setting operation of the current source circuit of the pixel is not conducted. In FIG. 81, the setting operation is performed in the period of Ta2. The setting operation of the current source circuit of the pixel is performed in the other period. Thus, the setting operation of the current source circuit in the signal line driver circuit can be performed while avoiding the period during which the setting operation of the current source circuit of the pixel (input operation of the current source circuit in the signal line driver circuit) is performed.

Further, from the above, the number of times of the setting operation of the current source circuit arranged in the signal line driver circuit can be reduced. Therefore, consumption power can be reduced. Note that the setting operation of the current source circuit in the signal line driver circuit can be conducted an arbitrary number of times at an arbitrary timing. Incidentally, in order not to fluctuate the charge accumulated in the capacitor element arranged in the current source circuit, there arises a need that the setting operation of the current source circuit is performed in a certain cycle to thereby refresh the charge. Thus, the operation for refreshing the charge accumulated in the capacitor element may be conducted any number of times in one frame period. Alternatively, the operation may be conducted once in several frame periods.

In FIG. 81, the setting operation of the current source circuit is conducted only once in the period including the address period Ta2. How often the setting operation is conducted may be appropriately determined in accordance with the conservation situation of the charge in the capacitor element of the current source circuit.

Figure 82:
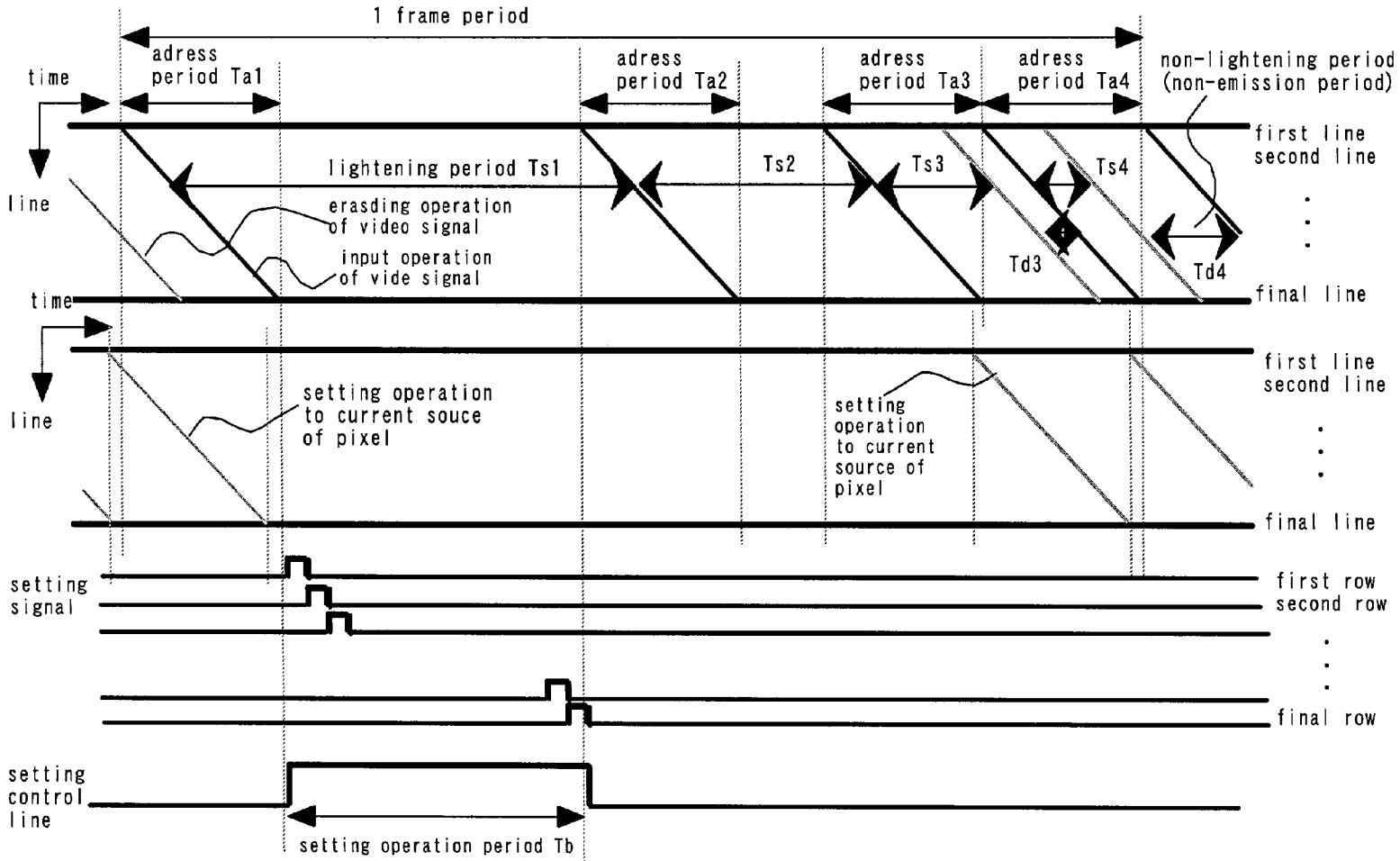
FIG. 82 is a timing chart.

Next, the case where the timing of the setting operation of the current source circuit arranged in the signal line driver circuit is different from that in FIG. 81 is shown in FIG. 82.

In FIG. 82, by utilizing the setting control line, the setting operation of the current source circuit in the signal line driver circuit is not performed in an address period while the setting operation of the current source circuit is performed in the period between one address period and another address period. Then, the input operation of the current source circuit in the signal line driver circuit (output of a current to the pixel, that is, the setting operation of the current source circuit of the pixel) is performed while the input operation of the current source circuit of the pixel is not conducted, that is, during the non-lightening period (non-light emission period) (Td3, Td4) in which a current does not flow through the light emitting element.

From the above, it becomes possible that the setting operation and the input operation of the current source circuit in the signal line driver circuit are not performed simultaneously.

The setting operation of the current source circuit in the signal line driver circuit is performed in the period other than the address period as described above, whereby the operation speed can be changed between the operation in the address period and the operation in the setting operation. That is, the frequency of the sampling pulse output from the shift register 411 can be changed. Therefore, only in the case where the setting operation of the current source circuit in the signal line driver circuit is conducted, the operation of the shift register 411 can be conducted slowly. As a result, the setting operation of the current source circuit can be performed for a sufficient time, and the setting operation can be conducted with more accuracy.

Note that even when the shift register 411 is operated for conducting the setting operation of the current source circuit, no influence is imparted to the pixel if the scanning line (gate line) in the pixel is not selected. That is, since the scanning line (gate line) is not selected in the address period, no influence is imparted to the pixel.

Figure 83:
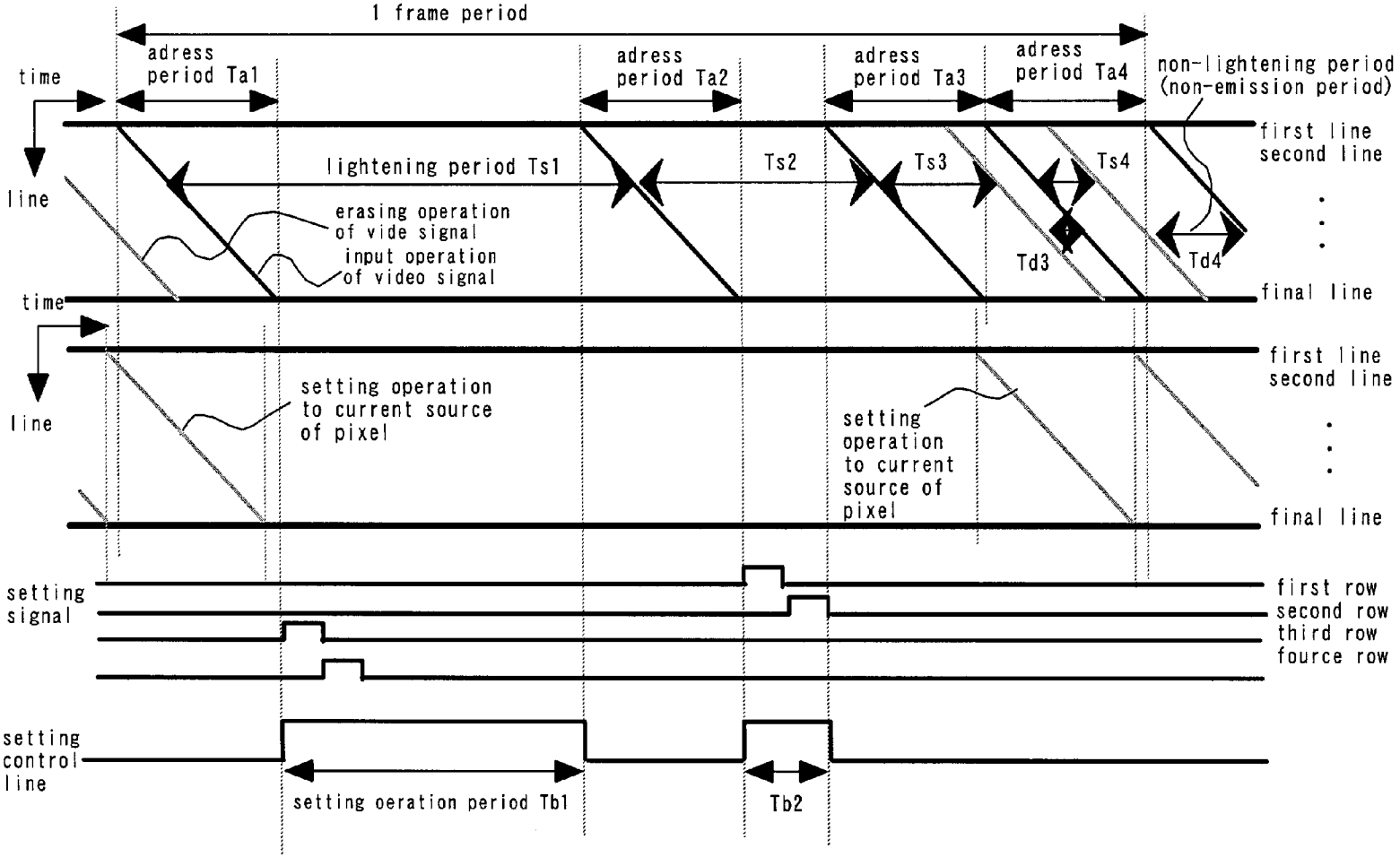
FIG. 83 is a timing chart.
Figure 84:
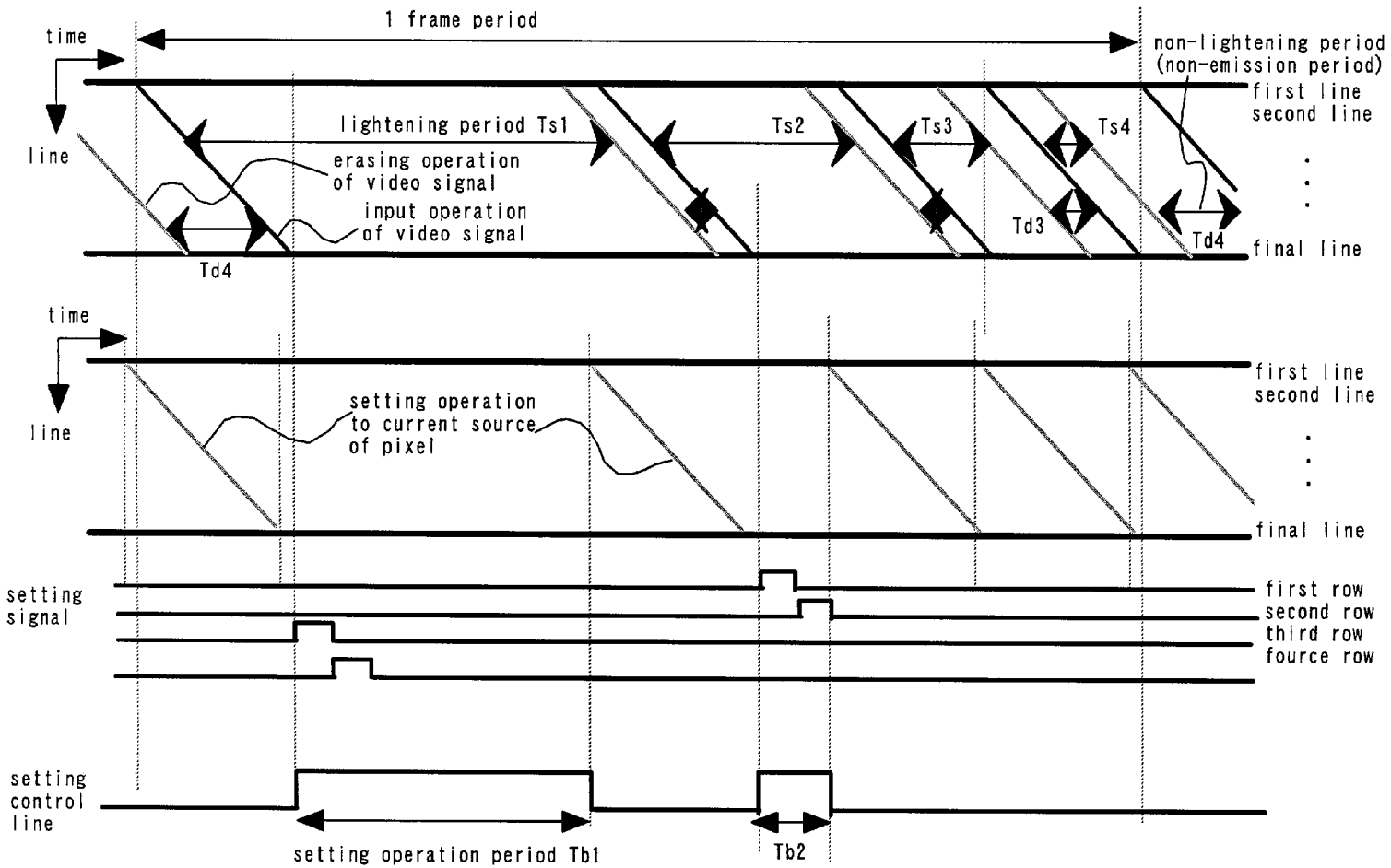
FIG. 84 is a timing chart.

Further, in the case where the shift register 411 is the circuit capable of selecting a plurality of wirings at random as in FIG. 43, FIG. 44, FIG. 45, FIG. 46, or the like, the setting operation for all the current source circuits does not need to be finished in the period between one address period and another address period. In other words, the setting operation for all the current source circuits may be finished in several frame periods. Alternatively, in the case where there exist a plurality of periods, each of which is between one address period and another address period, in one frame period, the setting operation of the current source circuit may be conducted by using some periods selected from those periods. The timing chart at this time is FIG. 83.

Note that there is a case where the period is short if the setting operation to the current source circuit of the pixel is conducted only in a non-lightening period. In such a case, it may be such that a non-lightening period is forcibly provided before each address period and that the setting operation to the current source circuit of the pixel is conducted in the non-lightening period.

So far, the description has been made of the timing chart in the case where digital gradation and time gradation are combined. Next, a description is made of the timing chart for the case of analog gradation. Also here, a description is made of the timing chart for the case where the setting operation and the input operation to the current source circuit in the signal line driver circuit cannot be simultaneously performed.

First, it is assumed that a pixel corresponds to FIG. 13(A) or FIG. 13(B) and that the signal line driver circuit corresponds to the structure of FIG. 27 or FIG. 54, that is, the circuit as shown in FIG. 29, FIG. 7, FIG. 8, or FIG. 55. The timing chart at this time is FIG. 85.

A scanning line (a first scanning line 1102 in FIG. 13(A) or a first scanning line 1132 in FIG. 13(B)) is selected one by one, and a current is input from a signal line (1101 in FIG. 13(A) or 1131 in FIG. 13(B)). This current has a value corresponding to a video signal. This is performed in one frame period.

The timing chart on the image display operation, that is, the operation of the pixel is described above. Next, a description is made of the timing of the setting operation of the current source circuit arranged in the signal line driver circuit. The current source circuit described here is one capable of simultaneously performing the setting operation and the input operation. Thus, the current source circuit corresponds to the case where FIG. 57, FIG. 58, or the like is applied to a constant current circuit.

Figure 85:
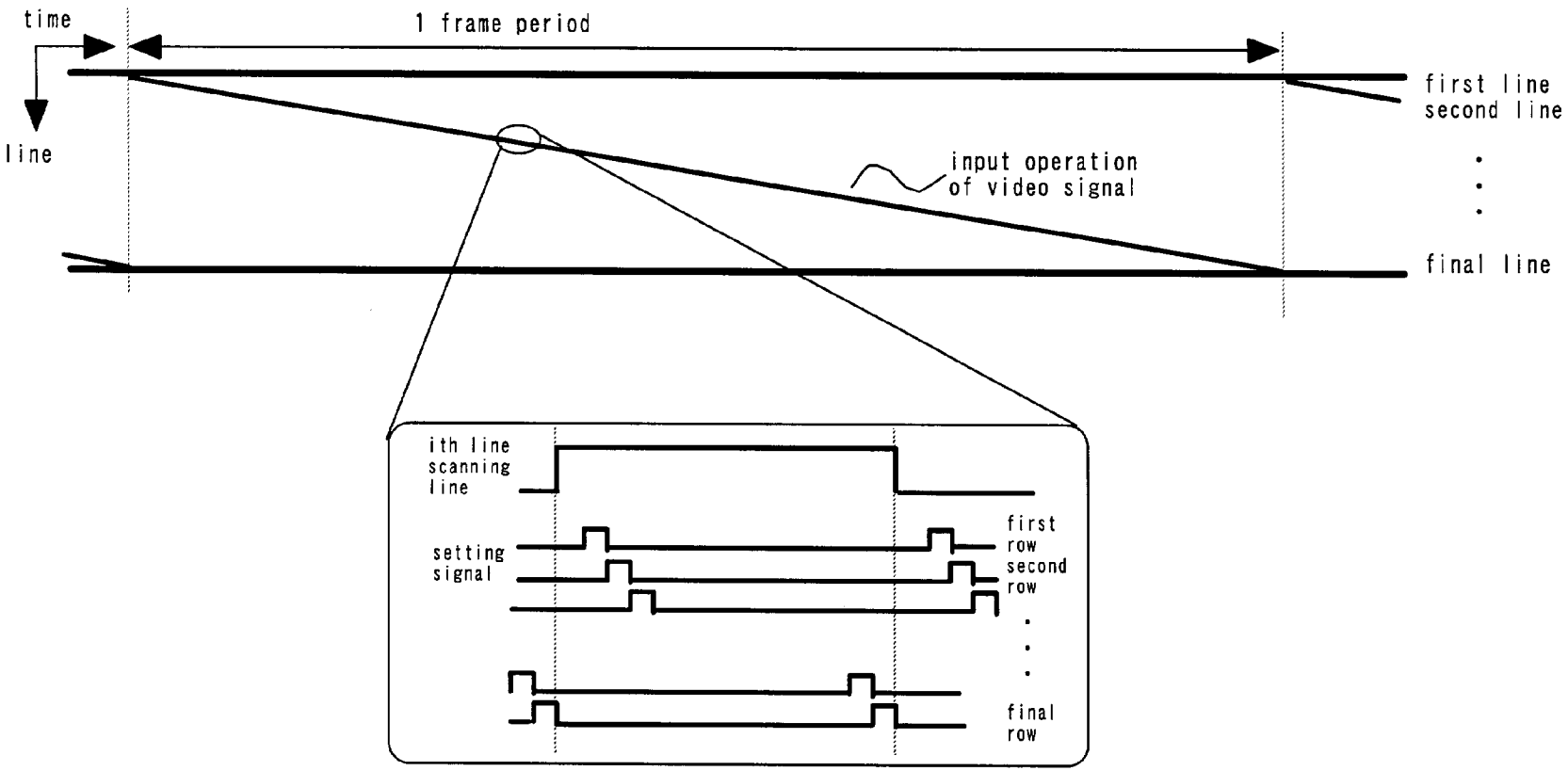
FIG. 85 is a timing chart.

The input operation of the current source circuit in the signal line driver circuit is generally conducted in one frame period. Then, as shown in FIG. 85, the setting operation of the current source circuit in the signal line driver circuit is performed in one frame period.

Next, a description is made of the timing chart for the case where a setting control line and a logical operator exist as in FIG. 53, FIG. 60, FIG. 59, FIG. 61, or FIG. 62. In this case, whether the setting operation of the current source circuit is conducted or not is controlled by the setting control line Note that, in FIG. 60, the first to third setting control lines control to which current source circuit the setting operation is conducted and to which current source circuit the input operation is conducted. Also, the fourth setting control line controls whether the setting operation of the current source circuit is performed or not.

Figure 86:
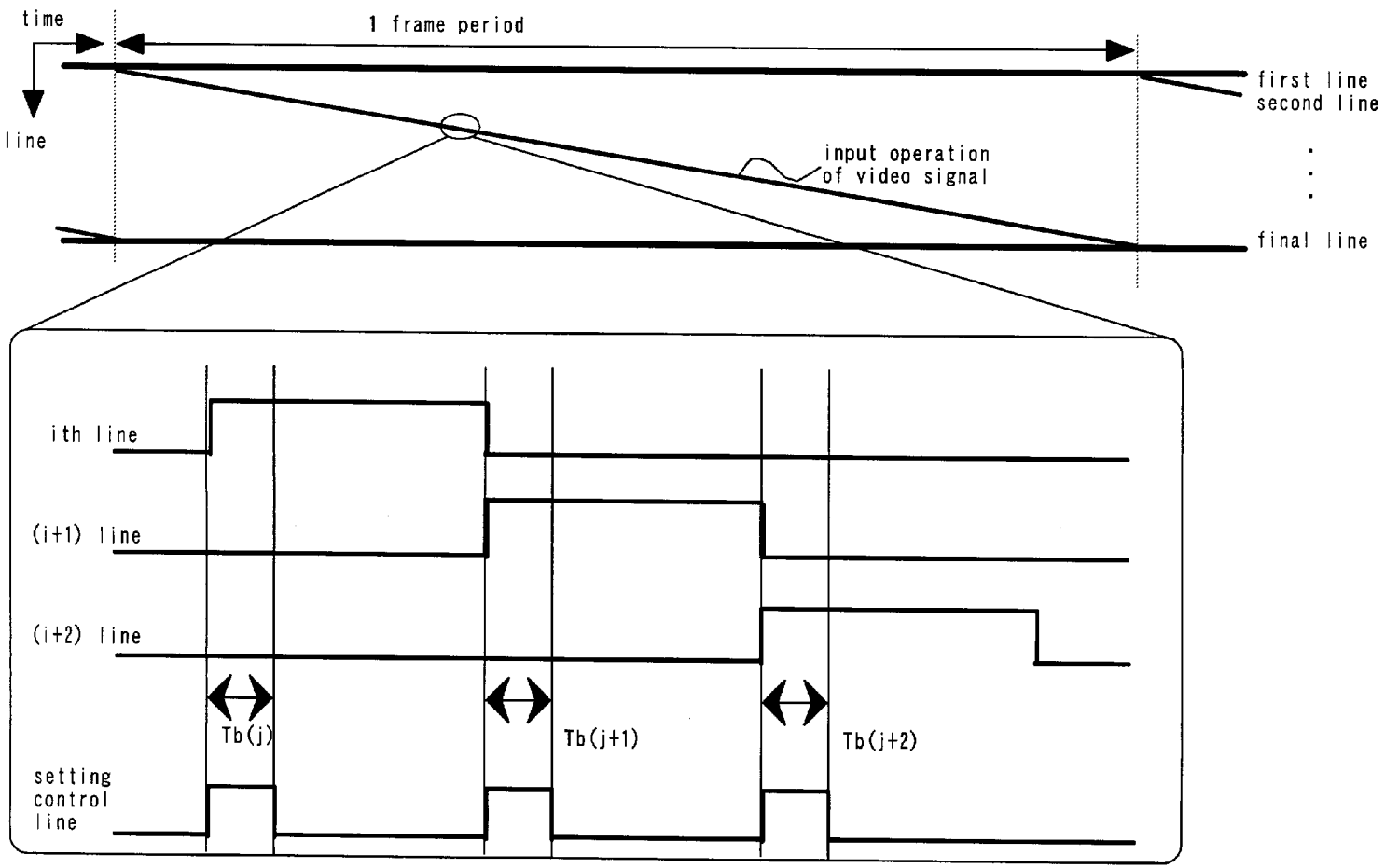
FIG. 86 is a timing chart.

Therefore, as shown in FIG. 86, it becomes possible that the setting operation period Tb is provided in a certain period during which the scanning line (gate line) is selected and that the setting operation is performed in the setting operation period Tb.

In this case, since the setting operation and the input operation of the current source circuit arranged in the signal line driver circuit can be simultaneously performed in the case of FIG. 61 or FIG. 60, there does not arise the problem on the timing of conducting the setting operation. In the case where the setting operation and the input operation of the current source circuit in the signal line driver circuit cannot be performed simultaneously, it may be such that the input operation of the current source circuit in the signal line driver circuit is stopped and that the setting operation is conducted while the scanning line is selected, that is, during the first period. Note that the period may coincide with a return period.

Figure 9:
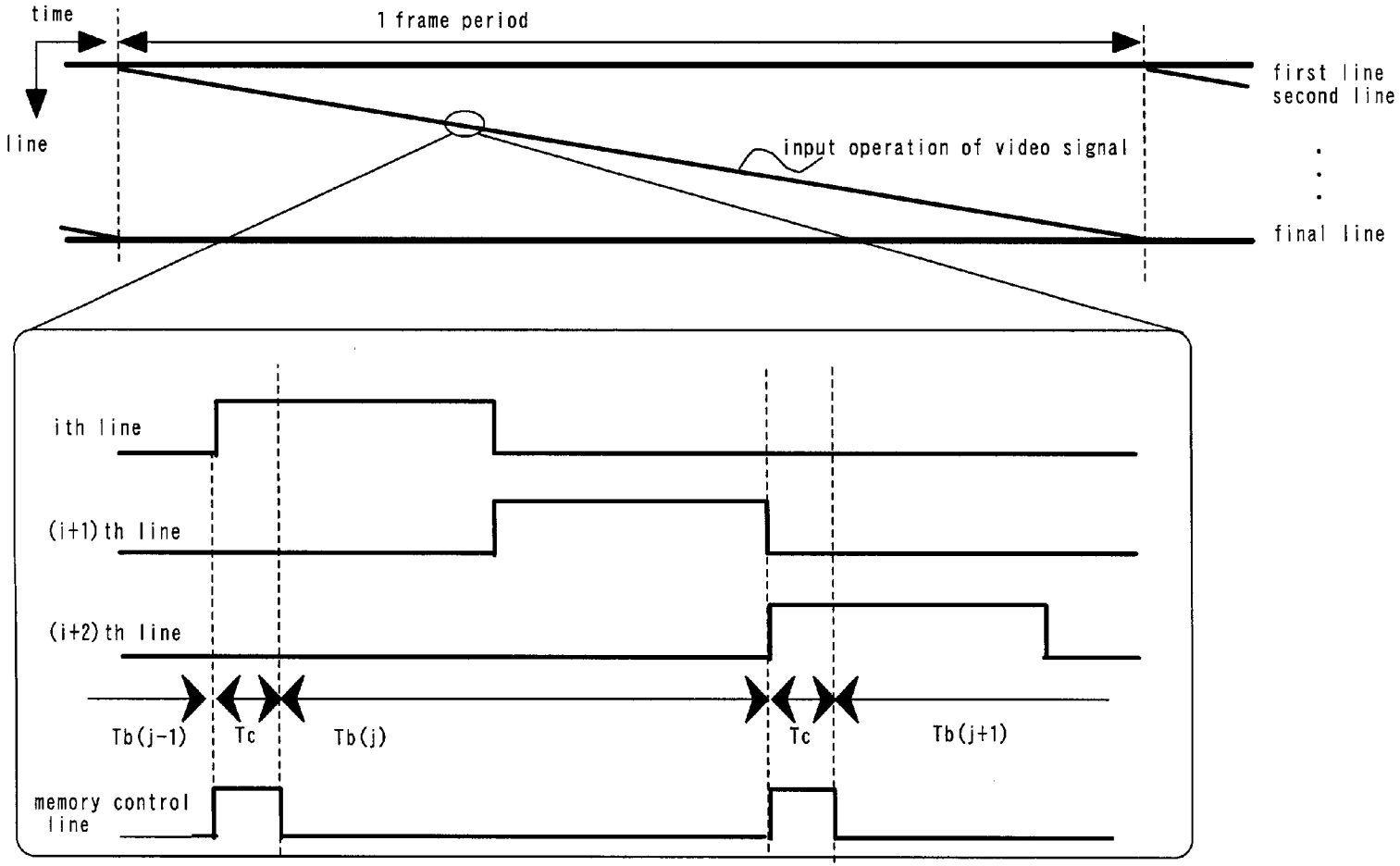
FIG. 9 is a timing chart.

Further, as shown in FIG. 9, the setting operation does not need to be performed for each line when the scanning line is selected. In FIG. 86 or FIG. 9, it is desirable that the current source circuit can be selected at random by using the circuit in FIG. 43 or the like as a circuit (shift register) for controlling the current source circuit. Further, the circuit in FIG. 44, FIG. 45, FIG. 46, or the like may be used.

Figure 10:
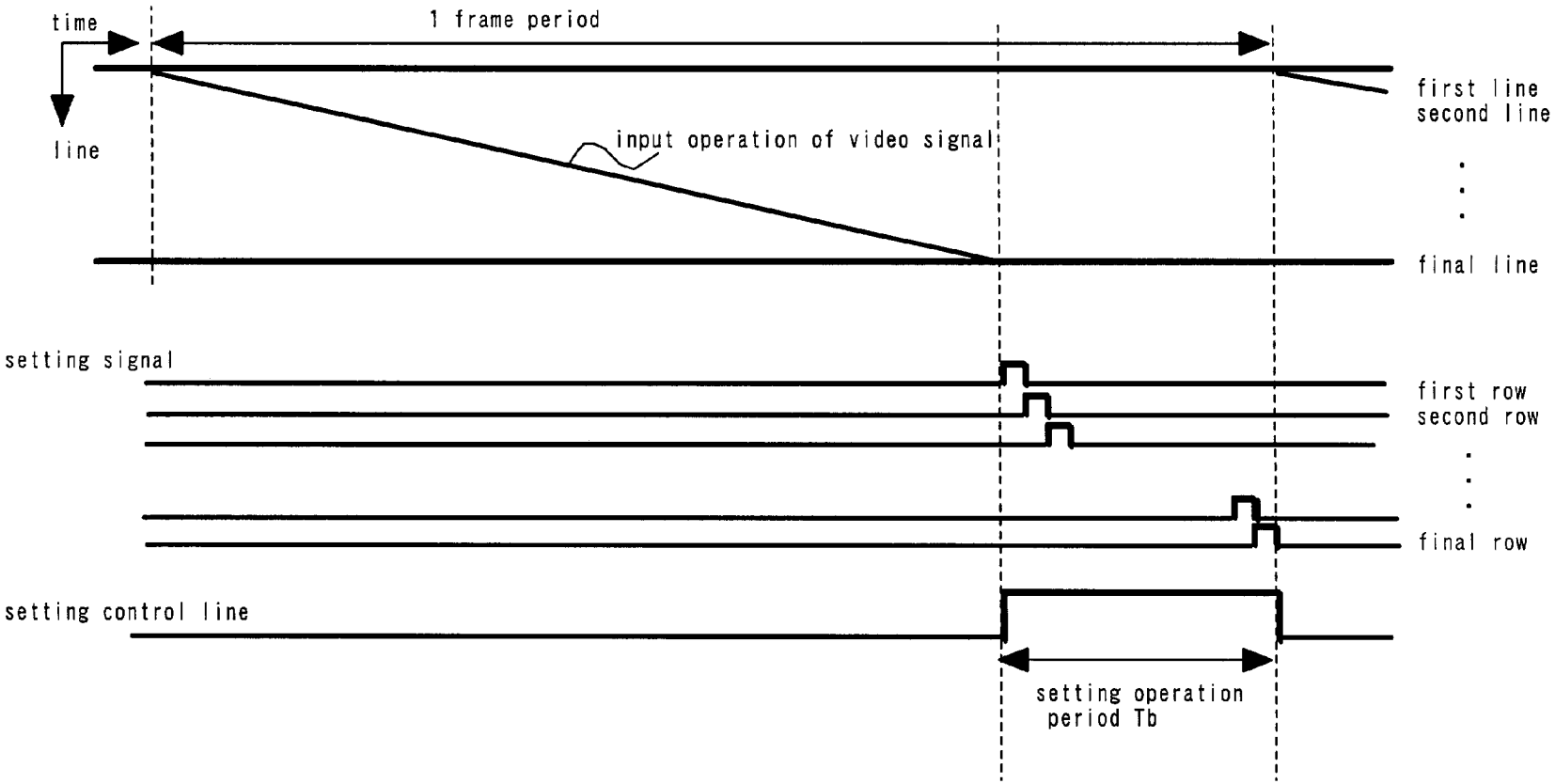
FIG. 10 is a timing chart.
Figure 11:
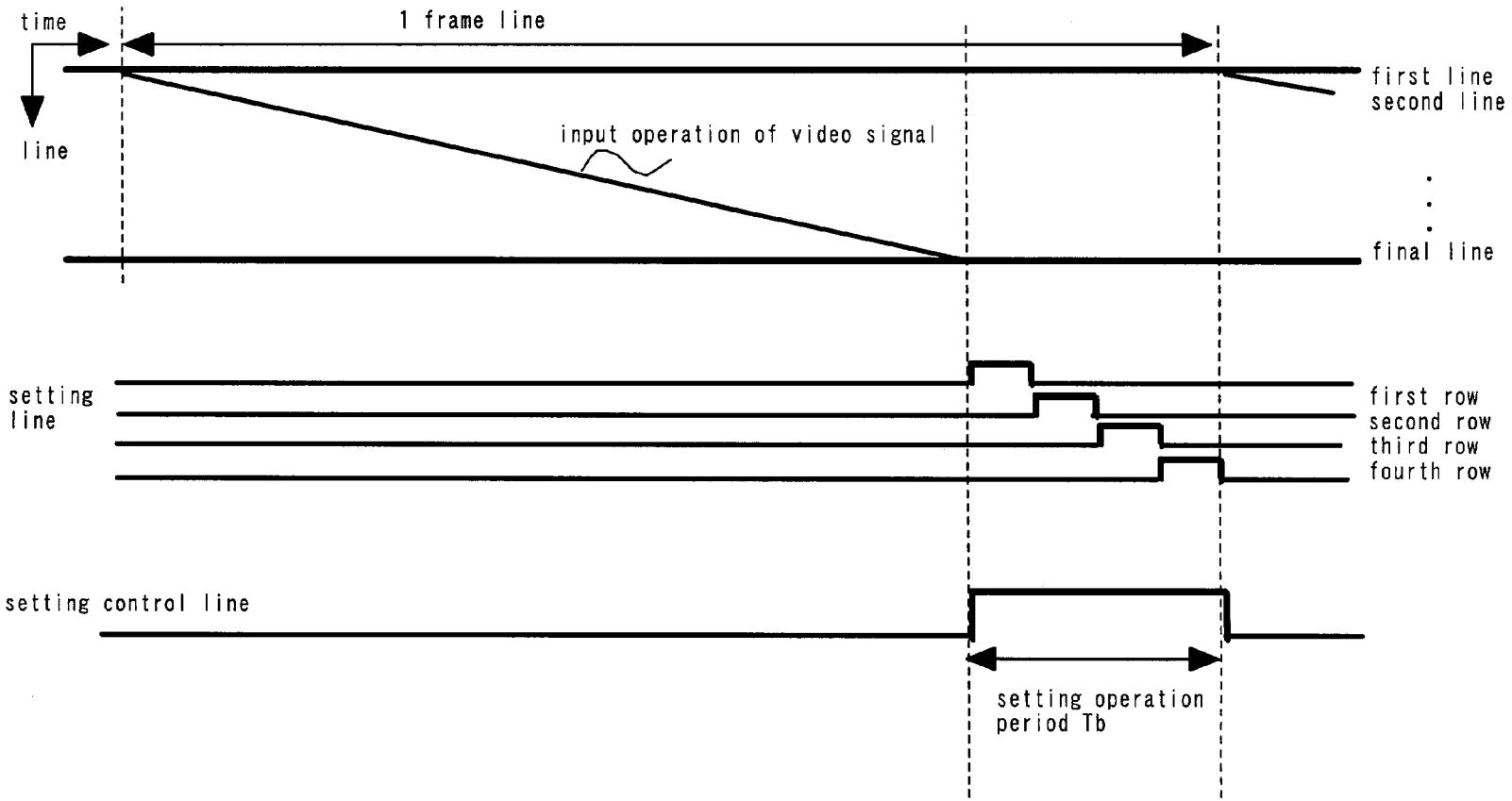
FIG. 11 is a timing chart.

Alternatively, as shown in FIG. 10 or FIG. 11, it may be such that the input operation of the current source circuit in the signal line driver circuit (input operation of a video signal, that is, the output of a current to the pixel) is performed in several tens of percent of one frame period and that the setting operation of the current source circuit in the signal line driver circuit is conducted in the rest period. In this case, the setting operation and the input operation of the current source circuit in the signal line driver circuit may not be performed simultaneously.

At that time, in the case where the setting operation of the current source circuit in the signal line driver circuit is performed, the setting operation may be conducted to the current source circuit for each column as shown in FIG. 10. Alternatively, the current source circuit is made to be selected at random by using the circuit in FIG. 43, FIG. 44, FIG. 45, FIG. 46, or the like, and thus, the setting operation for all the current source circuits may not be performed in one frame period. In other words, the setting operation for all the current source circuits may be performed in several frame periods or more. In this case, the setting operation can be conducted to one current source circuit for a long time, and thus, the setting operation can be conducted with more accuracy.

Note that in the case where the setting operation of the current source circuit in the signal line driver circuit is performed, the setting operation needs to be performed in the state in which a current does not leak or another current does not enter. Thus, the transistor 182 in FIG. 29, the transistors A, B, and C, and the like need to be previously turned OFF before the setting operation of the current source circuit in the signal line driver circuit is performed. Incidentally, this does not need to be taken into consideration in the case where: the transistor 193 is arranged as shown in FIG. 56; and a current does not leak or another current does not enter.

This embodiment can be arbitrarily combined with Embodiment Modes 1 to 8 and Embodiment 1.

Embodiment 3

In this embodiment, technical devices when performing color display will be described.

With a light emitting element comprised of an organic EL element, the luminance is variable depending on the color even though current having the same magnitude is supplied to the light emitting element. In addition, in the case where the light emitting element has deteriorated, the deterioration degree is variable depending on the color. Thus, various technical devices are required to adjust the white balance.

The simplest technique is to change the magnitude of the current that is input to the pixel. To achieve the technique, the magnitude of the current of the reference constant current source should be changed depending on the color.

Another technique is to use circuits as shown in FIGS. 6(C) to 6(E) for the pixel, signal line driver circuit, reference constant current source, and the like, and then, change the W/L ratio of two transistors forming the current mirror circuit depending on the color. Thus, the magnitude of the current can be changed depending on the color.

Still another technique is to change the length of a lightening period depending on the color. The technique can be applied to either of the case where the time gradation method is employed and the case where the time gradation method is not employed. According to the technique, the luminance can be adjusted.

The white balance can be easily adjusted by using any one of the techniques or a combination thereof.

This embodiment may be arbitrarily combined with Embodiment Modes 1 to 8 and Embodiments 1 and 2.

Embodiment 4

Figure 12A:
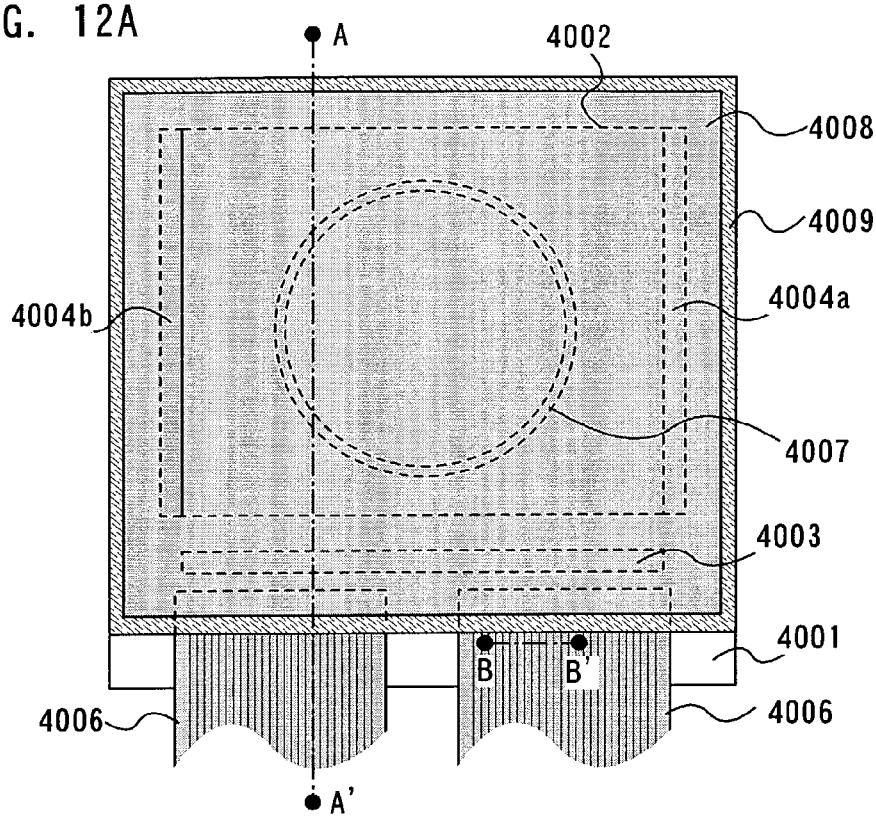
FIG. 12 is views of the appearance of a light emitting device.
Figure 12B:
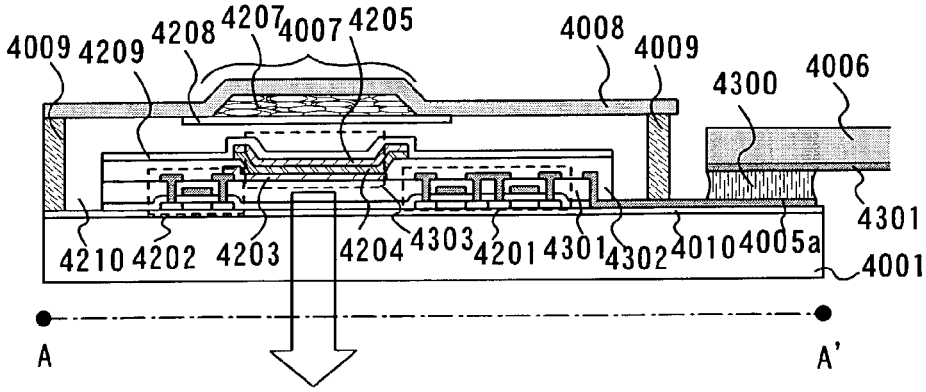
Figure 12C:
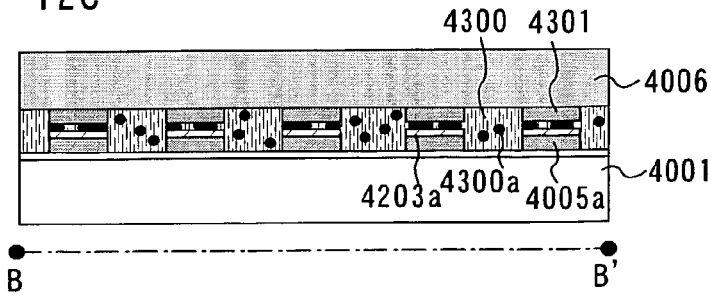

In this embodiment, the appearances of the light emitting devices (semiconductor devices) of the present invention will be described using FIG. 12. FIG. 12 is a top view of a light emitting device formed such that an element substrate on which transistors are formed is sealed with a sealing material; FIG. 12(B) is a cross-sectional view taken along the line A-A' of FIG. 12(A); and FIG. 12(C) is a cross-sectional view taken along the line B-B' of FIG. 12(A).

A sealing material 4009 is provided so as to enclose a pixel portion 4002, a source signal line driver circuit 4003, and gate signal line driver circuits 4004*a* and 4004*b* that are provided on a substrate 4001. In addition, a sealing material 4008 is provided over the pixel portion 4002, the source signal line driver circuit 4003, and the gate signal line driver circuits 4004*a* and 4004*b*. Thus, the pixel portion 4002, the source signal line driver circuit 4003, and the gate signal line driver circuits 4004*a* and 4004*b* are sealed by the substrate 4001, the sealing material 4009, and the sealing material 4008 with a filler material 4210.

The pixel portion 4002, the source signal line driver circuit 4003, and the gate signal line driver circuits 4004*a* and 4004*b*, which are provided over the substrate 4001, include a plurality of TFTs. FIG. 12(B) representatively shows a driving TFT (incidentally, an n-channel TFT and a p-channel TFT are shown in this example) 4201 included in the source signal line driver circuit 4003, and an erasing TFT 4202 included in the pixel portion 4002, which are formed on a base film 4010.

In this embodiment, a p-channel TFT or an n-channel TFT that is manufactured according to a known method is used for the driving TFT 4201, and an n-channel TFT manufactured according to a known method is used for the erasing TFT 4202.

An interlayer insulating film (leveling film) 4301 is formed on the driving TFT 4201 and the erasing TFT 4202, and a pixel electrode (anode) 4203 for being electrically connected to a drain of the erasing TFT 4202 is formed thereon. A transparent conductive film having a large work function is used for the pixel electrode 4203. For the transparent conductive film, a compound of indium oxide and tin oxide, a compound of indium oxide and zinc oxide, zinc oxide, tin oxide, or indium oxide can be used. Alternatively, the transparent conductive film added with gallium may be used.

An insulating film 4302 is formed on the pixel electrode 4203, and the insulating film 4302 is formed with an opening portion formed on the pixel electrode 4203. In the opening portion, a light emitting layer 4204 is formed on the pixel electrode 4203. The light emitting layer 4204 may be formed using a known light emitting material or inorganic light emitting material. As the light emitting material, either of a low molecular weight (monomer) material and a high molecular weight (polymer) material may be used.

As a forming method of the light emitting layer 4204, a known vapor deposition technique or coating technique may be used. The structure of the light emitting layer 4204 may be either a laminate structure, which is formed by arbitrarily combining a hole injection layer, a hole transportation layer, a light-emitting layer, an electron transportation layer, and an electron injection layer, or a single-layer structure.

Formed on the light emitting layer 4204 is a cathode 4205 formed of a conductive film (representatively, a conductive film containing aluminum, copper, or silver as its main constituent, or a laminate film of the conductive film and another conductive film) having a light shielding property. Moisture and oxygen existing on an interface of the cathode 4205 and the light emitting layer 4204 are desirably eliminated as much as possible. For this reason, a technical device is necessary in that the light emitting layer 4204 is formed in an nitrogen or noble gas atmosphere, and the cathode 4205 is formed without being exposed to oxygen, moisture, and the like. In this embodiment, the above-described film deposition is enabled using a multi-chamber method (cluster-tool method) film deposition apparatus. In addition, the cathode 4205 is applied with a predetermined voltage.

In the above-described manner, a light emitting element 4303 constituted by the pixel electrode (anode) 4203, the light emitting layer 4204, and the cathode 4205 is formed. A protective film is formed on the insulating film so as to cover the light emitting element 4303. The protective film is effective for preventing, for example, oxygen and moisture, from entering the light emitting element 4303.

Reference numeral 4005*a* denotes a drawing wiring that is connected to a power supply line and that is electrically connected to a source region of the erasing TFT 4202. The drawing wiring 4005*a* is passed between the sealing material 4009 and the substrate 4001 and is then electrically connected to an FPC wiring 4301 of an FPC 4006 via an anisotropic conductive film 4300.

As the sealing material 4008, a glass material, a metal material (representatively, a stainless steel material), ceramics material, or a plastic material (including a plastic film) may be used. As the plastic material, an FRP (fiberglass reinforced plastics) plate, a PVF (polyvinyl fluoride) film, a Mylar film, a polyester film, or an acrylic resin film may be used. Alternatively, a sheet having a structure in which an aluminum foil is sandwiched by the PVF film or the Mylar film may be used.

However, a cover material needs to be transparent when light emission is directed from the light emitting layer to the cover material. In this case, a transparent substance such as a glass plate, a plastic plate, a polyester film, or an acrylic film, is used.

Further, for the filler material 4210, ultraviolet curing resin or a thermosetting resin may be used in addition to an inactive gas, such as nitrogen or argon; and PVC (polyvinyl chloride), acrylic, polyimide, epoxy resin, silicon resin, PVB (polyvinyl butyral), or EVA (ethylene vinyl acetate) may be used. In this embodiment, nitrogen was used for the filler material.

To keep the filler material 4210 to be exposed to a hygroscopic substance (preferably, barium oxide) or an oxygen-absorbable substance, a concave portion 4007 is provided on the surface of the sealing material 4008 on the side of the substrate 4001, and a hygroscopic substance or oxygen-absorbable substance 4207 is arranged. The hygroscopic substance or oxygen-absorbable substance 4207 is held in the concave portion 4007 via a concave-portion cover material 4208 such that the hygroscopic substance or oxygen-absorbable substance 4207 does not diffuse. The concave-portion cover material 4208 is in a fine mesh state and is formed to allow air and moisture to pass through and not to allow the hygroscopic substance or oxygen-absorbable substance 4207 to pass through. The provision of the hygroscopic substance or oxygen-absorbable substance 4207 enables the suppression of deterioration of the light emitting element 4303.

As shown in FIG. 12(C), simultaneously with the formation of the pixel electrode 4203, a conductive film 4203*a* is formed so as to be contact with an upper portion of the drawing wiring 4005*a*.

In addition, the anisotropic conductive film 4300 includes a conductive filler 4300*a*. The substrate 4001 and the FPC 4006 are thermally press-bonded, whereby the conductive film 4203*a* on the substrate 4001 and the FPC wiring 4301 on the FPC 4006 are electrically connected via the conductive filler 4300*a*.

This embodiment may be arbitrarily combined with Embodiment Modes 1 to 8 and Embodiments 1 to 3.

Embodiment 5

A light emitting device using light emitting elements is of self-light emitting type, so that in comparison to a liquid crystal display, the light emitting device offers a better visibility in bright portions and a wider view angle. Hence, the light emitting device can be used in display portions of various electronic devices.

Electronic devices using the light emitting device of the present invention include, there are given, for example, video cameras, digital cameras, goggle type displays (head mount displays), navigation systems, audio reproducing devices (such as car audio and audio components), notebook personal computers, game machines, mobile information terminals (such as mobile computers, mobile telephones, portable game machines, and electronic books), and image reproducing devices provided with a recording medium (specifically, devices for reproducing a recording medium such as a digital versatile disc (DVD), which includes display capable of displaying images). In particular, in the case of mobile information terminals, since the degree of the view angle is appreciated important, the terminals preferably use the light emitting device. Practical examples are shown in FIG. 22.

Figure 22A:
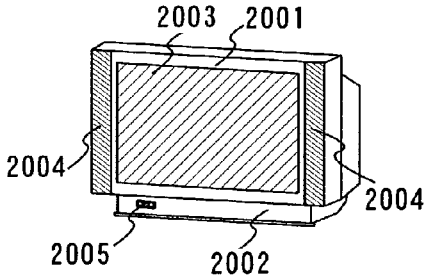
FIG. 22 is views of electronic devices to which the present invention is applied.

FIG. 22(A) shows a light emitting element, which contains a casing 2001, a support base 2002, a display portion 2003, a speaker portion 2004, a video input terminal 2005, and the like. The light emitting element of the present invention can be applied to the display portion 2003. Further, the light emitting element shown in FIG. 22(A) is completed with the present invention. Since the light emitting element is of self-light emitting type, it does not need a back light, and therefore a display portion that is thinner than a liquid crystal display can be obtained. Note that light emitting elements include all information display devices, for example, personal computers, television broadcast transmitter-receivers, and advertisement displays.

Figure 22B:
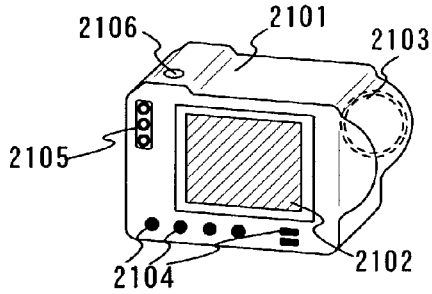

FIG. 22(B) shows a digital still camera, which contains a main body 2101, a display portion 2102, an image receiving portion 2103, operation keys 2104, an external connection port 2105, a shutter 2106, and the like. The light emitting element of the present invention can be applied to the display portion 2102. Further, the digital still camera shown in FIG. 22(B) is completed with the present invention.

Figure 22C:
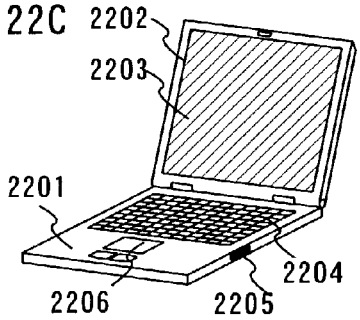

FIG. 22(C) shows a notebook personal computer, which contains a main body 2201, a casing 2202, a display portion 2203, a keyboard 2204, external connection ports 2205, a pointing mouse 2206, and the like. The light emitting element of the present invention can be applied to the display portion 2203. Further, the light emitting element shown in FIG. 22(C) is completed with the present invention.

Figure 22D:
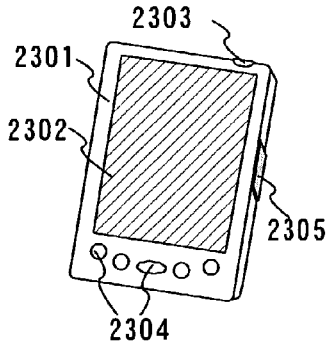

FIG. 22(D) shows a mobile computer, which contains a main body 2301, a display portion 2302, a switch 2303, operation keys 2304, an infrared port 2305, and the like. The light emitting element of present invention can be applied to the display portion 2302. Further, the mobile computer shown in FIG. 22(D) is completed with the present invention.

Figure 22E:
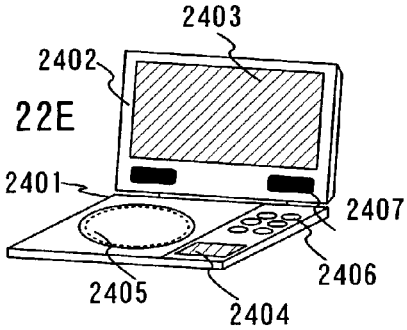

FIG. 22(E) shows a portable image reproducing device provided with a recording medium (specifically, a DVD reproducing device), which contains a main body 2401, a casing 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information. The light emitting element of the present invention can be used in the display portion A 2403 and in the display portion B 2404. Note that family game machines and the like are included in the image reproducing devices provided with a recording medium. Further, the DVD reproducing device shown in FIG. 22(E) is completed with the present invention.

Figure 22F:
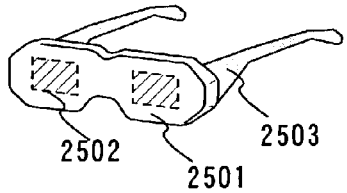

FIG. 22(F) shows a goggle type display (head mounted display), which contains a main body 2501, a display portion 2502, an arm portion 2503, and the like. The light emitting element of the present invention can be used in the display portion 2502. The goggle type display shown in FIG. 22(F) is completed with the present invention.

Figure 22G:
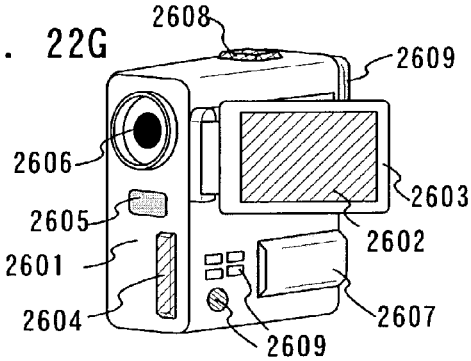

FIG. 22(G) shows a video camera, which contains a main body 2601, a display portion 2602, a casing 2603, external connection ports 2604, a remote control reception portion 2605, an image receiving portion 2606, a battery 2607, an audio input portion 2608, operation keys 2609, an eyepiece portion 2610, and the like. The light emitting element of the present invention can be used in the display portion 2602. The video camera shown in FIG. 22(G) is completed with the present invention.

Figure 22H:
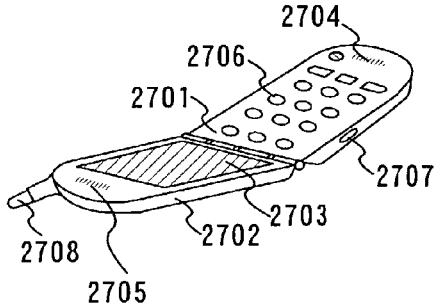

Here, FIG. 22(H) shows a mobile telephone, which contains a main body 2701, a casing 2702, a display portion 2703, an audio input portion 2704, an audio output portion 2705, operation keys 2706, external connection ports 2707, an antenna 2708, and the like. The light emitting element of the present invention can be used in the display portion 2703. Note that, by displaying white characters on a black background, the display portion 2703 can suppress the consumption current of the mobile telephone. Further, the mobile telephone shown in FIG. 22(H) is completed with the present invention.

When the emission luminance of light emitting materials are increased in the future, the light emitting element will be able to be applied to a front or rear type projector by expanding and projecting light containing image information having been output lenses or the like.

Cases are increasing in which the above-described electronic devices display information distributed via electronic communication lines such as the Internet and CATVs (cable TVs). Particularly increased are cases where moving picture information is displayed. Since the response speed of the light emitting material is very high, the light emitting device is preferably used for moving picture display.

Since the light emitting device consumes the power in light emitting portions, information is desirably displayed so that the light emitting portions are reduced as much as possible. Thus, in the case where the light emitting device is used for a display portion of a mobile information terminal, particularly, a mobile telephone, an audio playback device, or the like, which primarily displays character information, it is preferable that the character information be formed in the light emitting portions with the non-light emitting portions being used as the background.

As described above, the application range of the present invention is very wide, so that the invention can be used for electronic devices in all of fields. The electronic devices according to this embodiment may use the light emitting device with the structure according to any one of Embodiment Modes 1 to 6 and Embodiments 1 to 6.

The present invention having the structures described above can suppress influences of variation in characteristics of TFTs, which is caused by manufacturing steps and the difference in a substrate used, and can supply a desired signal current to the outside.

Further, in the present invention, one shift register has two functions. One function of the two is for controlling the current source circuit. The other function is for controlling the circuit which controls video signal, that is, the circuits which operates to display an image. For example, the circuits are a latch circuit, a sampling switch, and a switch 101 (a signal current control switch). According to the above-mentioned structures, it is possible to reduce elements of the circuits which is provided, since the circuit which controls the current source circuit and each circuit which control a video signal are unnecessary to provide. Further, since the additional number of elements can be reduced, the layout area can be reduced. Therefore, process yield in the manufacturing steps is improved, and costs can be reduced. Furthermore, the frame area can be narrowed if the layout area is reduced, consequently the device can be miniaturized.

In addition, in the case that the shift register has a structure which has a function that can choose plurality of wirings at random, the setting signal which is supplied to the power source circuit can be output at random. Accordingly, the setting operation can be performed at random for the current source circuit rather than sequentially from the first column to the latest column. Then the setting operation period for the current source circuit can be determined freely. Further, it is possible that the influence of charge leakage in a capacitor device of the current source circuit can be made inconspicuous. Thus, when a defect has occurred in association with the setting operation, the defect can be made inconspicuous.

The invention claimed is:

1. A signal line driver circuit comprising:

a plurality of first current source circuits corresponding to a plurality of wirings;

a shift register, a latch circuit electrically connected to the shift register;

a plurality of switches disposed between the plurality of first current source circuits and the plurality of wirings, and a second current source circuit, wherein each of the plurality of current source circuits converts a supplied current to a voltage in accordance with a sampling pulse supplied from the shift register, holds the converted voltage, and supplies a current corresponding to the held voltage, wherein each of the plurality of first current source circuits includes a first terminal, a second terminal, and a third terminal, wherein the first terminal is electrically connected to the shift register, wherein the second terminal is electrically connected to the second current source circuit, and wherein the third terminal is electrically connected to one of the plurality of wirings through one of the plurality of switches.

2. A signal line driver circuit according to claim 1, wherein the plurality of wirings are a plurality of signal lines or a plurality of current lines.

3. A signal line driver circuit according to claim 1, wherein the shift register comprises a decoder circuit, and selects the plurality of wirings at random.

4. A signal line driver circuit according to claim 1, wherein each of the plurality of first current source circuits comprises a transistor.

5. A signal line driver circuit according to claim 1, wherein each of the plurality of current source circuits comprises a transistor, a capacitor, a first switch, and a second switch.

6. A signal line driver circuit according to claim 1, wherein one of the plurality of current source circuits is electrically connected to one of the plurality of wirings through one of the plurality of switches in accordance with a signal supplied from the latch circuit.

7. A light emitting device comprising:

a signal line driver circuit comprising a shift register, a latch circuit electrically connected to the shift register, a plurality of switches disposed between a plurality of first current source circuits and a plurality of wirings, the plurality of first current source circuits corresponding to the plurality of wirings, and a second current circuit; and a pixel portion in which a plurality of pixels each including a light emitting element are arranged in matrix, wherein each of the plurality of first current source circuits converts a supplied current to a voltage in accordance with a sampling pulse supplied from the shift register, holds the converted voltage, and supplies a current corresponding to the held voltage, and wherein a current is supplied to the light emitting element from the signal line driver circuit, wherein each of the plurality of first current source circuits includes a first terminal, a second terminal, and a third terminal, wherein the first terminal is electrically connected to the shift register, wherein the second terminal is electrically connected to the second current source circuit, and wherein the third terminal is electrically connected to one of the plurality of wirings through one of the plurality of switches.

8. A light emitting device according to claim 7, wherein one of the plurality of current source circuits is electrically connected to one of the plurality of wirings through one of the plurality of switches in accordance with a signal supplied from the latch circuit.

* * * * *